US009047809B2

(12) United States Patent
Kimura et al.

(10) Patent No.: US 9,047,809 B2
(45) Date of Patent: Jun. 2, 2015

(54) DISPLAY DEVICE AND DRIVING METHOD AND ELECTRONIC APPARATUS OF THE DISPLAY DEVICE

(75) Inventors: Hajime Kimura, Kanagawa (JP); Hideaki Shishido, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 990 days.

(21) Appl. No.: 12/781,280

(22) Filed: May 17, 2010

(65) Prior Publication Data

US 2011/0122164 A1 May 26, 2011

Related U.S. Application Data

(63) Continuation of application No. 11/399,256, filed on Apr. 6, 2006, now Pat. No. 7,719,526.

(30) Foreign Application Priority Data

Apr. 14, 2005 (JP) ..... 2005-117610

(51) Int. Cl.
*G09G 5/00* (2006.01)
*G09G 3/32* (2006.01)
*G09G 3/20* (2006.01)

(52) U.S. Cl.
CPC ..... *G09G 3/32* (2013.01); *G09G 3/2033* (2013.01); *G09G 3/204* (2013.01); *G09G 2300/08* (2013.01); *G09G 2300/0809* (2013.01); *G09G 2320/0266* (2013.01)

(58) Field of Classification Search
USPC ..... 345/204, 60, 76–77
See application file for complete search history.

(56) References Cited

U.S. PATENT DOCUMENTS 4,070,663 A 1/1978 Kanatani et al.
4,773,738 A 9/1988 Hayakawa et al.

(Continued)

FOREIGN PATENT DOCUMENTS

CN 1383121 A 12/2002
EP 0 831 449 A2 3/1998

(Continued)

OTHER PUBLICATIONS

Inukai, K. et al, "36.4L: Late-News Paper: 4.0-in. TFT-OLED Displays and a Novel Digital Driving Method," SID 00 Digest, 2000, pp. 924-927.

(Continued)

*Primary Examiner* — William Boddie
*Assistant Examiner* — Leonid Shapiro
(74) *Attorney, Agent, or Firm* — Husch Blackwell LLP

(57) ABSTRACT

To reduce a pseudo contour which occurs when displaying by a time gray scale method. When gradation is expressed with an n bit, bits each of which is shown by a binary of the gray scales are divided into three bit groups, and one frame is divided into two subframe groups. Then, a (0<a<n) subframes corresponding to bits belonging to a first bit group are divided into three or more, each about half of which is arranged in each subframe group; b (0<b<n) subframes corresponding to bits belonging to a second bit group are divided into two, each one of which is arranged in each the subframe group; and c (0≤c<n and a+b+c=n) subframes corresponding to bits belonging to a third bit group are arranged in at least one of the subframe groups. And then, an overlapped time gray scale method is applied in each subframe group to express gradation.

12 Claims, 65 Drawing Sheets

(56) References Cited

U.S. PATENT DOCUMENTS

| | | | | |
|---|---|---|---|---|
| 5,091,722 | A | 2/1992 | Kitajima et al. | |
| 5,200,846 | A | 4/1993 | Hiroki et al. | |
| 5,225,823 | A | 7/1993 | Kanaly | |
| 5,302,966 | A | 4/1994 | Stewart | |
| 5,349,366 | A | 9/1994 | Yamazaki et al. | |
| 5,414,442 | A | 5/1995 | Yamazaki et al. | |
| 5,424,752 | A | 6/1995 | Yamazaki et al. | |
| 5,471,225 | A | 11/1995 | Parks | |
| 5,479,283 | A | 12/1995 | Kaneko et al. | |
| 5,583,534 | A | 12/1996 | Katakura et al. | |
| 5,600,169 | A | 2/1997 | Burgener et al. | |
| 5,642,129 | A | 6/1997 | Zavracky et al. | |
| 5,712,652 | A | 1/1998 | Sato et al. | |
| 5,767,828 | A | 6/1998 | McKnight | |
| 5,798,746 | A | 8/1998 | Koyama | |
| 5,969,710 | A | 10/1999 | Doherty et al. | |
| 5,986,640 | A | 11/1999 | Baldwin et al. | |
| 5,990,629 | A | 11/1999 | Yamada et al. | |
| 6,034,659 | A | 3/2000 | Wald et al. | |
| 6,040,819 | A | 3/2000 | Someya | |
| 6,091,203 | A | 7/2000 | Kawashima et al. | |
| 6,144,364 | A | 11/2000 | Otobe et al. | |
| 6,157,356 | A | 12/2000 | Troutman | |
| 6,215,466 | B1 | 4/2001 | Yamazaki et al. | |
| 6,222,512 | B1 | 4/2001 | Tajima et al. | |
| 6,229,506 | B1 | 5/2001 | Dawson et al. | |
| 6,229,508 | B1 | 5/2001 | Kane | |
| 6,249,265 | B1 | 6/2001 | Tajima et al. | |
| 6,278,423 | B1 | 8/2001 | Wald et al. | |
| 6,292,159 | B1 | 9/2001 | Someya et al. | |
| 6,333,737 | B1 * | 12/2001 | Nakajima | 345/205 |
| 6,373,454 | B1 | 4/2002 | Knapp et al. | |
| 6,417,835 | B1 | 7/2002 | Otobe et al. | |
| 6,448,960 | B1 | 9/2002 | Shigeta | |
| 6,452,341 | B1 | 9/2002 | Yamauchi et al. | |
| 6,518,977 | B1 | 2/2003 | Naka et al. | |
| 6,542,138 | B1 | 4/2003 | Shannon et al. | |
| 6,552,701 | B1 | 4/2003 | Tanaka | |
| 6,563,480 | B1 | 5/2003 | Nakamura | |
| 6,563,486 | B2 | 5/2003 | Otobe et al. | |
| 6,778,152 | B1 | 8/2004 | Huang | |
| 7,027,074 | B2 | 4/2006 | Koyama | |
| 2001/0045923 | A1 | 11/2001 | Otobe et al. | |
| 2002/0047852 | A1 | 4/2002 | Inukai et al. | |
| 2002/0160553 | A1 * | 10/2002 | Yamanaka et al. | 438/149 |
| 2003/0057423 | A1 | 3/2003 | Shimoda et al. | |
| 2003/0058195 | A1 | 3/2003 | Adachi et al. | |
| 2003/0090444 | A1 | 5/2003 | Jeong | |
| 2003/0201727 | A1 * | 10/2003 | Yamazaki et al. | 315/169.1 |
| 2004/0189626 | A1 | 9/2004 | Mori | |
| 2004/0212568 | A1 | 10/2004 | Yamada | |
| 2004/0263434 | A1 | 12/2004 | Otobe et al. | |
| 2006/0238458 | A1 | 10/2006 | Koyama | |

FOREIGN PATENT DOCUMENTS

| | | | |
|---|---|---|---|
| EP | 0 838 799 | A1 | 4/1998 |
| EP | 1 184 833 | A2 | 3/2002 |
| EP | 1 187 087 | A1 | 3/2002 |
| EP | 1 251 481 | A2 | 10/2002 |
| JP | 7-49663 | | 2/1995 |
| JP | 7-175439 | | 7/1995 |
| JP | 7-271325 | | 10/1995 |
| JP | 9-34399 | | 2/1997 |
| JP | 9-172589 | | 6/1997 |
| JP | 09-218662 | A | 8/1997 |
| JP | 10-31455 | | 2/1998 |
| JP | 10-171400 | | 6/1998 |
| JP | 10-171401 | | 6/1998 |
| JP | 10-307561 | | 11/1998 |
| JP | 2903984 | B2 | 6/1999 |
| JP | 11-305726 | | 11/1999 |
| JP | 2000-137461 | | 5/2000 |
| JP | 2001-42818 | | 2/2001 |
| JP | 2001-324958 | | 11/2001 |
| JP | 2002-351390 | | 12/2002 |
| JP | 2003-177699 | | 6/2003 |
| JP | 2004-151162 | | 5/2004 |
| WO | WO 99/60557 | A1 | 11/1999 |
| WO | WO 99/65012 | A2 | 12/1999 |
| WO | WO 01/52229 | A1 | 7/2001 |
| WO | WO 03/032352 | A2 | 4/2003 |

OTHER PUBLICATIONS

Office Action re Chinese application No. CN 200610074395.5, dated Sep. 11, 2009 (with English translation).

* cited by examiner

FIG. 1 a former subframe group a latter subframe group subframes

| | SF1 | SF2 | SF3 | SF4 | SF5 | SF6 | SF7 | SF8 | SF9 | SF10 |
|---|---|---|---|---|---|---|---|---|---|---|
| | 1 | 2 | 4 | 4 | 4 | 2 | 2 | 4 | 4 | 4 |
| 0 | × | × | × | × | × | × | × | × | × | × |
| 1 | ○ | × | × | × | × | × | × | × | × | × |
| 2 | × | × | × | × | × | ○ | × | × | × | × |
| 3 | ○ | × | × | × | × | ○ | × | × | × | × |
| 4 | × | ○ | × | × | × | × | ○ | × | × | × |
| 5 | ○ | ○ | × | × | × | × | ○ | × | × | × |
| 6 | × | ○ | × | × | × | ○ | ○ | × | × | × |
| 7 | ○ | ○ | × | × | × | ○ | ○ | × | × | × |
| 8 | × | × | ○ | × | × | × | × | ○ | × | × |
| 9 | ○ | × | ○ | × | × | × | × | ○ | × | × |
| 10 | × | × | ○ | × | × | ○ | × | ○ | × | × |
| 11 | ○ | × | ○ | × | × | ○ | × | ○ | × | × |
| 12 | × | ○ | ○ | × | × | × | ○ | ○ | × | × |
| 13 | ○ | ○ | ○ | × | × | × | ○ | ○ | × | × |
| 14 | × | ○ | ○ | × | × | ○ | ○ | ○ | × | × |
| 15 | ○ | ○ | ○ | × | × | ○ | ○ | ○ | × | × |
| 16 | × | × | ○ | ○ | × | × | × | ○ | ○ | × |
| 17 | ○ | × | ○ | ○ | × | × | × | ○ | ○ | × |
| 18 | × | × | ○ | ○ | × | ○ | × | ○ | ○ | × |
| 19 | ○ | × | ○ | ○ | × | ○ | × | ○ | ○ | × |
| 20 | × | ○ | ○ | ○ | × | × | ○ | ○ | ○ | × |
| 21 | ○ | ○ | ○ | ○ | × | × | ○ | ○ | ○ | × |
| 22 | × | ○ | ○ | ○ | × | ○ | ○ | ○ | ○ | × |
| 23 | ○ | ○ | ○ | ○ | × | ○ | ○ | ○ | ○ | × |
| 24 | × | × | ○ | ○ | ○ | × | × | ○ | ○ | ○ |
| 25 | ○ | × | ○ | ○ | ○ | × | × | ○ | ○ | ○ |
| 26 | × | × | ○ | ○ | ○ | ○ | × | ○ | ○ | ○ |
| 27 | ○ | × | ○ | ○ | ○ | ○ | × | ○ | ○ | ○ |
| 28 | × | ○ | ○ | ○ | ○ | × | ○ | ○ | ○ | ○ |
| 29 | ○ | ○ | ○ | ○ | ○ | × | ○ | ○ | ○ | ○ |
| 30 | × | ○ | ○ | ○ | ○ | ○ | ○ | ○ | ○ | ○ |
| 31 | ○ | ○ | ○ | ○ | ○ | ○ | ○ | ○ | ○ | ○ |

lengths of lighting periods gray scale levels an overlapped time gray scale method ○ : lighting × : non-lighting

FIG. 3 a former subframe group ← → a latter subframe group

| | SF1 | SF2 | SF3 | SF4 | SF5 | SF6 | SF7 | SF8 | SF9 | SF10 |
|---|---|---|---|---|---|---|---|---|---|---|
| | 1 | 2 | 2 | 4 | 4 | 4 | 2 | 4 | 4 | 4 |
| 0 | × | × | × | × | × | × | × | × | × | × |
| 1 | ○ | × | × | × | × | × | × | × | × | × |
| 2 | × | ○ | × | × | × | × | × | × | × | × |
| 3 | ○ | ○ | × | × | × | × | × | × | × | × |
| 4 | × | × | ○ | × | × | × | ○ | × | × | × |
| 5 | ○ | × | ○ | × | × | × | ○ | × | × | × |
| 6 | × | ○ | ○ | × | × | × | ○ | × | × | × |
| 7 | ○ | ○ | ○ | × | × | × | ○ | × | × | × |
| 8 | × | × | × | ○ | × | × | × | ○ | × | × |
| 9 | ○ | × | × | ○ | × | × | × | ○ | × | × |
| 10 | × | ○ | × | ○ | × | × | × | ○ | × | × |
| 11 | ○ | ○ | × | ○ | × | × | × | ○ | × | × |
| 12 | × | × | ○ | ○ | × | × | ○ | ○ | × | × |
| 13 | ○ | × | ○ | ○ | × | × | ○ | ○ | × | × |
| 14 | × | ○ | ○ | ○ | × | × | ○ | ○ | × | × |
| 15 | ○ | ○ | ○ | ○ | × | × | ○ | ○ | × | × |
| 16 | × | × | × | ○ | ○ | × | × | ○ | ○ | × |
| 17 | ○ | × | × | ○ | ○ | × | × | ○ | ○ | × |
| 18 | × | ○ | × | ○ | ○ | × | × | ○ | ○ | × |
| 19 | ○ | ○ | × | ○ | ○ | × | × | ○ | ○ | × |
| 20 | × | × | ○ | ○ | ○ | × | ○ | ○ | ○ | × |
| 21 | ○ | × | ○ | ○ | ○ | × | ○ | ○ | ○ | × |
| 22 | × | ○ | ○ | ○ | ○ | × | ○ | ○ | ○ | × |
| 23 | ○ | ○ | ○ | ○ | ○ | × | ○ | ○ | ○ | × |
| 24 | × | × | × | ○ | ○ | ○ | × | ○ | ○ | ○ |
| 25 | ○ | × | × | ○ | ○ | ○ | × | ○ | ○ | ○ |
| 26 | × | ○ | × | ○ | ○ | ○ | × | ○ | ○ | ○ |
| 27 | ○ | ○ | × | ○ | ○ | ○ | × | ○ | ○ | ○ |
| 28 | × | × | ○ | ○ | ○ | ○ | ○ | ○ | ○ | ○ |
| 29 | ○ | × | ○ | ○ | ○ | ○ | ○ | ○ | ○ | ○ |
| 30 | × | ○ | ○ | ○ | ○ | ○ | ○ | ○ | ○ | ○ |
| 31 | ○ | ○ | ○ | ○ | ○ | ○ | ○ | ○ | ○ | ○ |

○ : lighting

× : non-lighting

FIG. 4 a former subframe group | a latter subframe group

| | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| | 1 | 2 | 4 | 8 | 8 | 8 | 2 | 2 | 4 | 8 | 8 | 8 |
| 0 | × | × | × | × | × | × | × | × | × | × | × | × |
| 1 | ○ | × | × | × | × | × | × | × | × | × | × | × |
| 2 | × | × | × | × | × | × | ○ | × | × | × | × | × |
| 3 | ○ | × | × | × | × | × | ○ | × | × | × | × | × |
| 4 | × | ○ | × | × | × | × | × | ○ | × | × | × | × |
| 5 | ○ | ○ | × | × | × | × | × | ○ | × | × | × | × |
| 6 | × | ○ | × | × | × | × | ○ | ○ | × | × | × | × |
| 7 | ○ | ○ | × | × | × | × | ○ | ○ | × | × | × | × |
| 8 | × | × | ○ | × | × | × | × | × | ○ | × | × | × |
| 9 | ○ | × | ○ | × | × | × | × | × | ○ | × | × | × |
| 10 | × | × | ○ | × | × | × | ○ | × | ○ | × | × | × |
| 11 | ○ | × | ○ | × | × | × | ○ | × | ○ | × | × | × |
| 12 | × | ○ | ○ | × | × | × | × | ○ | ○ | × | × | × |
| 13 | ○ | ○ | ○ | × | × | × | × | ○ | ○ | × | × | × |
| 14 | × | ○ | ○ | × | × | × | ○ | ○ | ○ | × | × | × |
| 15 | ○ | ○ | ○ | × | × | × | ○ | ○ | ○ | × | × | × |
| 16 | × | × | × | ○ | × | × | × | × | × | ○ | × | × |
| 17 | ○ | × | × | ○ | × | × | × | × | × | ○ | × | × |
| 18 | × | × | × | ○ | × | × | ○ | × | × | ○ | × | × |
| 19 | ○ | × | × | ○ | × | × | ○ | × | × | ○ | × | × |
| 20 | × | ○ | × | ○ | × | × | × | ○ | × | ○ | × | × |
| 21 | ○ | ○ | × | ○ | × | × | × | ○ | × | ○ | × | × |
| 22 | × | ○ | × | ○ | × | × | ○ | ○ | × | ○ | × | × |
| 23 | ○ | ○ | × | ○ | × | × | ○ | ○ | × | ○ | × | × |
| 24 | × | × | ○ | ○ | × | × | × | × | ○ | ○ | × | × |
| 25 | ○ | × | ○ | ○ | × | × | × | × | ○ | ○ | × | × |
| 26 | × | × | ○ | ○ | × | × | ○ | × | ○ | ○ | × | × |
| 27 | ○ | × | ○ | ○ | × | × | ○ | × | ○ | ○ | × | × |
| 28 | × | ○ | ○ | ○ | × | × | × | ○ | ○ | ○ | × | × |
| 29 | ○ | ○ | ○ | ○ | × | × | × | ○ | ○ | ○ | × | × |
| 30 | × | ○ | ○ | ○ | × | × | ○ | ○ | ○ | ○ | × | × |
| 31 | ○ | ○ | ○ | ○ | × | × | ○ | ○ | ○ | ○ | × | × |
| 32 | × | × | × | ○ | ○ | × | × | × | × | ○ | ○ | × |
| 33 | ○ | × | × | ○ | ○ | × | × | × | × | ○ | ○ | × |
| 34 | × | × | × | ○ | ○ | × | ○ | × | × | ○ | ○ | × |
| 35 | ○ | × | × | ○ | ○ | × | ○ | × | × | ○ | ○ | × |
| 36 | × | ○ | × | ○ | ○ | × | × | ○ | × | ○ | ○ | × |
| 37 | ○ | ○ | × | ○ | ○ | × | × | ○ | × | ○ | ○ | × |
| 38 | × | ○ | × | ○ | ○ | × | ○ | ○ | × | ○ | ○ | × |
| 39 | ○ | ○ | × | ○ | ○ | × | ○ | ○ | × | ○ | ○ | × |
| 40 | × | × | ○ | ○ | ○ | × | × | × | ○ | ○ | ○ | × |
| 41 | ○ | × | ○ | ○ | ○ | × | × | × | ○ | ○ | ○ | × |
| 42 | × | × | ○ | ○ | ○ | × | ○ | × | ○ | ○ | ○ | × |
| 43 | ○ | × | ○ | ○ | ○ | × | ○ | × | ○ | ○ | ○ | × |
| 44 | × | ○ | ○ | ○ | ○ | × | × | ○ | ○ | ○ | ○ | × |
| 45 | ○ | ○ | ○ | ○ | ○ | × | × | ○ | ○ | ○ | ○ | × |
| 46 | × | ○ | ○ | ○ | ○ | × | ○ | ○ | ○ | ○ | ○ | × |
| 47 | ○ | ○ | ○ | ○ | ○ | × | ○ | ○ | ○ | ○ | ○ | × |
| 48 | × | × | × | ○ | ○ | ○ | × | × | × | ○ | ○ | ○ |
| 49 | ○ | × | × | ○ | ○ | ○ | × | × | × | ○ | ○ | ○ |
| 50 | × | × | × | ○ | ○ | ○ | ○ | × | × | ○ | ○ | ○ |
| 51 | ○ | × | × | ○ | ○ | ○ | ○ | × | × | ○ | ○ | ○ |
| 52 | × | ○ | × | ○ | ○ | ○ | × | ○ | × | ○ | ○ | ○ |
| 53 | ○ | ○ | × | ○ | ○ | ○ | × | ○ | × | ○ | ○ | ○ |
| 54 | × | ○ | × | ○ | ○ | ○ | ○ | ○ | × | ○ | ○ | ○ |
| 55 | ○ | ○ | × | ○ | ○ | ○ | ○ | ○ | × | ○ | ○ | ○ |
| 56 | × | × | ○ | ○ | ○ | ○ | × | × | ○ | ○ | ○ | ○ |
| 57 | ○ | × | ○ | ○ | ○ | ○ | × | × | ○ | ○ | ○ | ○ |
| 58 | × | × | ○ | ○ | ○ | ○ | ○ | × | ○ | ○ | ○ | ○ |
| 59 | ○ | × | ○ | ○ | ○ | ○ | ○ | × | ○ | ○ | ○ | ○ |
| 60 | × | ○ | ○ | ○ | ○ | ○ | × | ○ | ○ | ○ | ○ | ○ |
| 61 | ○ | ○ | ○ | ○ | ○ | ○ | × | ○ | ○ | ○ | ○ | ○ |
| 62 | × | ○ | ○ | ○ | ○ | ○ | ○ | ○ | ○ | ○ | ○ | ○ |
| 63 | ○ | ○ | ○ | ○ | ○ | ○ | ○ | ○ | ○ | ○ | ○ | ○ |

an overlapped time gray scale method

○ : lighting

× : non-lighting

FIG. 6

| | SF1 | SF2 | SF3 | SF4 | SF5 | SF6 | SF7 | SF8 | SF9 | SF10 | SF11 |
|---|---|---|---|---|---|---|---|---|---|---|---|
| | 1 | 1 | 2 | 4 | 4 | 4 | 1 | 2 | 4 | 4 | 4 |
| 0 | × | × | × | × | × | × | × | × | × | × | × |
| 1 | ○ | × | × | × | × | × | × | × | × | × | × |
| 2 | × | ○ | × | × | × | × | ○ | × | × | × | × |
| 3 | ○ | ○ | × | × | × | × | ○ | × | × | × | × |
| 4 | × | × | ○ | × | × | × | × | ○ | × | × | × |
| 5 | ○ | × | ○ | × | × | × | × | ○ | × | × | × |
| 6 | × | ○ | ○ | × | × | × | ○ | ○ | × | × | × |
| 7 | ○ | ○ | ○ | × | × | × | ○ | ○ | × | × | × |
| 8 | × | × | × | ○ | × | × | × | × | ○ | × | × |
| 9 | ○ | × | × | ○ | × | × | × | × | ○ | × | × |
| 10 | × | ○ | × | ○ | × | × | ○ | × | ○ | × | × |
| 11 | ○ | ○ | × | ○ | × | × | ○ | × | ○ | × | × |
| 12 | × | × | ○ | ○ | × | × | × | ○ | ○ | × | × |
| 13 | ○ | × | ○ | ○ | × | × | × | ○ | ○ | × | × |
| 14 | × | ○ | ○ | ○ | × | × | ○ | ○ | ○ | × | × |
| 15 | ○ | ○ | ○ | ○ | × | × | ○ | ○ | ○ | × | × |
| 16 | × | × | × | ○ | ○ | × | × | × | ○ | ○ | × |
| 17 | ○ | × | × | ○ | ○ | × | × | × | ○ | ○ | × |
| 18 | × | ○ | × | ○ | ○ | × | ○ | × | ○ | ○ | × |
| 19 | ○ | ○ | × | ○ | ○ | × | ○ | × | ○ | ○ | × |
| 20 | × | × | ○ | ○ | ○ | × | × | ○ | ○ | ○ | × |
| 21 | ○ | × | ○ | ○ | ○ | × | × | ○ | ○ | ○ | × |
| 22 | × | ○ | ○ | ○ | ○ | × | ○ | ○ | ○ | ○ | × |
| 23 | ○ | ○ | ○ | ○ | ○ | × | ○ | ○ | × | ○ | × |
| 24 | × | × | × | ○ | ○ | ○ | × | × | ○ | ○ | ○ |
| 25 | ○ | × | × | ○ | ○ | ○ | × | × | ○ | ○ | ○ |
| 26 | × | ○ | × | ○ | ○ | ○ | ○ | × | ○ | ○ | ○ |
| 27 | ○ | ○ | × | ○ | ○ | ○ | ○ | × | ○ | ○ | ○ |
| 28 | × | × | ○ | ○ | ○ | ○ | × | ○ | ○ | ○ | ○ |
| 29 | ○ | × | ○ | ○ | ○ | ○ | × | ○ | ○ | ○ | ○ |
| 30 | × | ○ | ○ | ○ | ○ | ○ | ○ | ○ | ○ | ○ | ○ |
| 31 | ○ | ○ | ○ | ○ | ○ | ○ | ○ | ○ | ○ | ○ | ○ |

○ : lighting

× : non-lighting

FIG. 7

| | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| | 1 | 2 | 2 | 2 | 4 | 4 | 2 | 2 | 2 | 2 | 4 | 4 |
| 0 | × | × | × | × | × | × | × | × | × | × | × | × |
| 1 | ○ | × | × | × | × | × | × | × | × | × | × | × |
| 2 | × | × | × | × | × | × | ○ | × | × | × | × | × |
| 3 | ○ | × | × | × | × | × | ○ | × | × | × | × | × |
| 4 | × | ○ | × | × | × | × | × | ○ | × | × | × | × |
| 5 | ○ | ○ | × | × | × | × | × | ○ | × | × | × | × |
| 6 | × | ○ | × | × | × | × | ○ | ○ | × | × | × | × |
| 7 | ○ | ○ | × | × | × | × | ○ | ○ | × | × | × | × |
| 8 | × | ○ | ○ | × | × | × | × | ○ | ○ | × | × | × |
| 9 | ○ | ○ | ○ | × | × | × | × | ○ | ○ | × | × | × |
| 10 | × | ○ | ○ | × | × | × | ○ | ○ | ○ | × | × | × |
| 11 | ○ | ○ | ○ | × | × | × | ○ | ○ | ○ | × | × | × |
| 12 | × | ○ | ○ | ○ | × | × | × | ○ | ○ | ○ | × | × |
| 13 | ○ | ○ | ○ | ○ | × | × | × | ○ | ○ | ○ | × | × |
| 14 | × | ○ | ○ | ○ | × | × | ○ | ○ | ○ | ○ | × | × |
| 15 | ○ | ○ | ○ | ○ | × | × | ○ | ○ | ○ | ○ | × | × |
| 16 | × | × | × | × | ○ | ○ | × | × | × | × | ○ | ○ |
| 17 | ○ | × | × | × | ○ | ○ | × | × | × | × | ○ | ○ |
| 18 | × | × | × | × | ○ | ○ | ○ | × | × | × | ○ | ○ |
| 19 | ○ | × | × | × | ○ | ○ | ○ | × | × | × | ○ | ○ |
| 20 | × | ○ | × | × | ○ | ○ | × | ○ | × | × | ○ | ○ |
| 21 | ○ | ○ | × | × | ○ | ○ | × | ○ | × | × | ○ | ○ |
| 22 | × | ○ | × | × | ○ | ○ | ○ | ○ | × | × | ○ | ○ |
| 23 | ○ | ○ | × | × | ○ | ○ | ○ | ○ | × | × | ○ | ○ |
| 24 | × | ○ | ○ | × | ○ | ○ | × | ○ | ○ | × | ○ | ○ |
| 25 | ○ | ○ | ○ | × | ○ | ○ | × | ○ | ○ | × | ○ | ○ |
| 26 | × | ○ | ○ | × | ○ | ○ | ○ | ○ | ○ | × | ○ | ○ |
| 27 | ○ | ○ | ○ | × | ○ | ○ | ○ | ○ | ○ | × | ○ | ○ |
| 28 | × | ○ | ○ | ○ | ○ | ○ | × | ○ | ○ | ○ | ○ | ○ |
| 29 | ○ | ○ | ○ | ○ | ○ | ○ | × | ○ | ○ | ○ | ○ | ○ |
| 30 | × | ○ | ○ | ○ | ○ | ○ | ○ | ○ | ○ | ○ | ○ | ○ |
| 31 | ○ | ○ | ○ | ○ | ○ | ○ | ○ | ○ | ○ | ○ | ○ | ○ |

○ : lighting

× : non-lighting

FIG. 8

| | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| | 0.5 | 1 | 2 | 4 | 4 | 4 | 0.5 | 1 | 2 | 4 | 4 | 4 |
| 0 | × | × | × | × | × | × | × | × | × | × | × | × |
| 1 | ○ | × | × | × | × | × | ○ | × | × | × | × | × |
| 2 | × | ○ | × | × | × | × | × | ○ | × | × | × | × |
| 3 | ○ | ○ | × | × | × | × | ○ | ○ | × | × | × | × |
| 4 | × | × | ○ | × | × | × | × | × | ○ | × | × | × |
| 5 | ○ | × | ○ | × | × | × | ○ | × | ○ | × | × | × |
| 6 | × | ○ | ○ | × | × | × | × | ○ | ○ | × | × | × |
| 7 | ○ | ○ | ○ | × | × | × | ○ | ○ | ○ | × | × | × |
| 8 | × | × | × | ○ | × | × | × | × | × | ○ | × | × |
| 9 | ○ | × | × | ○ | × | × | ○ | × | × | ○ | × | × |
| 10 | × | ○ | × | ○ | × | × | × | ○ | × | ○ | × | × |
| 11 | ○ | ○ | × | ○ | × | × | ○ | ○ | × | ○ | × | × |
| 12 | × | × | ○ | ○ | × | × | × | × | ○ | ○ | × | × |
| 13 | ○ | × | ○ | ○ | × | × | ○ | × | ○ | ○ | × | × |
| 14 | × | ○ | ○ | ○ | × | × | × | ○ | ○ | ○ | × | × |
| 15 | ○ | ○ | ○ | ○ | × | × | ○ | ○ | ○ | ○ | × | × |
| 16 | × | × | × | ○ | ○ | × | × | × | × | ○ | ○ | × |
| 17 | ○ | × | × | ○ | ○ | × | ○ | × | × | ○ | ○ | × |
| 18 | × | ○ | × | ○ | ○ | × | × | ○ | × | ○ | ○ | × |
| 19 | ○ | ○ | × | ○ | ○ | × | ○ | ○ | × | ○ | ○ | × |
| 20 | × | × | ○ | ○ | ○ | × | × | × | ○ | ○ | ○ | × |
| 21 | ○ | × | ○ | ○ | ○ | × | ○ | × | ○ | ○ | ○ | × |
| 22 | × | ○ | ○ | ○ | ○ | × | × | ○ | ○ | ○ | ○ | × |
| 23 | ○ | ○ | ○ | ○ | ○ | × | ○ | ○ | ○ | ○ | ○ | × |
| 24 | × | × | × | ○ | ○ | ○ | × | × | × | ○ | ○ | ○ |
| 25 | ○ | × | × | ○ | ○ | ○ | ○ | × | × | ○ | ○ | ○ |
| 26 | × | ○ | × | ○ | ○ | ○ | × | ○ | × | ○ | ○ | ○ |
| 27 | ○ | ○ | × | ○ | ○ | ○ | ○ | ○ | × | ○ | ○ | ○ |
| 28 | × | × | ○ | ○ | ○ | ○ | × | × | ○ | ○ | ○ | ○ |
| 29 | ○ | × | ○ | ○ | ○ | ○ | ○ | × | ○ | ○ | ○ | ○ |
| 30 | × | ○ | ○ | ○ | ○ | ○ | × | ○ | ○ | ○ | ○ | ○ |
| 31 | ○ | ○ | ○ | ○ | ○ | ○ | ○ | ○ | ○ | ○ | ○ | ○ |

○ : lighting

× : non-lighting

FIG. 9

| | SF1 | SF2 | SF3 | SF4 | SF5 | SF6 | SF7 | SF8 | SF9 | SF10 |
|---|---|---|---|---|---|---|---|---|---|---|
| | 1 | 2 | 2 | 2 | 8 | 2 | 2 | 2 | 2 | 8 |
| 0 | × | × | × | × | × | × | × | × | × | × |
| 1 | ○ | × | × | × | × | × | × | × | × | × |
| 2 | × | × | × | × | × | ○ | × | × | × | × |
| 3 | ○ | × | × | × | × | ○ | × | × | × | × |
| 4 | × | ○ | × | × | × | × | ○ | × | × | × |
| 5 | ○ | ○ | × | × | × | × | ○ | × | × | × |
| 6 | × | ○ | × | × | × | ○ | ○ | × | × | × |
| 7 | ○ | ○ | × | × | × | ○ | ○ | × | × | × |
| 8 | × | ○ | ○ | × | × | × | ○ | ○ | × | × |
| 9 | ○ | ○ | ○ | × | × | × | ○ | ○ | × | × |
| 10 | × | ○ | ○ | × | × | ○ | ○ | ○ | × | × |
| 11 | ○ | ○ | ○ | × | × | ○ | ○ | ○ | × | × |
| 12 | × | ○ | ○ | ○ | × | × | ○ | ○ | ○ | × |
| 13 | ○ | ○ | ○ | ○ | × | × | ○ | ○ | ○ | × |
| 14 | × | ○ | ○ | ○ | × | ○ | ○ | ○ | ○ | × |
| 15 | ○ | ○ | ○ | ○ | × | ○ | ○ | ○ | ○ | × |
| 16 | × | × | × | × | ○ | × | × | × | × | ○ |
| 17 | ○ | × | × | × | ○ | × | × | × | × | ○ |
| 18 | × | × | × | × | ○ | ○ | × | × | × | ○ |
| 19 | ○ | × | × | × | ○ | ○ | × | × | × | ○ |
| 20 | × | ○ | × | × | ○ | × | ○ | × | × | ○ |
| 21 | ○ | ○ | × | × | ○ | × | ○ | × | × | ○ |
| 22 | × | ○ | × | × | ○ | ○ | ○ | × | × | ○ |
| 23 | ○ | ○ | × | × | ○ | ○ | ○ | × | × | ○ |
| 24 | × | ○ | ○ | × | ○ | × | ○ | ○ | × | ○ |
| 25 | ○ | ○ | ○ | × | ○ | × | ○ | ○ | × | ○ |
| 26 | × | ○ | ○ | × | ○ | ○ | ○ | ○ | × | ○ |
| 27 | ○ | ○ | ○ | × | ○ | ○ | ○ | ○ | × | ○ |
| 28 | × | ○ | ○ | ○ | ○ | × | ○ | ○ | ○ | ○ |
| 29 | ○ | ○ | ○ | ○ | ○ | × | ○ | ○ | ○ | ○ |
| 30 | × | ○ | ○ | ○ | ○ | ○ | ○ | ○ | ○ | ○ |
| 31 | ○ | ○ | ○ | ○ | ○ | ○ | ○ | ○ | ○ | ○ |

○ : lighting

× : non-lighting

FIG. 10

| | SF1 | SF2 | SF3 | SF4 | SF5 | SF6 | SF7 | SF8 | SF9 | SF10 | SF11 | SF12 | SF13 | SF14 |
|---|---|---|---|---|---|---|---|---|---|---|---|---|---|---|
| | 1 | 2 | 2 | 2 | 8/3 | 8/3 | 8/3 | 2 | 2 | 2 | 2 | 8/3 | 8/3 | 8/3 |
| 0 | × | × | × | × | × | × | × | × | × | × | × | × | × | × |
| 1 | ○ | × | × | × | × | × | × | × | × | × | × | × | × | × |
| 2 | × | × | × | × | × | × | × | ○ | × | × | × | × | × | × |
| 3 | ○ | × | × | × | × | × | × | ○ | × | × | × | × | × | × |
| 4 | × | ○ | × | × | × | × | × | × | ○ | × | × | × | × | × |
| 5 | ○ | ○ | × | × | × | × | × | × | ○ | × | × | × | × | × |
| 6 | × | ○ | × | × | × | × | × | ○ | ○ | × | × | × | × | × |
| 7 | ○ | ○ | × | × | × | × | × | ○ | ○ | × | × | × | × | × |
| 8 | × | ○ | ○ | × | × | × | × | × | ○ | ○ | × | × | × | × |
| 9 | ○ | ○ | ○ | × | × | × | × | × | ○ | ○ | × | × | × | × |
| 10 | × | ○ | ○ | × | × | × | × | ○ | ○ | ○ | × | × | × | × |
| 11 | ○ | ○ | ○ | × | × | × | × | ○ | ○ | ○ | × | × | × | × |
| 12 | × | ○ | ○ | ○ | × | × | × | × | ○ | ○ | ○ | × | × | × |
| 13 | ○ | ○ | ○ | ○ | × | × | × | × | ○ | ○ | ○ | × | × | × |
| 14 | × | ○ | ○ | ○ | × | × | × | ○ | ○ | ○ | ○ | × | × | × |
| 15 | ○ | ○ | ○ | ○ | × | × | × | ○ | ○ | ○ | ○ | × | × | × |
| 16 | × | × | × | × | ○ | ○ | ○ | × | × | × | × | ○ | ○ | ○ |
| 17 | ○ | × | × | × | ○ | ○ | ○ | × | × | × | × | ○ | ○ | ○ |
| 18 | × | × | × | × | ○ | ○ | ○ | ○ | × | × | × | ○ | ○ | ○ |
| 19 | ○ | × | × | × | ○ | ○ | ○ | ○ | × | × | × | ○ | ○ | ○ |
| 20 | × | ○ | × | × | ○ | ○ | ○ | × | ○ | × | × | ○ | ○ | ○ |
| 21 | ○ | ○ | × | × | ○ | ○ | ○ | × | ○ | × | × | ○ | ○ | ○ |
| 22 | × | ○ | × | × | ○ | ○ | ○ | ○ | ○ | × | × | ○ | ○ | ○ |
| 23 | ○ | ○ | × | × | ○ | ○ | ○ | ○ | ○ | × | × | ○ | ○ | ○ |
| 24 | × | ○ | ○ | × | ○ | ○ | ○ | × | ○ | ○ | × | ○ | ○ | ○ |
| 25 | ○ | ○ | ○ | × | ○ | ○ | ○ | × | ○ | ○ | × | ○ | ○ | ○ |
| 26 | × | ○ | ○ | × | ○ | ○ | ○ | ○ | ○ | ○ | × | ○ | ○ | ○ |
| 27 | ○ | ○ | ○ | × | ○ | ○ | ○ | ○ | ○ | ○ | × | ○ | ○ | ○ |
| 28 | × | ○ | ○ | ○ | ○ | ○ | ○ | × | ○ | ○ | ○ | ○ | ○ | ○ |
| 29 | ○ | ○ | ○ | ○ | ○ | ○ | ○ | × | ○ | ○ | ○ | ○ | ○ | ○ |
| 30 | × | ○ | ○ | ○ | ○ | ○ | ○ | ○ | ○ | ○ | ○ | ○ | ○ | ○ |
| 31 | ○ | ○ | ○ | ○ | ○ | ○ | ○ | ○ | ○ | ○ | ○ | ○ | ○ | ○ |

○ : lighting

× : non-lighting

FIG. 11

| | SF1 | SF2 | SF3 | SF4 | SF5 | SF6 | SF7 | SF8 | SF9 | SF10 |
|---|---|---|---|---|---|---|---|---|---|---|
| | 1 | 2 | 2 | 4 | 4 | 2 | 2 | 6 | 4 | 4 |
| 0 | × | × | × | × | × | × | × | × | × | × |
| 1 | ○ | × | × | × | × | × | × | × | × | × |
| 2 | × | × | × | × | × | ○ | × | × | × | × |
| 3 | ○ | × | × | × | × | ○ | × | × | × | × |
| 4 | × | ○ | × | × | × | × | ○ | × | × | × |
| 5 | ○ | ○ | × | × | × | × | ○ | × | × | × |
| 6 | × | ○ | × | × | × | ○ | ○ | × | × | × |
| 7 | ○ | ○ | × | × | × | ○ | ○ | × | × | × |
| 8 | × | ○ | × | × | × | × | × | ○ | × | × |
| 9 | ○ | ○ | × | × | × | × | × | ○ | × | × |
| 10 | × | ○ | × | × | × | ○ | × | ○ | × | × |
| 11 | ○ | ○ | × | × | × | ○ | × | ○ | × | × |
| 12 | × | ○ | ○ | × | × | × | ○ | ○ | × | × |
| 13 | ○ | ○ | ○ | × | × | × | ○ | ○ | × | × |
| 14 | × | ○ | ○ | × | × | ○ | ○ | ○ | × | × |
| 15 | ○ | ○ | ○ | × | × | ○ | ○ | ○ | × | × |
| 16 | × | × | × | ○ | ○ | × | × | × | ○ | ○ |
| 17 | ○ | × | × | ○ | ○ | × | × | × | ○ | ○ |
| 18 | × | × | × | ○ | ○ | ○ | × | × | ○ | ○ |
| 19 | ○ | × | × | ○ | ○ | ○ | × | × | ○ | ○ |
| 20 | × | ○ | × | ○ | ○ | × | ○ | × | ○ | ○ |
| 21 | ○ | ○ | × | ○ | ○ | × | ○ | × | ○ | ○ |
| 22 | × | ○ | × | ○ | ○ | ○ | ○ | × | ○ | ○ |
| 23 | ○ | ○ | × | ○ | ○ | ○ | ○ | × | ○ | ○ |
| 24 | × | ○ | × | ○ | ○ | × | × | ○ | ○ | ○ |
| 25 | ○ | ○ | × | ○ | ○ | × | × | ○ | ○ | ○ |
| 26 | × | ○ | × | ○ | ○ | ○ | × | ○ | ○ | ○ |
| 27 | ○ | ○ | × | ○ | ○ | ○ | × | ○ | ○ | ○ |
| 28 | × | ○ | ○ | ○ | ○ | × | ○ | ○ | ○ | ○ |
| 29 | ○ | ○ | ○ | ○ | ○ | × | ○ | ○ | ○ | ○ |
| 30 | × | ○ | ○ | ○ | ○ | ○ | ○ | ○ | ○ | ○ |
| 31 | ○ | ○ | ○ | ○ | ○ | ○ | ○ | ○ | ○ | ○ |

○ : lighting

× : non-lighting

FIG. 12A

| | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| | 1 | 2 | 2 | 2 | 2 | 6 | 2 | 2 | 2 | 2 | 2 | 6 |
| 0 | × | × | × | × | × | × | × | × | × | × | × | × |
| 1 | ○ | × | × | × | × | × | × | × | × | × | × | × |
| 2 | × | × | × | × | × | × | ○ | × | × | × | × | × |
| 3 | ○ | × | × | × | × | × | ○ | × | × | × | × | × |
| 4 | × | ○ | × | × | × | × | × | ○ | × | × | × | × |
| 5 | ○ | ○ | × | × | × | × | × | ○ | × | × | × | × |
| 6 | × | ○ | × | × | × | × | ○ | ○ | × | × | × | × |
| 7 | ○ | ○ | × | × | × | × | ○ | ○ | × | × | × | × |
| 8 | × | ○ | ○ | × | × | × | × | ○ | ○ | × | × | × |
| 9 | ○ | ○ | ○ | × | × | × | × | ○ | ○ | × | × | × |
| 10 | × | ○ | ○ | × | × | × | ○ | ○ | ○ | × | × | × |
| 11 | ○ | ○ | ○ | × | × | × | ○ | ○ | ○ | × | × | × |
| 12 | × | ○ | ○ | ○ | × | × | × | ○ | ○ | ○ | × | × |
| 13 | ○ | ○ | ○ | ○ | × | × | × | ○ | ○ | ○ | × | × |
| 14 | × | ○ | ○ | ○ | × | × | ○ | ○ | ○ | ○ | × | × |
| 15 | ○ | ○ | ○ | ○ | × | × | ○ | ○ | ○ | ○ | × | × |
| 16 | × | × | × | × | ○ | ○ | × | × | × | × | ○ | ○ |
| 17 | ○ | × | × | × | ○ | ○ | × | × | × | × | ○ | ○ |
| 18 | × | × | × | × | ○ | ○ | ○ | × | × | × | ○ | ○ |
| 19 | ○ | × | × | × | ○ | ○ | ○ | × | × | × | ○ | ○ |
| 20 | × | ○ | × | × | ○ | ○ | × | ○ | × | × | ○ | ○ |
| 21 | ○ | ○ | × | × | ○ | ○ | × | ○ | × | × | ○ | ○ |
| 22 | × | ○ | × | × | ○ | ○ | ○ | ○ | × | × | ○ | ○ |
| 23 | ○ | ○ | × | × | ○ | ○ | ○ | ○ | × | × | ○ | ○ |
| 24 | × | ○ | ○ | × | ○ | ○ | × | ○ | ○ | × | ○ | ○ |
| 25 | ○ | ○ | ○ | × | ○ | ○ | × | ○ | ○ | × | ○ | ○ |
| 26 | × | ○ | ○ | × | ○ | ○ | ○ | ○ | ○ | × | ○ | ○ |
| 27 | ○ | ○ | ○ | × | ○ | ○ | ○ | ○ | ○ | × | ○ | ○ |
| 28 | × | ○ | ○ | ○ | ○ | ○ | × | ○ | ○ | ○ | ○ | ○ |
| 29 | ○ | ○ | ○ | ○ | ○ | ○ | × | ○ | ○ | ○ | ○ | ○ |
| 30 | × | ○ | ○ | ○ | ○ | ○ | ○ | ○ | ○ | ○ | ○ | ○ |
| 31 | ○ | ○ | ○ | ○ | ○ | ○ | ○ | ○ | ○ | ○ | ○ | ○ |

FIG. 12B

| | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| | 1 | 2 | 2 | 2 | 2 | 6 | 2 | 2 | 2 | 2 | 2 | 6 |
| 0 | × | × | × | × | × | × | × | × | × | × | × | × |
| 1 | ○ | × | × | × | × | × | × | × | × | × | × | × |
| 2 | × | × | × | × | × | × | ○ | × | × | × | × | × |
| 3 | ○ | × | × | × | × | × | ○ | × | × | × | × | × |
| 4 | × | ○ | × | × | × | × | × | ○ | × | × | × | × |
| 5 | ○ | ○ | × | × | × | × | × | ○ | × | × | × | × |
| 6 | × | ○ | × | × | × | × | ○ | ○ | × | × | × | × |
| 7 | ○ | ○ | × | × | × | × | ○ | ○ | × | × | × | × |
| 8 | × | ○ | ○ | × | × | × | × | ○ | ○ | × | × | × |
| 9 | ○ | ○ | ○ | × | × | × | × | ○ | ○ | × | × | × |
| 10 | × | ○ | ○ | × | × | × | ○ | ○ | ○ | × | × | × |
| 11 | ○ | ○ | ○ | × | × | × | ○ | ○ | ○ | × | × | × |
| 12 | × | ○ | ○ | ○ | × | × | × | ○ | ○ | ○ | × | × |
| 13 | ○ | ○ | ○ | ○ | × | × | × | ○ | ○ | ○ | × | × |
| 14 | × | ○ | ○ | ○ | × | × | ○ | ○ | ○ | ○ | × | × |
| 15 | ○ | ○ | ○ | ○ | × | × | ○ | ○ | ○ | ○ | × | × |
| 16 | × | ○ | × | × | × | ○ | × | ○ | × | × | × | ○ |
| 17 | ○ | ○ | × | × | × | ○ | × | ○ | × | × | × | ○ |
| 18 | × | ○ | × | × | × | ○ | ○ | ○ | × | × | × | ○ |
| 19 | ○ | ○ | × | × | × | ○ | ○ | ○ | × | × | × | ○ |
| 20 | × | ○ | ○ | × | × | ○ | × | ○ | ○ | × | × | ○ |
| 21 | ○ | ○ | ○ | × | × | ○ | × | ○ | ○ | × | × | ○ |
| 22 | × | ○ | ○ | × | × | ○ | ○ | ○ | ○ | × | × | ○ |
| 23 | ○ | ○ | ○ | × | × | ○ | ○ | ○ | ○ | × | × | ○ |
| 24 | × | ○ | ○ | ○ | × | ○ | × | ○ | ○ | ○ | × | ○ |
| 25 | ○ | ○ | ○ | ○ | × | ○ | × | ○ | ○ | ○ | × | ○ |
| 26 | × | ○ | ○ | ○ | × | ○ | ○ | ○ | ○ | ○ | × | ○ |
| 27 | ○ | ○ | ○ | ○ | × | ○ | ○ | ○ | ○ | ○ | × | ○ |
| 28 | × | ○ | ○ | ○ | ○ | ○ | × | ○ | ○ | ○ | ○ | ○ |
| 29 | ○ | ○ | ○ | ○ | ○ | ○ | × | ○ | ○ | ○ | ○ | ○ |
| 30 | × | ○ | ○ | ○ | ○ | ○ | ○ | ○ | ○ | ○ | ○ | ○ |
| 31 | ○ | ○ | ○ | ○ | ○ | ○ | ○ | ○ | ○ | ○ | ○ | ○ |

○ : lighting

× : non-lighting

FIG. 13A

| | SF1 | SF2 | SF3 | SF4 | SF5 | SF6 | SF7 | SF8 | SF9 | SF10 |
|---|---|---|---|---|---|---|---|---|---|---|
| | 1 | 2 | 4 | 4 | 4 | 2 | 2 | 4 | 4 | 4 |
| 0 | × | × | × | × | × | × | × | × | × | × |
| 1 | ○ | × | × | × | × | × | × | × | × | × |
| 2 | × | × | × | × | × | ○ | × | × | × | × |
| 3 | ○ | × | × | × | × | ○ | × | × | × | × |
| 4 | × | ○ | × | × | × | × | ○ | × | × | × |
| 5 | ○ | ○ | × | × | × | × | ○ | × | × | × |
| 6 | × | ○ | × | × | × | ○ | ○ | × | × | × |
| 7 | ○ | ○ | × | × | × | ○ | ○ | × | × | × |
| 8 | × | × | ○ | × | × | × | × | ○ | × | × |
| 9 | ○ | × | ○ | × | × | × | × | ○ | × | × |
| 10 | × | × | ○ | × | × | ○ | × | ○ | × | × |
| 11 | ○ | × | ○ | × | × | ○ | × | ○ | × | × |
| 12 | × | ○ | ○ | × | × | × | ○ | ○ | × | × |
| 13 | ○ | ○ | ○ | × | × | × | ○ | ○ | × | × |
| 14 | × | ○ | ○ | × | × | ○ | ○ | ○ | × | × |
| 15 | ○ | ○ | ○ | × | × | ○ | ○ | ○ | × | × |
| 16 | × | × | ○ | ○ | × | × | × | ○ | ○ | × |
| 17 | ○ | × | ○ | ○ | × | × | × | ○ | ○ | × |
| 18 | × | × | ○ | ○ | × | ○ | × | ○ | ○ | × |
| 19 | ○ | × | ○ | ○ | × | ○ | × | ○ | ○ | × |
| 20 | × | ○ | ○ | ○ | × | × | ○ | ○ | ○ | × |
| 21 | ○ | ○ | ○ | ○ | × | × | ○ | ○ | ○ | × |
| 22 | × | ○ | ○ | ○ | × | ○ | ○ | ○ | ○ | × |
| 23 | ○ | ○ | ○ | ○ | × | ○ | ○ | ○ | ○ | × |
| 24 | × | × | ○ | ○ | ○ | × | × | ○ | ○ | ○ |
| 25 | ○ | × | ○ | ○ | ○ | × | × | ○ | ○ | ○ |
| 26 | × | × | ○ | ○ | ○ | ○ | × | ○ | ○ | ○ |
| 27 | ○ | × | ○ | ○ | ○ | ○ | × | ○ | ○ | ○ |
| 28 | × | ○ | ○ | ○ | ○ | × | ○ | ○ | ○ | ○ |
| 29 | ○ | ○ | ○ | ○ | ○ | × | ○ | ○ | ○ | ○ |
| 30 | × | ○ | ○ | ○ | ○ | ○ | ○ | ○ | ○ | ○ |
| 31 | ○ | ○ | ○ | ○ | ○ | ○ | ○ | ○ | ○ | ○ |

FIG. 13B

| | SF1 | SF2 | SF3 | SF4 | SF5 | SF6 | SF7 | SF8 | SF9 | SF10 |
|---|---|---|---|---|---|---|---|---|---|---|
| | 1 | 2 | 4 | 4 | 4 | 2 | 2 | 4 | 4 | 4 |
| 0 | × | × | × | × | × | × | × | × | × | × |
| 1 | ○ | × | × | × | × | × | × | × | × | × |
| 2 | × | × | × | × | × | ○ | × | × | × | × |
| 3 | ○ | × | × | × | × | ○ | × | × | × | × |
| 4 | × | ○ | × | × | × | × | ○ | × | × | × |
| 5 | ○ | ○ | × | × | × | × | ○ | × | × | × |
| 6 | × | ○ | × | × | × | ○ | ○ | × | × | × |
| 7 | ○ | ○ | × | × | × | ○ | ○ | × | × | × |
| 8 | × | × | ○ | × | × | × | × | ○ | × | × |
| 9 | ○ | × | ○ | × | × | × | × | ○ | × | × |
| 10 | × | × | ○ | × | × | ○ | × | ○ | × | × |
| 11 | ○ | × | ○ | × | × | ○ | × | ○ | × | × |
| 12 | × | ○ | ○ | × | × | × | ○ | ○ | × | × |
| 13 | ○ | ○ | ○ | × | × | × | ○ | ○ | × | × |
| 14 | × | ○ | ○ | × | × | ○ | ○ | ○ | × | × |
| 15 | ○ | ○ | ○ | × | × | ○ | ○ | ○ | × | × |
| 16 | × | ○ | ○ | × | × | × | ○ | ○ | ○ | × |
| 17 | ○ | × | ○ | ○ | × | × | × | ○ | ○ | × |
| 18 | × | × | ○ | ○ | × | ○ | × | ○ | ○ | × |
| 19 | ○ | × | ○ | ○ | × | ○ | × | ○ | ○ | × |
| 20 | × | ○ | ○ | ○ | × | × | ○ | ○ | ○ | × |
| 21 | ○ | ○ | ○ | ○ | × | × | ○ | ○ | ○ | × |
| 22 | × | ○ | ○ | ○ | × | ○ | ○ | ○ | ○ | × |
| 23 | ○ | ○ | ○ | × | ○ | ○ | ○ | ○ | × | ○ |
| 24 | × | × | ○ | ○ | ○ | × | × | ○ | ○ | ○ |
| 25 | ○ | × | ○ | ○ | ○ | × | × | ○ | ○ | ○ |
| 26 | × | × | ○ | ○ | ○ | ○ | × | ○ | ○ | ○ |
| 27 | ○ | × | ○ | ○ | ○ | ○ | × | ○ | ○ | ○ |
| 28 | × | ○ | ○ | ○ | ○ | × | ○ | ○ | ○ | ○ |
| 29 | ○ | ○ | ○ | ○ | ○ | × | ○ | ○ | ○ | ○ |
| 30 | × | ○ | ○ | ○ | ○ | ○ | ○ | ○ | ○ | ○ |
| 31 | ○ | ○ | ○ | ○ | ○ | ○ | ○ | ○ | ○ | ○ |

○ : lighting

× : non-lighting

FIG. 14A

| | SF1 | SF2 | SF3 | SF4 | SF5 | SF6 | SF7 | SF8 | SF9 | SF10 |
|---|---|---|---|---|---|---|---|---|---|---|
| | 1 | 2 | 4 | 4 | 4 | 2 | 2 | 4 | 4 | 4 |
| 0 | × | × | × | × | × | × | × | × | × | × |
| 1 | ○ | × | × | × | × | × | × | × | × | × |
| 2 | × | × | × | × | × | ○ | × | × | × | × |
| 3 | ○ | × | × | × | × | ○ | × | × | × | × |
| 4 | × | ○ | × | × | × | × | ○ | × | × | × |
| 5 | ○ | ○ | × | × | × | × | ○ | × | × | × |
| 6 | × | ○ | × | × | × | ○ | ○ | × | × | × |
| 7 | ○ | ○ | × | × | × | ○ | ○ | × | × | × |
| 8 | × | × | ○ | × | × | × | × | ○ | × | × |
| 9 | ○ | × | ○ | × | × | × | × | ○ | × | × |
| 10 | × | × | ○ | × | × | ○ | × | ○ | × | × |
| 11 | ○ | × | ○ | × | × | ○ | × | ○ | × | × |
| 12 | × | ○ | ○ | × | × | × | ○ | ○ | × | × |
| 13 | ○ | ○ | ○ | × | × | × | ○ | ○ | × | × |
| 14 | × | ○ | ○ | × | × | ○ | ○ | ○ | × | × |
| 15 | ○ | ○ | ○ | × | × | ○ | ○ | ○ | × | × |
| 16 | × | × | ○ | ○ | × | × | × | ○ | ○ | × |
| 17 | ○ | × | ○ | ○ | × | × | × | ○ | ○ | × |
| 18 | × | × | ○ | ○ | × | ○ | × | ○ | ○ | × |
| 19 | ○ | × | ○ | ○ | × | ○ | × | ○ | ○ | × |
| 20 | × | ○ | ○ | ○ | × | × | ○ | ○ | ○ | × |
| 21 | ○ | ○ | ○ | ○ | × | × | ○ | ○ | ○ | × |
| 22 | × | ○ | ○ | ○ | × | ○ | ○ | ○ | ○ | × |
| 23 | ○ | ○ | ○ | ○ | × | ○ | ○ | ○ | ○ | × |
| 24 | × | × | ○ | ○ | ○ | × | × | ○ | ○ | ○ |
| 25 | ○ | × | ○ | ○ | ○ | × | × | ○ | ○ | ○ |
| 26 | × | × | ○ | ○ | ○ | ○ | × | ○ | ○ | ○ |
| 27 | ○ | × | ○ | ○ | ○ | ○ | × | ○ | ○ | ○ |
| 28 | × | ○ | ○ | ○ | ○ | × | ○ | ○ | ○ | ○ |
| 29 | ○ | ○ | ○ | ○ | ○ | × | ○ | ○ | ○ | ○ |
| 30 | × | ○ | ○ | ○ | ○ | ○ | ○ | ○ | ○ | ○ |
| 31 | ○ | ○ | ○ | ○ | ○ | ○ | ○ | ○ | ○ | ○ |

FIG. 14B

| | SF1 | SF2 | SF3 | SF4 | SF5 | SF6 | SF7 | SF8 | SF9 | SF10 |
|---|---|---|---|---|---|---|---|---|---|---|
| | 1 | 2 | 2 | 4 | 4 | 2 | 2 | 6 | 4 | 4 |
| 0 | × | × | × | × | × | × | × | × | × | × |
| 1 | ○ | × | × | × | × | × | × | × | × | × |
| 2 | × | × | × | × | × | ○ | × | × | × | × |
| 3 | ○ | × | × | × | × | ○ | × | × | × | × |
| 4 | × | ○ | × | × | × | × | ○ | × | × | × |
| 5 | ○ | ○ | × | × | × | × | ○ | × | × | × |
| 6 | × | ○ | × | × | × | ○ | ○ | × | × | × |
| 7 | ○ | ○ | × | × | × | ○ | ○ | × | × | × |
| 8 | × | ○ | × | × | × | × | × | ○ | × | × |
| 9 | ○ | ○ | × | × | × | × | × | ○ | × | × |
| 10 | × | ○ | × | × | × | ○ | × | ○ | × | × |
| 11 | ○ | ○ | × | × | × | ○ | × | ○ | × | × |
| 12 | × | ○ | ○ | × | × | × | ○ | ○ | × | × |
| 13 | ○ | ○ | ○ | × | × | × | ○ | ○ | × | × |
| 14 | × | ○ | ○ | × | × | ○ | ○ | ○ | × | × |
| 15 | ○ | ○ | ○ | × | × | ○ | ○ | ○ | × | × |
| 16 | × | × | × | ○ | ○ | × | × | × | ○ | ○ |
| 17 | ○ | × | × | ○ | ○ | × | × | × | ○ | ○ |
| 18 | × | × | × | ○ | ○ | ○ | × | × | ○ | ○ |
| 19 | ○ | × | × | ○ | ○ | ○ | × | × | ○ | ○ |
| 20 | × | ○ | × | ○ | ○ | × | ○ | × | ○ | ○ |
| 21 | ○ | ○ | × | ○ | ○ | × | ○ | × | ○ | ○ |
| 22 | × | ○ | × | ○ | ○ | ○ | ○ | × | ○ | ○ |
| 23 | ○ | ○ | × | ○ | ○ | ○ | ○ | × | ○ | ○ |
| 24 | × | ○ | × | ○ | ○ | × | × | ○ | ○ | ○ |
| 25 | ○ | ○ | × | ○ | ○ | × | × | ○ | ○ | ○ |
| 26 | × | ○ | × | ○ | ○ | ○ | × | ○ | ○ | ○ |
| 27 | ○ | ○ | × | ○ | ○ | ○ | × | ○ | ○ | ○ |
| 28 | × | ○ | ○ | ○ | ○ | × | ○ | ○ | ○ | ○ |
| 29 | ○ | ○ | ○ | ○ | ○ | × | ○ | ○ | ○ | ○ |
| 30 | × | ○ | ○ | ○ | ○ | ○ | ○ | ○ | ○ | ○ |
| 31 | ○ | ○ | ○ | ○ | ○ | ○ | ○ | ○ | ○ | ○ |

○ : lighting

× : non-lighting

FIG. 15

| | | SF1 | SF2 | SF3 | SF4 | SF5 | SF6 | SF7 | SF8 | SF9 | SF10 | SF11 | SF12 |
|---|---|---|---|---|---|---|---|---|---|---|---|---|---|
| | | 1 | 2 | 4 | 8 | 8 | 8 | 2 | 2 | 4 | 8 | 8 | 8 |
| 0 | 0 | × | × | × | × | × | × | × | × | × | × | × | × |
| 1 | 0 | × | × | × | × | × | × | × | × | × | × | × | × |
| 2 | 0 | × | × | × | × | × | × | × | × | × | × | × | × |
| 3 | 0 | × | × | × | × | × | × | × | × | × | × | × | × |
| 4 | 1 | ○ | × | × | × | × | × | × | × | × | × | × | × |
| 5 | 1 | ○ | × | × | × | × | × | × | × | × | × | × | × |
| 6 | 2 | × | × | × | × | × | × | ○ | × | × | × | × | × |
| 7 | 2 | × | × | × | × | × | × | ○ | × | × | × | × | × |
| 8 | 3 | ○ | × | × | × | × | × | ○ | × | × | × | × | × |
| 9 | 4 | × | ○ | × | × | × | × | × | ○ | × | × | × | × |
| 10 | 5 | ○ | ○ | × | × | × | × | × | ○ | × | × | × | × |
| 11 | 6 | × | ○ | × | × | × | × | ○ | ○ | × | × | × | × |
| 12 | 8 | × | × | ○ | × | × | × | × | × | ○ | × | × | × |
| 13 | 9 | ○ | × | ○ | × | × | × | × | × | ○ | × | × | × |
| 14 | 11 | ○ | × | ○ | × | × | × | ○ | × | ○ | × | × | × |
| 15 | 13 | ○ | ○ | ○ | × | × | × | × | ○ | ○ | × | × | × |
| 16 | 15 | ○ | ○ | ○ | × | × | × | ○ | ○ | ○ | × | × | × |
| 17 | 17 | ○ | × | × | ○ | × | × | × | × | × | ○ | × | × |
| 18 | 19 | ○ | × | × | ○ | × | × | ○ | × | × | ○ | × | × |
| 19 | 21 | ○ | ○ | × | ○ | × | × | × | ○ | × | ○ | × | × |
| 20 | 24 | × | × | ○ | ○ | × | × | × | × | ○ | ○ | × | × |
| 21 | 27 | ○ | × | ○ | ○ | × | × | ○ | × | ○ | ○ | × | × |
| 22 | 30 | × | ○ | ○ | ○ | × | × | ○ | ○ | ○ | ○ | × | × |
| 23 | 33 | ○ | × | × | ○ | ○ | × | × | × | × | ○ | ○ | × |
| 24 | 36 | × | ○ | × | ○ | ○ | × | × | ○ | × | ○ | ○ | × |
| 25 | 39 | ○ | ○ | × | ○ | ○ | × | ○ | ○ | × | ○ | ○ | × |
| 26 | 43 | ○ | × | ○ | ○ | ○ | × | ○ | × | ○ | ○ | ○ | × |
| 27 | 46 | × | ○ | ○ | ○ | ○ | × | ○ | ○ | ○ | ○ | ○ | × |
| 28 | 50 | × | × | × | ○ | ○ | ○ | ○ | × | × | ○ | ○ | ○ |
| 29 | 54 | × | ○ | × | ○ | ○ | ○ | ○ | ○ | × | ○ | ○ | ○ |
| 30 | 59 | ○ | × | ○ | ○ | ○ | ○ | ○ | × | ○ | ○ | ○ | ○ |
| 31 | 63 | ○ | ○ | ○ | ○ | ○ | ○ | ○ | ○ | ○ | ○ | ○ | ○ |

subframes lengths of lighting periods

○ : lighting

× : non-lighting 32 gray scale levels using a gamma correction 64 gray scale levels

FIG. 17 subframes

| | | SF1 | SF2 | SF3 | SF4 | SF5 | SF6 | SF7 | SF8 | SF9 | SF10 | SF11 | SF12 |
|---|---|---|---|---|---|---|---|---|---|---|---|---|---|
| | | 1 | 2 | 4 | 8 | 8 | 8 | 2 | 2 | 4 | 8 | 8 | 8 |
| 0 | 0 | × | × | × | × | × | × | × | × | × | × | × | × |
| 1 | 1 | ○ | × | × | × | × | × | × | × | × | × | × | × |
| 2 | 2 | × | × | × | × | × | × | ○ | × | × | × | × | × |
| 3 | 3 | ○ | × | × | × | × | × | ○ | × | × | × | × | × |
| 4 | 4 | × | ○ | × | × | × | × | × | ○ | × | × | × | × |
| 5 | 5 | ○ | ○ | × | × | × | × | × | ○ | × | × | × | × |
| 6 | 6 | × | ○ | × | × | × | × | ○ | ○ | × | × | × | × |
| 7 | 7 | ○ | ○ | × | × | × | × | ○ | ○ | × | × | × | × |
| 8 | 8 | × | × | ○ | × | × | × | × | × | ○ | × | × | × |
| 9 | 9 | ○ | × | ○ | × | × | × | × | × | ○ | × | × | × |
| 10 | 10 | × | × | ○ | × | × | × | ○ | × | ○ | × | × | × |
| 11 | 11 | ○ | × | ○ | × | × | × | ○ | × | ○ | × | × | × |
| 12 | 12 | × | ○ | ○ | × | × | × | × | ○ | ○ | × | × | × |
| 13 | 13 | ○ | ○ | ○ | × | × | × | × | ○ | ○ | × | × | × |
| 14 | 14 | × | ○ | ○ | × | × | × | ○ | ○ | ○ | × | × | × |
| 15 | 15 | ○ | ○ | ○ | × | × | × | ○ | ○ | ○ | × | × | × |
| 16 | 16 | × | × | × | ○ | × | × | × | × | × | ○ | × | × |
| 17 | 17 | ○ | × | × | ○ | × | × | × | × | × | ○ | × | × |
| 18 | 19 | ○ | × | × | ○ | × | × | ○ | × | × | ○ | × | × |
| 19 | 21 | ○ | ○ | × | ○ | × | × | × | ○ | × | ○ | × | × |
| 20 | 24 | × | × | ○ | ○ | × | × | × | × | ○ | ○ | × | × |
| 21 | 27 | ○ | × | ○ | ○ | × | × | ○ | × | ○ | ○ | × | × |
| 22 | 30 | × | ○ | ○ | ○ | × | × | ○ | ○ | ○ | ○ | × | × |
| 23 | 33 | ○ | × | × | ○ | ○ | × | × | × | × | ○ | ○ | × |
| 24 | 36 | × | ○ | × | ○ | ○ | × | × | ○ | × | ○ | ○ | × |
| 25 | 39 | ○ | ○ | × | ○ | ○ | × | ○ | ○ | × | ○ | ○ | × |
| 26 | 43 | ○ | × | ○ | ○ | ○ | × | ○ | × | ○ | ○ | ○ | × |
| 27 | 46 | × | ○ | ○ | ○ | ○ | × | ○ | ○ | ○ | ○ | ○ | × |
| 28 | 50 | × | × | × | ○ | ○ | ○ | ○ | × | × | ○ | ○ | ○ |
| 29 | 54 | × | ○ | × | ○ | ○ | ○ | ○ | ○ | × | ○ | ○ | ○ |
| 30 | 59 | ○ | × | ○ | ○ | ○ | ○ | ○ | × | ○ | ○ | ○ | ○ |
| 31 | 63 | ○ | ○ | ○ | ○ | ○ | ○ | ○ | ○ | ○ | ○ | ○ | ○ |

lengths of lighting periods 32 gray scale levels using a gamma correction 64 gray scale levels ○ : lighting × : non-lighting

FIG. 21

| | | | | | | | | | | | |
|---|---|---|---|---|---|---|---|---|---|---|---|
| 1 | SF1 | SF2 | SF3 | SF4 | SF5 | SF6 | SF7 | SF8 | SF9 | SF10 |
| 2 | SF10 | SF9 | SF8 | SF7 | SF6 | SF5 | SF4 | SF3 | SF2 | SF1 |
| 3 | SF1 | SF2 | SF5 | SF4 | SF3 | SF6 | SF7 | SF10 | SF9 | SF8 |
| 4 | SF1 | SF2 | SF4 | SF3 | SF5 | SF6 | SF7 | SF9 | SF8 | SF10 |
| 5 | SF6 | SF7 | SF8 | SF9 | SF10 | SF1 | SF2 | SF3 | SF4 | SF5 |
| 6 | SF1 | SF3 | SF4 | SF2 | SF5 | SF6 | SF8 | SF9 | SF7 | SF10 |
| 7 | SF2 | SF3 | SF4 | SF1 | SF5 | SF7 | SF9 | SF9 | SF6 | SF10 |
| 8 | SF1 | SF4 | SF3 | SF2 | SF5 | SF6 | SF9 | SF8 | SF7 | SF10 |
| 9 | SF4 | SF2 | SF3 | SF1 | SF5 | SF9 | SF7 | SF8 | SF6 | SF10 |
| 10 | SF2 | SF3 | SF1 | SF4 | SF5 | SF7 | SF8 | SF6 | SF9 | SF10 |
| 11 | SF2 | SF4 | SF3 | SF5 | SF1 | SF7 | SF9 | SF8 | SF10 | SF6 |

: a first bit group

: a second bit group

: a third bit group

FIG. 22 a first subframe group | a second subframe group | a third subframe group subframes

| gray scale levels | SF1 | SF2 | SF3 | SF4 | SF5 | SF6 | SF7 | SF8 | SF9 | SF10 | SF11 | SF12 | SF13 | SF14 |
|---|---|---|---|---|---|---|---|---|---|---|---|---|---|---|
| | 1 | 4/3 | 8/3 | 8/3 | 8/3 | 2 | 4/3 | 8/3 | 8/3 | 8/3 | 4/3 | 8/3 | 8/3 | 8/3 |
| 0 | × | × | × | × | × | × | × | × | × | × | × | × | × | × |
| 1 | ○ | × | × | × | × | × | × | × | × | × | × | × | × | × |
| 2 | × | × | × | × | × | ○ | × | × | × | × | × | × | × | × |
| 3 | ○ | × | × | × | × | ○ | × | × | × | × | × | × | × | × |
| 4 | × | ○ | × | × | × | × | ○ | × | × | × | ○ | × | × | × |
| 5 | ○ | ○ | × | × | × | × | ○ | × | × | × | ○ | × | × | × |
| 6 | × | ○ | × | × | × | ○ | ○ | × | × | × | ○ | × | × | × |
| 7 | ○ | ○ | × | × | × | ○ | ○ | × | × | × | ○ | × | × | × |
| 8 | × | × | ○ | × | × | × | × | ○ | × | × | × | ○ | × | × |
| 9 | ○ | × | ○ | × | × | × | × | ○ | × | × | × | ○ | × | × |
| 10 | × | × | ○ | × | × | ○ | × | ○ | × | × | × | ○ | × | × |
| 11 | ○ | × | ○ | × | × | ○ | × | ○ | × | × | × | ○ | × | × |
| 12 | × | ○ | ○ | × | × | × | ○ | ○ | × | × | ○ | ○ | × | × |
| 13 | ○ | ○ | ○ | × | × | × | ○ | ○ | × | × | ○ | ○ | × | × |
| 14 | × | ○ | ○ | × | × | ○ | ○ | ○ | × | × | ○ | ○ | × | × |
| 15 | ○ | ○ | ○ | × | × | ○ | ○ | ○ | × | × | ○ | ○ | × | × |
| 16 | × | × | ○ | ○ | × | × | × | ○ | ○ | × | × | ○ | ○ | × |
| 17 | ○ | × | ○ | ○ | × | × | × | ○ | ○ | × | × | ○ | ○ | × |
| 18 | × | × | ○ | ○ | × | ○ | × | ○ | ○ | × | × | ○ | ○ | × |
| 19 | ○ | × | ○ | ○ | × | ○ | × | ○ | ○ | × | × | ○ | ○ | × |
| 20 | × | ○ | ○ | ○ | × | × | ○ | ○ | ○ | × | ○ | ○ | ○ | × |
| 21 | ○ | ○ | ○ | ○ | × | × | ○ | ○ | ○ | × | ○ | ○ | ○ | × |
| 22 | × | ○ | ○ | ○ | × | ○ | ○ | ○ | ○ | × | ○ | ○ | ○ | × |
| 23 | ○ | ○ | ○ | ○ | × | ○ | ○ | ○ | ○ | × | ○ | ○ | ○ | × |
| 24 | × | × | ○ | ○ | ○ | × | × | ○ | ○ | ○ | × | ○ | ○ | ○ |
| 25 | ○ | × | ○ | ○ | ○ | × | × | ○ | ○ | ○ | × | ○ | ○ | ○ |
| 26 | × | × | ○ | ○ | ○ | ○ | × | ○ | ○ | ○ | × | ○ | ○ | ○ |
| 27 | ○ | × | ○ | ○ | ○ | ○ | × | ○ | ○ | ○ | × | ○ | ○ | ○ |
| 28 | × | ○ | ○ | ○ | ○ | × | ○ | ○ | ○ | ○ | ○ | ○ | ○ | ○ |
| 29 | ○ | ○ | ○ | ○ | ○ | × | ○ | ○ | ○ | ○ | ○ | ○ | ○ | ○ |
| 30 | × | ○ | ○ | ○ | ○ | ○ | ○ | ○ | ○ | ○ | ○ | ○ | ○ | ○ |
| 31 | ○ | ○ | ○ | ○ | ○ | ○ | ○ | ○ | ○ | ○ | ○ | ○ | ○ | ○ |

lengths of lighting periods

○ : lighting

× : non-lighting

FIG. 23

| | SF1 | SF2 | SF3 | SF4 | SF5 | SF6 | SF7 | SF8 | SF9 | SF10 | SF11 | SF12 | SF13 | SF14 | SF15 | SF16 |
|---|---|---|---|---|---|---|---|---|---|---|---|---|---|---|---|---|
| | 0.5 | 4/3 | 8/3 | 8/3 | 8/3 | 1 | 4/3 | 8/3 | 8/3 | 8/3 | 0.5 | 1 | 4/3 | 8/3 | 8/3 | 8/3 |
| 0 | × | × | × | × | × | × | × | × | × | × | × | × | × | × | × | × |
| 1 | ○ | × | × | × | × | × | × | × | × | × | ○ | × | × | × | × | × |
| 2 | × | × | × | × | × | ○ | × | × | × | × | × | ○ | × | × | × | × |
| 3 | ○ | × | × | × | × | ○ | × | × | × | × | ○ | ○ | × | × | × | × |
| 4 | × | ○ | × | × | × | × | ○ | × | × | × | × | × | ○ | × | × | × |
| 5 | ○ | ○ | × | × | × | × | ○ | × | × | × | ○ | × | ○ | × | × | × |
| 6 | × | ○ | × | × | × | ○ | ○ | × | × | × | × | ○ | ○ | × | × | × |
| 7 | ○ | ○ | × | × | × | ○ | ○ | × | × | × | ○ | ○ | ○ | × | × | × |
| 8 | × | × | ○ | × | × | × | × | ○ | × | × | × | × | × | ○ | × | × |
| 9 | ○ | × | ○ | × | × | × | × | ○ | × | × | ○ | × | × | ○ | × | × |
| 10 | × | × | ○ | × | × | ○ | × | ○ | × | × | × | ○ | × | ○ | × | × |
| 11 | ○ | × | ○ | × | × | ○ | × | ○ | × | × | ○ | ○ | × | ○ | × | × |
| 12 | × | ○ | ○ | × | × | × | ○ | ○ | × | × | × | × | ○ | ○ | × | × |
| 13 | ○ | ○ | ○ | × | × | × | ○ | ○ | × | × | ○ | × | ○ | ○ | × | × |
| 14 | × | ○ | ○ | × | × | ○ | ○ | ○ | × | × | × | ○ | ○ | ○ | × | × |
| 15 | ○ | ○ | ○ | × | × | ○ | ○ | ○ | × | × | ○ | ○ | ○ | ○ | × | × |
| 16 | × | × | ○ | ○ | × | × | × | ○ | ○ | × | × | × | × | ○ | ○ | × |
| 17 | ○ | × | ○ | ○ | × | × | × | ○ | ○ | × | ○ | × | × | ○ | ○ | × |
| 18 | × | × | ○ | ○ | × | ○ | × | ○ | ○ | × | × | ○ | × | ○ | ○ | × |
| 19 | ○ | × | ○ | ○ | × | ○ | × | ○ | ○ | × | ○ | ○ | × | ○ | ○ | × |
| 20 | × | ○ | ○ | ○ | × | × | ○ | ○ | ○ | × | × | × | ○ | ○ | ○ | × |
| 21 | ○ | ○ | ○ | ○ | × | × | ○ | ○ | ○ | × | ○ | × | ○ | ○ | ○ | × |
| 22 | × | ○ | ○ | ○ | × | ○ | ○ | ○ | ○ | × | × | ○ | ○ | ○ | ○ | × |
| 23 | ○ | ○ | ○ | ○ | × | ○ | ○ | ○ | ○ | × | ○ | ○ | ○ | ○ | ○ | × |
| 24 | × | × | ○ | ○ | ○ | × | × | ○ | ○ | ○ | × | × | × | ○ | ○ | ○ |
| 25 | ○ | × | ○ | ○ | ○ | × | × | ○ | ○ | ○ | ○ | × | × | ○ | ○ | ○ |
| 26 | × | × | ○ | ○ | ○ | ○ | × | ○ | ○ | ○ | × | ○ | × | ○ | ○ | ○ |
| 27 | ○ | × | ○ | ○ | ○ | ○ | × | ○ | ○ | ○ | ○ | ○ | × | ○ | ○ | ○ |
| 28 | × | ○ | ○ | ○ | ○ | × | ○ | ○ | ○ | ○ | × | × | ○ | ○ | ○ | ○ |
| 29 | ○ | ○ | ○ | ○ | ○ | × | ○ | ○ | ○ | ○ | ○ | × | ○ | ○ | ○ | ○ |
| 30 | × | ○ | ○ | ○ | ○ | ○ | ○ | ○ | ○ | ○ | × | ○ | ○ | ○ | ○ | ○ |
| 31 | ○ | ○ | ○ | ○ | ○ | ○ | ○ | ○ | ○ | ○ | ○ | ○ | ○ | ○ | ○ | ○ |

○ : lighting

× : non-lighting

FIG. 43

| | SF1 | SF2 | SF3 | SF4 | SF5 |
|---|---|---|---|---|---|
| | 1 | 2 | 4 | 8 | 16 |
| 0 | × | × | × | × | × |
| 1 | ○ | × | × | × | × |
| 2 | × | ○ | × | × | × |
| 3 | ○ | ○ | × | × | × |
| 4 | × | × | ○ | × | × |
| 5 | ○ | × | ○ | × | × |
| 6 | × | ○ | ○ | × | × |
| 7 | ○ | ○ | ○ | × | × |
| 8 | × | × | × | ○ | × |
| 9 | ○ | × | × | ○ | × |
| 10 | × | ○ | × | ○ | × |
| 11 | ○ | ○ | × | ○ | × |
| 12 | × | × | ○ | ○ | × |
| 13 | ○ | × | ○ | ○ | × |
| 14 | × | ○ | ○ | ○ | × |
| 15 | ○ | ○ | ○ | ○ | × |
| 16 | × | × | × | × | ○ |
| 17 | ○ | × | × | × | ○ |
| 18 | × | ○ | × | × | ○ |
| 19 | ○ | ○ | × | × | ○ |
| 20 | × | × | ○ | × | ○ |
| 21 | ○ | × | ○ | × | ○ |
| 22 | × | ○ | ○ | × | ○ |
| 23 | ○ | ○ | ○ | × | ○ |
| 24 | × | × | × | ○ | ○ |
| 25 | ○ | × | × | ○ | ○ |
| 26 | × | ○ | × | ○ | ○ |
| 27 | ○ | ○ | × | ○ | ○ |
| 28 | × | × | ○ | ○ | ○ |
| 29 | ○ | × | ○ | ○ | ○ |
| 30 | × | ○ | ○ | ○ | ○ |
| 31 | ○ | ○ | ○ | ○ | ○ |

○ : lighting

× : non-lighting

PRIOR ART

FIG. 44

| | SF1 | SF2 | SF3 | SF4 | SF5 | SF6 | SF7 | SF8 | SF9 | SF10 |
|---|---|---|---|---|---|---|---|---|---|---|
| | 0.5 | 1 | 2 | 4 | 8 | 0.5 | 1 | 2 | 4 | 8 |
| 0 | × | × | × | × | × | × | × | × | × | × |
| 1 | ○ | × | × | × | × | ○ | × | × | × | × |
| 2 | × | ○ | × | × | × | × | ○ | × | × | × |
| 3 | ○ | ○ | × | × | × | ○ | ○ | × | × | × |
| 4 | × | × | ○ | × | × | × | × | ○ | × | × |
| 5 | ○ | × | ○ | × | × | ○ | × | ○ | × | × |
| 6 | × | ○ | ○ | × | × | × | ○ | ○ | × | × |
| 7 | ○ | ○ | ○ | × | × | ○ | ○ | ○ | × | × |
| 8 | × | × | × | ○ | × | × | × | × | ○ | × |
| 9 | ○ | × | × | ○ | × | ○ | × | × | ○ | × |
| 10 | × | ○ | × | ○ | × | × | ○ | × | ○ | × |
| 11 | ○ | ○ | × | ○ | × | ○ | ○ | × | ○ | × |
| 12 | × | × | ○ | ○ | × | × | × | ○ | ○ | × |
| 13 | ○ | × | ○ | ○ | × | ○ | × | ○ | ○ | × |
| 14 | × | ○ | ○ | ○ | × | × | ○ | ○ | ○ | × |
| 15 | ○ | ○ | ○ | ○ | × | ○ | ○ | ○ | ○ | × |
| 16 | × | × | × | × | ○ | × | × | × | × | ○ |
| 17 | ○ | × | × | × | ○ | ○ | × | × | × | ○ |
| 18 | × | ○ | × | × | ○ | × | ○ | × | × | ○ |
| 19 | ○ | ○ | × | × | ○ | ○ | ○ | × | × | ○ |
| 20 | × | × | ○ | × | ○ | × | × | ○ | × | ○ |
| 21 | ○ | × | ○ | × | ○ | ○ | × | ○ | × | ○ |
| 22 | × | ○ | ○ | × | ○ | × | ○ | ○ | × | ○ |
| 23 | ○ | ○ | ○ | × | ○ | ○ | ○ | ○ | × | ○ |
| 24 | × | × | × | ○ | ○ | × | × | × | ○ | ○ |
| 25 | ○ | × | × | ○ | ○ | ○ | × | × | ○ | ○ |
| 26 | × | ○ | × | ○ | ○ | × | ○ | × | ○ | ○ |
| 27 | ○ | ○ | × | ○ | ○ | ○ | ○ | × | ○ | ○ |
| 28 | × | × | ○ | ○ | ○ | × | × | ○ | ○ | ○ |
| 29 | ○ | × | ○ | ○ | ○ | ○ | × | ○ | ○ | ○ |
| 30 | × | ○ | ○ | ○ | ○ | × | ○ | ○ | ○ | ○ |
| 31 | ○ | ○ | ○ | ○ | ○ | ○ | ○ | ○ | ○ | ○ |

○ : lighting

× : non-lighting

PRIOR ART

FIG. 45

| | SF1 | SF2 | SF3 | SF4 | SF5 | SF6 |
|---|---|---|---|---|---|---|
| | 1 | 2 | 4 | 8 | 16 | 32 |
| 0 | × | × | × | × | × | × |
| 1 | ○ | × | × | × | × | × |
| 2 | × | ○ | × | × | × | × |
| 3 | ○ | ○ | × | × | × | × |
| 4 | × | × | ○ | × | × | × |
| 5 | ○ | × | ○ | × | × | × |
| 6 | × | ○ | ○ | × | × | × |
| 7 | ○ | ○ | ○ | × | × | × |
| 8 | × | × | × | ○ | × | × |
| 9 | ○ | × | × | ○ | × | × |
| 10 | × | ○ | × | ○ | × | × |
| 11 | ○ | ○ | × | ○ | × | × |
| 12 | × | × | ○ | ○ | × | × |
| 13 | ○ | × | ○ | ○ | × | × |
| 14 | × | ○ | ○ | ○ | × | × |
| 15 | ○ | ○ | ○ | ○ | × | × |
| 16 | × | × | × | × | ○ | × |
| 17 | ○ | × | × | × | ○ | × |
| 18 | × | ○ | × | × | ○ | × |
| 19 | ○ | ○ | × | × | ○ | × |
| 20 | × | × | ○ | × | ○ | × |
| 21 | ○ | × | ○ | × | ○ | × |
| 22 | × | ○ | ○ | × | ○ | × |
| 23 | ○ | ○ | ○ | × | ○ | × |
| 24 | × | × | × | ○ | ○ | × |
| 25 | ○ | × | × | ○ | ○ | × |
| 26 | × | ○ | × | ○ | ○ | × |
| 27 | ○ | ○ | × | ○ | ○ | × |
| 28 | × | × | ○ | ○ | ○ | × |
| 29 | ○ | × | ○ | ○ | ○ | × |
| 30 | × | ○ | ○ | ○ | ○ | × |
| 31 | ○ | ○ | ○ | ○ | ○ | × |
| 32 | × | × | × | × | × | ○ |
| 33 | ○ | × | × | × | × | ○ |
| 34 | × | ○ | × | × | × | ○ |
| 35 | ○ | ○ | × | × | × | ○ |
| 36 | × | × | ○ | × | × | ○ |
| 37 | ○ | × | ○ | × | × | ○ |
| 38 | × | ○ | ○ | × | × | ○ |
| 39 | ○ | ○ | ○ | × | × | ○ |
| 40 | × | × | × | ○ | × | ○ |
| 41 | ○ | × | × | ○ | × | ○ |
| 42 | × | ○ | × | ○ | × | ○ |
| 43 | ○ | ○ | × | ○ | × | ○ |
| 44 | × | × | ○ | ○ | × | ○ |
| 45 | ○ | × | ○ | ○ | × | ○ |
| 46 | × | ○ | ○ | ○ | × | ○ |
| 47 | ○ | ○ | ○ | ○ | × | ○ |
| 48 | × | × | × | × | ○ | ○ |
| 49 | ○ | × | × | × | ○ | ○ |
| 50 | × | ○ | × | × | ○ | ○ |
| 51 | ○ | ○ | × | × | ○ | ○ |
| 52 | × | × | ○ | × | ○ | ○ |
| 53 | ○ | × | ○ | × | ○ | ○ |
| 54 | × | ○ | ○ | × | ○ | ○ |
| 55 | ○ | ○ | ○ | × | ○ | ○ |
| 56 | × | × | × | ○ | ○ | ○ |
| 57 | ○ | × | × | ○ | ○ | ○ |
| 58 | × | ○ | × | ○ | ○ | ○ |
| 59 | ○ | ○ | × | ○ | ○ | ○ |
| 60 | × | × | ○ | ○ | ○ | ○ |
| 61 | ○ | × | ○ | ○ | ○ | ○ |
| 62 | × | ○ | ○ | ○ | ○ | ○ |
| 63 | ○ | ○ | ○ | ○ | ○ | ○ |

○ : lighting

× : non-lighting

PRIOR ART

FIG. 46

| | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| | 0.5 | 1 | 2 | 4 | 8 | 16 | 0.5 | 1 | 2 | 4 | 8 | 16 |
| 0 | × | × | × | × | × | × | × | × | × | × | × | × |
| 1 | ○ | × | × | × | × | × | ○ | × | × | × | × | × |
| 2 | × | ○ | × | × | × | × | × | ○ | × | × | × | × |
| 3 | ○ | ○ | × | × | × | × | ○ | ○ | × | × | × | × |
| 4 | × | × | ○ | × | × | × | × | × | ○ | × | × | × |
| 5 | ○ | × | ○ | × | × | × | ○ | × | ○ | × | × | × |
| 6 | × | ○ | ○ | × | × | × | × | ○ | ○ | × | × | × |
| 7 | ○ | ○ | ○ | × | × | × | ○ | ○ | ○ | × | × | × |
| 8 | × | × | × | ○ | × | × | × | × | × | ○ | × | × |
| 9 | ○ | × | × | ○ | × | × | ○ | × | × | ○ | × | × |
| 10 | × | ○ | × | ○ | × | × | × | ○ | × | ○ | × | × |
| 11 | ○ | ○ | × | ○ | × | × | ○ | ○ | × | ○ | × | × |
| 12 | × | × | ○ | ○ | × | × | × | × | ○ | ○ | × | × |
| 13 | ○ | × | ○ | ○ | × | × | ○ | × | ○ | ○ | × | × |
| 14 | × | ○ | ○ | ○ | × | × | × | ○ | ○ | ○ | × | × |
| 15 | ○ | ○ | ○ | ○ | × | × | ○ | ○ | ○ | ○ | × | × |
| 16 | × | × | × | × | ○ | × | × | × | × | × | ○ | × |
| 17 | ○ | × | × | × | ○ | × | ○ | × | × | × | ○ | × |
| 18 | × | ○ | × | × | ○ | × | × | ○ | × | × | ○ | × |
| 19 | ○ | ○ | × | × | ○ | × | ○ | ○ | × | × | ○ | × |
| 20 | × | × | ○ | × | ○ | × | × | × | ○ | × | ○ | × |
| 21 | ○ | × | ○ | × | ○ | × | ○ | × | ○ | × | ○ | × |
| 22 | × | ○ | ○ | × | ○ | × | × | ○ | ○ | × | ○ | × |
| 23 | ○ | ○ | ○ | × | ○ | × | ○ | ○ | ○ | × | ○ | × |
| 24 | × | × | × | ○ | ○ | × | × | × | × | ○ | ○ | × |
| 25 | ○ | × | × | ○ | ○ | × | ○ | × | × | ○ | ○ | × |
| 26 | × | ○ | × | ○ | ○ | × | × | ○ | × | ○ | ○ | × |
| 27 | ○ | ○ | × | ○ | ○ | × | ○ | ○ | × | ○ | ○ | × |
| 28 | × | × | ○ | ○ | ○ | × | × | × | ○ | ○ | ○ | × |
| 29 | ○ | × | ○ | ○ | ○ | × | ○ | × | ○ | ○ | ○ | × |
| 30 | × | ○ | ○ | ○ | ○ | × | × | ○ | ○ | ○ | ○ | × |
| 31 | ○ | ○ | ○ | ○ | ○ | × | ○ | ○ | ○ | ○ | ○ | × |
| 32 | × | × | × | × | × | ○ | × | × | × | × | × | ○ |
| 33 | ○ | × | × | × | × | ○ | ○ | × | × | × | × | ○ |
| 34 | × | ○ | × | × | × | ○ | × | ○ | × | × | × | ○ |
| 35 | ○ | ○ | × | × | × | ○ | ○ | ○ | × | × | × | ○ |
| 36 | × | × | ○ | × | × | ○ | × | × | ○ | × | × | ○ |
| 37 | ○ | × | ○ | × | × | ○ | ○ | × | ○ | × | × | ○ |
| 38 | × | ○ | ○ | × | × | ○ | × | ○ | ○ | × | × | ○ |
| 39 | ○ | ○ | ○ | × | × | ○ | ○ | ○ | ○ | × | × | ○ |
| 40 | × | × | × | ○ | × | ○ | × | × | × | ○ | × | ○ |
| 41 | ○ | × | × | ○ | × | ○ | ○ | × | × | ○ | × | ○ |
| 42 | × | ○ | × | ○ | × | ○ | × | ○ | × | ○ | × | ○ |
| 43 | ○ | ○ | × | ○ | × | ○ | ○ | ○ | × | ○ | × | ○ |
| 44 | × | × | ○ | ○ | × | ○ | × | × | ○ | ○ | × | ○ |
| 45 | ○ | × | ○ | ○ | × | ○ | ○ | × | ○ | ○ | × | ○ |
| 46 | × | ○ | ○ | ○ | × | ○ | × | ○ | ○ | ○ | × | ○ |
| 47 | ○ | ○ | ○ | ○ | × | ○ | ○ | ○ | ○ | ○ | × | ○ |
| 48 | × | × | × | × | ○ | ○ | × | × | × | × | ○ | ○ |
| 49 | ○ | × | × | × | ○ | ○ | ○ | × | × | × | ○ | ○ |
| 50 | × | ○ | × | × | ○ | ○ | × | ○ | × | × | ○ | ○ |
| 51 | ○ | ○ | × | × | ○ | ○ | ○ | ○ | × | × | ○ | ○ |
| 52 | × | × | ○ | × | ○ | ○ | × | × | ○ | × | ○ | ○ |
| 53 | ○ | × | ○ | × | ○ | ○ | ○ | × | ○ | × | ○ | ○ |
| 54 | × | ○ | ○ | × | ○ | ○ | × | ○ | ○ | × | ○ | ○ |
| 55 | ○ | ○ | ○ | × | ○ | ○ | ○ | ○ | ○ | × | ○ | ○ |
| 56 | × | × | × | ○ | ○ | ○ | × | × | × | ○ | ○ | ○ |
| 57 | ○ | × | × | ○ | ○ | ○ | ○ | × | × | ○ | ○ | ○ |
| 58 | × | ○ | × | ○ | ○ | ○ | × | ○ | × | ○ | ○ | ○ |
| 59 | ○ | ○ | × | ○ | ○ | ○ | ○ | ○ | × | ○ | ○ | ○ |
| 60 | × | × | ○ | ○ | ○ | ○ | × | × | ○ | ○ | ○ | ○ |
| 61 | ○ | × | ○ | ○ | ○ | ○ | ○ | × | ○ | ○ | ○ | ○ |
| 62 | × | ○ | ○ | ○ | ○ | ○ | × | ○ | ○ | ○ | ○ | ○ |
| 63 | ○ | ○ | ○ | ○ | ○ | ○ | ○ | ○ | ○ | ○ | ○ | ○ |

○ : lighting

× : non-lighting

PRIOR ART

PRIOR ART

PRIOR ART pixel A gray scale level : 127 pixel B gray scale level : 128

PRIOR ART pixel A gray scale level : 127 pixel B gray scale level : 128

PRIOR ART

FIG. 51

| | SF1 | SF2 | SF3 | SF4 | SF5 | SF6 | SF7 | SF8 | SF9 | SF10 |
|---|---|---|---|---|---|---|---|---|---|---|
| | 2 | 4 | 1 | 4 | 4 | 2 | 4 | 4 | 2 | 4 |
| 0 | × | × | × | × | × | × | × | × | × | × |
| 1 | × | × | ○ | × | × | × | × | × | × | × |
| 2 | × | × | × | × | × | × | × | × | ○ | × |
| 3 | × | × | ○ | × | × | × | × | × | ○ | × |
| 4 | ○ | × | × | × | × | ○ | × | × | × | × |
| 5 | ○ | × | ○ | × | × | ○ | × | × | × | × |
| 6 | ○ | × | × | × | × | ○ | × | × | ○ | × |
| 7 | ○ | × | ○ | × | × | ○ | × | × | ○ | × |
| 8 | × | ○ | × | × | × | × | ○ | × | × | × |
| 9 | × | ○ | ○ | × | × | × | ○ | × | × | × |
| 10 | × | ○ | × | × | × | × | ○ | × | ○ | × |
| 11 | × | ○ | ○ | × | × | × | ○ | × | ○ | × |
| 12 | ○ | ○ | × | × | × | ○ | ○ | × | × | × |
| 13 | ○ | ○ | ○ | × | × | ○ | ○ | × | × | × |
| 14 | ○ | ○ | × | × | × | ○ | ○ | × | ○ | × |
| 15 | ○ | ○ | ○ | × | × | ○ | ○ | × | ○ | × |
| 16 | × | ○ | × | ○ | × | × | ○ | ○ | × | × |
| 17 | × | ○ | ○ | ○ | × | × | ○ | ○ | × | × |
| 18 | × | ○ | × | ○ | × | × | ○ | ○ | ○ | × |
| 19 | × | ○ | ○ | ○ | × | × | ○ | ○ | ○ | × |
| 20 | ○ | ○ | × | ○ | × | ○ | ○ | ○ | × | × |
| 21 | ○ | ○ | ○ | ○ | × | ○ | ○ | ○ | × | × |
| 22 | ○ | ○ | × | ○ | × | ○ | ○ | ○ | ○ | × |
| 23 | ○ | ○ | ○ | ○ | × | ○ | ○ | ○ | ○ | × |
| 24 | × | ○ | × | ○ | ○ | × | ○ | ○ | × | ○ |
| 25 | × | ○ | ○ | ○ | ○ | × | ○ | ○ | × | ○ |
| 26 | × | ○ | × | ○ | ○ | × | ○ | ○ | ○ | ○ |
| 27 | × | ○ | ○ | ○ | ○ | × | ○ | ○ | ○ | ○ |
| 28 | ○ | ○ | × | ○ | ○ | ○ | ○ | ○ | × | ○ |
| 29 | ○ | ○ | ○ | ○ | ○ | ○ | ○ | ○ | × | ○ |
| 30 | ○ | ○ | × | ○ | ○ | ○ | ○ | ○ | ○ | ○ |
| 31 | ○ | ○ | ○ | ○ | ○ | ○ | ○ | ○ | ○ | ○ |

○ : lighiting

× : non-lighting

FIG. 52

| | SF1 | SF2 | SF3 | SF4 | SF5 | SF6 | SF7 | SF8 | SF9 | SF10 |
|---|---|---|---|---|---|---|---|---|---|---|
| | 1 | 2 | 4 | 3 | 5 | 2 | 2 | 4 | 3 | 5 |
| 0 | × | × | × | × | × | × | × | × | × | × |
| 1 | ○ | × | × | × | × | × | × | × | × | × |
| 2 | × | × | × | × | × | ○ | × | × | × | × |
| 3 | ○ | × | × | × | × | ○ | × | × | × | × |
| 4 | × | ○ | × | × | × | × | ○ | × | × | × |
| 5 | ○ | ○ | × | × | × | × | ○ | × | × | × |
| 6 | × | ○ | × | × | × | ○ | ○ | × | × | × |
| 7 | ○ | ○ | × | × | × | ○ | ○ | × | × | × |
| 8 | × | × | ○ | × | × | × | × | ○ | × | × |
| 9 | ○ | × | ○ | × | × | × | × | ○ | × | × |
| 10 | × | × | ○ | × | × | ○ | × | ○ | × | × |
| 11 | ○ | × | ○ | × | × | ○ | × | ○ | × | × |
| 12 | × | ○ | ○ | × | × | × | ○ | ○ | × | × |
| 13 | ○ | ○ | ○ | × | × | × | ○ | ○ | × | × |
| 14 | × | ○ | ○ | × | × | ○ | ○ | ○ | × | × |
| 15 | ○ | ○ | ○ | × | × | ○ | ○ | ○ | × | × |
| 16 | × | × | ○ | ○ | × | ○ | × | ○ | ○ | × |
| 17 | ○ | × | ○ | ○ | × | ○ | × | ○ | ○ | × |
| 18 | × | ○ | ○ | ○ | × | × | ○ | ○ | ○ | × |
| 19 | ○ | ○ | ○ | ○ | × | × | ○ | ○ | ○ | × |
| 20 | × | ○ | ○ | ○ | × | ○ | ○ | ○ | ○ | × |
| 21 | ○ | ○ | ○ | ○ | × | ○ | ○ | ○ | ○ | × |
| 22 | × | ○ | ○ | × | ○ | × | ○ | ○ | × | ○ |
| 23 | ○ | ○ | ○ | × | ○ | × | ○ | ○ | × | ○ |
| 24 | × | ○ | ○ | × | ○ | ○ | ○ | ○ | × | ○ |
| 25 | ○ | ○ | ○ | × | ○ | ○ | ○ | ○ | × | ○ |
| 26 | × | × | ○ | ○ | ○ | ○ | × | ○ | ○ | ○ |
| 27 | ○ | × | ○ | ○ | ○ | ○ | × | ○ | ○ | ○ |
| 28 | × | ○ | ○ | ○ | ○ | × | ○ | ○ | ○ | ○ |
| 29 | ○ | ○ | ○ | ○ | ○ | × | ○ | ○ | ○ | ○ |
| 30 | × | ○ | ○ | ○ | ○ | ○ | ○ | ○ | ○ | ○ |
| 31 | ○ | ○ | ○ | ○ | ○ | ○ | ○ | ○ | ○ | ○ |

○ : lighting

× : non-lighting

FIG. 53

| | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| | 1 | 2 | 4 | 8 | 10 | 12 | 2 | 2 | 4 | 8 | 10 | 12 |
| 0 | × | × | × | × | × | × | × | × | × | × | × | × |
| 1 | × | × | × | × | × | × | × | × | × | × | × | × |
| 2 | × | × | × | × | × | × | × | × | × | × | × | × |
| 3 | × | × | × | × | × | × | × | × | × | × | × | × |
| 4 | ○ | × | × | × | × | × | × | × | × | × | × | × |
| 5 | ○ | × | × | × | × | × | × | × | × | × | × | × |
| 6 | × | × | × | × | × | × | ○ | × | × | × | × | × |
| 7 | ○ | × | × | × | × | × | ○ | × | × | × | × | × |
| 8 | × | ○ | × | × | × | × | × | ○ | × | × | × | × |
| 9 | ○ | ○ | × | × | × | × | × | ○ | × | × | × | × |
| 10 | × | ○ | × | × | × | × | ○ | ○ | × | × | × | × |
| 11 | × | × | ○ | × | × | × | × | × | ○ | × | × | × |
| 12 | ○ | × | ○ | × | × | × | × | × | ○ | × | × | × |
| 13 | × | × | ○ | × | × | × | ○ | × | ○ | × | × | × |
| 14 | ○ | × | ○ | × | × | × | ○ | × | ○ | × | × | × |
| 15 | × | ○ | ○ | × | × | × | × | ○ | ○ | × | × | × |
| 16 | × | ○ | ○ | × | × | × | ○ | ○ | ○ | × | × | × |
| 17 | × | × | × | ○ | × | × | × | × | × | ○ | × | × |
| 18 | × | × | × | ○ | × | × | ○ | × | × | ○ | × | × |
| 19 | ○ | ○ | × | ○ | × | × | × | ○ | × | ○ | × | × |
| 20 | × | × | ○ | ○ | × | × | × | × | ○ | ○ | × | × |
| 21 | ○ | × | ○ | ○ | × | × | ○ | × | ○ | ○ | × | × |
| 22 | ○ | ○ | ○ | ○ | × | × | ○ | ○ | ○ | ○ | × | × |
| 23 | × | × | × | ○ | ○ | × | × | × | × | ○ | ○ | × |
| 24 | ○ | × | × | ○ | ○ | × | ○ | × | × | ○ | ○ | × |
| 25 | × | × | ○ | ○ | ○ | × | × | × | ○ | ○ | ○ | × |
| 26 | × | ○ | ○ | ○ | ○ | × | × | ○ | ○ | ○ | ○ | × |
| 27 | ○ | ○ | ○ | ○ | ○ | × | ○ | ○ | ○ | ○ | ○ | × |
| 28 | × | × | × | ○ | ○ | ○ | × | × | × | ○ | ○ | ○ |
| 29 | ○ | ○ | × | ○ | ○ | ○ | × | ○ | × | ○ | ○ | ○ |
| 30 | × | × | ○ | ○ | ○ | ○ | ○ | × | ○ | ○ | ○ | ○ |
| 31 | ○ | ○ | ○ | ○ | ○ | ○ | ○ | ○ | ○ | ○ | ○ | ○ |

○ : lighting

× : non-lighting

DISPLAY DEVICE AND DRIVING METHOD AND ELECTRONIC APPARATUS OF THE DISPLAY DEVICE

This application is a continuation of copending application Ser. No. 11/399,256 filed on Apr. 6, 2006 now U.S. Pat. No. 7,719,526.

BACKGROUND OF THE INVENTION

1. Field of the Invention

The present invention relates to a display device and a driving method thereof, particularly to a display device to which a time gray scale method is applied.

2. Description of the Related Art

In recent years, a so-called self-luminous display device in which a pixel is formed using a light emitting element such as a light-emitting diode (LED) has attracted attention. As a light emitting element used for such a self-luminous display device, an organic light emitting diode (OLED) (also referred to as an "organic EL element", an "electroluminescence (EL) element", or the like) has attracted attentions, and have been used for an EL display or the like. A light emitting element such as an OLED is of self-luminous type; therefore, it has advantages such as higher visibility of pixels, no backlight, and higher response speed compared to a liquid crystal display. The luminance of a light emitting element is, in addition, controlled by a current value flowing therein.

As a driving method of controlling light emission gray scales of such a display device, there are a digital gray scale method and an analog gray scale method. In the digital gray scale method, a light emitting element is turned on/off by controlling in a digital manner to express gradation. On the other hand, in the analog gray scale method, there are a method of controlling the emission intensity of a light emitting element in an analog manner and a method of controlling the emission time of a light emitting element in an analog manner.

In the case of the digital gray scale method, there are only two states of a light emitting state and a non-light emitting state so that only two gray scale levels can be expressed. Therefore, multi-gray scale display is achieved by combining with another method. As the method for achieving multi-gray scale, a time gray scale method is used in many cases.

As a display in which a display state of a pixel is controlled in a digital manner and a time gray scale method is combined to express gradation, there are some displays other than an organic EL display using a digital gray scale method, such as a plasma display.

A time gray scale method is a method for expressing gradation by controlling the length of a light emitting period and the number of light emissions. That is, one frame is divided into a plurality of subframes, each of which is weighted such as by the number of light emissions or a light emitting period, and the total weight (the sum of the number of light emissions or the sum of the light emitting periods) is differentiated per gray scale level, thereby gradation is expressed. It is known that a display defect called a pseudo contour (or a false contour) occurs when such a time gray scale method is used. Thus, a countermeasure against the problem has been considered (see Patent Document 1).

In addition, the frame frequency has been increased to reduce the pseudo contour. As one of methods, there has been a method in which the length of a subframe is reduced to half so that the number of subframes within one frame is doubled. This is substantially the same as that the frame frequency is doubled (see Patent Document 2). This method is referred to as a "double speed frame method" in this specification.

Here, considered is a case of a 5-bit display (32 gray-scale levels). First, a selection method of subframes according to a conventional time gray scale method, that is, whether each subframe is for lighting or not at each gray-scale level is shown in FIG. 43. In FIG. 43, one frame is divided into 5 subframes (SF1 to SF5) and respective lengths of lighting periods of the subframes are set such that SF1=1, SF2=2, SF3=4, SF4=8, and SF5=16; that is, each length of the lighting period is power of two. Note that a gray scale level of 1 and a length of 1 of a lighting period correspond to each other. By combining these lighting periods, a display with 32 gray-scale levels (a 5-bit gray scale) can be performed.

Here, a way to see FIG. 43 is described. Lighting is performed in a subframe indicated by ○-indication whereas lighting is not performed in a subframe indicated by x-indication. Gradation is expressed by selecting a subframe to perform lighting at each gray scale level. For example, in the case of a gray scale level of 0, lighting is not performed in SF1 to SF 5. In the case of a gray scale level of 1, lighting is not performed in SF2 to SF 5 whereas lighting is performed in SF1. In the case of a gray scale level of 7, lighting is not performed in SF4 and SF5 whereas lighting is performed in SF1 to SF3.

Next, shown in FIG. 44 is an example in which a double speed frame method is applied to the case of FIG. 43. Each subframe in FIG. 43 is divided into two equally, thereby 10 subframes (SF1 to SF10) are formed and respective lengths of lighting periods thereof are such that SF1=0.5, SF2=1, SF3=2, SF4=4, SF5=8, SF6=0.5, SF7=1, SF8=2, SF9=4, and SF10=8. As a result of this, the frame frequency is doubled substantially.

Further, a case of a 6-bit display (64 gray-scale levels) can also be considered similarly. Shown in FIG. 46 is an example in which a double speed frame method is applied to a subframe structure for a 6-bit display according to a time gray scale method as shown in FIG. 45. Each subframe in FIG. 45 is divided into two equally, thereby 12 subframes (SF1 to SF12) are formed and respective lengths of lighting periods thereof are such that SF1=0.5, SF2=1, SF3=2, SF4=4, SF5=8, SF6=16, SF7=0.5, SF8=1, SF9=2, SF10=4, SF11=8, and SF12=16. Note that a gray scale level of 1 and a length of 1 of a lighting period correspond to each other. Similarly to the case of a 5-bit display, gradation is expressed by selecting a subframe to perform lighting at each gray scale level.

As described above, by dividing each subframe into two equally, the frame frequency can be increased to twice substantially.

In addition, as another method for increasing the frame frequency, there has been a method disclosed in Patent Document 3.

Patent Document 3 has described a case of an 8-bit display (256 gray-scale levels). Selection methods of subframes in this case are shown in FIGS. 47A and 47B. In a case of an 8-bit display, according to a conventional time gray scale method, one frame is divided into 8 subframes and respective lengths of lighting periods of the subframes are set so as to be 1, 2, 4, 8, 16, 32, 64, and 128 so that each length of the lighting period is power of two. Described in Patent Document 3 is an example in which only four subframes among the 8 subframes in order of decreasing lighting period are divided; a selection method of subframes in this case is shown in FIG. 47A.

In Patent Document 3, in addition, described is an example in which, in the case of expressing 256 gray-scale levels not by setting each length of the lighting period so as to be power of two but by using an arithmetical progression of which a difference between adjacent bits among 5 higher-order bits is 16 such as that of 1, 2, 4, 8, 16, 32, 48, 64, and 80, only five subframes in order of decreasing lighting period are divided. A selection method of subframes in this case is shown in FIG. 47B.

By using the above-described method, the frame frequency can be increased substantially.

[Patent Document 1] Japanese Patent No. 2903984

[Patent Document 2] Japanese Patent Laid-Open No. 2004-151162

[Patent Document 3] Japanese Patent Laid-Open No. 2001-42818

However, even in the double speed frame method, a pseudo contour occurs where selection of a lighting period is largely changed.

First, a case of a 5-bit display is considered. It is assumed that a gray scale level of 15 is expressed in a pixel A while a gray scale level of 16 is expressed in a pixel B adjacent to the pixel A, using the subframes shown in FIG. 44. A state of lighting/non-lighting in each subframe in that case is shown in FIGS. 48A and 48B. Here, FIG. 48A shows a case of seeing only the pixel A or the pixel B without moving a visual axis. A pseudo contour does not occur in this case. This is because eyes sense brightness in accordance with the sum of brightness where a visual axis passes. Thus, eyes sense that the gray scale level is 15 (=4+2+1+0.5+4+2+1+0.5) in the pixel A and the gray scale level is 16 (=8+8) in the pixel B. That is, an accurate gray scale level is sensed by eyes.

On the other hand, it is assumed that a visual axis moves from the pixel A to the pixel B or from the pixel B to the pixel A. That case is shown in FIG. 48B. In this case, depending on the movement of the visual axis, eyes sense that the gray scale level is 15.5 (=4+2+1+0.5+8) or 23.5 (=8+8+4+2+1+0.5) sometimes. Although it should be seen that the gray scale levels are 15 and 16 normally, the gray scale level is seen to be 15.5 or 23.5 so that a pseudo contour occurs.

Next, a case of a 6-bit display (64 gray-scale levels) is shown in FIG. 49. For example, assuming that a gray scale level of 31 is expressed in a pixel A while a gray scale level of 32 is expressed in a pixel B adjacent to the pixel A, eyes sense that the gray scale level is 31.5 (=8+4+2+1+0.5+16) or 47.5 (=16+16+8+4+2+1+0.5) sometimes, depending on the movement of a visual axis similarly to the case of a 5-bit display. Although it should be seen that the gray scale levels are 31 and 32 normally, the gray scale level is seen to be 31.5 or 47.5 so that a pseudo contour occurs.

Further, the case of FIG. 47A is shown in FIG. 50A and the case of FIG. 47B is shown in FIG. 50B. For example, assuming that a gray scale level of 127 is expressed in a pixel A while a gray scale level of 128 is expressed in a pixel B adjacent to the pixel A, the gray scale level to be sensed is different depending on the movement of a visual axis similarly to the examples described hereinabove. For example, in the case of FIG. 50A, eyes sense that the gray scale level is 121 (=64+32+16+8+1) or 134 (=32+16+8+8+4+2+64) sometimes. In the case of FIG. 50B, eyes sense that the gray scale level is 120 (=40+24+32+16+8) or 134 (=32+16+8+8+4+2+40+24) sometimes. In either case, although it should be seen that the gray scale levels are 127 and 128 normally, the gray scale level is sensed with over width so that a pseudo contour occurs.

In the double speed frame method also, the number of subframes is increased so that a duty ratio (a proportion of a lighting period to one frame) is decreased. Therefore, in order to realize the same average luminance as in the case of not using the double speed frame method, a voltage applied to a light emitting element is increased so that power consumption is increased, reliability of the light emitting element is decreased, and the like.

DISCLOSURE OF INVENTION

In view of the foregoing problems, it is an object of the invention to provide a display device having a small number of subframes and which can reduce a pseudo contour, and a driving method thereof.

For solving the above-described problems, a driving method described as follows is devised in the invention.

According to the invention, in a driving method of a display device which expresses gradation by dividing one frame into a plurality of subframes, in the case where gradation is expressed with an n bit (here n is an integer), bits each of which is shown by a binary of the gray scales are classified into three kinds of bit groups, that is, a first bit group, a second bit group, and a third bit group; one frame is divided into two subframe groups; a (here, a is an integer satisfying $0<a<n$) subframes corresponding to bits belonging to the first bit group are divided into three or more, each about half of which is arranged in each of the two subframe groups of the one frame; b (here, b is an integer satisfying $0<b<n$) subframes corresponding to bits belonging to the second bit group are divided into two, each one of which is arranged in each of the two subframe groups of the one frame; and c (here, c is an integer satisfying $0\leq c<n$ and $a+b+c=n$) subframes corresponding to bits belonging to the third bit group are arranged in at least one of the two subframe groups of the one frame; wherein an appearance order of a plurality of subframes corresponding to bits belonging to the first bit group and a plurality of subframes corresponding to bits belonging to the second bit group is approximately the same between the two subframe groups of the one frame; and wherein as for a part or all of the plurality of subframes corresponding to the bits belonging to the first bit group and the plurality of subframes corresponding to the bits belonging to the second bit group, a weight is added sequentially in each of the two subframe groups of the one frame, thereby expressing gradation. Herein, "about half" means a case where, assuming that a subframe is divided into x and the x subframes are divided to be y subframes and z subframes ($z=x-y$; $y>z$) to arrange in the subframe groups respectively, a ratio of z to y (namely, z/y) is 0.5 or more. That is, included is a case where, assuming that a subframe is divided into 3, the subframes are divided to be one subframe and two subframes to arrange in the subframe groups respectively. Of cause, it may be exactly half and is within the range of $1\geq z/y\geq 0.5$. Preferably, it may be within the range of $1\geq z/y\geq 0.65$, and more preferably within the range of $1\geq z/y\geq 0.8$.

According to the invention, in a driving method of a display device which expresses gradation by dividing one frame into a plurality of subframes, in the case where gradation is expressed with an n bit (here n is an integer), bits each of which is shown by a binary of the gray scales are classified into three kinds of bit groups, that is, a first bit group, a second bit group, and a third bit group; one frame is divided into k (here k is an integer satisfying $k\geq 3$) subframe groups; a (here, a is an integer satisfying $0<a<n$) subframes corresponding to bits belonging to the first bit group are divided into (k+1) or more, which are arranged in the k subframe groups of the one frame so as to be included about the same number; b (here, b is an integer satisfying $0<b<n$) subframes corresponding to bits belonging to the second bit group are divided into k, each one of which is arranged in each of the k subframe groups of the one frame; and c (here c is an integer satisfying $0\leq c<n$ and a+b+c=n) subframes corresponding to bits belonging to the third bit group are divided into (k−1) or less or are not divided, and arranged in at least one of the k subframe groups of the one frame; wherein an appearance order of a plurality of subframes corresponding to bits belonging to the first bit group and a plurality of subframes corresponding to bits belonging to the second bit group is approximately the same among the k subframe groups of the one frame; and wherein as for a part or all of the plurality of subframes corresponding to bits belonging to the first bit group and the plurality of subframes corresponding to bits belonging to the second bit group, a weight is added sequentially in each of the k subframe groups of the one frame, thereby expressing gradation. Herein, "about the same number" means a case where, as for divided subframes arranged in subframe groups, when the maximum number of arranged subframes is Y while the minimum number thereof is Z, a ratio of Z to Y (namely, Z/Y) is 0.5 or more. That is, included is a case where, assuming that a subframe is divided into four to arrange in three subframe groups, the subframes are divided to be one subframe, one subframe, and two subframes (that is, Z=1, Y=2) to arrange in the subframe groups respectively. Of cause, it may be complete the same number and is within the range of $1 \geq Z/Y \geq 0.5$. Preferably, it may be within the range of $1 \geq Z/Y \geq 0.65$, and more preferably within the range of $1 \geq Z/Y \geq 0.8$.

Herein, a subframe group means a group including a plurality of subframes. It is to be noted that when one frame is divided into a plurality of subframe groups, the number of subframes included in each subframe group is not limited; however, the subframe groups each preferably include about the same number of subframes. In addition, the length of a lighting period in each subframe group is not limited; however, the length of a lighting period is preferably about equal in the subframe groups.

In addition, in this specification, bits of a gray scale level expressed by using a binary are classified into three kinds of bit groups, that is, a first bit group, a second bit group, and a third bit group. These three kinds of bit groups are distinguished depending on the number of division of a subframe corresponding to each bit of the gray scale level. That is, it is defined here that the first bit group is a group for including a bit that a subframe corresponding to the bit of the gray scale level is divided into the number larger than the number of subframe groups, the second bit group is a group for including a bit that a subframe corresponding to the bit of the gray scale level is divided into the number equal to the number of subframe groups, and the third bit group is a group for including a bit that a subframe corresponding to the bit of the gray scale level is divided into the number smaller than the number of subframe groups or not divided. Therefore, it is not necessary that a high-order bit (large-weighted bit) is included in the first bit group, a middle-order bit (middle-weighted bit) is included in the second bit group, and a low-order bit (small-weighted bit) is included in the third bit group. For example, even a high-order bit is included in the second bit group if a subframe thereof is divided into the number equal to the number of subframe groups whereas it is included in the third bit group if a subframe thereof is divided into the number smaller than the number of subframe groups. Similarly, even a low-order bit is included in the first bit group if a subframe thereof is divided into the number larger than the number of subframe groups whereas it is included in the second bit group if a subframe thereof is divided into the number equal to the number of subframe groups.

It is to be noted that division of a subframe means to divide the length of a lighting period included in the subframe.

In addition, the case where "an appearance order of a plurality of subframes corresponding to bits belonging to the first bit group and a plurality of subframes corresponding to bits belonging to the second bit group is approximately the same" includes not only the case of exact match but also the case where a subframe corresponding to a bit belonging to the third bit group is interposed between the plurality of subframes corresponding to bits belonging to the first bit group and the plurality of subframes corresponding to bits belonging to the second bit group.

Note that according to the invention, as for the first bit group and the second bit group, gradation is expressed by sequentially adding a lighting period included in a part or all of the subframes corresponding to bits belonging to the first bit group and the second bit group (or the number of lighting within a time), in each subframe group. That is, the number of subframes to perform lighting is increased as the gray scale level is increased. Therefore, in a subframe to perform lighting at a small gray scale level also, lighting is also performed at a large gray scale level. Such a gray scale method is called an "overlapped time gray scale method" in this specification. Note that the overlapped time gray scale method is applied to subframes of which lighting periods are equal in each subframe group, among the subframes corresponding to the bits belonging to the first bit group and the second bit group; however, the invention is not limited to this.

It is to be noted that in the invention, various modes of a transistor can be used; therefore, the kind of a transistor to use is not limited. Thus, a thin film transistor (TFT) using a non-single crystal semiconductor film typified by amorphous silicon or polycrystalline silicon, a MOS transistor formed using a semiconductor substrate or an SOI substrate, a junction transistor, a bipolar transistor, a transistor using a compound semiconductor such as ZnO or a-InGaZnO, a transistor using an organic semiconductor or a carbon nanotube, or another transistor can be used. In addition, the transistor may be interposed over any kind of substrate and the kind of a substrate is not particularly limited. Therefore, for example, the transistor can be interposed over a single crystalline substrate, an SOI substrate, a glass substrate, a plastic substrate, a paper substrate, a cellophane substrate, a stone substrate, or the like. Further, the transistor may be formed using a substrate, and after that the transistor may be transferred to another substrate to provide over the substrate.

It is to be noted in this invention that "being connected" means electrical connection and direct connection; therefore, another element (e.g., a switch, a transistor, a capacitor, an inductor, a resistor, or a diode) capable of electrical connection may be interposed in the predetermined connection in a configuration disclosed in the invention. Alternatively, another element is not necessarily interposed in the arrangement. Note that only the case where connection is performed without interposing another element capable of electrical connection so as to directly connect, without including the case of electrically connecting, is referred to as "being directly connected" or "being connected in a direct manner". Note also that "being electrically connected" includes both the case where it is electrically connected and the case where it is directly connected.

It is to be noted in this specification that the term "semiconductor device" means a device having a circuit including a semiconductor element (e.g., a transistor or a diode). Further, the semiconductor device may also mean every device that can function by using semiconductor characteristics. In addition, a "display device" means a device having a display element (e.g., a liquid crystal element or a light emitting element). Further, the display device may also mean a main body of a display panel in which a plurality of pixels each including the display element such as a liquid crystal element or an EL element and a peripheral driver circuit for driving the pixels are formed over a substrate, which may further include the display panel provided with a flexible printed circuit (FPC) or a printed wiring board (PWB). In addition, a "light emitting device" means a display device having a self luminous display element such as in particular an EL element or an element used for an FED. A "liquid crystal display device" means a display device having a liquid crystal element.

Note that distinction between a source and a drain of a transistor is difficult structurally. Further, the height of respective potentials thereof may be reversed depending on operation of a circuit. In this specification, therefore, a source and a drain are not specified and they are referred to as a "first electrode" and a "second electrode". For example, when the first electrode is a source, the second electrode is a drain whereas when the first electrode is a drain, the second electrode is a source.

According to the invention, a pseudo contour can be reduced. Therefore, image quality is improved so that a clear image can be displayed. In addition, the duty ratio is improved as compared to the conventional double speed frame method, and a voltage applied to a light emitting element can be reduced, thereby power consumption can be reduced and deterioration of the light emitting element can be suppressed.

BRIEF DESCRIPTION OF THE DRAWINGS

FIG. 1 is a table showing an example of a selection method of subframes according to a driving method of the invention.

FIG. 3 is a table showing an example of a selection method of subframes according to a driving method of the invention.

FIG. 4 is a table showing an example of a selection method of subframes according to a driving method of the invention.

FIG. 6 is a table showing an example of a selection method of subframes according to a driving method of the invention.

FIG. 7 is a table showing an example of a selection method of subframes according to a driving method of the invention.

FIG. 8 is a table showing an example of a selection method of subframes according to a driving method of the invention.

FIG. 9 is a table showing an example of a selection method of subframes according to a driving method of the invention.

FIG. 10 is a table showing an example of a selection method of subframes according to a driving method of the invention.

FIG. 11 is a table showing an example of a selection method of subframes according to a driving method of the invention.

FIGS. 12A and 12B are tables showing an example of a selection method of subframes according to a driving method of the invention.

FIGS. 13A and 13B are tables showing an example of a selection method of subframes according to a driving method of the invention.

FIGS. 14A and 14B are tables showing an example of a selection method of subframes according to a driving method of the invention.

FIG. 15 is a table showing an example of a selection method of subframes in the case of performing gamma correction in a driving method of the invention.

FIG. 17 is a table showing an example of a selection method of subframes in the case of performing gamma correction in a driving method of the invention.

FIG. 21 is a diagram showing an example of an appearance order of subframes in a driving method of the invention.

FIG. 22 is a table showing an example of a selection method of subframes according to a driving method of the invention.

FIG. 23 is a table showing an example of a selection method of subframes according to a driving method of the invention.

FIG. 43 is a table showing an example of a selection method of subframes according to a conventional time gray scale method.

FIG. 44 is a table showing an example of a selection method of subframes according to a conventional double speed frame method.

FIG. 45 is a table showing an example of a selection method of subframes according to a conventional time gray scale method.

FIG. 46 is a table showing an example of a selection method of subframes according to a conventional double speed frame method.

FIG. 51 is a table showing an example of a selection method of subframes according to a driving method of the invention.

FIG. 52 is a table showing an example of a selection method of subframes according to a driving method of the invention.

FIG. 53 is a table showing an example of a selection method of subframes in the case of performing gamma correction in a driving method of the invention.

DETAILED DESCRIPTION OF THE INVENTION

Figure 2A:
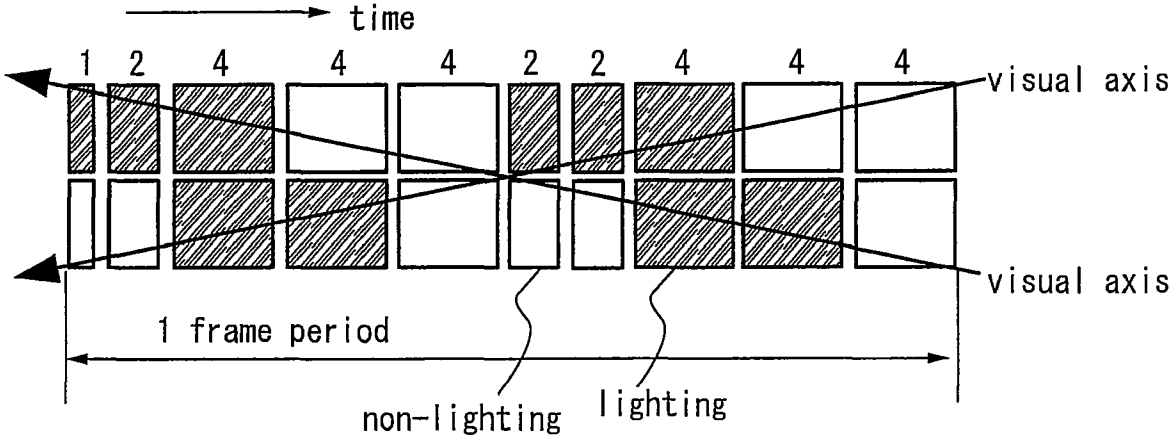
FIGS. 2A and 2B are diagrams showing a reason to reduce a pseudo contour, in a driving method of the invention.

Although the invention will be fully described by way of embodiment modes with reference to the accompanying drawings, it is to be understood that various changes and modifications will be apparent to those skilled in the art. Therefore, unless such changes and modifications depart from the scope of the invention, they should be construed as being included therein.

Embodiment Mode 1

Described in this embodiment mode is an example in which a driving method of the invention is applied to the case of a 5-bit display (32 gray-scale levels) and is applied to the case of a 6-bit display (64 gray-scale levels).

In an example of a driving method of this embodiment mode, according to a conventional time gray scale method, a subframe corresponding to a bit belonging to a first bit group is divided into four, a subframe corresponding to a bit belonging to a second bit group is divided into two, and a subframe corresponding to a bit belonging to a third bit group is not divided. Then, one frame is divided into two subframe groups which are a former half and a latter half, and each two of the divided bits belonging to the first bit group are arranged in each subframe group. One of the divided bits belonging to the second bit group is arranged in each subframe group, and the bits belonging to the third bit group are arranged in one or both of the subframe groups. At this time, an appearance order of subframes corresponding to bits belonging to the first bit group and subframes corresponding to bits belonging to the second bit group is approximately the same between the two subframe groups. Note that the bits belonging to the third bit group can be considered that they are not divided or they are divided into two once and then integrated into one subframe. Note that an overlapped time gray scale method is applied to subframes of which lighting periods are equal in each subframe group, among the subframes corresponding to the bits belonging to the first bit group and the second bit group. That is, the number of subframes for lighting is increased as the gray scale level is increased.

First, considered is a case of a 5-bit display (32 gray-scale levels). At first, a selection method of subframes at each gray scale level, that is, whether each subframe is for lighting or not at each gray scale level is described. Here, FIG. 1 shows an example of a selection method of subframes according to the invention in the case of expressing gradation with 5 bits. In FIG. 1, according to a conventional time gray scale method (FIG. 43), assuming that one bit is assigned to a first bit group, two bits are assigned to a second bit group, and two bits are assigned to a third bit group, SF5 is assigned to the bit belonging to the first bit group, SF3 and SF4 are assigned to the bits belonging to the second bit group, and SF1 and SF2 are assigned to the bits belonging to the third bit group. Then, SF5 is divided equally into 4, SF3 and SF4 are divided equally into 2 respectively, and SF1 and SF2 are not divided. Next, each two of the four divided bits belonging to the first bit group are arranged in each subframe group, one of the two divided bits belonging to the second bit group is arranged in each subframe group, and the bits belonging to the third bit group are arranged in the subframe groups respectively. That is, the bits belonging to the first bit group are arranged in SF4, SF5, SF9, and SF10 in FIG. 1, the bits belonging to the second bit group are arranged in SF2, SF3, SF7, and SF8 in FIG. 1, and the bits belonging to the third bit group are arranged in SF1 and SF6 in FIG. 1. As a result, the number of subframes becomes 10 and respective lengths of lighting periods of the subframes are such that SF1=1, SF2=2, SF3=4, SF4=4, SF5=4, SF6=2, SF7=2, SF8=4, SF9=4, and SF10=4. Since the respective lengths of the lighting periods of SF3 to SF5 and SF8 to SF10 are all 4 here, an overlapped time gray scale method is applied to both SF3 to SF5 and SF8 to SF10.

By dividing each subframe in this manner, the number of subframes can be kept to be the same number as in a conventional double speed frame method. Accordingly, the frame frequency can be the same as that in the conventional double speed frame method, which can be doubled substantially.

Described next is an example of a method of expressing a gray scale level, that is, a selection method of each subframe. In particularly, as for subframes of which lengths of lighting periods are equal, there is preferably the following regularity in the selection of the subframes.

First, an example of subframes to which an overlapped time gray scale method is applied is described. As for SF3 to SF5 arranged in the former subframe group and SF8 to SF10 arranged in the latter subframe group, SF3 and SF8, SF4 and SF9, and SF5 and SF10 are lighted at the same time respectively such that the number of subframes to perform lighting is increased as the gray scale level is increased. That is, in the former subframe group, SF3, SF4, and SF5 are added sequentially to light as the gray scale level is increased. Similarly in the latter subframe group, SF8, SF9, and SF10 are added sequentially to light as the gray scale level is increased. Therefore, subframes corresponding to the same bit (SF3 and SF8, SF4 and SF9, and SF5 and SF10) are lighted at the same time. Consequently, SF3 and SF8 keep lighting in the case of the gray scale level of 8 or more, SF4 and SF9 keep lighting in the case of the gray scale level of 16 or more, and SF5 and SF10 keep lighting in the case of the gray scale level of 24 or more. That is, a subframe which lights at a small gray scale level also lights at a large gray scale level.

Next, subframes to which the overlapped time gray scale method is not applied is described. As for SF1, SF2, SF6, and SF7 to which the overlapped time gray scale method is not applied, whether each subframe lights or not is selected to express gradation. It is to be noted that among SF2, SF6, and SF7 each of which the length of a lighting period is 2, SF2 and SF7 are lighted at the same time. This is because SF2 and SF7 are formed by dividing a subframe of which lighting period is 4 into two. However, subframes to be lighted at the same time are not limited to them; for example, SF2 and SF6 may be lighted at the same time.

Accordingly, in the case of expressing a gray scale level of 2, for example, SF6 among SF2, SF6, and SF7 each of which the length of a lighting period is 2 is lighted. In the case of expressing a gray scale level of 4, SF2 and SF7 in which lighting is performed at the same time among SF2, SF6, and SF7 each of which the length of a lighting period is 2 are lighted. In the case of expressing a gray scale level of 8, SF3 and SF8 in which lighting is performed at the same time among SF3 to SF5 and SF8 to SF10 each of which the length of a lighting period is 4 are lighted. In the case of expressing a gray scale level of 16, SF3, SF4, SF8, and SF9 among SF3 to SF5 and SF8 to SF10 each of which the length of a lighting period is 4 are lighted. In the case where the gray scale level to be expressed is larger also, lighting/non-lighting is selected, similarly.

Figure 2B:
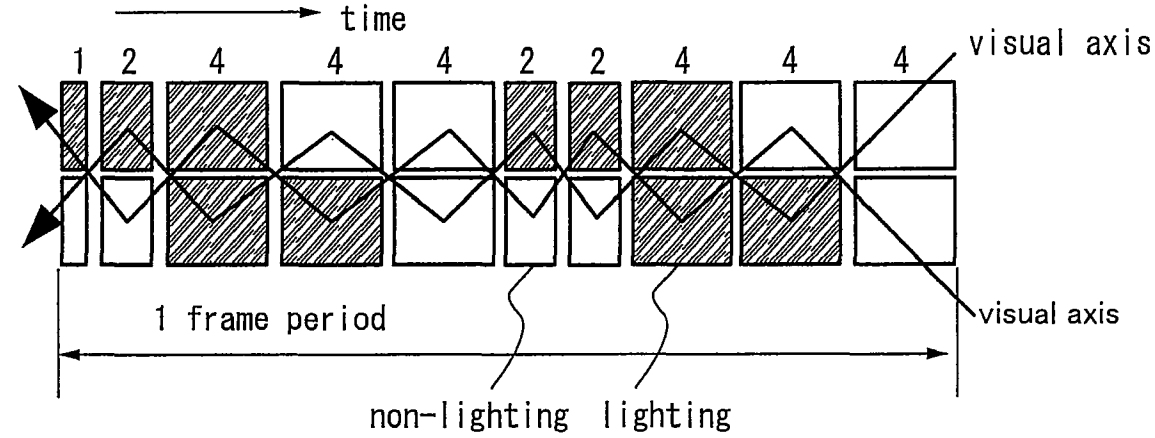

According to the driving method of the invention, a pseudo contour can be reduced. For example, assuming that the gray scale level of 15 is expressed in a pixel A while the gray scale level of 16 is expressed in a pixel B in FIG. 1, lighting/non-lighting in each subframe is shown in FIGS. 2A and 2B. Here, if a visual axis is moved, eyes sense that the gray scale level is 15 (=4+4+4+2+1) or 16 (=4+2+2+4+4) sometimes, in accordance with a trace of the visual axis. FIG. 2A shows this case. Since it should be seen that the gray scale levels are 15 and 16 normally, they are seen accurately so that a pseudo contour is reduced.

Next, FIG. 2B shows a case of moving a visual axis drastically. If the visual axis is moved drastically, eyes sense that the gray scale level is 15 (=4+2+4+4+1) or 16 (=4+4+2+4+2) sometimes, in accordance with a trace of the visual axis. Since it should be seen that the gray scale levels are 15 and 16 normally, they are seen accurately so that a pseudo contour is reduced.

Note that although the length (or the number of lightings within a time, namely, the quantity of weight) of a lighting period of each subframe is 1, 2, or 4, the invention is not limited to this. In addition, although it is set such that SF1=1, SF2=2, SF3=4, SF4=4, SF5=4, SF6=2, SF7=2, SF8=4, SF9=4, and SF10=4, correspondence between the subframe number and the length of a lighting period is not limited to this.

In addition, a selection method of each subframe is not limited to this. For example, in the case of expressing a gray scale level of 4, SF2 and SF7 in which lighting is performed at the same time among SF2, SF6, and SF7 each of which the length of a lighting period is 2 are lighted in this embodiment mode; however, SF2 and SF6 may be lighted as well.

In addition, the case where "an appearance order of a plurality of subframes corresponding to bits belonging to the first bit group and a plurality of subframes corresponding to bits belonging to the second bit group is approximately the same" includes not only the case of exact match but also the case where a subframe corresponding to a bit belonging to the third bit group is interposed between the plurality of subframes corresponding to bits belonging to the first bit group and the plurality of subframes corresponding to bits belonging to the second bit group. Thus, even if a position of the subframe corresponding to a bit belonging to the third bit group is different between the former subframe group and the later subframe group, an appearance order of the plurality of subframes corresponding to bits belonging to the first bit group and the plurality of subframes corresponding to bits belonging to the second bit group is the same. An example thereof is shown in FIG. 51. In FIG. 51, SF1 and SF2 assigned to bits belonging to the third bit group according to the conventional time gray scale method (FIG. 43) are arranged in SF3 and SF9 respectively.

It is to be noted that although, in FIG. 1, each of the subframes corresponding to bits belonging to the third bit group is arranged in each of the two subframe groups, the invention is not limited to this, and the two subframes may be arranged in one of the two subframe groups as well. For example, an example in which the two bits belonging to the third bit group are arranged in the former subframe group in FIG. 1, is shown in FIG. 3. In FIG. 3, according to the conventional time gray scale method (FIG. 43), SF1 and SF2 assigned to the bits belonging to the third bit group are arranged in the former subframe group. That is, the bits belonging to the third bit group are arranged in SF1 and SF2 in FIG. 3 respectively.

It is to be noted that the length of a lighting period is arbitrarily changed depending on the total number of gray scale levels (the number of bits), the total number of subframes, or the like. Therefore, even if the length of a lighting period is equal, the length of a period for actually lighting (e.g., the size of μs) may be changed if the total number of gray scale levels (the number of bits) or the total number of subframes is changed.

It is to be noted that a "lighting period" is used for the case where light is emitted continuously and "the number of lighting" is used for the case where light keeps blinking within a time. A typical display device which employs the number of lighting is a plasma display. A typical display device which employs the lighting period is an organic EL display.

Next, considered is a case of a 6-bit display (64 gray-scale levels). Here, FIG. 4 shows an example of a selection method of subframes according to the invention in the case of expressing gradation with 6 bits.

In FIG. 4, according to a conventional time gray scale method (FIG. 45), assuming that one bit is assigned to a first bit group, three bits are assigned to a second bit group, and two bits are assigned to a third bit group, SF6 is assigned to the bit belonging to the first bit group, SF3, SF4, and SF5 are assigned to the bits belonging to the second bit group, and SF1 and SF2 are assigned to the bits belonging to the third bit group. Then, SF6 is divided equally into 4, SF3, SF4, and SF5 are divided equally into 2 respectively, and SF1 and SF2 are not divided. Next, each two of the four divided bits belonging to the first bit group are arranged in each subframe group, one of the two divided bits belonging to the second bit group is arranged in each subframe group, and the bits belonging to the third bit group are arranged in the subframe groups respectively. That is, the bits belonging to the first bit group are arranged in SF5, SF6, SF11, and SF12 in FIG. 4, the bits belonging to the second bit group are arranged in SF2, SF3, SF4, SF8, SF9, and SF10 in FIG. 4, and the bits belonging to the third bit group are arranged in SF1 and SF7 in FIG. 4. As a result, the number of subframes becomes 12 and respective lengths of lighting periods of the subframes are such that SF1=1, SF2=2, SF3=4, SF4=8, SF5=8, SF6=8, SF7=2, SF8=2, SF9=4, SF10=8, SF11=8, and SF12=8. Since the respective lengths of the lighting periods of SF4 to SF6 and SF10 to SF12 are all 8 here, an overlapped time gray scale method is applied to both SF4 to SF6 and SF10 to SF12.

Figure 5A:
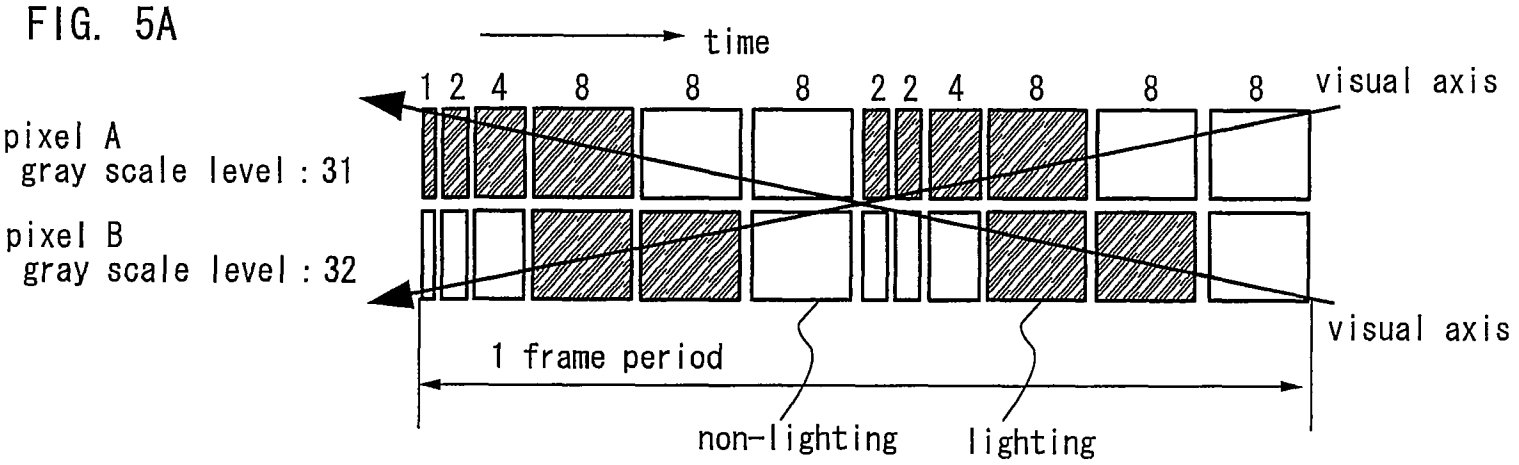
FIGS. 5A and 5B are diagrams showing a reason to reduce a pseudo contour, in a driving method of the invention.
Figure 5B:
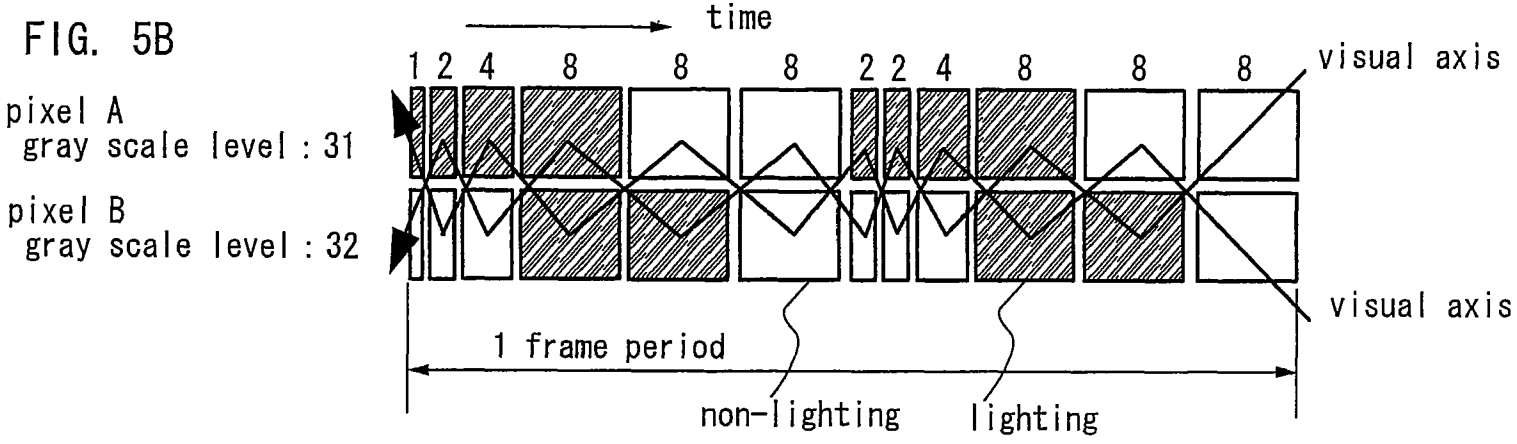

Similarly to the case of a 5-bit display, according to a driving method of the invention, a pseudo contour can be reduced. For example, assuming that a gray scale level of 31 is expressed in a pixel A while a gray scale level of 32 is expressed in a pixel B using the subframes shown in FIG. 4, lighting/non-lighting in each subframe is shown in FIGS. 5A and 5B. Here, if a visual axis is moved, eyes sense that the gray scale level is 31 (=8+8+8+4+2+1) or 32 (=8+4+2+2+8+8) sometimes, in accordance with a trace of the visual axis. FIG. 5A shows this case. Since it should be seen that the gray scale levels are 31 and 32 normally, they are seen accurately so that a pseudo contour is reduced.

Next, FIG. 5B shows a case of moving the visual axis drastically. If the visual axis is moved drastically, eyes sense that the gray scale level is 27 (=8+4+2+8+4+1) or 36 (=8+8+2+8+8+2) sometimes, in accordance with a trace of the visual axis. Although it should be seen that the gray scale levels are 31 and 32 normally, the gray scale level is seen to be 27 or 36 so that a pseudo contour occurs. However, a gap of the gray scale level is smaller than the case of the conventional double speed frame method (FIG. 46), thereby a pseudo contour is reduced.

Note that, similarly to the case of a 5-bit display, although the lengths (or the number of lighting within a time, namely, the quantity of weight) of a lighting period of each subframe are 1, 2, 4, and 8, the invention is not limited to this. In addition, although it is set such that SF1=1, SF2=2, SF3=4, SF4=8, SF5=8, SF6=8, SF7=2, SF8=2, SF9=4, SF10=8, SF11=8, and SF12=8, correspondence between the subframe number and the length of a lighting period is not limited to this. In addition, a selection method of subframes is not limited to this.

It is to be noted that the number of bits assigned to each bit group is not limited to the examples described above, in this embodiment mode. However, to the first bit group and the second bit group, at least one bit is preferably assigned respectively.

For example, FIG. 6 shows an example in which, in the case of a 5-bit display, one bit is assigned to a first bit group, three bits are assigned to a second bit group, and one bit is assigned to a third bit group. According to the conventional time gray scale method (FIG. 43), SF5 is assigned to the bit belonging to the first bit group, SF2 to SF4 are assigned to the bits belonging to the second bit group, and SF1 is assigned to the bit belonging to the third bit group. Then, SF5 is divided into 4, SF2 to SF4 are divided into 2 respectively, and SF1 is not divided. Next, each two of the four divided bits belonging to the first bit group are arranged in each subframe group, one of the two divided bits belonging to the second bit group is arranged in each subframe group, and the bit belonging to the third bit group is arranged in one of the subframe groups. That is, the bits belonging to the first bit group are arranged in SF5, SF6, SF10, and SF11 in FIG. 6, the bits belonging to the second bit group are arranged in SF2 to SF4 and SF7 to SF9 in FIG. 6, and the bit belonging to the third bit group is arranged in SF1 in FIG. 6. As a result, the number of subframes becomes 11 and respective lengths of lighting periods of the subframes are such that SF1=1, SF2=1, SF3=2, SF4=4, SF5=4, SF6=4, SF7=1, SF8=2, SF9=4, SF10=4, and SF11=4. Since the respective lengths of the lighting periods of SF4 to SF6 and SF9 to SF11 are all 4 here, an overlapped time gray scale method is applied to both SF4 to SF6 and SF9 to SF11.

Further, for example, FIG. 7 shows an example in which, in the case of a 5-bit display, two bits are assigned to a first bit group, one bit is assigned to a second bit group, and two bits are assigned to a third bit group. According to the conventional time gray scale method (FIG. 43), SF4 and SF5 are assigned to the bits belonging to the first bit group, SF3 is assigned to the bit belonging to the second bit group, and SF1 and SF2 are assigned to the bits belonging to the third bit group. Then, SF4 and SF5 are divided into 4 respectively, SF3 is divided into 2, and SF1 and SF2 are not divided. Next, each two of the four divided bits belonging to the first bit group are arranged in each subframe group, one of the two divided bits belonging to the second bit group is arranged in each subframe group, and the bits belonging to the third bit group are arranged in the subframe groups respectively. That is, the bits belonging to the first bit group are arranged in SF3 to SF6 and SF9 to SF12 in FIG. 7, the bits belonging to the second bit group are arranged in SF2 and SF8 in FIG. 7, and the bits belonging to the third bit group are arranged in SF1 and SF7 in FIG. 7. As a result, the number of subframes becomes 12 and respective lengths of lighting periods of the subframes are such that SF1=1, SF2=2, SF3=2, SF4=2, SF5=4, SF6=4, SF7=2, SF8=2, SF9=2, SF10=2, SF11=4, and SF12=4. Since the respective lengths of the lighting periods of SF2 to SF4 and SF8 to SF10 are all 2 here, an overlapped time gray scale method is applied to both SF2 to SF4 and SF8 to SF10.

Further, for example, FIG. 8 shows an example in which, in the case of a 5-bit display, one bit is assigned to a first bit group, four bits are assigned to a second bit group, and zero bit is assigned to a third bit group. According to the conventional time gray scale method (FIG. 43), SF5 is assigned to the bit belonging to the first bit group, and the other SF1 to SF4 are assigned to the bits belonging to the second bit group. Then, SF5 is divided into 4, and the other SF1 to SF4 are divided into 2 respectively. Next, each two of the four divided bits belonging to the first bit group are arranged in each subframe group, one of the two divided bits belonging to the second bit group is arranged in each subframe group. That is, the bits belonging to the first bit group are arranged in SF5, SF6, SF11, and SF12 in FIG. 8, and the bits belonging to the second bit group are arranged in SF1 to SF4 and SF7 to SF10 in FIG. 8. As a result, the number of subframes becomes 12 and respective lengths of lighting periods of the subframes are such that SF1=0.5, SF2=1, SF3=2, SF4=4, SF5=4, SF6=4, SF7=0.5, SF8=1, SF9=2, SF10=4, SF11=4, and SF12=4. Since the respective lengths of the lighting periods of SF4 to SF6 and SF10 to SF12 are all 4 here, an overlapped time gray scale method is applied to both SF4 to SF6 and SF10 to SF12.

It is to be noted that FIG. 8 is seemed as a case where the bit belonging to the third bit group in FIG. 6 is divided to arrange in the former subframe group and the latter subframe group. As a result, as for the bit belonging to the third bit group, it seems that the frame frequency thereof is substantially increased. Consequently, human eyes can be tricked so that a pseudo contour can be reduced.

It is to be noted that although the highest-order bit (the largest-weighted bit) is selected as the bit belonging to the first bit group in this embodiment mode, the bit belonging to the first bit group is not limited to this and any bit may be selected as the bit belonging to the first bit group. Similarly, any bit may be selected as the bit belonging to the second bit group or the third bit group.

For example, FIG. 9 shows an example in which, in the case of a 5-bit display, the second highest-order bit is selected as a bit belonging to a first bit group. According to the conventional time gray scale method (FIG. 43), assuming that one bit is assigned to a first bit group, two bits are assigned to a second bit group, and two bits are assigned to a third bit group, SF4 corresponding to the second highest-order bit is assigned to the bit belonging to the first bit group, SF3 and SF5 are assigned to the bits belonging to the second bit group, and SF1 and SF2 are assigned to the bits belonging to the third bit group. Then, SF4 is divided into 4, SF3 and SF5 are divided into 2 respectively, and SF1 and SF2 are not divided. Next, each two of the four divided bits belonging to the first bit group are arranged in each subframe group, one of the two divided bits belonging to the second bit group is arranged in each subframe group, and the bits belonging to the third bit group are arranged in the subframe groups respectively. That is, the bits belonging to the first bit group are arranged in SF3, SF4, SF8, and SF9 in FIG. 9, the bits belonging to the second bit group are arranged in SF2, SF5, SF7, and SF10 in FIG. 9, and the bits belonging to the third bit group are arranged in SF1 and SF6 in FIG. 9. As a result, the number of subframes becomes 10 and respective lengths of lighting periods of the subframes are such that SF1=1, SF2=2, SF3=2, SF4=2, SF5=8, SF6=2, SF7=2, SF8=2, SF9=2, and SF10=8. Since the respective lengths of the lighting periods of SF2 to SF4 and SF7 to SF9 are all 2 here, an overlapped time gray scale method is applied to both SF2 to SF4 and SF7 to SF9.

Note that as shown in the example in FIG. 9, a subframe corresponding to the highest-order bit, which is divided into the same number as the number of subframe groups, belongs to the second bit group.

It is to be noted that although described in this embodiment mode is the example in which the subframe corresponding to the bit belonging to the first bit group is divided into 4, the division number of a subframe corresponding to the bit belonging to the first bit group is not limited to this as long as it is larger than the number of subframe groups. That is, in the case where the number of subframe groups is two, the division number is 3 or more. For example, the subframe corresponding to the bit belonging to the first bit group may be divided into 3 and arranged such that two subframes and one subframe are included in the two subframe groups respectively. Note that the subframe corresponding to the bit belonging to the first bit group is preferably divided into multiples of the number of subframe groups; that is, when the number of subframe groups is two, the subframe is preferably divided into (2×m) (here m is an integer satisfying m≥2). This is because the divided bits corresponding to the bit belonging to the first bit group can be arranged in the subframe groups evenly so that a flicker or a pseudo contour can be prevented. For example, a subframe corresponding to the bit belonging to the first bit group may be divided into 6. However, the invention is not limited to this.

It is to be noted that although all the subframes corresponding to the bits belonging to the first bit group are divided into 4 respectively in this embodiment mode, all the subframes corresponding to the bits belonging to the first bit group may be different in the number of division. The number of division may be different in the first bit group.

For example, shown in FIG. 10 is an example in which, according to the conventional time gray scale method (FIG. 43), SF4 and SF5 are assigned to the bits belonging to the first bit group, SF3 is assigned to the bit belonging to the second bit group, and SF1 and SF2 are assigned to the bits belonging to the third bit group similarly to the case of FIG. 7, and then SF4 is divided into 4 while SF5 is divided into 6, which are assigned to the bits belonging to the first bit group. First, SF4 is divided into 4 and SF5 is divided into 6, which are assigned to the bits belonging to the first bit group. Next, each three of the six divided bits belonging to the first bit group are arranged in each subframe group, and each two of the four divided bits belonging to the first bit group are arranged in each subframe group. That is, the six divided bits belonging to the first bit group are arranged in SF5 to SF7 and SF12 to SF14 in FIG. 10, and the four divided bits belonging to the first bit group are arranged in SF3, SF4, SF10, and SF11 in FIG. 10. As a result, the number of subframes becomes 14 and respective lengths of lighting periods of the subframes are such that SF1=1, SF2=2, SF3=2, SF4=2, SF5=8/3, SF6=8/3, SF7=8/3, SF8=2, SF9=2, SF10=2, SF11=2, SF12=8/3, SF13=8/3, and SF14=8/3. Since the respective lengths of the lighting periods of SF2 to SF4 and SF9 to SF11 are all 2 here, an overlapped time gray scale method is applied to both SF2 to SF4 and SF9 to SF11.

It is to be noted that although the subframe corresponding to the bit belonging to the first bit group is divided equally into 4 and the subframe corresponding to the bit belonging to the second bit group is divided equally into 2 with respect to the conventional time gray scale method in this embodiment mode, the width of division of a subframe is not limited to this. The subframe is not necessarily equally divided.

For example, in the case of a 5-bit display, a subframe (SF4) corresponding to the bit belonging to the second bit group may be divided into such that a lighting period (a length of 8) thereof is divided to be 2 and 6 according to the conventional time gray scale method (FIG. 43), an example of which is shown in FIG. 11. In FIG. 11, SF4 assigned to the bit belonging to the second bit group is divided to be a lighting period of 2 and a lighting period of 6, and the divided subframe of which a lighting period is 2 is arranged in SF3 and the divided subframe of which a lighting period is 6 is arranged in SF8. Since the respective lengths of the lighting periods of SF2 and SF3 in FIG. 11 are all 2 here, an overlapped time gray scale method is applied to SF2 and SF3.

It is to be noted that an appearance order of subframes corresponding to bits belonging to the first bit group and belonging to the second bit group is the same between the two subframe groups in this embodiment mode. However, the invention is not limited to the case of exact match in the appearance order, and between the two subframe groups, an order of subframes may be different. For example, SF8 and SF9 may be changed for each other in the case of FIG. 1, that is, there may be such arrangement that SF1, SF2, SF3, SF4, SF5, SF6, SF7, SF9, SF8, and SF10.

Note that the descriptions about the number of bits to be assigned to each bit group, a bit to be selected as a bit belonging to each bit group, the number of division of a bit belonging to a first bit group, the width of division of a subframe, and an appearance order of subframes, as described hereinabove may be used in combination.

For example, shown in FIGS. 12A and 12B are examples in which in the case of a 5-bit display, two bits are assigned to the first bit group, one bit is assigned to the second bit group, and two bits are assigned to the third bit group, and one of the bits belonging to the first bit group is changed in the width of division according to the conventional time gray scale method (FIG. 43). According to the conventional time gray scale method (FIG. 43), SF4 and SF5 are assigned to the bits belonging to the first bit group, SF3 is assigned to the bit belonging to the second bit group, and SF1 and SF2 are assigned to the bits belonging to the third bit group. Then, SF4 and SF5 are divided into 4 respectively. At this time, a lighting period (a length of 8) of SF4 is equally divided to be 2, 2, 2, and 2 while a lighting period (a length of 16) of SF5 is divided to be 2, 6, 2, and 6. In addition, SF3 is divided into two and SF1 and SF2 are not divided. Next, each two of the four divided bits belonging to the first bit group are arranged in each of two subframe groups, each of the two divided bits belonging to the second bit group is arranged in each of the two subframe groups, and the bits belonging to the third bit group are arranged in the two subframe groups respectively. That is, among the bits belonging to the first bit group, SF4 is divided to arrange in SF3, SF4, SF9, and SF10 in FIGS. 12A and 12B, and SF5 is divided to be lighting periods of 2, 2, 6, and 6 to arrange in SF5, SF11, SF6, and SF12 respectively in FIGS. 12A and 12B. In addition, the bits belonging to the second bit group are arranged in SF2 and SF8 respectively in FIGS. 12A and 12B, and the bits belonging to the third bit group are arranged in SF1 and SF7 respectively in FIGS. 12A and 12B. As a result, the number of subframes becomes 12 and respective lengths of lighting periods of the subframes are such that SF1=1, SF2=2, SF3=2, SF4=2, SF5=2, SF6=6, SF7=2, SF8=2, SF9=2, SF10=2, SF11=2, and SF12=6.

Here, description is made on a subframe to which an overlapped time gray scale method is applied. Since the respective lengths of the lighting periods of SF2 to SF5 and SF8 to SF11 are all 2 in FIGS. 12A and 12B, an overlapped time gray scale method is applied to these subframes. At this time, the overlapped time gray scale method is not necessarily applied to all of the subframes of which lighting periods are equal. For example, the overlapped time gray scale method may be applied to both SF2 to SF4 and SF8 to SF10 as shown in FIG. 12A, or the overlapped time gray scale method may be applied to both SF2 to SF5 and SF8 to SF11 as shown in FIG. 12B.

It is to be noted that an overlapped time gray scale method is applied to subframes of which lighting periods are equal in each subframe group, among subframes corresponding to bits belonging to the first bit group and the second bit group in this embodiment mode; however, subframes to which the overlapped time gray scale method is applied are not limited to subframes of which lighting periods are equal. The overlapped time gray scale method may be applied to subframes of which lighting periods are different as well.

For example, shown in FIG. 52 is an example in which the bit belonging to the first bit group is changed in the width of division in the case of FIG. 1. In FIG. 52, according to the conventional time gray scale method (FIG. 43), SF5 corresponding to the bit belonging to the first bit group is divided such that a lighting period (a length of 16) thereof is divided to be 3, 5, 3, and 5, and the bits each of which a lighting period is 3 are arranged in SF4 and SF9 in FIG. 52 while the bits each of which a lighting period is 5 are arranged in SF5 and SF10 in FIG. 52. As a result, the number of subframes becomes 10 and respective lengths of lighting periods of the subframes are such that SF1=1, SF2=2, SF3=4, SF4=3, SF5=5, SF6=2, SF7=2, SF8=4, SF9=3, and SF10=5. Here, although the respective lighting periods between SF3 and SF4, and between SF8 and SF9 in FIG. 52 are different from each other, an overlapped time gray scale method is applied both SF3 and SF4, and SF8 and SF9.

Described hereinabove is the case of expressing gradation with 5 bits or 6 bits by using a driving method of the invention. In a similar manner, the invention can be employed for the case of the various number of bits. For example, in the case of expressing gradation with n bits (here n is an integer), the total number of subframes is n according to the conventional time gray scale method. In addition, the length of a lighting period of the subframe corresponding to the highest-order bit is $2^{n-1}$. On the other hand, with respect to the conventional time gray scale method, assuming that the number of bits belonging to a first bit group to be divided into L (here L is an integer satisfying $L \geq 3$) is a (here a is an integer satisfying $0<a<n$), the number of bits belonging to a second bit group to be divided into 2 is b (here b is an integer satisfying $0<b<n$), and the number of bits belonging to a third bit group not to be divided is c (here c is an integer satisfying $0 \leq c<n$ and $a+b+c=n$), the total number of subframes according to a driving method of the invention becomes at least ($L \times a+2 \times b+c$). In addition, in the case where the highest-order bit is selected as a bit belonging to the first bit group and a subframe corresponding to this bit is equally divided into L, the length of a lighting period of each subframe after the division corresponding to this bit is ($2^{n-1}/L$). For example, in the case of FIG. 1, since n=5, L=4, a=1, b=2, and c=2, the total number of subframes is ($4 \times 1+2 \times 2+2=$) 10 and the length of each lighting period of a subframe after the division corresponding to the bit belonging to the first bit group is ($2^{5-1}/4=$) 4. Similarly, in the case of FIG. 4, since n=6, L=4, a=1, b=3, and c=2, the total number of subframes is ($4 \times 1+2 \times 3+2=$) 12 and the length of each lighting period of a subframe after the division corresponding to the bit belonging to the first bit group is ($2^{6-1}/4=$) 8. Further, in the case of FIG. 7, since n=5, L=4, a=2, b=1, and c=2, the total number of subframes is ($4 \times 2+2 \times 1+2=$) 12 and the length of each lighting period of a subframe after the division corresponding to the highest-order bit among the bits belonging to the first bit group is ($2^{5-1}/4=$) 4.

As described above, by using the driving method of the invention, to reduce a pseudo contour, to increase the number of gray scale levels to display, or the like can be realized without increasing the number of subframes.

It is to be noted that there may be a plurality of selection methods of subframes for expressing one gray scale level. Therefore, the selection method of subframes at a certain gray scale level may be changed depending on time or place as well. That is, the selection method of subframes may be changed depending on time or it may be changed depending on a pixel. Further, it may be changed depending on both of time and a pixel.

For example, for expressing a certain gray scale level, the selection method of subframes may be changed depending on whether the frame number is an odd number or an even number. Here, an embodiment in the case of a 5-bit display is shown in FIGS. 13A and 13B. For example, gradation may be expressed by a selection method of subframes shown in FIG. 13A in an odd-numbered frame whereas gradation may be expressed by a selection method of subframes shown in FIG. 13B in an even-numbered frame. FIGS. 13A and 13B are different in a selection method of subframes for expressing the gray scale levels 16 and 23. By the way, a pseudo contour tends to occur at the gray scale levels 16 and 23 in the case of a 5-bit display. Therefore, a pseudo contour can be reduced by changing the selection method of subframes at the gray scale level at which a pseudo contour tends to occur, between an odd-numbered frame and an even-numbered frame.

It is to be noted that the selection method of subframes is changed at the gray scale level at which a pseudo contour tends to occur in FIGS. 13A and 13B; however, the selection method of subframes may be changed at an arbitrarily gray scale level as well.

In addition, another embodiment is shown in FIGS. 14A and 14B. Gradation may be expressed by a selection method of subframes shown in FIG. 14A in an odd-numbered frame whereas gradation may be expressed by a selection method of subframes shown in FIG. 14B in an even-numbered frame. FIGS. 14A and 14B are different in the lengths of lighting periods of SF3 and SF8, and the selection method of subframes is different.

Further, for expressing a certain gray scale level, the selection method of subframes may be changed depending on whether the row number of pixels is an odd number or an even number, as well. Further alternatively, for expressing a certain gray scale level, the selection method of subframes may be changed depending on whether the column number of pixels is an odd number or an even number.

It is to be noted that another gray scale display method may be used in combination with the driving method of the invention. An area gray scale method is a method of expressing gradation by dividing one pixel into a plurality of sub-pixels and changing a lighting area. As a result, a pseudo contour can be further reduced.

The description hereinabove is on the case where a lighting period is increased in linear proportion as the gray scale level is increased. Subsequently, a case where a gamma correction is performed is described in this embodiment mode. The gamma correction is performed so that the lighting period is increased nonlinearly as the gray scale level is increased. Even when luminance is increased in linear proportion, human eyes cannot sense that brightness is increased in linear proportion. As the luminance is increased, the difference of brightness is less sensible to human eyes. Therefore, in order to sense the difference of brightness by human eyes, it is required that the lighting period is increased as the gray scale level is increased, that is, a gamma correction is performed. Note that where a gray scale level is x and a luminance is y, a relation between the gray scale level and the luminance with the gamma correction is represented by the following formula (1).

[Formula 1]

$$y=Ax^{\gamma} \tag{1}$$

Note that A is a constant for normalizing the luminance y to be $0 \leq y \leq 1$. Here, $\gamma$ which is an exponent of the gray scale level x is a parameter for expressing the degree of the gamma correction.

As the simplest method for performing the gamma correction, there is a method in which display is to be performed with a larger number of bits (gray scale levels) than the number of bits (gray scale levels) actually displayed. For example, in the case of a 6-bit (64 gray scale levels) display, an 8 bits (256 gray scale levels) are to be displayed actually. Then, in actually performing display, the display is performed with 6 bits (64 gray scale levels) so that the luminance of the gray scale levels becomes non-linear. Accordingly, a gamma correction can be realized.

Figure 16A:
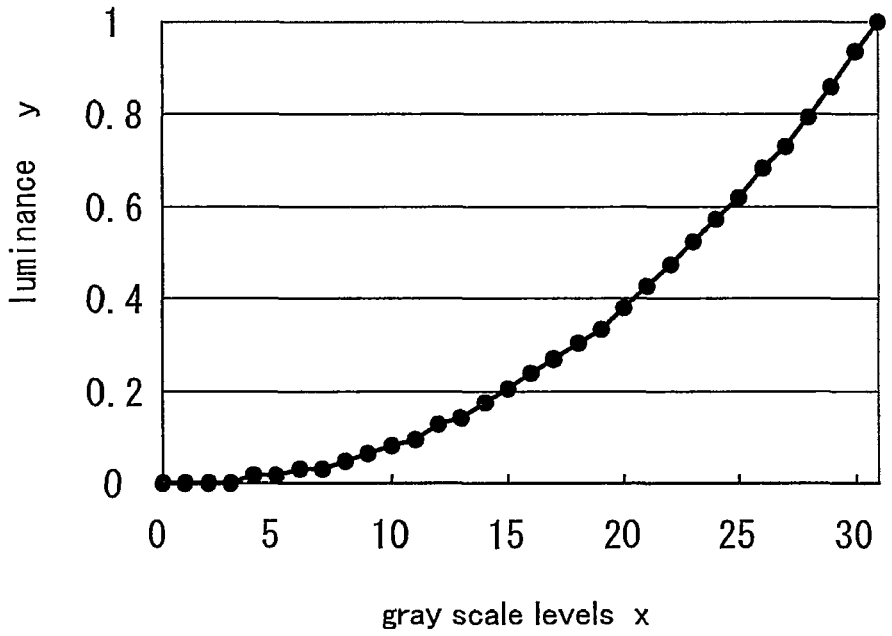
FIGS. 16A and 16B are graphs showing a relation between the gray scale level and the luminance in the case of performing gamma correction in a driving method of the invention.
Figure 16B:
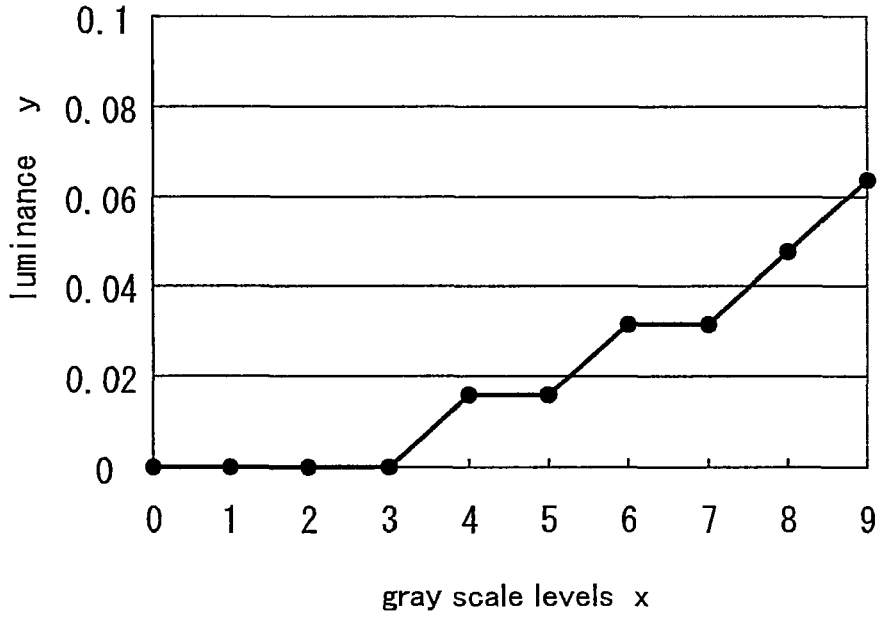

As an example, shown in FIG. 15 is a selection method of subframes in the case where display is to be performed with 6 bits and the display is performed with 5 bits by performing a gamma correction. FIG. 15 shows a selection method of subframes in the case of a 5-bit display by performing a gamma correction so as to satisfy $\gamma=2.2$ at all gray scale levels. Note that $\gamma=2.2$ is a value to compensate most visual sense characteristics of human, and even when the luminance is high, the most suitable difference of brightness can be sensed. In FIG. 15, up to a gray scale level of 3 with 5 bits gamma-corrected, display is performed actually by a selection method of subframes at a gray scale level of 0 with 6 bits. Similarly, at a gray scale level of 4 with 5 bits gamma-corrected, the display is performed actually by a selection method of subframes at a gray scale level of 1 with 6 bits, and at a gray scale level of 6 with 5 bits gamma-corrected, the display is performed actually by a selection method of subframes at a gray scale level of 2 with 6 bits. FIGS. 16A and 16B are graphs of the gray scale level x and the luminance y. FIG. 16A shows a relation between the gray scale level x and the luminance y at all gray scale levels and FIG. 16B is a graph showing the gray scale level x and the luminance y at lower gray scale levels. Thus, display may be performed in accordance with a table in which gray scale levels with 5 bits gamma-corrected correspond to gray scale levels with 6 bits. In this manner, a gamma correction can be realized so as to satisfy $\gamma=2.2$.

However, as shown in FIG. 16B, gray scale levels of 0 to 3, gray scale levels of 4 and 5, and gray scale levels of 6 and 7 can be displayed with the same luminance respectively in the case of FIG. 15. This is because, in the case of a 6-bit display, the luminance difference cannot be expressed since the number of gray scale levels is not enough. As for a countermeasure against it, there are the following two methods.

A first method is to increase the number of bits capable of being displayed. Not with 6 bits, display is to perform with 7 bits or more, and preferably with 8 bits or more. As a result, smooth display can be performed even at a region of a low gray scale level (a region where the luminance is low).

Figure 18A:
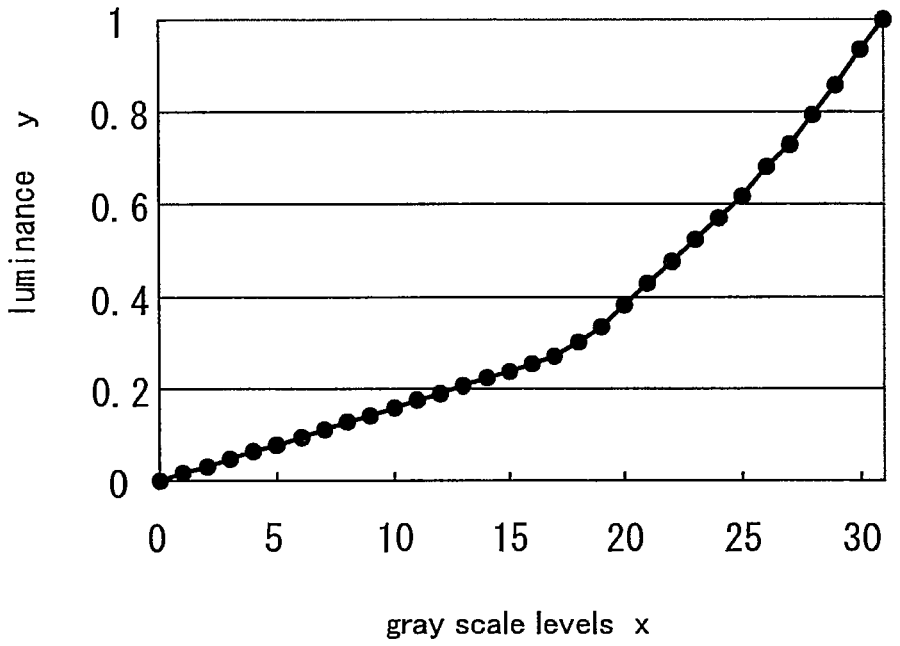
FIGS. 18A and 18B are graphs showing a relation between the gray scale level and the luminance in the case of performing gamma correction in a driving method of the invention.
Figure 18B:
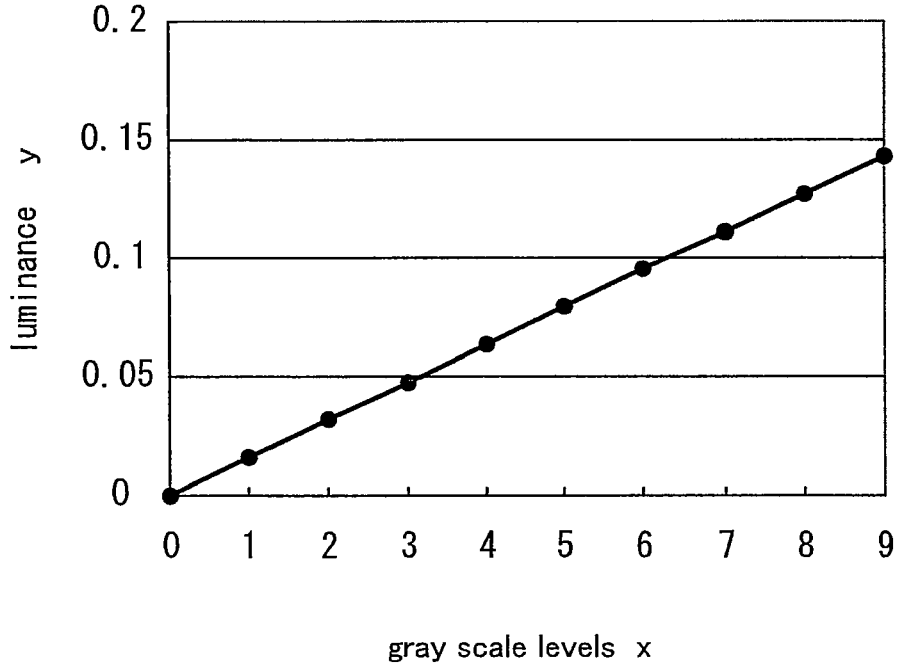

A second method is a method for displaying smoothly by changing the luminance linearly though the relation of $\gamma=2.2$ is not satisfied at a region of a low gray scale level. A selection method of subframes in this case is shown in FIG. 17. In FIG. 17, up to a gray scale level of 17 with 5 bits, the selection method of subframes is the same as that with 6 bits. However, at a gray scale level of 18 with 5 bits gamma-corrected, the lighting is actually performed by a selection method of subframes at a gray scale level of 19 with 6 bits. Similarly, at a gray scale level of 19 with a 5-bit display gamma-corrected, the lighting is actually performed by a selection method of subframes at a gray scale level of 21 with 6 bits, and at a gray scale level of 20 with 5 bits gamma-corrected, the lighting is actually performed by a selection method of subframes at a gray scale level of 24 with 6 bits. FIGS. 18A and 18B are graphs of the gray scale level x and the luminance y. FIG. 18A shows a relation between the gray scale level x and the luminance y at all gray scale levels and FIG. 18B is a graph showing the gray scale level x and the luminance y at lower gray scale levels. At a region of a low gray scale level, the luminance changes linearly. By performing thus gamma correction, lower gray scale levels can be displayed more smoothly.

That is, the luminance is changed linearly in proportion in a region of lower gray scale levels, and in the other region of the other gray scale levels, the luminance is changed nonlinearly, thereby the region of lower gray scale levels can be displayed more smoothly.

Figure 54:
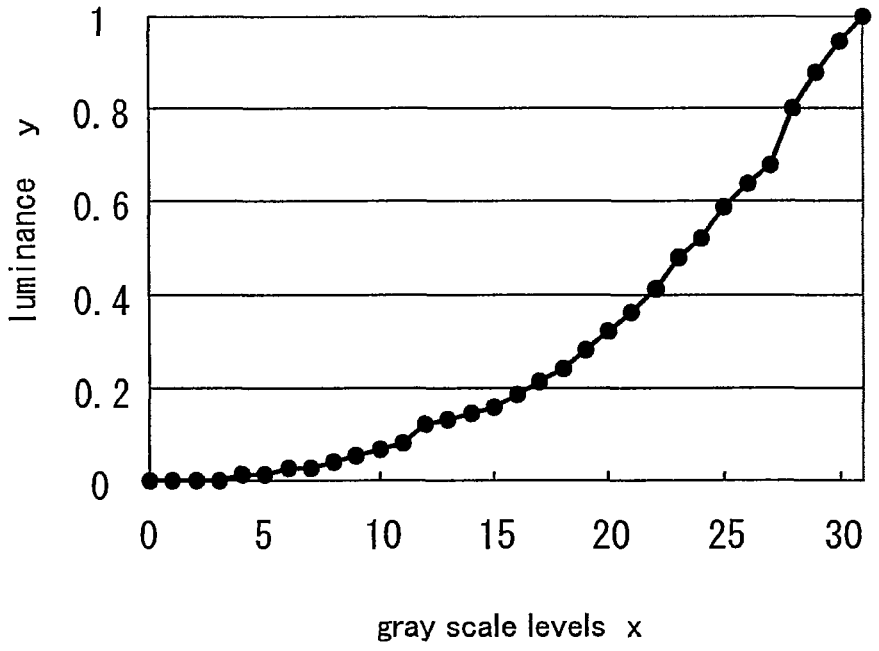
FIG. 54 is a graph showing a relation between the gray scale level and the luminance in the case of performing gamma correction according to a driving method of the invention.

It is to be noted that gamma correction may be performed by lengthening a lighting period of each subframe. For example, FIG. 53 shows a selection method of subframes in the case where a gamma correction is performed by lengthening a lighting period of a subframe to which an overlapped time gray scale method is applied. In FIG. 53, a lighting period is increased by two in SF4 to SF6 and SF10 to SF12 to which the overlapped time gray scale method is applied. FIG. 54 is a graph of the gray scale level x and the luminance y at this case. A gamma correction may be performed by such a method as well. Note that the luminance may be changed linearly or nonlinearly at a region of lower gray scale levels.

It is to be noted that a correspondence table between a gray scale level with 5 bits gamma-corrected and a gray scale level with 6 bits, can be arbitrarily changed. Therefore, by changing the correspondence table, the degree of gamma correction (namely, a value of $\gamma$) can be easily changed. Thus, the invention is not limited to $\gamma=2.2$.

In addition, how many bits (for example, p bits, p is an integer here) to be displayed are set, and with how many bits (for example, q bits, q is an integer here) gamma-corrected display is performed are not limited to the above. In the case where display is performed after a gamma correction has been performed, it is preferable that the number p of bits be as large as possible in order to smoothly express gradation. However, if the number of bits is too large, there is also an adverse effect such that the number of subframes becomes large. Therefore, a relation between the number q of bits and the number p of bits preferably satisfies $q+2 \leq p \leq q+5$. According to this, it can be achieved that the number of subframes is not increased too much while gradation is smoothly expressed.

Hereinabove, described is a method of expressing gradation, that is, a selection method of subframes. Next, an appearance order of subframes is described. Although the case of a 5-bit display (FIG. 1) is used here as an example, the invention is not limited to this and can be applied similarly to another drawing.

First, the most basic one frame is structured by SF1, SF2, SF3, SF4, SF5, SF6, SF7, SF8, SF9 and SF10 in this order. According to this arrangement of subframes, in each subframe group, a subframe of which lighting period is the shortest is arranged first, subframes to which an overlapped time gray scale method is not applied are arranged in order of increasing lighting period, and then subframes to which the overlapped time gray scale method is applied are arranged in order of lighting. FIG. 1 corresponds to this appearance order of subframes.

On the contrary, one frame may be structured by SF10, SF9, SF8, SF7, SF6, SF5, SF4, SF3, SF2 and SF1 in this order as well. According to this arrangement of subframes, a subframe of which a lighting period is the longest is arranged first, subframes to which an overlapped time gray scale method is applied are arranged in reverse order of lighting, and then subframes to which the overlapped time gray scale method is not applied are arranged in order of decreasing lighting period.

It is to be noted that the subframes to which the overlapped time gray scale method is applied may be arranged in order of lighting (for example, an order of SF3, SF4, and SF5 and an order of SF8, SF9, and SF10) or in reverse order thereof (for example, an order of SF5, SF4, and SF3 and an order of SF10, SF9, and SF8). Alternatively, the subframes may be lighted gradually from the middle subframe (for example, an order of SF4, SF3, and SF5 and an order of SF9, SF8, and SF10).

Figure 19A:
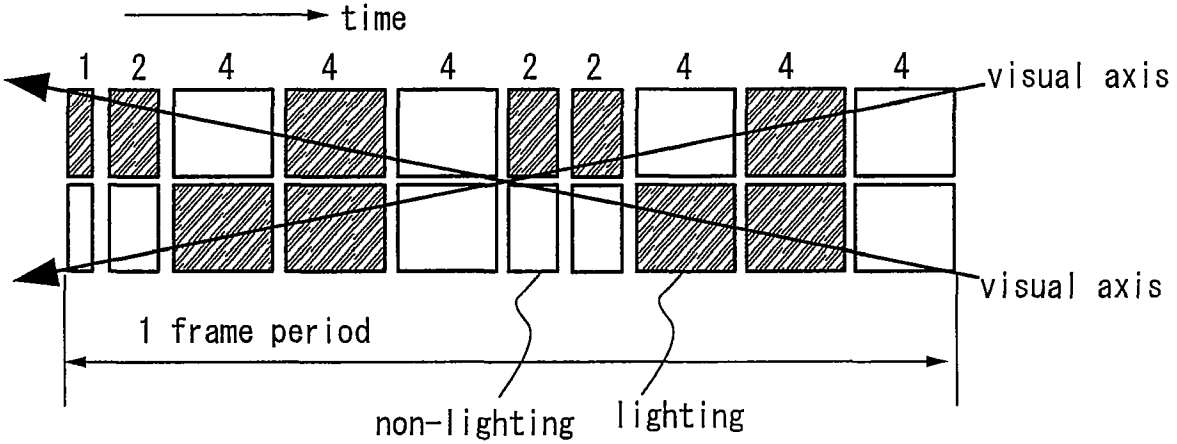
FIGS. 19A and 19B are diagrams showing a reason to reduce a pseudo contour in a driving method of the invention.
Figure 19B:
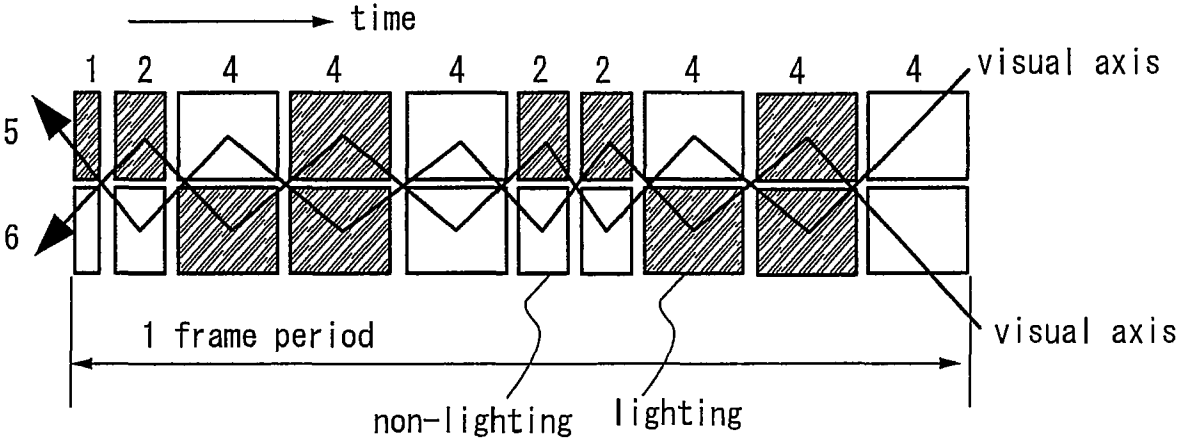

For example, FIGS. 19A and 19B show the case where subframes are arranged in an order of SF1, SF2, SF4, SF3, SF5, SF6, SF7, SF9, SF8, and SF10 in the case of a 5-bit display. It is assumed here that a gray scale level of 15 is expressed in a pixel A while a gray scale level of 16 is expressed in a pixel B. Here, if a visual axis is moved, eyes sense that the gray scale level is 15 (=4+4+4+2+1) or 16 (=4+2+2+4+4) sometimes, in accordance with a trace of the visual axis. FIG. 19A shows this case. Since it should be seen that the gray scale levels are 15 and 16 normally, they are seen accurately so that a pseudo contour is reduced.

Next, FIG. 19B shows a case of moving the visual axis drastically. If the visual axis is moved drastically, eyes sense that the gray scale level is 15 (=4+4+2+4+1) or 16 (=4+2+4+4+2) sometimes, in accordance with a trace of the visual axis. Since it should be seen that the gray scale levels are 15 and 16 normally, they are seen accurately so that a pseudo contour is reduced.

As described above, a pseudo contour can be reduced by arranging subframes to which an overlapped time gray scale method is applied so as to light gradually from the middle subframe. In addition, a pseudo contour can be reduced from occurring at a timing of changing from the first frame to the second frame. That is, a moving image pseudo contour can be reduced.

Described next is a case where a subframe corresponding to a bit belonging to the second bit group or the third bit group is interposed between subframes corresponding to bits belonging to the first bit group. For example, there is an order of SF1, SF3, SF4, SF2, SF5, SF6, SF8, SF9, SF7, and SF10 in which SF2 corresponding to a bit belonging to the second bit group is interposed between SF4 and SF5 corresponding to bits belonging to the first bit group, and SF7 corresponding to a bit belonging to the second bit group is interposed between SF9 and SF10 corresponding to bits belonging to the first bit group. Note that a position for interposing the subframe corresponding to a bit belonging to the second bit group or the third bit group is not limited to this. In addition, the number of subframes to be interposed is not limited to this.

It is to be noted that by interposing a subframe corresponding to a bit belonging to the second bit group or the third bit group between subframes corresponding to bits belonging to the first bit group, human eyes can be tricked so that a pseudo contour seems to be reduced.

Note that in the case where a subframe corresponding to a bit belonging to the second bit group or the third bit group is interposed between subframes corresponding to bits belonging to the first bit group, a pseudo contour can be further reduced by interposing a subframe of which a lighting period is the most nearest to a lighting period of the subframe corresponding to the bit belonging to the first bit group. For example, by interposing the subframes of which lighting periods are the most nearest to that of the bit belonging to the first bit group (the total lighting period is 8: SF3 and SF8), between the subframes corresponding to the bits belonging to the first bit group (the total lighting period is 16: SF4, SF5, SF9, and SF10) in the most basic structure of SF1, SF2, SF3, SF4, SF5, SF6, SF7, SF8, SF9, and SF10, a pseudo contour can be reduced as shown in FIGS. 19A and 19B.

Described next is a case where one of subframes corresponding to bits belonging to the first bit group and one of subframes corresponding to bits belonging to the second bit group or the third bit group are changed for each other. For example, there is an order of SF1, SF4, SF3, SF2, SF5, SF6, SF9, SF8, SF7, and SF10 in which SF4 corresponding to a bit belonging to the first bit group and SF2 corresponding to a bit belonging to the second bit group, and SF9 corresponding to a bit belonging to the first bit group and SF7 corresponding to a bit belonging to the second bit group are changed for each other respectively. Note that a position for changing a subframe is not limited to this. In addition, the number of subframes to be changed is not limited to this.

In this manner, by changing an order of a subframe corresponding to a bit belonging to the first bit group and an order of a subframe corresponding to a bit belonging to the second bit group or the third bit group for each other, human eyes can be tricked so that a pseudo contour seems to be reduced.

Figure 20A:
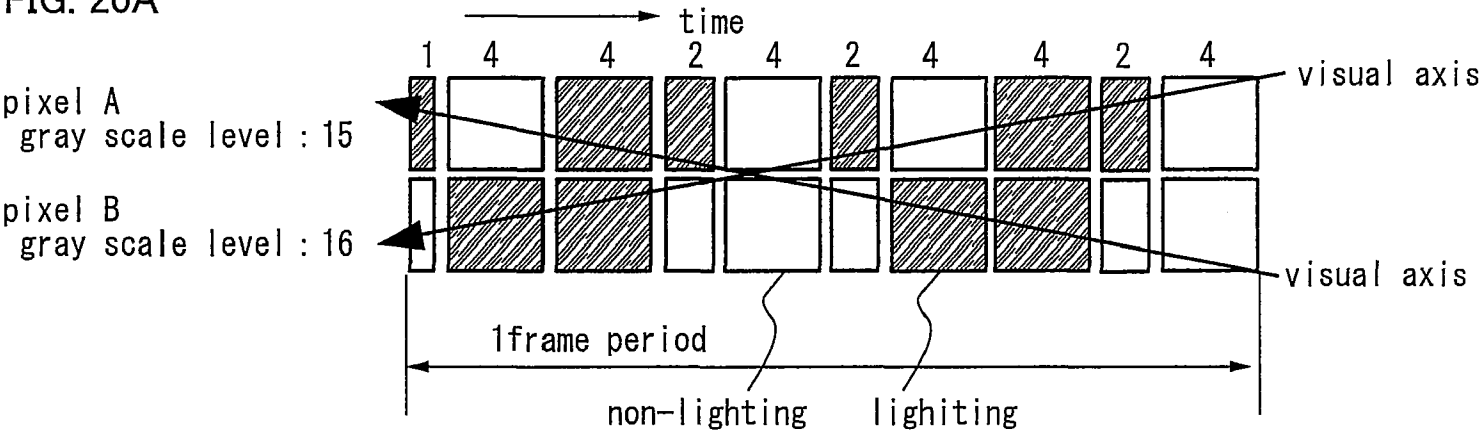
FIGS. 20A and 20B are diagrams showing a reason to reduce a pseudo contour in a driving method of the invention.
Figure 20B:
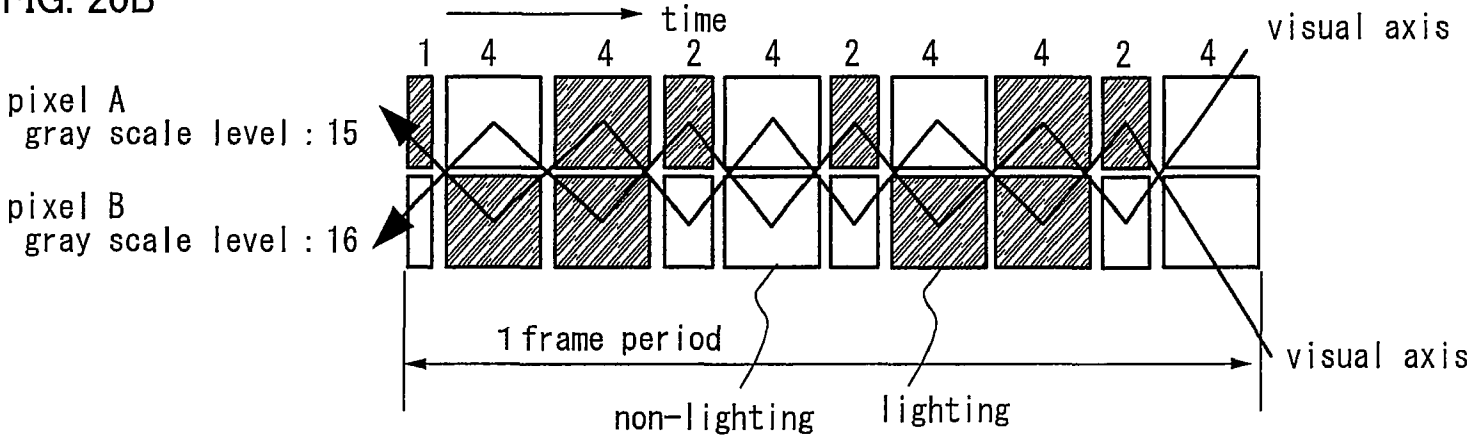

Here, FIGS. 20A and 20B show the case where subframes are arranged in an order of SF1, SF4, SF3, SF2, SF5, SF6, SF9, SF8, SF7, and SF10 in the case of a 5-bit display. It is assumed here that a gray scale level of 15 is expressed in a pixel A while a gray scale level of 16 is expressed in a pixel B. Here, if a visual axis is moved, eyes sense that the gray scale level is 15 (=4+4+2+4+1) or 16 (=2+4+2+4+4) sometimes, in accordance with a trace of the visual axis. FIG. 20A shows this case. Since it should be seen that the gray scale levels are 15 and 16 normally, they are seen accurately so that a pseudo contour is reduced.

Next, FIG. 20B shows a case of moving the visual axis drastically. If the visual axis is moved drastically, eyes sense that the gray scale level is 15 (=2+4+4+4+1) or 16 (=4+4+2+2+4) sometimes, in accordance with a trace of the visual axis. Since it should be seen that the gray scale levels are 15 and 16 normally, they are seen accurately so that a pseudo contour is reduced.

In this manner, in the case where a subframe corresponding to a bit belonging to the second bit group or the third bit group is interposed between subframes corresponding to bits belonging to the first bit group, or in the case where a subframe corresponding to a bit belonging to the first bit group is changed for a subframe corresponding to a bit belonging to the second bit group or the third bit group, an order of subframes corresponding to bits belonging to the first bit group may be determined first and a subframe corresponding to a bit belonging to the second bit group or the third bit group may be interposed therebetween so that an appearance order of all subframes is determined.

At this case, in each subframe group, the subframes corresponding to the bits belonging to the second bit group or the third bit group may be arranged in order of increasing lighting period or in reverse order thereof. Alternatively, the subframes may be arranged so as to light gradually from the middle subframe. Further alternatively, they may be arranged in entirely random order. As a result, human eyes can be tricked so that a pseudo contour seems to be reduced.

Note that, in the case of interposing a subframe corresponding to a bit belonging to the second bit group or the third bit group between subframes corresponding to bits belonging to the first bit group, the number of subframes to be interposed is not limited.

In addition, an order of subframes corresponding to bits belonging to the second bit group or the third bit group may be determined first and subframes corresponding to bits belonging to the first bit group may be interposed therebetween, so that an appearance order of subframes is determined.

In this manner, by interposing a subframe corresponding to a bit belonging to the second bit group or the third bit group between subframes corresponding to bits belonging to the first bit group, the subframes can be prevented from being eccentrically-arranged. Accordingly, human eyes are tricked so that a pseudo contour can be reduced.

As an example, FIG. 21 shows a pattern example of an appearance order of subframes in the case of FIG. 1.

As a first pattern, there is an order of SF1, SF2, SF3, SF4, SF5, SF6, SF7, SF8, SF9, and SF10. According to this arrangement of subframes, in each subframe group, a subframe of which a lighting period is the shortest is arranged first, subframes to which an overlapped time gray scale method is not applied are arranged in order of increasing lighting period, and then subframes to which the overlapped time gray scale method is applied are arranged in order of lighting.

As a second pattern, there is an order of SF10, SF9, SF8, SF7, SF6, SF5, SF4, SF3, SF2, and SF1. According to this arrangement of subframes, a subframe of which a lighting period is the longest is arranged first, subframes to which an overlapped time gray scale method is applied are arranged in reverse order of lighting, and then subframes to which the overlapped time gray scale method is not applied are arranged in order of decreasing light emitting period.

As a third pattern, there is an order of SF1, SF2, SF5, SF4, SF3, SF6, SF7, SF10, SF9, and SF8. According to this arrangement of subframes, with respect to the first pattern, the subframes of SF3, SF4, and SF5 and the subframes of SF8, SF9, and SF10 to which the overlapped time gray scale method is applied are arranged in reverse order of lighting.

As a fourth pattern, there is an order of SF1, SF2, SF4, SF3, SF5, SF6, SF7, SF9, SF8, and SF10. According to this arrangement of subframes, with respect to the first pattern, the subframes of SF3, SF4, and SF5 and the subframes of SF8, SF9, and SF10 to which the overlapped time gray scale method is applied are arranged so as to light gradually from the middle subframe respectively.

As a fifth pattern, there is an order of SF6, SF7, SF8, SF9, SF10, SF1, SF2, SF3, SF4, and SF5. According to this arrangement of subframes, with respect to the first pattern, the subframes in the former subframe group and the subframes in the latter subframe group are changed from each other.

As a sixth pattern, there is an order of SF1, SF3, SF4, SF2, SF5, SF6, SF8, SF9, SF7, and SF10. According to this arrangement of subframes, with respect to the first pattern, one of the subframes corresponding to the bits belonging to the second bit group is interposed between subframes corresponding to bits belonging to the first bit group.

As a seventh pattern, there is an order of SF2, SF3, SF4, SF1, SF5, SF7, SF8, SF9, SF6, and SF10. According to this arrangement of subframes, with respect to the first pattern, a subframe corresponding to a bit belonging to the third bit group is interposed between subframes corresponding to bits belonging to the first bit group.

As an eighth pattern, there is an order of SF1, SF4, SF3, SF2, SF5, SF6, SF9, SF8, SF7, and SF10. According to this arrangement of subframes, with respect to the first pattern, one of the subframes corresponding to the bits belonging to the first bit group and one of the subframes corresponding to the bits belonging to the second bit group are changed from each other.

As a ninth pattern, there is an order of SF4, SF2, SF3, SF1, SF5, SF9, SF7, SF8, SF6, and SF10. According to this arrangement of subframes, with respect to the first pattern, one of the subframes corresponding to the bits belonging to the first bit group and one of the subframes corresponding to the bits belonging to the third bit group are changed from each other.

As a tenth pattern, there is an order of SF2, SF3, SF1, SF4, SF5, SF7, SF8, SF6, SF9, and SF10. According to this arrangement of subframes, with respect to the first pattern, a subframe corresponding to a bit belonging to the third bit group is interposed between subframes corresponding to bits belonging to the first bit group and subframes corresponding to bits belonging to the second bit group.

As an eleventh pattern, there is an order of SF2, SF4, SF3, SF5, SF1, SF7, SF9, SF8, SF10, and SF6. According to this arrangement of subframes, the subframes corresponding to the bits belonging to the first bit group, the second bit group, and the third bit group are arranged in random order.

As described as an example of the above-described patterns, preferably, in at least one of a plurality of subframe groups, all the subframes corresponding to bits belonging to the first bit group may light and then, all the subframes corresponding to bits belonging to the second bit group or the third bit group may light.

In addition, preferably, in at least one of a plurality of subframe groups, all the subframes corresponding to bits belonging to the second bit group or the third bit group may light and then, all the subframes corresponding to bits belonging to the first bit group may light.

In addition, preferably, in at least one of a plurality of subframe groups, one of a plurality of subframes corresponding to bits belonging to the first bit group may light, at least one of a plurality of subframes corresponding to bits belonging to the second bit group or the third bit group may light, and then another of the plurality of subframes corresponding to the bits belonging to the first bit group may light.

In addition, preferably, in each subframe group, one of a plurality of subframes corresponding to bits belonging to the second bit group or the third bit group may light, then at least one of a plurality of subframes corresponding to bits belonging to the first bit group may light, and then another of the plurality of subframes corresponding to the bits belonging to the second bit group or the third bit group may light.

It is to be noted that the appearance order of subframes may be changed depending on time. For example, the appearance order of subframes may be changed between a first frame and a second frame. Further, the appearance order of subframes may be changed depending on place as well. For example, the appearance order of subframes may be changed between a pixel A and a pixel B. Further alternatively, the appearance order of subframes may be changed depending on both of time and place.

Embodiment Mode 2

Described in Embodiment Mode 1 is the case where one frame is divided into two subframe groups. However, according to the driving method of the invention, one frame can also be divided into three or more subframe groups. In this embodiment mode, therefore, description is made on the case where one frame is divided into three or more subframe groups, as an example. Note that the number of subframe groups is not limited to 2 or 3, and may be arbitrarily determined.

According to an example of a driving method of this embodiment mode, according to a conventional time gray scale method, subframes corresponding to bits belonging to a first bit group are divided into 6, subframes corresponding to bits belonging to a second bit group are divided into 3, and subframes corresponding to bits belonging to a third bit group are not divided, first. Then, one frame is divided into three subframe groups, and each two of the divided bits belonging to the first bit group are arranged in each subframe group. One of the divided bits belonging to the second bit group is arranged in each subframe group, and the bits belonging to the third bit group are arranged in at least one of the three subframe groups. At this time, an appearance order of subframes corresponding to bits belonging to the first bit group and subframes corresponding to bits belonging to the second bit group is approximately the same among the subframe groups. Note that the bits belonging to the third bit group can be considered that they are not divided or they are divided into three once and then integrated into one subframe. Note that an overlapped time gray scale method is applied to subframes of which lighting periods are equal in each subframe group, among the subframes corresponding to the bits belonging to the first bit group and the second bit group.

For example, an embodiment in the case of a 5-bit display is shown in FIG. 22. In FIG. 22, according to the conventional time gray scale method (FIG. 43), assuming that one bit is assigned to a first bit group, two bits are assigned to a second bit group, and two bits are assigned to a third bit group, SF5 is assigned to the bit belonging to the first bit group, SF3 and SF4 are assigned to the bits belonging to the second bit group, and SF1 and SF2 are assigned to the bits belonging to the third bit group. Then, SF5 is divided equally into 6, SF3 and SF4 are divided equally into 3 respectively, and SF1 and SF2 are not divided. Next, each two of the six divided bits belonging to the first bit group are arranged in each subframe group, one of the three divided bits belonging to the second bit group is arranged in each subframe group, and the bits belonging to the third bit group are arranged in at least one of the three subframe groups. That is, the bits belonging to the first bit group are arranged in SF4, SF5, SF9, SF10, SF13, and SF14 in FIG. 22, the bits belonging to the second bit group are arranged in SF2, SF3, SF7, SF8, SF11, and SF12 in FIG. 22, and the bits belonging to the third bit group are arranged in SF1 and SF6 in FIG. 22. As a result, the number of subframes becomes 14 and respective lengths of lighting periods of the subframes are such that SF1=1, SF2=4/3, SF3=8/3, SF4=8/3, SF5=8/3, SF6=2, SF7=4/3, SF8=8/3, SF9=8/3, SF10=8/3, SF11=4/3, SF12=8/3, SF13=8/3, and SF14=8/3. Since the respective lengths of the lighting periods of SF3 to SF5, SF8 to SF10, and SF12 to SF14 are all 8/3 here, an overlapped time gray scale method is applied to SF3 to SF5, SF8 to SF10, and SF12 to SF14.

By dividing each subframe in this manner, the frame frequency can be more than tripled substantially.

Note that although the length (or the number of lightings within a time, namely, the quantity of weight) of a lighting period of each subframe is not limited to this. In addition, correspondence between the subframe number and the length of a lighting period is not limited to this. In addition, the selection method of subframes is not limited to this.

It is to be noted that although the subframes corresponding to the bits belonging to the third bit group are not divided in this embodiment mode, they may be divided into the number smaller than the number of subframe groups as well.

For example, an example in which SF1 and SF6 assigned to the bits belonging to the third bit group are further divided into two respectively in the case of FIG. 22 is shown in FIG. 23. In FIG. 23, SF1 and SF6 are further divided into two respectively in FIG. 22 and arranged in SF1, SF6, SF11, and SF12 in FIG. 23. As a result, the number of subframes becomes 16 and respective lengths of lighting periods of the subframes are such that SF1=0.5, SF2=4/3, SF3=8/3, SF4=8/3, SF5=8/3, SF6=1, SF7=4/3, SF8=8/3, SF9=8/3, SF10=8/3, SF11=0.5, SF12=1, SF13=4/3, SF14=8/3, SF15=8/3, and SF16=8/3. Since the respective lengths of the lighting periods of SF3 to SF5, SF8 to SF10, and SF14 to SF16 are all 8/3 here, an overlapped time gray scale method is applied to SF3 to SF5, SF8 to SF10, and SF14 to SF16. Note that a subframe group in which the divided bits belonging to the third bit group are arranged is not limited to this.

It is to be noted that in this embodiment mode, the number of bits to be assigned to each bit group is not limited to the examples described hereinabove. However, preferably, at least one bit may be assigned to each of the first bit group and the second bit group.

It is to be noted that although the highest-order bit is selected as the bit belonging to the first bit group in this embodiment mode, the bit belonging to the first bit group is not limited to this and any bit may be selected as the bit belonging to the first bit group. Similarly, any bit may be selected as the bit belonging to the second bit group or the third bit group.

It is to be noted that although described in this embodiment mode is the example in which the subframe corresponding to the bit belonging to the first bit group is divided into 6, the division number of a subframe corresponding to the bit belonging to the first bit group is not limited to this. For example, the subframe corresponding to the bit belonging to the first bit group may be divided into 5 and arranged such that two subframes, two subframes, and one subframe are included in the three subframe groups respectively. Note that the subframe corresponding to the bit belonging to the first bit group is preferably divided into multiples of the number of subframe groups; that is, when the number of subframe groups is three, the subframe is preferably divided into (3×m) (here m is an integer satisfying m≥2). This is because the divided bits belonging to the first bit group can be arranged in the subframe groups evenly so that a flicker or a pseudo contour can be prevented. For example, a subframe corresponding to the bit belonging to the first bit group may be divided into 9. However, the invention is not limited to this.

It is to be noted that although all the subframes corresponding to the bits belonging to the first bit group are divided into 6 respectively with respect to the conventional time gray scale method in this embodiment mode, all the subframes corresponding to the bits belonging to the first bit group may be different in the number of division. The number of division may be different in the first bit group. Similarly to the bits belonging to the third bit group, all the subframes corresponding to the bits belonging to the third bit group may be different in the number of division.

It is to be noted that although the subframe corresponding to the bit belonging to the first bit group is divided equally into 6 and the subframe corresponding to the bit belonging to the second bit group is divided equally into 3 with respect to the conventional time gray scale method in this embodiment mode, the width of division of a subframe is not limited to this. The subframe is not necessarily equally divided. For example, in the case of a 5-bit display, a subframe (SF5) corresponding to the bit belonging to the first bit group according to the conventional time gray scale method (FIG. 43) may be divided into such that a lighting period (a length of 16) thereof is divided to be 2, 2, 4, 2, 3, and 3.

It is to be noted that an appearance order of subframes corresponding to bits belonging to the first bit group and belonging to the second bit group is the same among the three subframe groups in this embodiment mode. However, the invention is not limited to the case of exact match in the appearance order, and among the three subframe groups, an order of some of subframes may be different. For example, SF7 and SF8, and SF11 and SF12 may be changed for each other respectively in the case of FIG. 22, that is, there may be such arrangement that SF1, SF2, SF3, SF4, SF5, SF6, SF8, SF7, SF9, SF10, SF12, SF11, SF13, and SF14.

Note that the descriptions about the number of bits to be assigned to each bit group, a bit to be selected as a bit belonging to each bit group, the number of divisions of bits belonging to a first bit group and a third bit group respectively, the width of division of a subframe, and an appearance order of subframes, as described hereinabove may be used in combination.

Note that the descriptions about the number of bits to be assigned to each bit group, a bit to be selected as a bit belonging each bit group, the number of divisions of bits belonging to a first bit group and a third bit group respectively, the width of division of a subframe, and an appearance order of subframes, as described hereinabove can be applied also to the case where the number of subframe groups is 3 or more.

Considered is a case where one frame is divided into k (here k is an integer satisfying k≥3) subframe groups generally. In this case, according to the conventional time gray scale method, a subframe corresponding to a bit belonging to the first bit group is divided into (k+1) or more, a subframe corresponding to a bit belonging to the second bit group is divided into k, and a subframe corresponding to a bit belonging to the third bit group is divided into (k−1) or less or not divided. Then, the divided bits belonging to the first bit group are arranged in the k subframe groups so as to be included about the same number; each one of the divided bits belonging to the second bit group is arranged in each of the k subframe groups; and each of the bits belonging to the third bit group is arranged in at least one of the k subframe groups. At this time, an appearance order of subframes corresponding to bits belonging to the first bit group and subframes corresponding to bits belonging to the second bit group is approximately the same among the k subframe groups.

At this case, in the case where gradation is expressed with n bits (here n is an integer), the total subframe number is n according to the conventional time gray scale method. In addition, the length of a lighting period of a subframe corresponding to the highest-order bit is $2^{n-1}$. On the other hand, with respect to the conventional time gray scale method, assuming that the number of bits to be divided into $L_1$ (here $L_1$ is an integer satisfying $L_1 \geq k+1$) belonging to the first bit group is a (here a is an integer satisfying $0<a<n$), the number of bits to be divided into k belonging to the second bit group is b (here b is an integer satisfying $0<b<n$), and the number of bits to be divided into $L_2$ (here $L_2$ is an integer satisfying $1<L_2 \leq k-1$) or not divided (that is, which corresponds to $L_2=1$) belonging to the third bit group is c (here c is an integer satisfying $0 \leq c<n$ and $a+b+c=n$), the total number of subframes according to the driving method of the invention is $(L_1 \times a+k \times b+L_2 \times c)$. In addition, in the case where the highest-order bit is selected as the bit belonging to the first bit group and a subframe corresponding to this bit is equally divided into $L_1$, the length of a lighting period of each divided subframe corresponding to this bit is $(2^{n1}/L_1)$. For example, in the case of FIG. 22 where k=3, n=5, $L_1=6$, $L_2$-1, a=1, b=2, and c=2, the total number of subframes is 14 (=6×1+3×2+1×2), and the length of a lighting period of each divided subframe corresponding to the bit belonging to the first bit group is 8/3 ($=2^{5-1}/6$).

It is to be noted that description is made in this embodiment mode in which the description made in Embodiment Mode 1 is extended in point of the number of subframe groups. Therefore, this embodiment mode can be freely combined with Embodiment Mode 1.

Embodiment Mode 3

In this embodiment mode, description is made on an example of a timing chart. Although the selection method of subframes in FIG. 1 is used as an example of a selection method subframes, the invention is not limited to this. The invention can easily be applied to another selection method of subframes, another number of gray scale levels, and the like.

In addition, although an appearance order of subframes is an order of SF1, SF2, SF3, SF4, SF5, SF6, SF7, SF8, FS9, and SF10 as an example, the invention is not limited to this and can be applied to another order as well.

Figure 24:
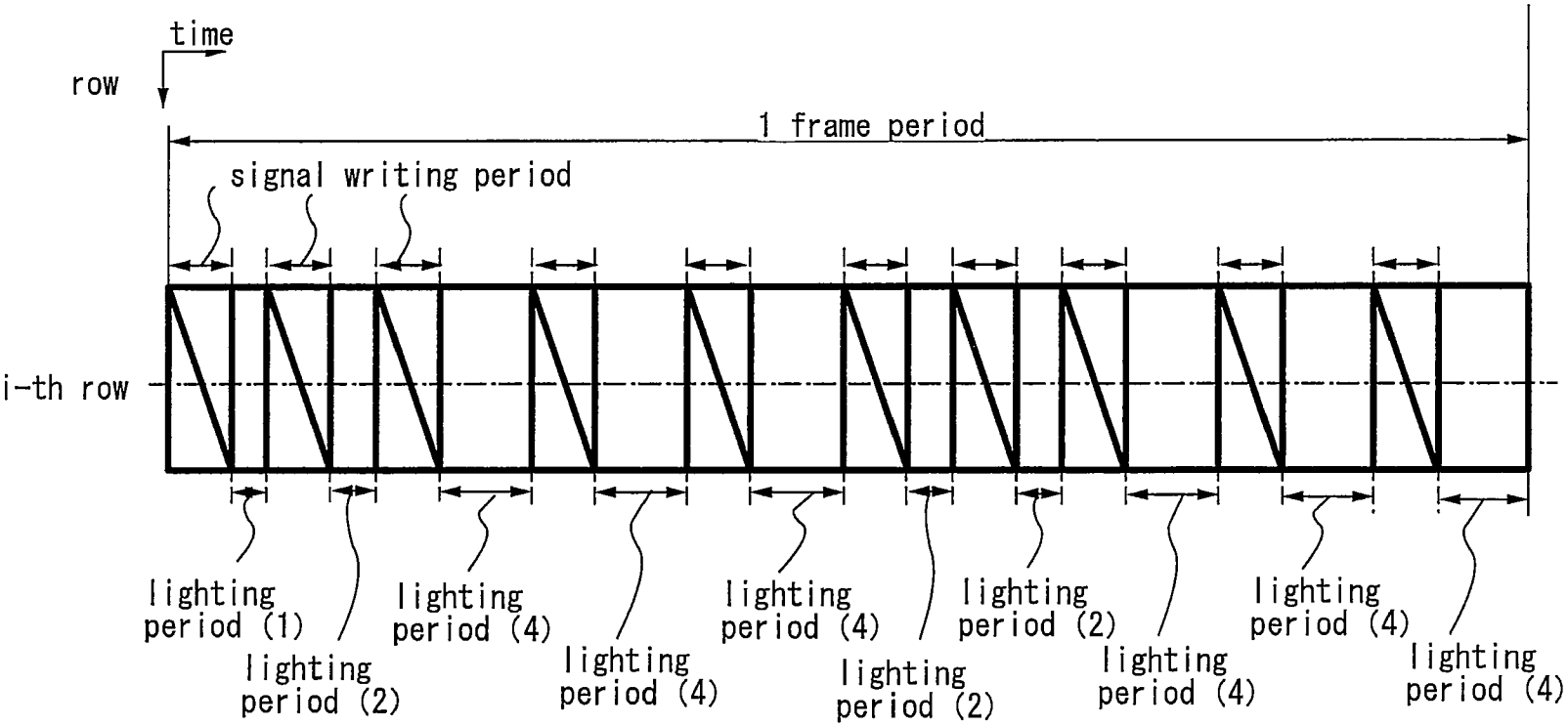
FIG. 24 is a diagram showing an example of a timing chart in the case where a signal writing period and a lighting period of a pixel are separated from each other.

First, FIG. 24 shows a timing chart in the case where a period of writing a signal to a pixel and a period of lighting are separated. At first, signals for one screen are input to all pixels in a signal writing period. During this period, the pixels do not emit light. After the signal writing period, a lighting period begins and a pixel emits light. The length of the lighting period at this time is 1. Next, a subsequent subframe begins and signals for one screen are input to all pixels in a signal writing period. During this period, the pixels do not emit light. After the signal writing period, a lighting period starts and a pixel emits light. The length of the lighting period at this time is 2.

By repeating the above operations, the lengths of the lighting periods are arranged in an order of 1, 2, 4, 4, 4, 2, 2, 4, 4, and 4.

A driving method in which a period of writing a signal to a pixel and a period of lighting are separated as described above is preferably applied to a plasma display. Note that, in the case where the driving method is used for a plasma display, an operation for initialization and the like is required; however, which is omitted in FIG. 24 for simplicity.

Further, this driving method is also preferably applied to an EL display (an organic EL display, an inorganic EL display, a display including an element containing both an organic material and an inorganic material, or the like), a field emission display, a display using a digital micromirror device (DMD), or the like.

Figure 25:
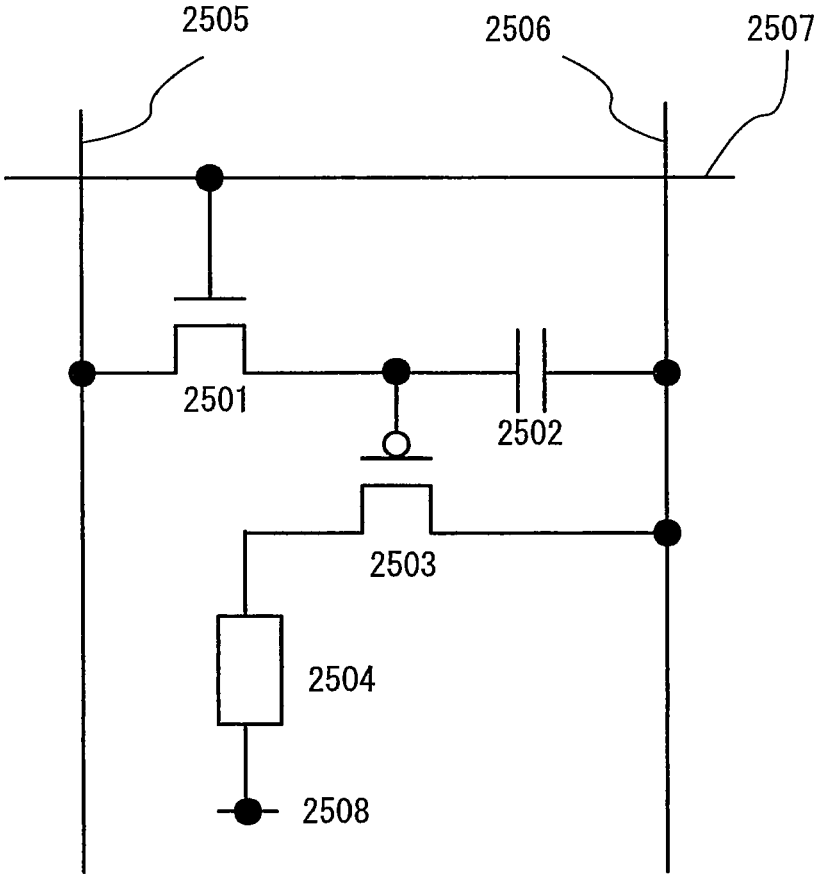
FIG. 25 is a diagram showing an example of a pixel configuration in the case where a signal writing period and a lighting period of a pixel are separated from each other.

FIG. 25 shows a pixel configuration in that case. A pixel shown in FIG. 25 includes a first transistor 2501, a second transistor 2503, a storage capacitor 2502, a display element 2504, a signal line 2505, a scan line 2507, a first power supply line 2506, and a second power supply line 2508.

A gate electrode of the first transistor 2501 is connected to the scan line 2507, a first electrode thereof is connected to the signal line 2505, and a second electrode thereof is connected to a second electrode of the storage capacitor 2502 and a gate electrode of the second transistor 2503. A first electrode of the second transistor 2503 is connected to the first power supply line 2506, and a second electrode thereof is connected to a first electrode of the display element 2504. A first electrode of the storage capacitor 2502 is connected to the first power supply line 2506. A second electrode of the display element 2504 is connected to the second power supply line 2508.

Note that the first transistor functions as a switch for connecting the signal line 2505 to the second electrode of the storage capacitor 2502 in order to input to the storage capacitor 2502 a signal which is input from the signal line 2505.

Note that the second transistor has a function to supply current to the display element 2504.

An operation of the pixel configuration shown in FIG. 25 is described next. First, in a signal writing period, a potential of the scan line 2507 is made higher than the highest potential of the signal line 2505 or a potential of the first power supply line 2506 to select the scan line 2507, so that the first transistor 2501 is turned on and a signal is input from the signal line 2505 to the storage capacitor 2502.

Note that in the signal writing period, respective potentials of the first power supply line 2506 and the second power supply line 2508 are controlled so as not to apply voltage to the display element 2504. For example, the second power supply line 2508 may be set in a floating state. Alternatively, the potential of the second power supply line 2508 may be made equal to or higher than the potential of the first power supply line 2506. Accordingly, the display element 2504 can be prevented from lighting in the signal writing period.

Next, in a lighting period, respective potentials of the first power supply line 2506 and the second power supply line 2508 are controlled so as to apply a voltage to the display element 2504. For example, the potential of the second power supply line 2508 may be made lower than the potential of the first power supply line 2506. Accordingly, current of the second transistor 2503 is controlled in accordance with the signal which has been held in the storage capacitor 2502 in the signal writing period, so that a current flows from the first power supply line 2506 to the second power supply line 2508 through the display element 2504. Consequently, the display element 2504 is lighted.

Figure 26:
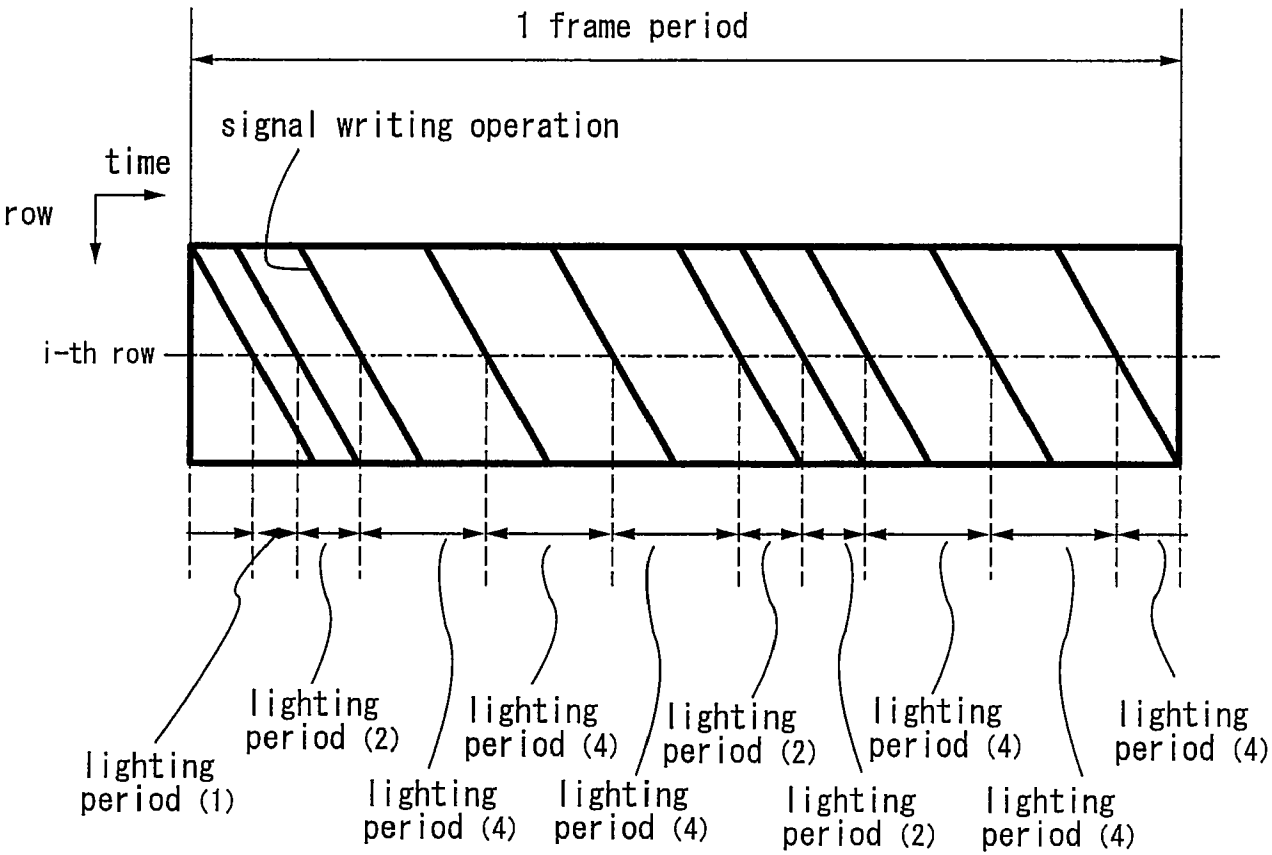
FIG. 26 is a diagram showing an example of a timing chart in the case where a signal writing period and a lighting period of a pixel are not separated from each other.

Next, FIG. 26 shows a timing chart in the case where a period of writing a signal to a pixel and a period of lighting are not separated. Right after a signal writing operation is performed to each row, a lighting period starts.

In a certain row, a signal is written and a predetermined lighting period finishes, and then a signal writing operation to a subsequent subframe starts. By repeating the abovementioned operation, the lengths of lighting periods are arranged in an order of 1, 2, 4, 4, 4, 2, 2, 4, 4, and 4.

According to this, many subframes can be arranged in one frame even if the signal writing operation is slow.

Such a driving method is preferably applied to a plasma display. Note that, in the case where the driving method is used for a plasma display, an operation for initialization or the like is required, however, which is omitted in FIG. 26 for simplicity.

Further, this driving method is also preferably applied to an EL display, a field emission display, a display using a digital micromirror device (DMD), or the like.

Figure 27:
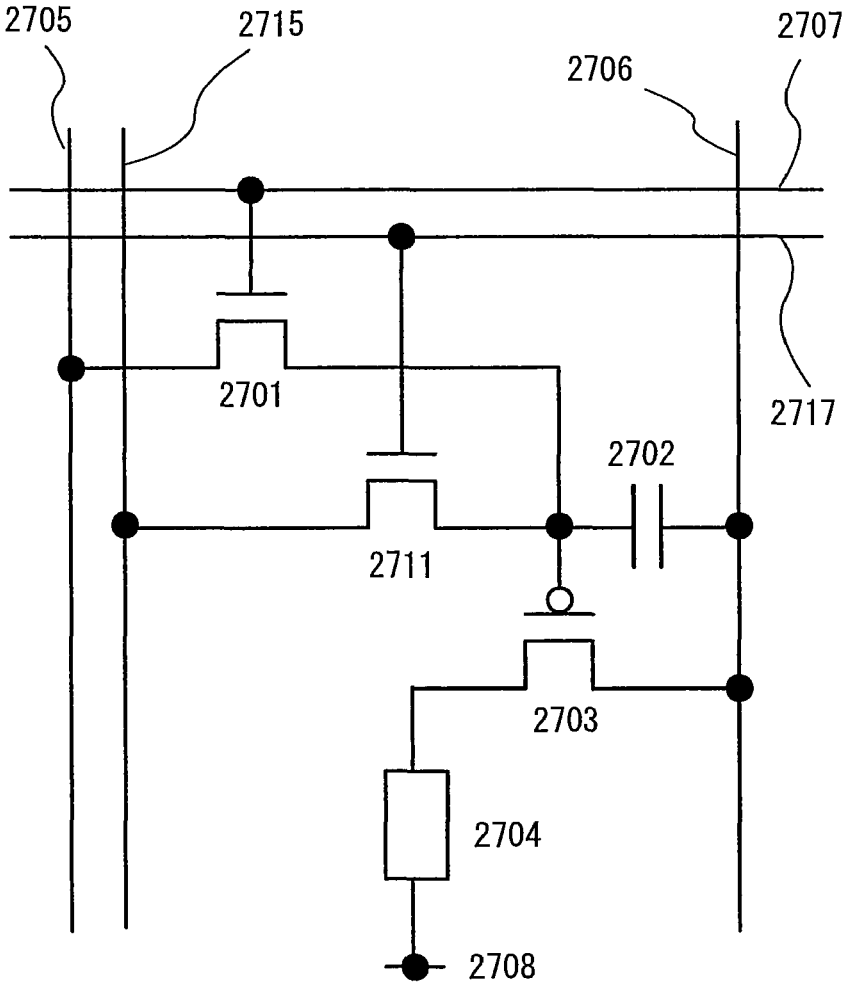
FIG. 27 is a diagram showing an example of a pixel configuration in the case where a signal writing period and a lighting period of a pixel are not separated from each other.

FIG. 27 shows a pixel configuration in that case. A pixel shown in FIG. 27 includes a first transistor 2701, a second transistor 2711, a third transistor 2703, a storage capacitor 2702, a display element 2704, a first signal line 2705, a second signal line 2715, a first scan line 2707, a second scan line 2717, a first power supply line 2706, and a second power supply line 2708.

A gate electrode of the first transistor 2701 is connected to the first scan line 2707, a first electrode thereof is connected to the first signal line 2705, and a second electrode thereof is connected to a second electrode of the storage capacitor 2702, a second electrode of the second transistor 2711, and a gate electrode of the third transistor 2703. A gate electrode of the second transistor 2711 is connected to the second scan line 2717, and a first electrode thereof is connected to the second signal line 2715. A first electrode of the third transistor 2703 is connected to the first power supply line 2706, and a second electrode thereof is connected to a first electrode of the display element 2704. A first electrode of the storage capacitor 2702 is connected to the first power supply line 2706. A second electrode of the display element 2704 is connected to the second power supply line 2708.

Note that the first transistor functions, in order to input to the storage capacitor 2702 a signal which is input from the first signal line 2705, as a switch for connecting the first signal line 2705 to the second electrode of the storage capacitor 2702.

Note that the second transistor functions, in order to input to the storage capacitor 2702 a signal which is input from the second signal line 2715, as a switch for connecting the second signal line 2715 to the second electrode of the storage capacitor 2702.

Note that the third transistor has a function to supply current to the display element 2704.

An operation of the pixel configuration shown in FIG. 27 is described next. First, a first signal writing operation starts. A potential of the first scan line 2707 is made higher than the highest potential of the first signal line 2705 or a potential of the first power supply line 2706 to select the first scan line 2707, so that the first transistor 2701 is turned on and a signal is input from the first signal line 2705 to the storage capacitor 2702. Accordingly, current of the third transistor 2703 is controlled in accordance with the signal which has been held in the storage capacitor 2702, so that a current flows from the first power supply line 2706 to the second power supply line 2708 through the display element 2704. Consequently, the display element 2704 is lighted.

After a predetermined lighting period, a signal writing operation to a subsequent subframe (a second signal writing operation) starts. A potential of the second scan line 2717 is made higher than the highest potential of the second signal line 2715 or a potential of the first power supply line 2706 to select the second scan line 2717, so that the second transistor 2711 is turned on and a signal is input from the second signal line 2715 to the storage capacitor 2702. Accordingly, current of the third transistor 2703 is controlled in accordance with the signal which has been held in the storage capacitor 2702, so that a current flows from the first power supply line 2706 to the second power supply line 2708 through the display element 2704. Consequently, the display element 2704 is lighted.

The first scan line 2707 and the second scan line 2717 can be controlled separately. Similarly, the first signal line 2705 and the second signal line 2715 can be controlled separately. Therefore, signals can be input to pixels of two rows at the same time so that the driving method as shown in FIG. 26 can be realized.

Figure 28:
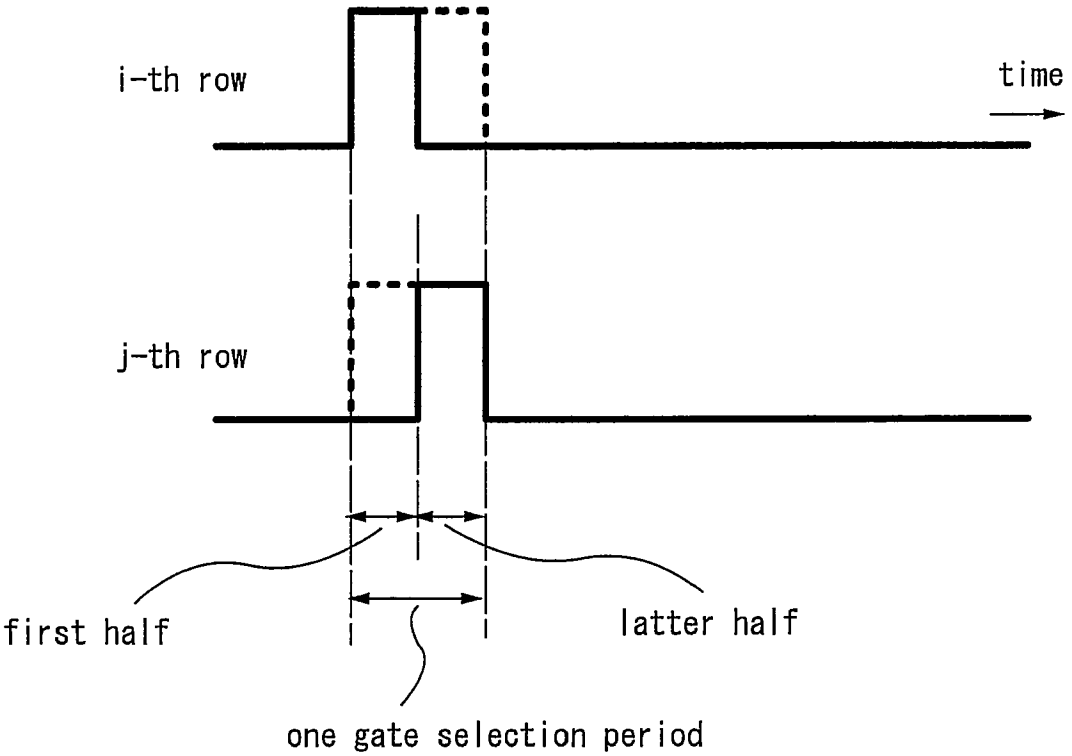
FIG. 28 is a diagram showing an example of a timing chart for selecting two rows within one gate selection period.

Note that the driving method as shown in FIG. 26 can also be realized by using the circuit of FIG. 25. A timing chart of this case is shown in FIG. 28. As shown in FIG. 28, one gate selection period is divided into a plurality of periods (two in FIG. 28). A potential of each scan line is made high in the divided selection period, to select each scan line so that a signal corresponding to the period is input to the first signal line 2705. For example, in a certain one gate selection period, an i-th row is selected in the first half of the period and a j-th row is selected in the latter half of the period. Accordingly, an operation can be performed as if two rows were selected at once in one gate selection period.

Note that details of the driving method are disclosed in Japanese Patent Laid-Open No. 2001-324958 and the like, of which content can be applied in combination with the invention.

Figure 29:
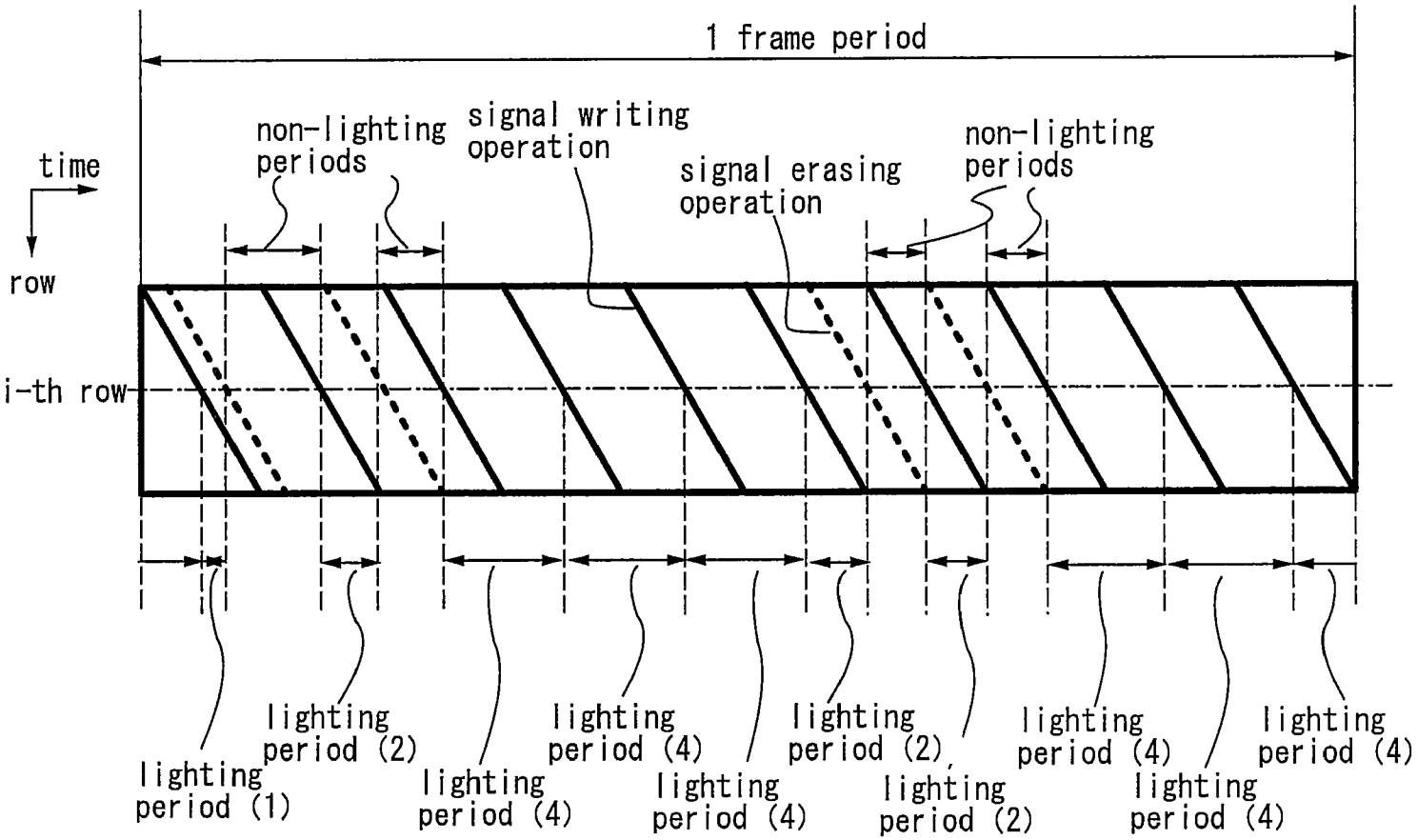
FIG. 29 is a diagram showing an example of a timing chart in the case where a signal erasing operation of a pixel is performed.

Next, FIG. 29 shows a timing chart in the case where an operation of erasing a signal of a pixel is performed. In each row, a signal writing operation is performed, and the signal of the pixel is erased before a subsequent signal writing operation starts. According to this, the length of a lighting period can easily be controlled.

In a certain row, after a signal is written and a predetermined lighting period finishes, a signal writing operation to a subsequent subframe starts. In the case where a lighting period is short, a signal erasing operation is performed so as to make a non-lighting state forcibly. By repeating the above-mentioned operation, the lengths of lighting periods are arranged in an order of 1, 2, 4, 4, 4, 2, 2, 4, 4, and 4.

Note that although a signal erasing operation is performed in the case where a lighting period is 1 or 2 in FIG. 29, the invention is not limited to this. The erasing operation may be performed in another lighting period as well.

According to this, many subframes can be arranged in one frame even if the signal writing operation is slow. Further, in the case where an erasing operation is performed, it is not necessary to take in data for erasing like a video signal, so that driving frequency of a signal line driver circuit can also be reduced.

Such a driving method is preferably applied to a plasma display. Note that, in the case where the driving method is used for a plasma display, an operation for initialization or the like is required, however, which is omitted in FIG. 29 for simplicity.

Further, this driving method is also preferably applied to an EL display, a field emission display, a display using a digital micromirror device (DMD), or the like.

Figure 30:
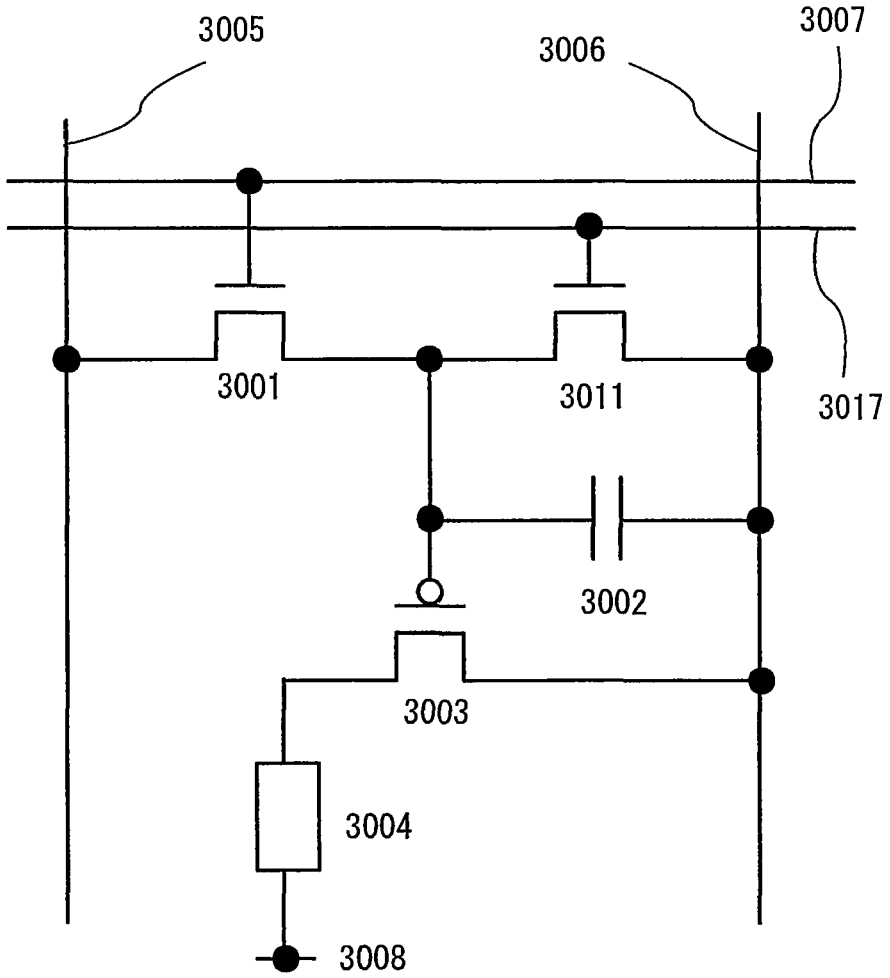
FIG. 30 is a diagram showing an example of a pixel configuration in the case where a signal erasing operation of a pixel is performed.

FIG. 30 shows a pixel configuration in that case. A pixel shown in FIG. 30 includes a first transistor 3001, a second transistor 3011, a third transistor 3003, a storage capacitor 3002, a display element 3004, a signal line 3005, a first scan line 3007, a second scan line 3017, a first power supply line 3006, and a second power supply line 3008.

A gate electrode of the first transistor 3001 is connected to the first scan line 3007, a first electrode thereof is connected to the signal line 3005, and a second electrode thereof is connected to a second electrode of the storage capacitor 3002, a second electrode of the second transistor 3011, and a gate electrode of the third transistor 3003. A gate electrode of the second transistor 3011 is connected to the second scan line 3017, and a first electrode thereof is connected to the first power supply line 3006. A first electrode of the third transistor 3003 is connected to the first power supply line 3006, and a second electrode thereof is connected to a first electrode of the display element 3004. A first electrode of the storage capacitor 3002 is connected to the first power supply line 3006. A second electrode of the display element 3004 is connected to the second power supply line 3008.

Note that the first transistor functions, in order to input to the storage capacitor 3002 a signal which is input from the signal line 3005, as a switch for connecting the signal line 3005 to the second electrode of the storage capacitor 3002.

Note that the second transistor functions, in order to turn off the third transistor, as a switch for connecting the gate electrode of the third transistor 3003 to the first power supply line 3006.

Note that the third transistor has a function to supply current to the display element 3004.

An operation of the pixel configuration shown in FIG. 30 is described next. First, when a signal is written to the pixel, a potential of the first scan line 3007 is made higher than the highest potential of the signal line 3005 or a potential of the first power supply line 3006 to select the first scan line 3007, so that the first transistor 3001 is turned on and a signal is input from the signal line 3005 to the storage capacitor 3002. Accordingly, current of the third transistor 3003 is controlled in accordance with the signal which has been held in the storage capacitor 3002, so that a current flows from the first power supply line 3006 to the second power supply line 3008 through the display element 3004. Consequently, the display element 3004 is lighted.

In the case where a signal is to be erased, a potential of the second scan line 3017 is made higher than the highest potential of the signal line 3005 or the potential of the first power supply line 3006 to select the second scan line 3017, so that the second transistor 3011 is turned on while the third transistor 3003 is turned off. Accordingly, a current is prevented from flowing from the first power supply line 3006 to the second power supply line 3008 through the display element 3004. Consequently, a non-lighting period can be provided so that the length of a lighting period can be freely controlled.

Although the second transistor 3011 is used to provide a non-lighting period in FIG. 30, another method can be used as well. In order to forcibly provide a non-lighting period, current is prevented from being supplied to the display element 3004. Therefore, a non-lighting period may be provided by arranging a switch somewhere in a path where current flows from the first power supply line 3006 to the second power supply line 3008 through the display element 3004 and controlling on/off of the switch. Alternatively, a gate-source voltage of the third transistor 3003 may be controlled to forcibly turn off the third transistor.

Figure 31:
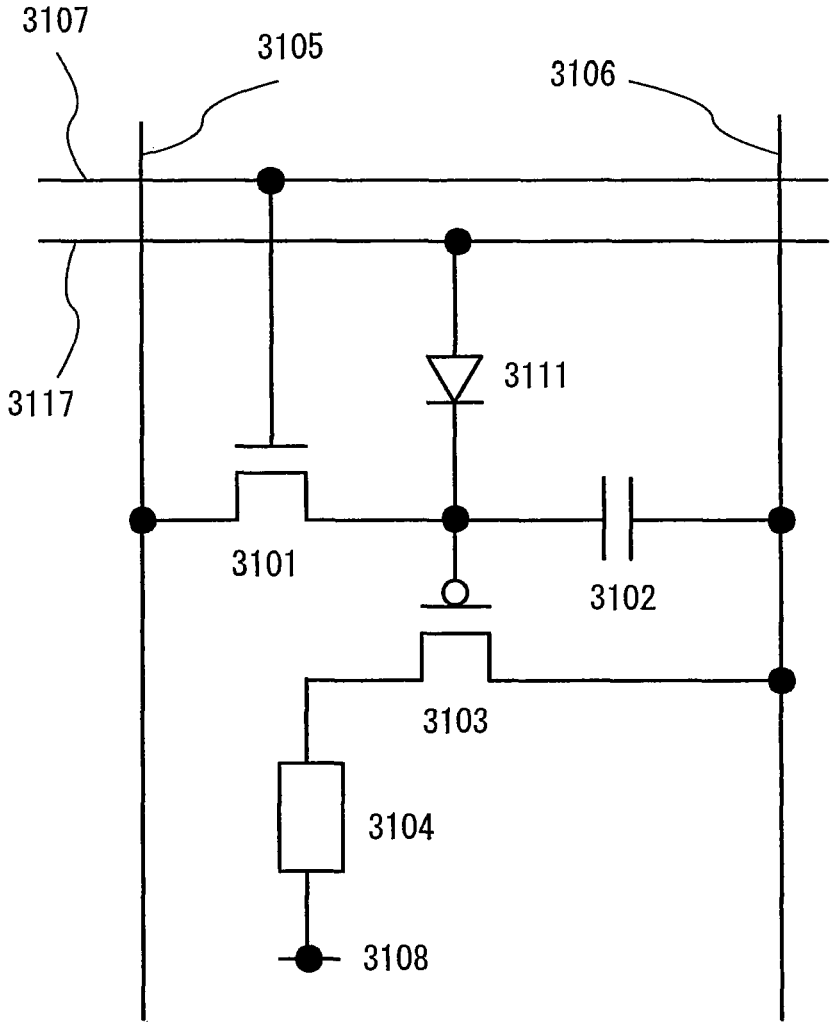
FIG. 31 is a diagram showing an example of a pixel configuration in the case where a signal erasing operation of a pixel is performed.

FIG. 31 shows an example of a pixel configuration in the case where a transistor corresponding to the third transistor in FIG. 30 is forcibly turned off. A pixel shown in FIG. 31 includes a first transistor 3101, a second transistor 3103, a storage capacitor 3102, a display element 3104, a signal line 3105, a first scan line 3107, a second scan line 3117, a first power supply line 3106, a second power supply line 3108, and a diode 3111. Here, the second transistor 3103 corresponds to the third transistor 3003 in FIG. 30.

A gate electrode of the first transistor 3101 is connected to the first scan line 3107, a first electrode thereof is connected to the signal line 3105, and a second electrode thereof is connected to a second electrode of the storage capacitor 3102, a gate electrode of the second transistor 3103, and a second electrode of the diode 3111. A first electrode of the second transistor 3103 is connected to the first power supply line 3106, and a second electrode thereof is connected to a first electrode of the display element 3104. A first electrode of the storage capacitor 3102 is connected to the first power supply line 3106. A second electrode of the display element 3104 is connected to the second power supply line 3108. A first electrode of the diode 3111 is connected to the second scan line 3117.

Note that the first transistor functions, in order to input to the storage capacitor 3102 a signal which is input to the signal line 3105, as a switch for connecting the signal line 3105 to the second electrode of the storage capacitor 3102.

Note that the second transistor has a function to supply current to the display element 3104.

Note that the storage capacitor 3102 has a function to hold a gate potential of the second transistor 3103. Therefore, it is connected between the gate of the second transistor 3103 and the first power supply line 3106; however, the invention is not limited to this as long as the gate potential of the second transistor 3103 can be held. Further, in the case where the gate potential of the second transistor 3103 can be held by using a gate capacitance of the second transistor 3103 or the like, the storage capacitor 3102 may be omitted.

An operation of the pixel configuration shown in FIG. 31 is described next. First, when a signal is written into the pixel, a potential of the first scan line 3107 is made higher than the highest potential of the signal line 3105 or a potential of the first power supply line 3106 to select the first scan line 3107, so that the first transistor 3101 is turned on and a signal is input from the signal line 3105 to the storage capacitor 3102. Accordingly, current of the second transistor 3103 is controlled in accordance with the signal which has been held in the storage capacitor 3102, so that a current flows from the first power supply line 3106 to the second power supply line 3108 through the display element 3104. Consequently, the display element 3104 is lighted.

In the case where a signal is to be erased, a potential of the second scan line 3117 is made higher than the highest potential of the signal line 3105 or the potential of the first power supply line 3106 to select the second scan line 3117, so that the diode 3111 is turned on and a current flows from the second scan line 3117 to the gate electrode of the second transistor 3103. As a result, the second transistor 3103 is turned off. Accordingly, a current is prevented from flowing from the first power supply line 3106 to the second power supply line 3108 through the display element 3104. Consequently, a non-lighting period can be provided so that the length of a lighting period can be freely controlled.

In the case where a signal is to be held, the potential of the second scan line 3117 is made lower than the lowest potential of the signal line 3105. Accordingly, the diode 3111 is turned off so that the gate potential of the second transistor 3103 is held.

Note that the diode 3111 may be anything as long as it is an element having a rectifying property. It may be a PN diode, a PIN diode, a Schottky diode, or a Zener diode.

Figure 32:
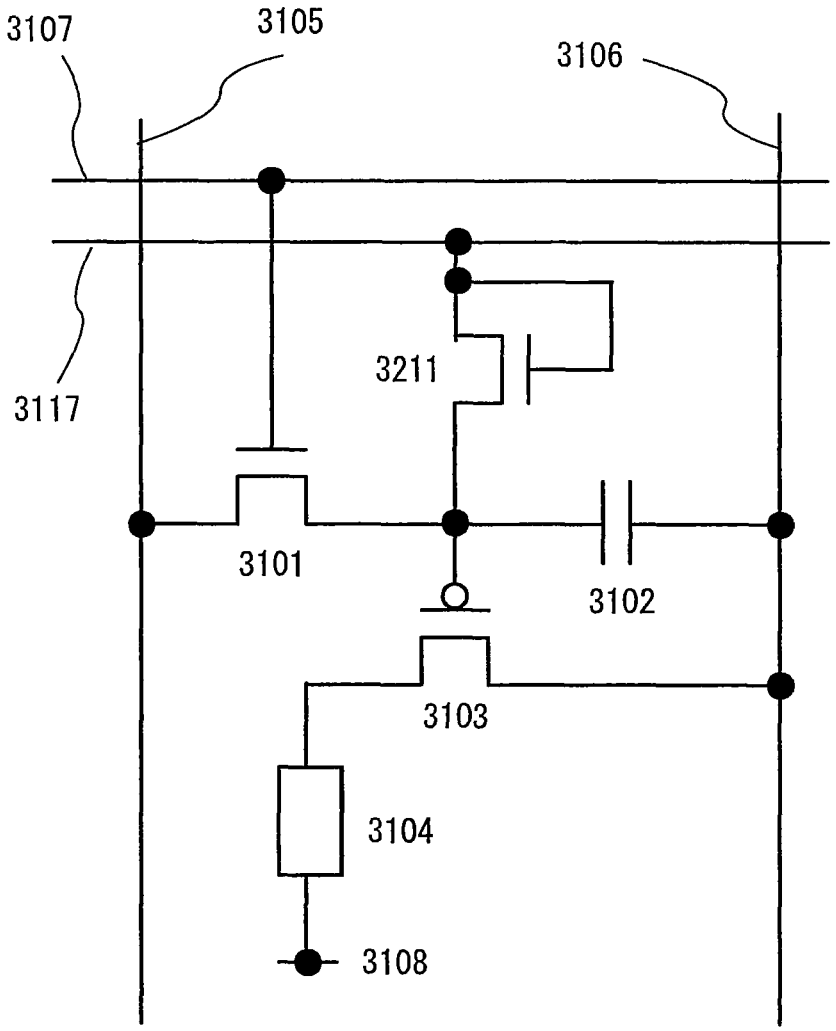
FIG. 32 is a diagram showing an example of a pixel configuration in the case where a signal erasing operation of a pixel is performed.

Alternatively, the diode 3111 may be a diode-connected transistor (a gate electrode and a drain electrode thereof are connected). FIG. 32 is a circuit diagram in that case. As the erasing diode 3111, a diode-connected transistor 3211 is used. Note that although an N-channel type transistor is used as the transistor 3211 here, the invention is not limited to this. A P-channel type transistor may be used as well.

Further, as another circuit, by using the circuit shown in FIG. 25, the driving method as shown in FIG. 29 can be realized. FIG. 28 shows a timing chart of that case. As shown in FIG. 28, one gate selection period is divided into a plurality of periods (two in FIG. 28). Each potential of the scan lines is made high in each of the divided selection periods to select each of the scan lines and a corresponding signal (a video signal and a signal for erasing) is input to the signal line 2505. For example, in one gate selection period, an i-th row is selected in the first half of the period and a j-th row is selected in the latter half of the period. When the i-th row is selected, a video signal is input whereas when the j-th row is selected, a signal for turning a driving transistor off is input. Accordingly, an operation can be performed as if two rows were selected at the same time in one gate selection period.

Note that details of the driving method are disclosed in Japanese Patent Laid-Open No. 2001-324958 and the like, of which the details can be applied in combination with the invention.

By the way, used in one example of the invention is a method in which a bit belonging to the first bit group is divided into 4, a bit belonging to the second bit group is divided into 2, and a bit belonging to the third bit group is not divided according to the conventional time gray scale method. According to this, a duty ratio becomes higher than that of the conventional double speed frame method. This is because, by dividing the bit belonging to the first bit group into 4, the number of subframes each of which a lighting period is the longest, that is, the number of subframes each of which does not require an erasing operation is increased, so that the number of subframes each of which requires an erasing operation is decreased and an erasing period per frame can be shortened.

Figure 33:
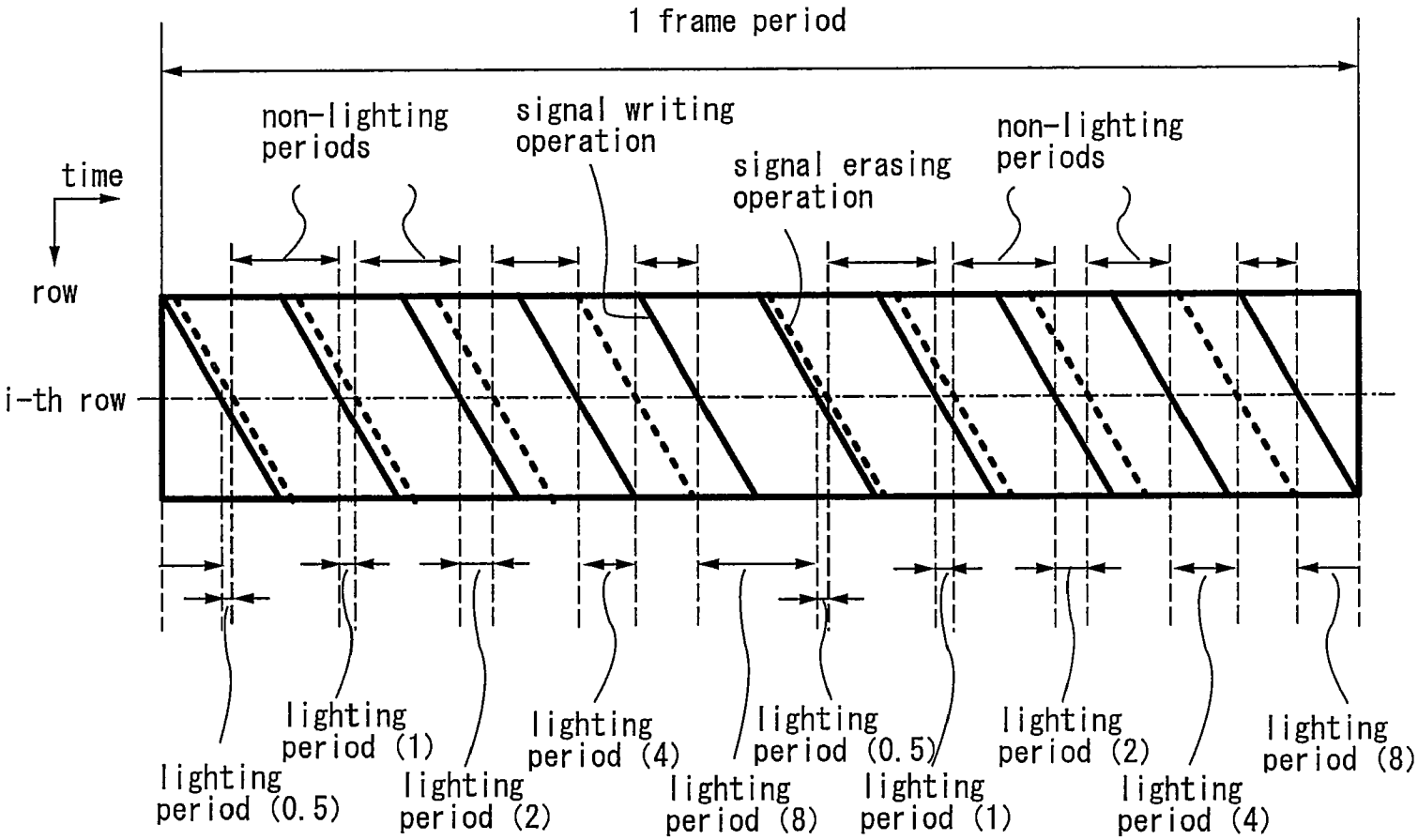
FIG. 33 is a diagram showing an example of a timing chart in the case where a signal erasing operation of a pixel is performed.

For example, a timing chart in the case where an operation of erasing a signal of a pixel is performed in the case where the conventional double speed frame method is applied in a case of a 5-bit display (FIG. 44), is shown in FIG. 33. Comparing the conventional double speed frame method (FIG. 33) with the driving method of the invention (FIG. 29) each other, the number of subframes each of which a lighting period is the longest (the number of subframes each of which does not require an erasing operation) is two in the conventional double speed frame method (FIG. 33) whereas is six in the driving method of the invention (FIG. 29). That is, the total erasing period in the driving method of the invention is shorter.

In this manner, according to the driving method of the invention, the duty ratio can be higher than that of the conventional double speed frame method, so that a voltage applied to a light emitting element can be decreased and power consumption can be reduced. In addition, deterioration of the light emitting element can also be suppressed.

Note that the timing charts, pixel configurations, and driving methods described in this embodiment mode are examples and the invention is not limited to them. The invention can be applied to various timing charts, pixel configurations, and driving methods.

It is to be noted that the appearance order of subframes may be changed depending on time. For example, the appearance order of subframes may be changed between a first frame and a second frame. Further, the appearance order of subframes may be changed depending on place as well. For example, the appearance order of subframes may be changed between a pixel A and a pixel B. Further alternatively, the appearance order of subframes may be changed depending on both of time and place.

Note that although the lighting period, the signal writing period, and the non-lighting period are provided in one frame in this embodiment mode, the invention is not limited to this. Another operation period may be provided. For example, a period in which polarity of a voltage applied to the display element is inverted with respect to the normal one, namely, a reverse-bias period may be provided as well. By providing the reverse-bias period, reliability of the display element may be improved. Note that the pixel configurations described in this embodiment mode are examples and the invention is not limited to them. In addition, the polarity of the transistor forming the pixel is also not limited to this.

Note that the content described in this embodiment mode can be implemented in free combination with the content described in Embodiment Mode 1 and Embodiment Mode 2.

Embodiment Mode 4

In this embodiment mode, description is made on a display device, constitution of a signal line driver circuit, a scan line driver circuit, or the like, and operations thereof.

Figure 34A:
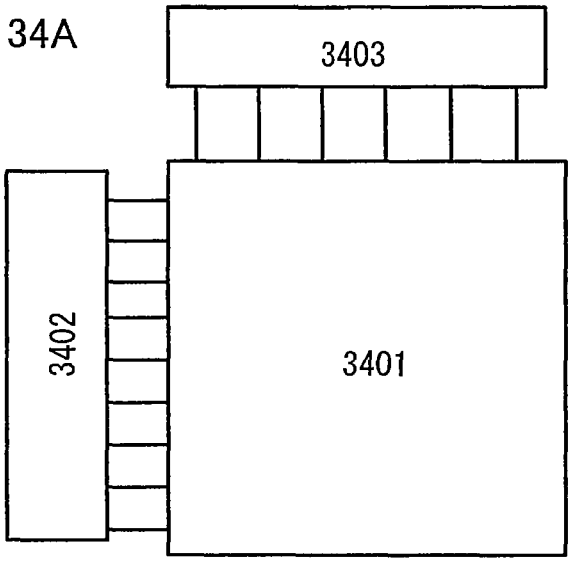
FIGS. 34A to 34C are diagrams showing an example of a display device using a driving method of the invention.

As shown in FIG. 34A, a display device includes a pixel portion 3401, a scan line driver circuit 3402, and a signal line driver circuit 3403.

Figure 34B:
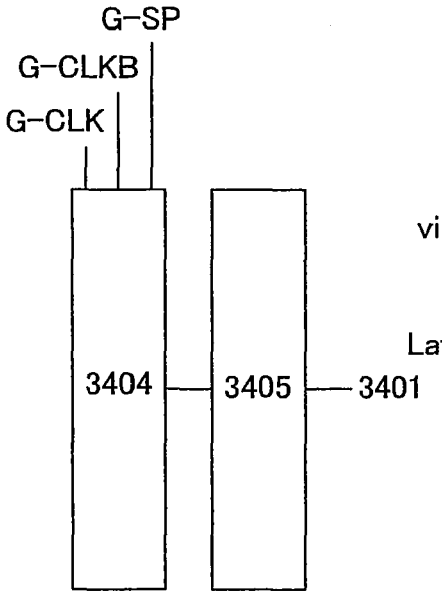

The scan line driver circuit 3402 outputs a selection signal sequentially to the pixel portion 3401. One example of constitution of the scan line driver circuit 3402 is shown in FIG. 34B. The scan line driver circuit includes a shift register 3404, a buffer circuit 3405, and the like. A clock signal (G-CLK), a start pulse (G-SP), and a inverted clock signal (G-CLKB) are input to the shift register 3404, and in accordance with the timing of these signals, the shift register 3404 outputs a sampling pulse sequentially. The sampling pulse which is output is amplified in the buffer circuit 3405 and input to the pixel portion 3401 through each scan line. Note that the scan line driver circuit 3402 includes a level shifter circuit, a pulse width controlling circuit, or the like in addition to the shift register 3404 and the buffer circuit 3405 in many cases.

The signal line driver circuit 3403 outputs a video signal to the pixel portion 3401 sequentially. The pixel portion 3401 displays an image by controlling a state of light in accordance with the video signal. The video signal input from the signal line driver circuit 3403 to the pixel portion 3401 is a voltage in many cases. That is, respective states of a display element and an element for controlling the display element arranged in each pixel are changed by the video signal (voltage) input from the signal line driver circuit 3403. As an example of the display element arranged in a pixel, there is an EL element, an element used for an FED (field emission display), a liquid crystal, a DMD (digital micromirror device), or the like.

Note that a plurality of the scan line driver circuits 3402 or the signal line driver circuits 3403 may be arranged.

Figure 34C:
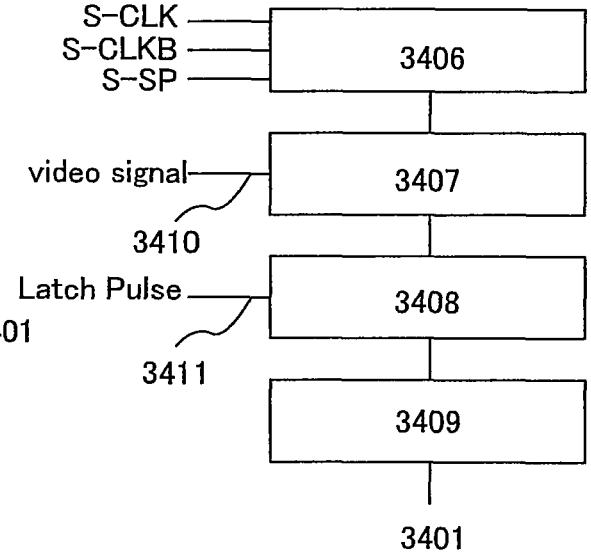

One example of constitution of the signal line driver circuit 3403 is shown in FIG. 34C. The signal line driver circuit 3403 includes a shift register 3406, a first latch circuit (LAT1) 3407, a second latch circuit (LAT2) 3408, and an amplifier circuit 3409. The amplifier circuit 3409 may have a function of converting a digital signal into an analog signal and may have a function of performing a gamma correction.

Further, a pixel includes a display element such as an EL element. A circuit of outputting a current (video signal) to the display element, namely, a current source circuit may also be included.

Next, an operation of the signal line driver circuit 3403 is described briefly. A clock signal (S-CLK), a start pulse (S-SP), and an inverted clock signal (S-CLKb) are input to the shift register 3406, and in accordance with the timing of these signals, the shift register 3406 outputs a sampling pulse sequentially.

The sampling pulse output from the shift register 3406 is input to the first latch circuit (LAT1) 3407. Since a video signal is input from a video signal line 3410 to the first latch circuit (LAT1) 3407, the video signal is held in each column in accordance with the input timing of the sampling pulse.

After holding of the video signal is completed up to the last column in the first latch circuit (LAT1) 3407, a latch pulse (Latch Pulse) is input from a latch control line 3411, and the video signal which has been held in the first latch circuit (LAT1) 3407 is transferred to the second latch circuit (LAT2) 3408 at once in a horizontal retrace period. After that, the video signals of one row, which have been held in the second latch circuit (LAT2) 3408, are input to the amplifier circuit 3409 all at once. A signal which is output from the amplifier circuit 3409 is input to the pixel portion 3401.

The video signal which has been held in the second latch circuit (LAT2) 3408 is input to the amplifier circuit 3409, and while the video signal is input to the pixel portion 3401, the shift register 3406 outputs a sampling pulse again. That is, two operations are performed at the same time. Accordingly, a line sequential driving can be realized. Hereafter, the aforementioned operation is repeated.

Note that the signal line driver circuit or a part thereof (such as the current source circuit or the amplifier circuit) may be formed using an external IC chip instead of being provided over the same substrate as the pixel portion 3401.

Figure 35:
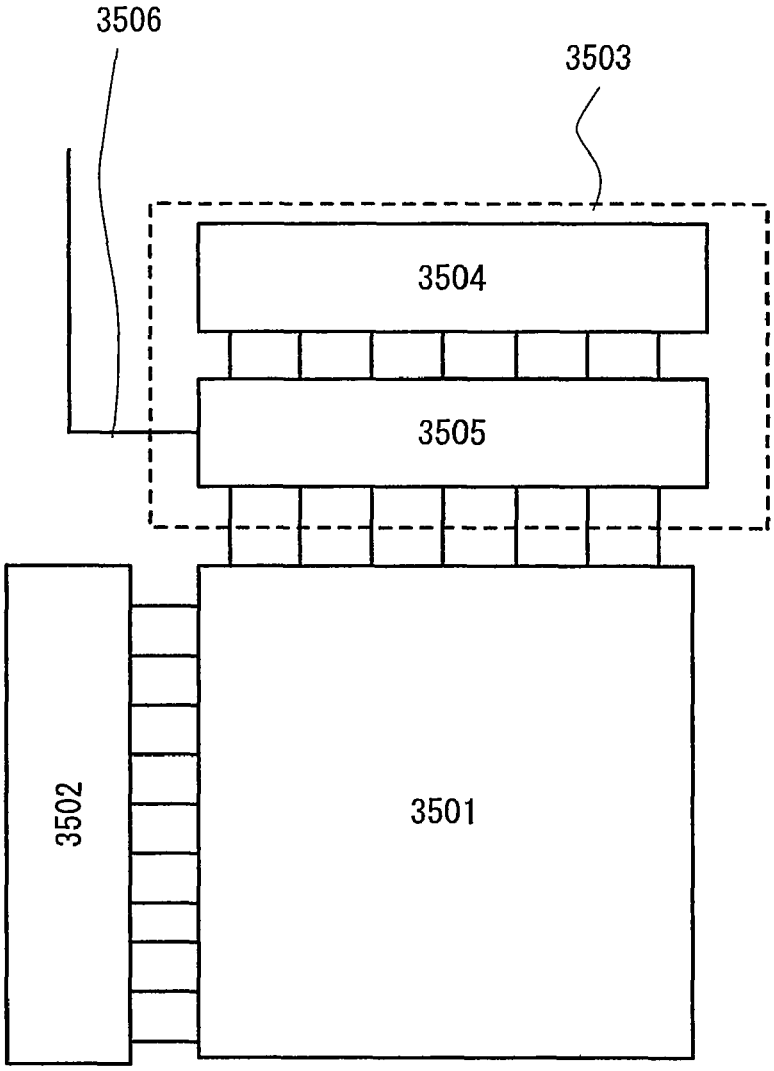
FIG. 35 is a diagram showing an example of a display device using a driving method of the invention.

Note that the constitution of the signal line driver circuit, the scan line driver circuit, or the like is not limited to those in FIGS. 34A to 34C. For example, a signal may be supplied to a pixel by a dot sequential driving. An example in that case is shown in FIG. 35. A signal line driver circuit 3503 includes a shift register 3504 and a sampling circuit 3505. A sampling pulse is output from the shift register 3504 to the sampling circuit 3505. A video signal is input from a video signal line 3506 and in accordance with the sampling pulse, output to a pixel portion 3501. Then, the signal is sequentially input to pixels of a row selected by a scan line driver circuit 3502.

Note that, as described above, a transistor of the invention may be any type of transistor, and formed over any substrate.

Therefore, all the circuits as shown in FIG. 34 or 35 may be formed over a glass substrate, a plastic substrate, a monocrystalline substrate, or an SOI substrate. Alternatively, a portion of the circuits in FIG. 34 or 35 may be formed over a certain substrate, and another portion of the circuits in FIG. 34 or 35 may be formed over another substrate. That is, the whole circuits in FIG. 34 or 35 are not required to be formed over the same substrate. For example, in FIG. 34 or 35, the pixel portion and the scan line driver circuit may be formed over a glass substrate using TFTs, and the signal line driver circuit (or a portion thereof) may be formed over a monocrystalline substrate as an IC chip, and then the IC chip may be mounted on the glass substrate by connecting by COG (Chip On Glass). Alternatively, the IC chip may be connected to the glass substrate by using TAB (Tape Auto Bonding) or a printed substrate.

Note that the description of this embodiment mode corresponds to description using the descriptions of Embodiment Modes 1 to 3. Therefore, the descriptions of Embodiment Modes 1 to 3 can also be applied to this embodiment mode.

Embodiment Mode 5

Figure 36:
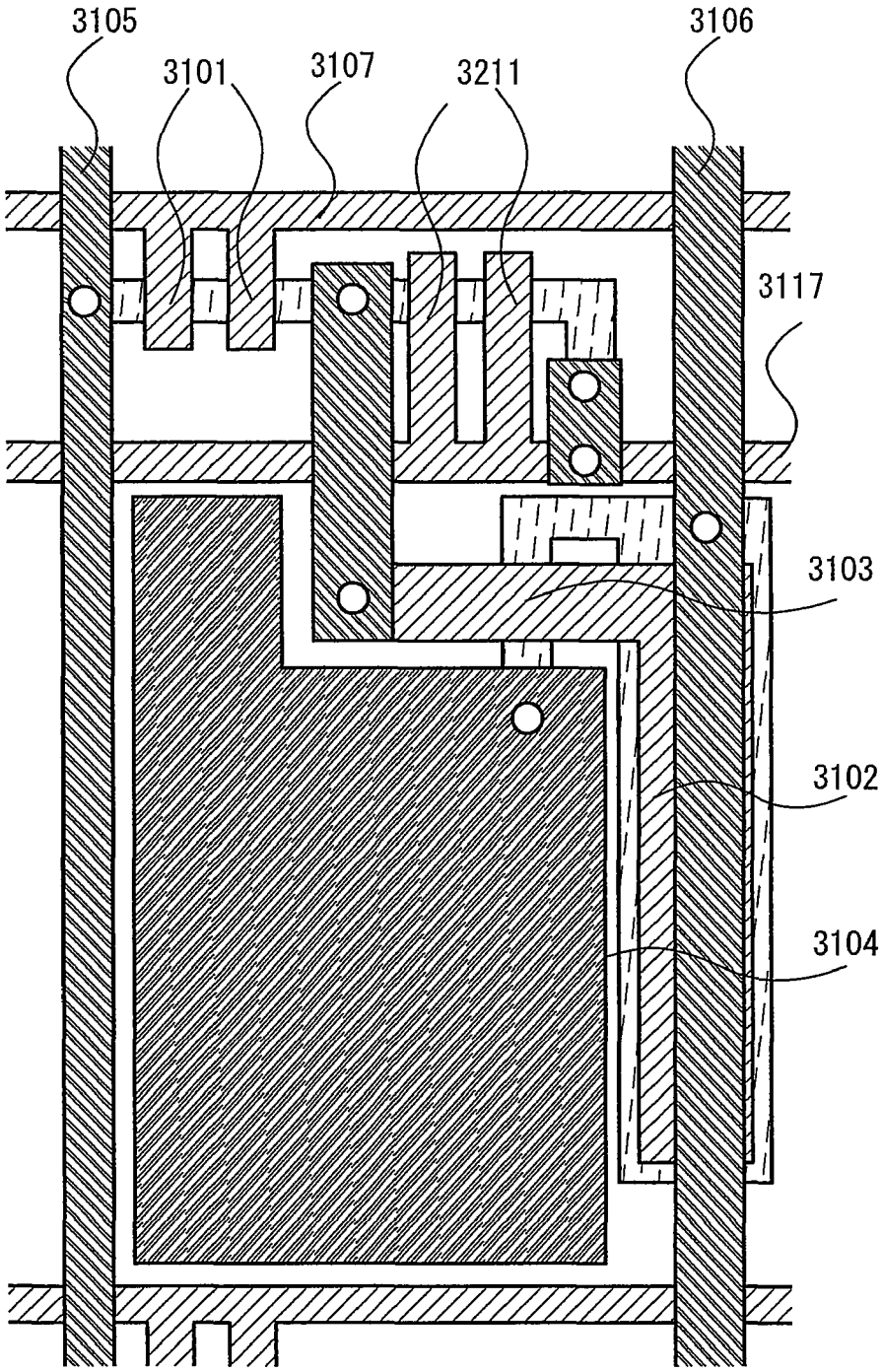
FIG. 36 is a diagram showing an example of a layout of a pixel portion in a display device using a driving method of the invention.

It this embodiment mode, description is made on a layout of a pixel in a display device of the invention. As an example, FIG. 36 is a layout diagram of the circuit configuration shown in FIG. 32. Note that reference numerals in FIG. 36 correspond to reference numerals in FIG. 32. In addition, a circuit diagram and a layout diagram are not limited to FIGS. 32 and 36.

A pixel shown in FIG. 36 includes the first transistor 3101, the second transistor 3103, the storage capacitor 3102, the display element 3104, the signal line 3105, the first scan line 3107, the second scan line 3117, the first power supply line 3106, the second power supply line 3108, and a diode-connected transistor 3211.

A gate electrode of the first transistor 3101 is connected to the first scan line 3107, a first electrode thereof is connected to the signal line 3105, and a second electrode thereof is connected to a second electrode of the storage capacitor 3102, a gate electrode of the second transistor 3103, and a second electrode of the diode-connected transistor 3111. A first electrode of the second transistor 3103 is connected to the first power supply line 3106, and a second electrode thereof is connected to a first electrode of the display element 3104. A first electrode of the storage capacitor 3102 is connected to the first power supply line 3106. A second electrode of the display element 3104 is connected to the second power supply line 3108. A gate electrode of the diode-connected transistor 3211 is connected to a second electrode of the diode-connected transistor 3211, and a first electrode thereof is connected to the second scan line 3117.

The signal line 3105 and the first power supply line 3106 are formed of a second wire, and the first scan line 3107 and the second scan line 3117 are formed of a first wire.

In the case of a top gate structure, a substrate, a semiconductor layer, a gate insulating film, a first wire, an interlayer insulating film, and a second wire are formed in this order. In the case of a bottom gate structure, a substrate, a first wire, a gate insulating film, a semiconductor layer, an interlayer insulating film, and a second wire are formed in this order.

Note that the content described in this embodiment mode can be implemented in free combination with the content described in Embodiment Modes 1 to 4.

Embodiment Mode 6

Described in this embodiment mode is hardware for controlling the driving methods described in Embodiment Modes 1 to 5.

Figure 37:
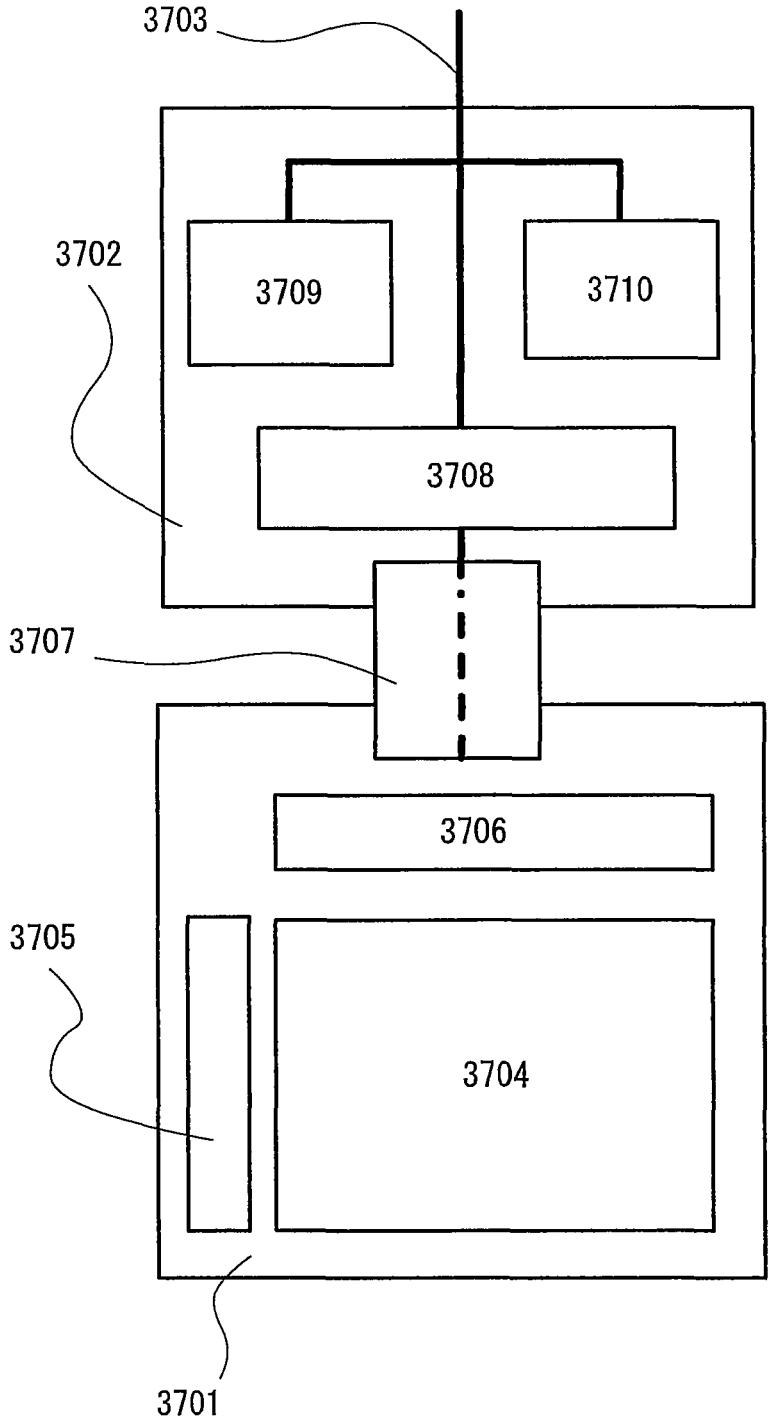
FIG. 37 is a diagram showing an example of hardware for controlling a driving method of the invention.

FIG. 37 is a rough constitution diagram. A pixel portion 3704 is arranged over a substrate 3701. In addition, a signal line driver circuit 3706 or a scan line driver circuit 3705 is arranged in many cases. Besides, a power supply circuit, a precharge circuit, a timing generating circuit, or the like may be arranged. There is also a case where the signal line driver circuit 3706 or the scan line driver circuit 3705 is not arranged. In that case, a circuit which is not provided over the substrate 3701 is formed on an IC in many cases. The IC is mounted on the substrate 3701 by COG (Chip On Glass) in many cases. Alternatively, the IC may be mounted on a connecting substrate 3707 for connecting a peripheral circuit substrate 3702 to the substrate 3701.

A signal 3703 is input to the peripheral circuit substrate 3702, and a controller 3708 controls so that the signal is stored in a memory 3709, a memory 3710, or the like. In the case where the signal 3703 is an analog signal, it is stored in the memory 3709, the memory 3710, or the like after an analog-digital conversion is performed in many cases. The controller 3708 outputs a signal to the substrate 3701 by using the signal stored in the memory 3709, the memory 3710, or the like.

In order to realize the driving methods described in Embodiment Modes 1 to 5, the controller 3708 controls the appearance order of subframes or the like, and outputs a signal to the substrate 3701.

Note that the content described in this embodiment mode can be implemented in free combination with the content described in Embodiment Modes 1 to 5.

Embodiment Mode 7

In this embodiment mode, an example of a manufacturing process of a thin film transistor which can be used for a display device of the invention is described with reference to FIGS. 55A to 55E. Note that in this embodiment mode, a manufacturing process of a top-gate thin film transistor formed with a crystalline semiconductor is described; however, a thin film transistor which can be used for the invention is not limited thereto. For example, a thin film transistor formed with an amorphous semiconductor or a bottom-gate thin film transistor may be used as well.

First, a base film 11201 is formed over a substrate 11200. A glass substrate made of barium borosilicate glass, alumino borosilicate glass, or the like, a silicon substrate, a plastic substrate or a resin substrate having heat resistance, or the like can be used as the substrate 11200. As the plastic substrate or resin substrate, polyethylene terephthalate (PET), polyethylene naphthalate (PEN), polyethersulfone (PES), acryl, polyimide, or the like can be used. The base film 11201 is formed using a single layer or a laminated layer of an oxide or nitride material containing silicon by a CVD method, a plasma CVD method, a sputtering method, a spin coating method, or the like. By forming the base film 11201, a semiconductor film can be prevented from deteriorating due to a contaminant from the substrate 11200.

Figure 55A:
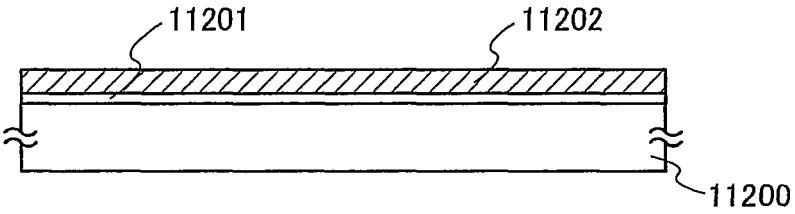
FIGS. 55A to 55E are views showing an example of a manufacturing process of a thin film transistor usable in the invention.

Subsequently, a semiconductor film 11202 is formed over the base film 11201 (see FIG. 55A). The semiconductor film 11202 may be formed with a thickness of 25 nm to 200 nm (preferably, 50 nm to 150 nm) by a sputtering method, an LPCVD method, a plasma CVD method, or the like. In this embodiment mode, an amorphous semiconductor film is formed and then crystallized. As a material of the semiconductor film 11202, silicon or germanium can be used; however, the material is not limited thereto.

As a crystallization method, a laser crystallization method, a thermal crystallization method, a thermal crystallization method using an element which promotes crystallization such as nickel, or the like may be employed. In the case of not introducing an element which promotes crystallization, hydrogen is released until a concentration of hydrogen contained in the amorphous silicon film becomes $1\times10^{20}$ atoms/$cm^3$ or less, by heating at 500° C. for one hour in a nitrogen atmosphere before irradiating the amorphous silicon film with laser light. This is because the amorphous silicon film containing a large amount of hydrogen is damaged when being irradiated with laser light.

There is no particular limitation on an introduction method in the case of introducing an element serving as a catalyst into the amorphous semiconductor film as long as the catalytic element can exist on the surface of or inside the amorphous semiconductor film. For example, a sputtering method, a CVD method, a plasma treatment method (including a plasma CVD method), an adsorption method, or a method for applying a metal salt solution can be employed. Among them, the method using a solution is advantageous in that it is simple, and easy in terms of concentration control of the metal element. It is preferable to form an oxide film at this time by UV light irradiation in an oxygen atmosphere, a thermal oxidation method, treatment with ozone water or hydrogen peroxide including a hydroxyl radical, or the like in order to spread a water solution over the entire surface of the amorphous semiconductor film.

Crystallization of the amorphous semiconductor film may be performed by a combination of heat treatment and laser light irradiation, or by independently performing heat treatment or laser light irradiation plural times. Alternatively, laser crystallization and crystallization using a metal element may be used in combination.

Subsequently, a mask of a resist is manufactured using a photolithography step over the crystalline semiconductor film 11202 that is formed by crystallizing the amorphous semiconductor film, and etching is performed using the mask to form a semiconductor region 11203. As for the mask, a commercial resist material containing a photosensitizing agent may be used. For example, a novolac resin that is a typical positive type resist, a naphthoquinone diazide compound that is a photosensitizing agent, a base resin that is a negative type resist, diphenylsilanediol, or an acid generating agent may be used. In using any of the materials, the surface tension and the viscosity can be appropriately controlled by adjusting the concentration of a solvent, adding a surfactant, or the like.

Note that an insulating film with a thickness of approximately a few nanometers may be formed over the semiconductor film before applying a resist in the photolithography step of this embodiment mode. This step can avoid direct contact between the semiconductor film and the resist and can prevent an impurity from entering the semiconductor film.

Subsequently, a gate insulating film 11204 is formed over the semiconductor region 11203. Note that the gate insulating film has a single-layer structure in this embodiment mode, however, it may have a laminated structure of two or more layers. In the case of a laminated structure, the insulating film is preferably formed continuously in the same chamber at the same temperature while keeping a vacuum with reactive gases changed. When the insulating film is continuously formed while keeping a vacuum, an interface between laminated layers can be prevented from being contaminated.

As a material of the gate insulating film 11204, silicon oxide ($SiO_X$: X>0), silicon nitride ($SiN_X$: X>0), silicon oxynitride ($SiO_XN_Y$: X>Y>0), silicon nitride oxide ($SiN_XO_Y$: X>Y>0), or the like can be used appropriately. Note that it is preferable that a rare gas element such as argon is included in a reactive gas and mixed into an insulating film to be formed in order to form a dense insulating film with low gate leakage current at low film formation temperature. In this embodiment mode, a silicon oxide film is formed as the gate insulating film 11204 by using $SiH_4$ and $N_2O$ as a reactive gas to have a thickness of 10 nm to 100 nm (preferably, 20 nm to 80 nm), and for example, 60 nm. Note that the thickness of the gate insulating film 11204 is not limited to this range.

Figure 55B:
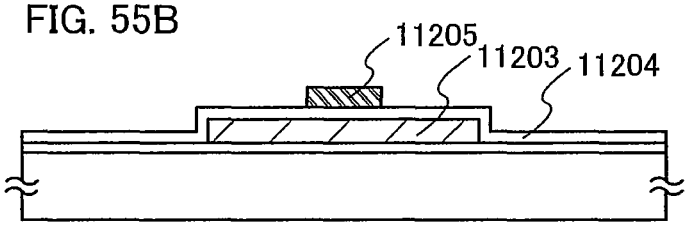

Subsequently, a gate electrode 11205 is formed over the gate insulating film 11204 (see FIG. 55B). The thickness of the gate electrode 11205 is preferably in the range of 10 nm to 200 nm. Although a method for manufacturing a TFT having a single-gate structure is described in this embodiment mode, a multi-gate structure provided with two or more gate electrodes may be employed as well. By employing a multi-gate structure, a TFT with an off-state leakage current reduced can be manufactured. As a material of the gate electrode 11205, a conductive element such as silver (Ag), gold (Au), platinum (Pt), nickel (Ni), tungsten (W), chromium (Cr), molybdenum (Mo), iron (Fe), cobalt (Co), copper (Cu), palladium (Pd), carbon (C), aluminum (Al), manganese (Mn), titanium (Ti), or tantalum (Ta), an alloy or compound material containing the element as its main component, or the like can be used depending on the application. Further, indium tin oxide (ITO) in which indium oxide is mixed with tin oxide; indium tin silicon oxide (ITSO) in which indium tin oxide (ITO) is mixed with silicon oxide; indium zinc oxide (IZO) in which indium oxide is mixed with zinc oxide; zinc oxide (ZnO); tin oxide ($SnO_2$); or the like can also be used. Note that indium zinc oxide (IZO) is a transparent conductive material that is formed by sputtering using a target in which ITO is mixed with zinc oxide (ZnO) of 2 wt % to 20 wt %.

Subsequently, an impurity element is added to the semiconductor region 11203 by using the gate electrode 11205 as a mask. Here, a semiconductor region exhibiting n-type conductivity can be formed by adding, for example, phosphorus (P) as an impurity element so as to be contained at a concentration of approximately $5\times10^{19}/cm^3$ to $5\times10^{20}/cm^3$. Alternatively, a semiconductor region exhibiting p-type conductivity may be formed by adding an impurity element imparting p-type conductivity. As the impurity element imparting n-type conductivity, phosphorus (P), arsenic (As), or the like can be used. As the impurity element imparting p-type conductivity, boron (B), aluminum (Al), gallium (Ga), or the like can be used. Note that an LDD (Lightly Doped Drain) region to which an impurity element is added at a low concentration may be formed. By forming the LDD region, a TFT with an off-state leakage current reduced can be manufactured.

Figure 55C:
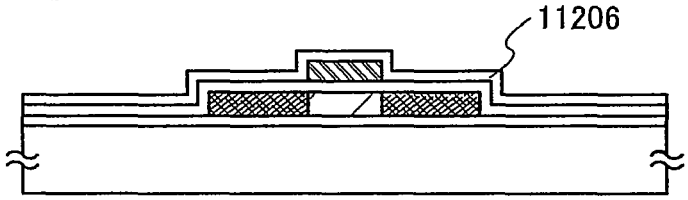
Figure 55D:
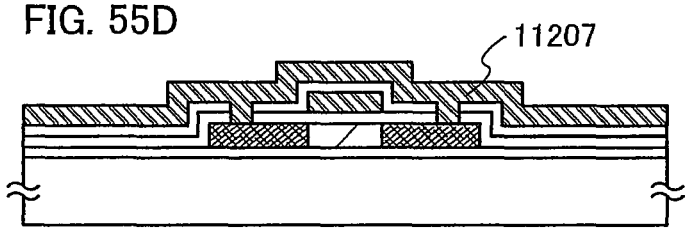

Subsequently, an insulating film 11206 is formed to cover the gate insulating film 11204 and the gate electrode 11205 (see FIG. 55C). As a material of the insulating film 11206, silicon oxide ($SiO_X$: X>0), silicon nitride ($SiN_X$: X>0), silicon oxynitride ($SiO_XN_Y$: X>Y>0), silicon nitride oxide ($SiN_XO_Y$: X>Y>0), or the like can be used appropriately. Note that the insulating film 11206 has a single-layer structure in this embodiment, however, it may have a laminated structure of two or more layers. Further, one or more interlayer insulating films may be provided over the insulating film 11206 as well.

Subsequently, a mask of a resist is manufactured using a photolithography step and the gate insulating film 11204 and the insulating film 11206 are etched to form an opening so as to expose a region of the semiconductor region 11203 to which the impurity element has been added. Thereafter, a conductive film 11207 serving as an electrode is formed to electrically connect to the semiconductor region 11203 (see FIG. 55D). As a material of the conductive film, the same material as the gate electrode 11205 can be used.

Figure 55E:
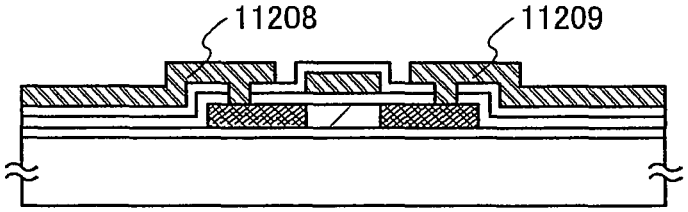

Next, a mask of a resist (not shown) is formed using a photolithography step and the conductive film 11207 is processed into a desired shape through the mask to form a source electrode and a drain electrode 11208 and 11209 (see FIG. 55E).

Note that etching in this embodiment mode may be performed by either plasma etching (dry etching) or wet etching; however, plasma etching is suitable for treating a large-sized substrate. As an etching gas, a fluorine-based gas such as $CF_4$, $NF_3$, $SF_6$, or $CHF_3$, a chlorine-based gas typified by $Cl_2$, $BCl_3$, $SiCl_4$, $CCl_4$, or the like, or an $O_2$ gas is used, to which an inert gas such as He or Ar may be appropriately added.

Through the above process, a top-gate thin film transistor formed with a crystalline semiconductor can be manufactured.

Note that the content described in this embodiment mode can be implemented in free combination with the content described in Embodiment Modes 1 to 6.

Embodiment Mode 8

Figures 56A, 56B:
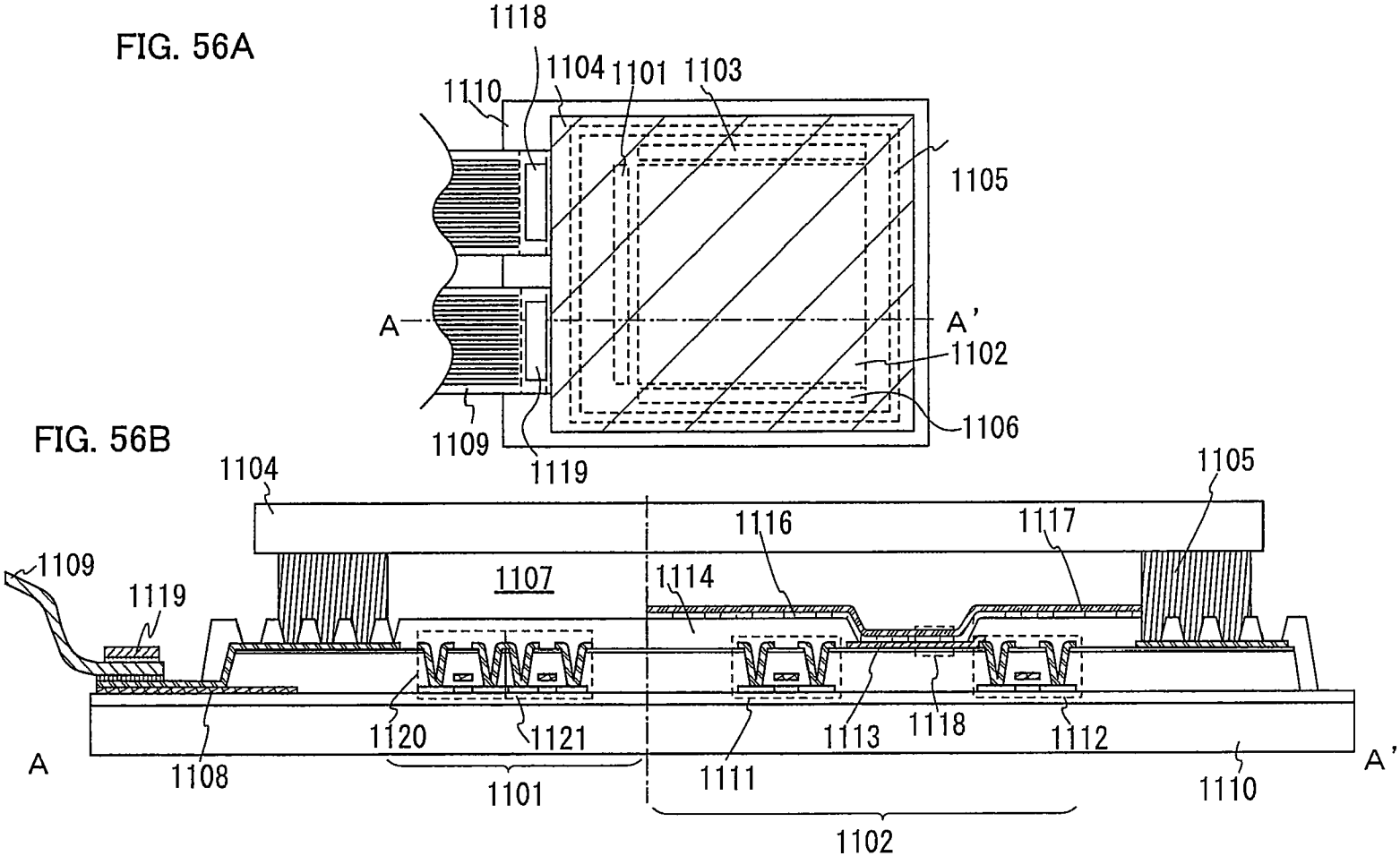
FIGS. 56A and 56B are views illustrating a display panel having a pixel configuration of the invention.

In this embodiment mode, a display panel of the invention is described with reference to FIGS. 56A and 56B and the like. Note that FIG. 56A is a top view showing a display panel, and FIG. 56B is a cross-sectional view of FIG. 56A taken along line A-A'. The display panel includes a signal line driver circuit (Data line) 1101, a pixel portion 1102, a first scan line driver circuit (G1 line) 1103, and a second scan line driver circuit (G2 line) 1106 which are indicated by a dotted line. It also includes a sealing substrate 1104 and a sealant 1105, and a portion surrounded by the sealant 1105 is a space 1107.

Note that a wire 1108 is a wire for transmitting a signal to be input to the first scanning driver circuit 1103, the second scan line driver circuit 1106, and the signal line driver circuit 1101 and receives a video signal, a clock signal, a start signal, and the like from an FPC (flexible printed circuit) 1109 that serves as an external input terminal. An IC chip (a semiconductor chip provided with a memory circuit, a buffer circuit, or the like) is mounted by COG (Chip On Glass) or the like at the junction of the FPC 1109 and the display panel. Note that only the FPC is shown here; however, a printed wiring board (PWB) may be attached to this FPC. The display device in this specification includes not only a display panel itself but also a display panel with an FPC or a PWB attached. In addition, it also includes a display panel on which an IC chip or the like is mounted.

Next, a cross-sectional structure is described with reference to FIG. 56B. The pixel portion 1102 and its peripheral driver circuits (the first scan line driver circuit 1103, the second scan line driver circuit 1106, and the signal line driver circuit 1102) are formed over a substrate 1110. Here, the signal line driver circuit 1101 and the pixel portion 1102 are shown.

Note that the signal line driver circuit 1101 is constituted by a unipolar transistor such as an n-channel transistor 1120 or an n-channel TFT 1121. Similarly, the first scan line driver circuit 1103 and the second scan line driver circuit 1106 are preferably constituted by an n-channel transistor. Note that a pixel configuration can be formed with a unipolar transistor by applying the pixel configuration of the invention thereto; therefore, a unipolar display panel can be manufactured. In this embodiment mode, a display panel in which the peripheral driver circuits are integrated over a substrate is described; however, the invention is not limited to this. All or part of the peripheral driver circuits may be formed in an IC chip or the like and mounted by COG or the like. In that case, there is no necessity for a driver circuit to be unipolar, and a p-channel transistor can be used in combination.

The pixel portion 1102 has a plurality of circuits each forming a pixel which includes a switching TFT 1111 and a driving TFT 1112. Note that a source electrode of the driving TFT 1112 is connected to a first electrode 1113. An insulator 1114 is formed to cover end portions of the first electrode 1113. Here, a positive type photosensitive acrylic resin film is used.

The insulator 1114 is formed to have a curved surface at an upper end portion or a lower end portion thereof in order to make the coverage favorable. For example, in the case of using positive type photosensitive acrylic as a material of the insulator 1114, the insulator 1114 is preferably formed to have a curved surface with a curvature radius (0.2 μm to 3 μm) only at an upper end portion. Either a negative type which becomes insoluble in an etchant by light irradiation or a positive type which becomes soluble in an etchant by light irradiation can be used as the insulator 1114.

A layer 1116 containing an organic compound and a second electrode 1117 are formed over the first electrode 1113. Here, a material having a high work function is preferably used as a material used for the first electrode 1113 which functions as an anode. For example, the first electrode 1113 can be formed by using a single-layer film such as an ITO (indium tin oxide) film, an indium zinc oxide film (IZO) film, a titanium nitride film, a chromium film, a tungsten film, a Zn film, or a Pt film; a laminated layer of a titanium nitride film and a film containing aluminum as its main component; a three-layer structure of a titanium nitride film, a film containing aluminum as its main component, and a titanium nitride film; or the like. When the first electrode 1113 has a laminated structure, it can have low resistance as a wire and form a favorable ohmic contact. Further, the first electrode can function as an anode.

In addition, the layer 1116 containing an organic compound is formed by an evaporation method using an evaporation mask or an ink jet method. A metal complex belonging to Group 4 of the Periodic Table is used for part of the layer 1116 containing an organic compound, and besides, a material which can be used in combination may be either a low molecular material or a high molecular material. In addition, as a material used for the layer containing an organic compound, a single layer or a laminated layer of an organic compound is often used generally. However, this embodiment mode also includes a structure in which an inorganic compound is used for part of the film formed of an organic compound. Moreover, a known triplet material can also be used.

As a material used for the second electrode (cathode) 1117 which is formed over the layer 1116 containing an organic compound, a material having a low work function (Al, Ag, Li, Ca, or an alloy thereof such as MgAg, MgIn, AlLi, $CaF_2$, or CaN) may be used. In the case where light generated in the layer 1116 containing an organic compound is transmitted through the second electrode 1117, a laminated layer of a metal thin film with a thin thickness and a transparent conductive film (an alloy of indium oxide and tin oxide (ITO), an alloy of indium oxide and zinc oxide ($In_2O_3$—ZnO), zinc oxide (ZnO), or the like) is preferably used as the second electrode (cathode) 1117.

By attaching the sealing substrate 1104 to the substrate 1110 with the sealant 1105, a structure is obtained in which a light emitting element 1118 is provided in the space 1107 surrounded by the substrate 1110, the sealing substrate 1104, and the sealant 1105. Note that there is also a case where the space 1107 is filled with the sealant 1105 as well as an inert gas (such as nitrogen or argon).

Note that an epoxy-based resin is preferably used as the sealant 1105. The material preferably allows as little moisture and oxygen as possible to penetrate. As the sealing substrate 1104, a plastic substrate formed of FRP (Fiberglass-Reinforced Plastics), PVF (polyvinyl fluoride), Myler, polyester, acrylic, or the like can be used besides a glass substrate or a quartz substrate.

As described above, a display panel having the pixel configuration of the invention can be obtained.

Cost reduction of a display device can be achieved by integrating the signal line driver circuit 1101, the pixel portion 1102, the first scan line driver circuit 1103, and the second scan line driver circuit 1106 as shown in FIGS. 56A and 56B. In this case also, by using unipolar transistors for the signal line driver circuit 1101, the pixel portion 1102, the first scan line driver circuit 1103, and the second scan line driver circuit 1106, a manufacturing process can be simplified, therefore, further cost reduction can be achieved. Much further cost reduction can be achieved by applying amorphous silicon to semiconductor layers of transistors used for the signal line driver circuit 1101, the pixel portion 1102, the first scan line driver circuit 1103, and the second scan line driver circuit 1106.

Note that the constitution of the display panel is not limited to the constitution in which the signal line driver circuit 1101, the pixel portion 1102, the first scan line driver circuit 1103, and the second scan line driver circuit 1106 are integrated as shown in FIG. 56*a*. There may be constitution in which a signal line driver circuit corresponding to the signal line driver circuit 1101 is formed on an IC chip and mounted on the display panel by COG or the like.

In other words, only a signal line driver circuit which requires high speed operation is formed on an IC chip using a CMOS or the like to reduce power consumption. In addition, higher-speed operation and lower power consumption can be achieved by using a semiconductor chip such as a silicon wafer as the IC chip.

Then, cost reduction can be achieved by integrating a scan line driver circuit with a pixel portion. When this scan line driver circuit and this pixel portion are constituted by a unipolar transistor, further cost reduction can be achieved. A pixel included in the pixel portion can be constituted by an n-channel transistor as described in Embodiment Mode 3. Moreover, by using amorphous silicon for a semiconductor layer of the transistor, a manufacturing process can be simplified and further cost reduction can be achieved.

Accordingly, cost reduction of a high-definition display device can be achieved. In addition, a substrate area can be used efficiently by mounting an IC chip provided with a functional circuit (a memory or a buffer) on a connection portion of the FPC 1109 and the substrate 1110.

Further, there may be constitution in which a signal line driver circuit, a first scan line driver circuit, and a second scan line driver circuit which correspond to the signal line driver circuit 1101, the first scan line driver circuit 1103, and the second scan line driver circuit 1106 in FIG. 56*a* respectively may be formed on an IC chip and mounted on a display panel by COG or the like. In this case, power consumption of the high-definition display device can be further reduced. Thus, polysilicon is preferably used for a semiconductor layer of a transistor used for a pixel portion in order to obtain a display device with lower power consumption.

Moreover, cost reduction can be achieved by using amorphous silicon for a semiconductor layer of a transistor in the pixel portion 1102. In addition, it becomes possible to manufacture a large-sized display panel.

Note that the scan line driver circuit and the signal line driver circuit are not limited to being provided in a row direction and a column direction of the pixel.

Figure 57:
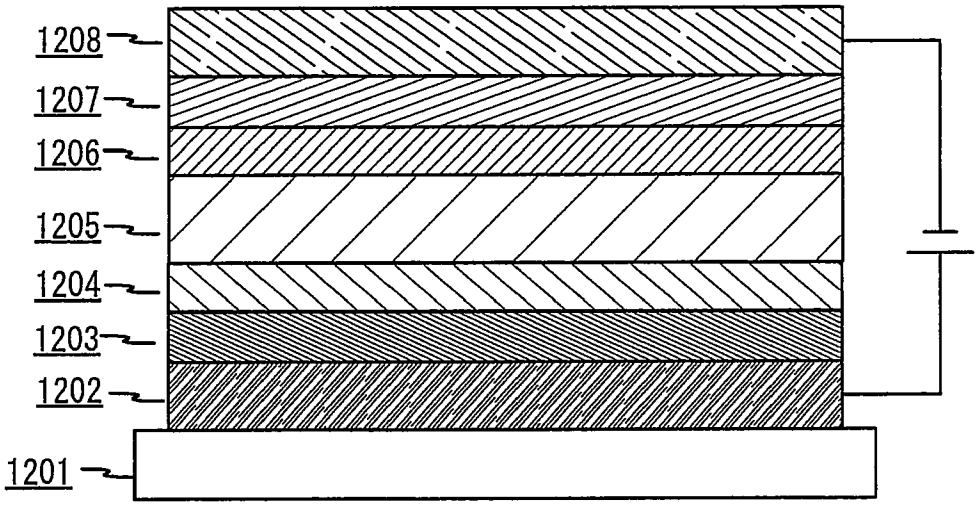
FIG. 57 is a diagram showing an example of a light emitting element applicable to a display device having a pixel configuration of the invention.

Next, an example of a light emitting element applicable to the light emitting element 1118 is shown in FIG. 57.

The light emitting element has an element structure in which an anode 1202, a hole injecting layer 1203 formed of a hole injecting material, a hole transporting layer 1204 formed of a hole transporting material, a light emitting layer 1205, an electron transporting layer 1206 formed of an electron transporting material, an electron injecting layer 1207 formed of an electron injecting material, and a cathode 1208 are laminated in this order over a substrate 1201. Here, the light emitting layer 1205 is formed of only one kind of a light emitting material in some cases, however, may be formed of two or more kinds of materials. In addition, an element structure of the invention is not limited to this structure.

In addition to the laminated structure of respective functional layers shown in FIG. 57, there is a wide range of variation in element structure, such as an element using a high molecular compound or a high-efficiency element in which a light emitting layer is formed using a triplet light emitting material that emits light from a triplet excited state. In addition, the element structure of the invention is also applicable to a white light emitting element realized by controlling a carrier recombination region with a hole blocking layer to divide a light emitting region into two regions, or the like.

In a manufacturing method of the element of the invention shown in FIG. 57, a hole injecting material, a hole transporting material, and a light emitting material are evaporated in this order over the substrate 1201 provided with the anode (ITO) 1202. Then, an electron transporting material and an electron injecting material are evaporated, and the cathode 1208 is lastly formed by evaporation.

Suitable materials for the hole injecting material, the hole transporting material, the electron transporting material, the electron injecting material, and the light emitting material are listed below.

As the hole injecting material, a porphyrin compound, phthalocyanine (hereinafter referred to as "$H_2Pc$"), copper phthalocyanine (hereinafter referred to as "CuPc"), or the like is effective among organic compounds. In addition, a material which has a smaller value of an ionization potential than that of the hole transporting material to be used and has a hole transporting function can also be used as the hole injecting material. There is also a chemically-doped conductive high molecular compound, which includes polyethylenedioxythiophene (hereinafter referred to as "PEDOT") doped with polystyrene sulfonate (hereinafter referred to as "PSS"), polyaniline, and the like. In addition, an insulating high molecular compound is also effective in planarization of an anode, and polyimide (hereinafter referred to as "PI") is often used. Further, an inorganic compound is also used, which includes an ultrathin film of aluminum oxide (hereinafter referred to as "alumina") as well as a thin film of metal such as gold or platinum.

A material that is most widely used as the hole transporting material is an aromatic amine-based compound (in other words, a compound having a bond of benzene ring-nitrogen). A material that is widely used includes 4,4'-bis(diphenylamino)-biphenyl (hereinafter referred to as "TAD"), a derivative thereof such as 4,4'-bis[N-(3-methylphenyl)-N-phenyl-amino]-biphenyl (hereinafter referred to as "TPD") or 4,4'-bis[N-(1-naphthyl)-N-phenyl-amino]-biphenyl (hereinafter referred to as "α-NPD"), and besides, a star burst aromatic amine compound such as 4,4',4"-tris(N,N-diphenyl-amino)-triphenylamine (hereinafter referred to as "TDATA") or 4,4',4"-tris[N-(3-methylphenyl)-N-phenyl-amino]-triphenylamine (hereinafter referred to as "MTDATA").

As the electron transporting material, a metal complex is often used, which includes a metal complex having a quinoline skeleton or a benzoquinoline skeleton such as tris(8-quinolinolato)aluminum (hereinafter referred to as "$Alq_3$"), BAlq, tris(4-methyl-8-quinolinolato)aluminum (hereinafter referred to as "Almq"), or bis(10-hydroxybenzo[h]-quinolinato)beryllium (hereinafter referred to as "Bebq"), and besides, a metal complex having an oxazole-based or a thiazole-based ligand such as bis[2-(2-hydroxyphenyl)-benzoxazolato]zinc (hereinafter referred to as "$Zn(BOX)_2$") or bis[2-(2-hydroxyphenyl)-benzothiazolato]zinc (hereinafter referred to as "$Zn(BTZ)_2$"). Further, other than the metal complex, an oxadiazole derivative such as 2-(4-biphenylyl)-5-(4-tert-butylphenyl)-1,3,4-oxadiazole (hereinafter referred to as "PBD") or OXD-7, a triazole derivative such as TAZ or 3-(4-tert-butylphenyl)-4-(4-ethylphenyl)-5-(4-biphenylyl)-1,2,4-triazole (hereinafter referred to as "p-EtTAZ"), and a phenanthroline derivative such as bathophenanthroline (hereinafter referred to as "BPhen") or BCP have an electron transporting property.

As the electron injecting material, the above-described electron transporting materials can be used. In addition, an ultrathin film of an insulator such as metal halide including calcium fluoride, lithium fluoride, cesium fluoride, and the like, or alkali metal oxide including lithium oxide, is often used. Further, an alkali metal complex such as lithium acetyl acetonate (hereinafter referred to as "Li(acac)") or 8-quinolinolato-lithium (hereinafter referred to as "Liq") is also effective.

As the light emitting material, other than the above-described metal complex such as $Alq_3$, Almq, BeBq, BAlq, $Zn(BOX)_2$, or $Zn(BTZ)_2$, various fluorescent pigments are effective. The fluorescent pigments include 4,4'-bis(2,2-diphenyl-vinyl)-biphenyl which is blue, 4-(dicyanomethylene)-2-methyl-6-(p-dimethylaminostyryl)-4H-pyran which is red-orange, and the like. In addition, a triplet light emitting material is also possible, which is mainly a complex with platinum or iridium as central metal. As the triplet light emitting material, tris(2-phenylpyridine)iridium, bis(2-(4'-tryl) pyridinato-N,$C^{2'}$)acetylacetonato iridium (hereinafter referred to as "$acacIr(tpy)_2$"), 2,3,7,8,12,13,17,18-octaethyl-21H,23H-porphyrin-platinum, and the like have been known.

By combining the above-described materials that have respective functions, a highly reliable light emitting element can be manufactured.

In addition, a light emitting element having layers laminated in reverse order of that in FIG. 57 can also be used. That is, in an element structure, the cathode 1208, the electron injecting layer 1207 formed of an electron injecting material, the electron transporting layer 1206 formed of an electron transporting material, the light emitting layer 1205, the hole transporting layer 1204 formed of a hole transporting material, the hole injecting layer 1203 formed of a hole injecting material, and the anode 1202 are sequentially laminated over the substrate 1201.

In addition, in order to extract light emission of a light emitting element, at least one of an anode and a cathode may be transparent. Then, a TFT and a light emitting element are formed over a substrate. There are light emitting elements having a top emission structure in which light emission is extracted through a surface opposite to the substrate, having a bottom emission structure in which light emission is extracted through a surface on the substrate side, and having a dual emission structure in which light emission is extracted through a surface opposite to the substrate and a surface on the substrate side. The pixel configuration of the invention can be applied to a light emitting element having any of the emission structures.

A light emitting element having a top emission structure is described with reference to FIG. 58A.

Over a substrate 1300, a driving TFT 1301 is formed, and a first electrode 1302 is formed in contact with a source electrode of the driving TFT 1301. A layer 1303 containing an organic compound and a second electrode 1304 are formed thereover.

Note that the first electrode 1302 is an anode of the light emitting element, and the second electrode 1304 is a cathode of the light emitting element. That is, the light emitting element is formed in a region where the layer 1303 containing an organic compound is sandwiched between the first electrode 1302 and the second electrode 1304.

The first electrode 1302 which functions as an anode is preferably formed using a material having a high work function. For example, a single-layer film such as a titanium nitride film, a chromium film, a tungsten film, a Zn film, or a Pt film, a laminated layer of a titanium nitride film and a film containing aluminum as its main component, or a three-layer structure of a titanium nitride film, a film containing aluminum as its main component, and a titanium nitride film, or the like can be used. Note that a laminated structure makes it possible to reduce the resistance as a wire, to form a good ohmic contact, and to function as an anode. By using a light-reflective metal film, an anode which does not transmit light can be formed.

The second electrode 1304 which functions as a cathode is preferably formed using a laminated layer of a metal thin film formed of a material having a low work function (Al, Ag, Li, Ca, or an alloy thereof such as MgAg, MgIn, AlLi, $CaF_2$, or CaN) and a transparent conductive film (indium tin oxide (ITO), indium zinc oxide (IZO), zinc oxide (ZnO), or the like). By using the thin metal film and the transparent conductive film as described above, a cathode which can transmit light can be formed.

Figure 58A:
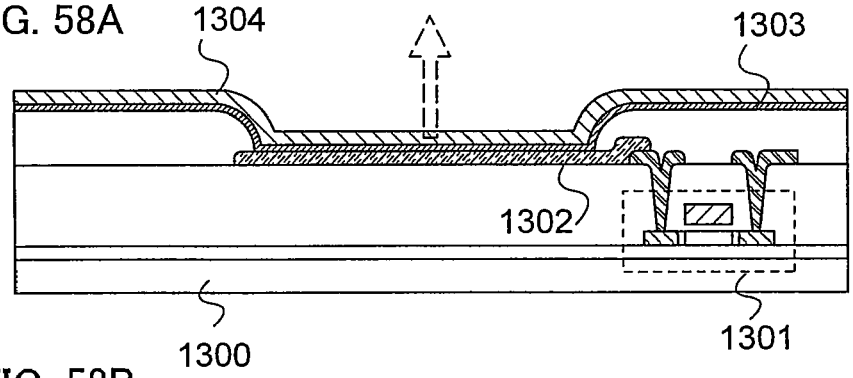
FIGS. 58A to 58C are views each showing a light emission structure of a light emitting element.

Thus, light of the light emitting element can be extracted from a top surface as indicated by an arrow in FIG. 58A. That is, in the case of applying the light emitting element to the display panel shown in FIGS. 56A and 56B, light is emitted toward the substrate 1110 side. Therefore, when a light emitting element having a top emission structure is used for the display device, a substrate which transmits light is used as the sealing substrate 1104.

In addition, in the case of providing an optical film, the optical film may be provided over the sealing substrate 1104.

Note that the first electrode 1302 can be formed using a metal film formed of a material having a low work function such as MgAg, MgIn, or AlLi to function as a cathode. In this case, the second electrode 1304 can be formed using a transparent conductive film such as an indium tin oxide (ITO) film or an indium zinc oxide (IZO) film. Consequently, with this structure, the transmittance of the top emission can be improved.

A light emitting element having a bottom emission structure is described with reference to FIG. 58B. Description is made using the same reference numerals as FIG. 58A since a structure except for its emission structure is identical.

The first electrode 1302 which functions as an anode is preferably formed using a material having a high work function. For example, a transparent conductive film such as an indium tin oxide (ITO) film or an indium zinc oxide (IZO)

film can be used. By using a transparent conductive film, an anode which can transmit light can be formed.

The second electrode 1304 which functions as a cathode can be formed using a metal film formed of a material having a low work function (Al, Ag, Li, Ca, or an alloy thereof such as MgAg, MgIn, AlLi, $CaF_2$, or CaN). By using a light-reflective metal film as described above, a cathode which does not transmit light can be formed.

Figure 58B:
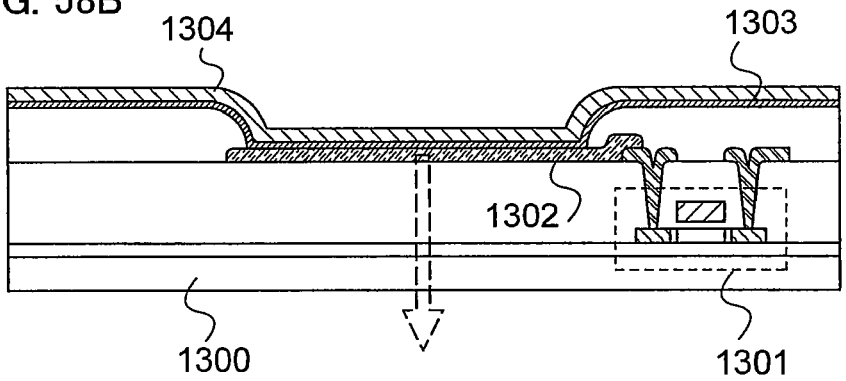

Thus, light of the light emitting element can be extracted from a bottom surface as indicated by an arrow in FIG. 58B. In other words, in the case of applying the light emitting element to the display panel shown in FIGS. 56A and 56B, light is emitted toward the substrate 1110 side. Therefore, when the light emitting element having a bottom emission structure is used for the display device, a substrate which transmits light is used as the substrate 1110.

In addition, in the case of providing an optical film, the optical film may be provided over the substrate 1110.

A light emitting element having a dual emission structure is described with reference to FIG. 58C. Description is made using the same reference numerals as FIG. 58A since a structure except for its emission structure is identical.

The first electrode 1302 which functions as an anode is preferably formed using a material having a high work function. For example, a transparent conductive film such as an indium tin oxide (ITO) film or an indium zinc oxide (IZO) film can be used. By using a transparent conductive film, an anode which can transmit light can be formed.

The second electrode 1304 which functions as a cathode is preferably formed using a laminated layer of a metal thin film formed of a material having a low work function (Al, Ag, Li, Ca, or an alloy thereof such as MgAg, MgIn, AlLi, $CaF_2$, or CaN) and a transparent conductive film (indium tin oxide (ITO), an alloy of indium oxide and zinc oxide ($In_2O_3$—ZnO), zinc oxide (ZnO), or the like). By using the thin metal film and the transparent conductive film as described above, a cathode which can transmit light can be formed.

Figure 58C:
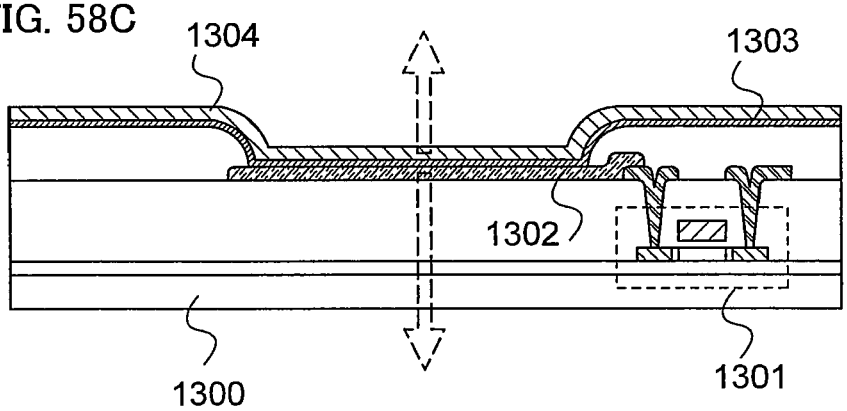

Thus, light of the light emitting element can be extracted from both surfaces as indicated by arrows in FIG. 58C. In other words, in the case of applying the light emitting element to the display panel shown in FIGS. 56A and 56B, light is emitted toward the substrate 1110 side and the sealing substrate 1104 side. Therefore, when the light emitting element having a dual emission structure is used for the display device, substrates which transmit light are used as both the substrate 1110 and the sealing substrate 1104.

In addition, in the case of providing an optical film, the optical film may be provided over both the substrate 1110 and the sealing substrate 1104.

In addition, the invention can be applied to a display device which achieves full-color display by using a white light emitting element and a color filter.

Figure 59:
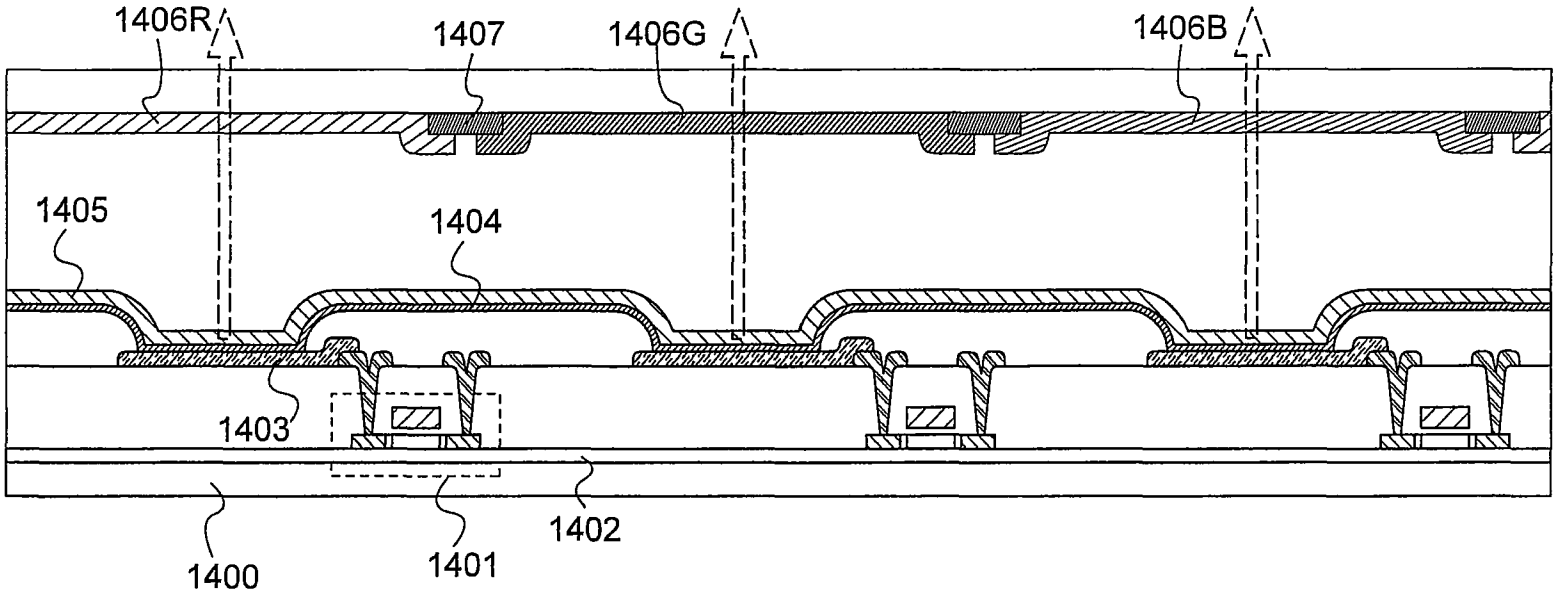
FIG. 59 is a cross-sectional view of a display panel for performing a full-color display using a color filter.

As shown in FIG. 59, over a substrate 1400, a driving TFT 1401 is formed, and a first electrode 1403 is formed in contact with a source electrode of the driving TFT 1401. A layer 1404 containing an organic compound and a second electrode 1405 are formed thereover.

Note that the first electrode 1403 is an anode of the light emitting element, and the second electrode 1405 is a cathode of the light emitting element. That is, the light emitting element is formed in a region where the layer 1404 containing an organic compound is sandwiched between the first electrode 1403 and the second electrode 1405. White light is emitted with the structure shown in FIG. 59. A red color filter 1406R, a green color filter 1406G, and a blue color filter 1406B are provided above the light emitting elements respectively to achieve full-color display. In addition, a black matrix (also called a "BM") 1407 which separates these color filters is provided.

The above-described structures of the light emitting element can be used in combination and can be appropriately applied to a display device having the pixel configuration of the invention. Note that the constitution of the display panel, and the light emitting element described above are merely examples, and it is needles to say that the pixel configuration of the invention can be applied to a display device having another constitution.

A partial cross-sectional view of a pixel portion of a display panel is shown next.

First, the case of using a polysilicon (p-Si:H) film as a semiconductor layer of a transistor is described with reference to FIGS. 60*a*, 60*b*, 61*a*, and 61*b*.

Here, as the semiconductor layer, an amorphous silicon (a-Si) film, for example, is formed over a substrate by a known film formation method. Note that there is no necessity to limit the semiconductor layer to the amorphous silicon film, and any semiconductor film having an amorphous structure (including a microcrystalline semiconductor film) may be used. Further, a compound semiconductor film having an amorphous structure, such as an amorphous silicon germanium film may be used as well.

Subsequently, the amorphous silicon film is crystallized by a laser crystallization method, a thermal crystallization method using RTA or an annealing furnace, a thermal crystallization method using a metal element which promotes crystallization, or the like. It is needless to say that crystallization may be performed by a combination of the above-described methods.

As a result of the above-described crystallization, a crystallized region is partially formed in the amorphous semiconductor film.

Next, the crystalline semiconductor film in which the crystallinity is partially enhanced is patterned into a desired shape to form an island-shaped semiconductor film from the crystallized region. This semiconductor film is used as the semiconductor layer of the transistor.

Figure 60A:
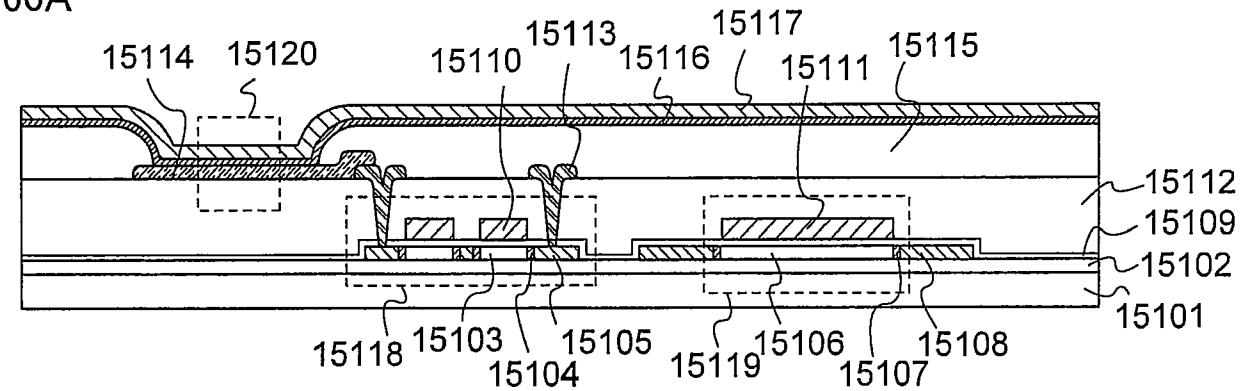
FIGS. 60A and 60B are partial cross-sectional views of a display panel.
Figure 60B:
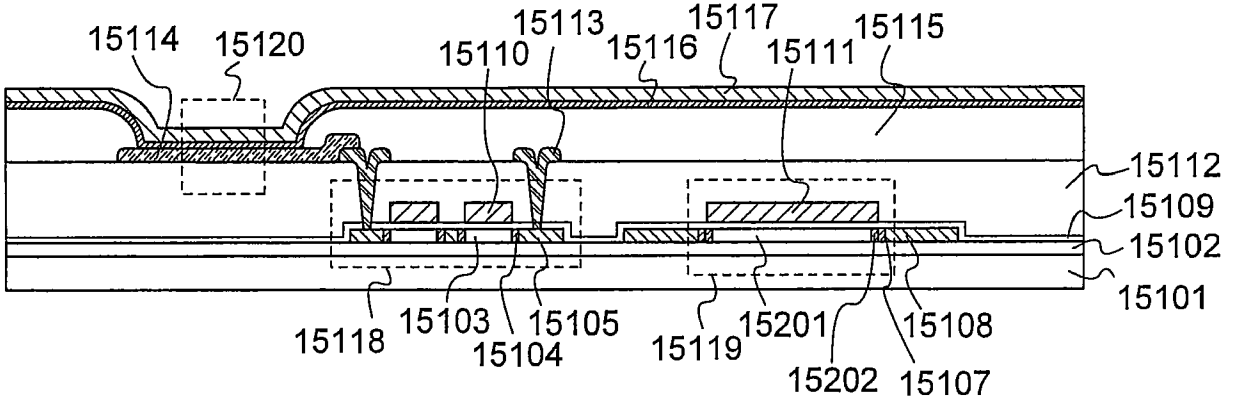

As shown in FIGS. 60A and 60B, a base film 15102 is formed over a substrate 15101, and a semiconductor layer is formed thereover. The semiconductor layer includes a channel formation region 15103, an LDD region 15104, and an impurity region 15105 which serves as a source region or a drain region of a driving transistor 15118, and includes a channel formation region 15106, an LDD region 15107, and an impurity region 15108 which serve as a lower electrode of a capacitor 15119. Note that channel doping may be performed to the channel formation region 15103 and the channel formation region 15106.

As the substrate, a glass substrate, a quartz substrate, a ceramic substrate, or the like can be used. The base film 15102 can be formed using a single layer of aluminum nitride (AlN), silicon oxide ($SiO_2$), silicon oxynitride ($SiO_XN_Y$), or the like, or a laminated layer thereof.

A gate electrode 15110 and an upper electrode 15111 of the capacitor are formed over the semiconductor layer with a gate insulating film 15109 therebetween.

An interlayer insulating film 15112 is formed to cover the driving transistor 15118 and the capacitor 15119. A contact hole is formed in the interlayer insulating film 15112, through which a wire 15113 is in contact with the impurity region 15105. A pixel electrode 15114 is formed in contact with the wire 15113, and an insulator 15115 is formed to cover end portions of the pixel electrode 15114 and the wire 15113; here, it is formed using a positive type photosensitive acrylic resin film. Then, a layer 15116 containing an organic compound and an opposing electrode 15117 are formed over the pixel electrode 15114. A light emitting element 15120 is formed in a region where the layer 15116 containing an organic compound is sandwiched between the pixel electrode 15114 and the opposing electrode 15117.

In addition, as shown in FIG. 60B, a region 15202 in an LDD region, which forms part of the lower electrode of the capacitor 15119, may be provided so as to be overlapped with the upper electrode 15111. Note that the same reference numerals as FIG. 60A are used for the common portions, and description thereof is omitted.

Figure 61A:
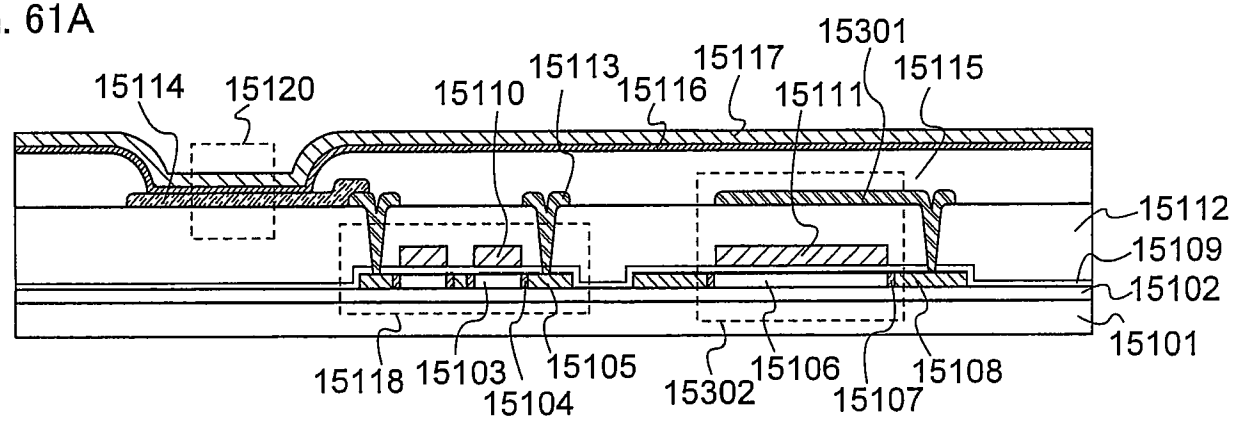
FIGS. 61A and 61B are partial cross-sectional views of a display panel.

In addition, as shown in FIG. 61A, a second upper electrode 15301 may be provided which is formed in the same layer as the wire 15113 in contact with the impurity region 15105 of the driving transistor 15118. Note that the same reference numerals as FIG. 15A are used for the common portions, and description thereof is omitted. A second capacitor is formed by interposing the interlayer insulating film 15112 between the second upper electrode 15301 and the upper electrode 15111. In addition, the second upper electrode 15301 is in contact with the impurity region 15108, so that a first capacitor in which the gate insulating film 15102 is sandwiched between the upper electrode 15111 and the channel formation region 15106 and the second capacitor in which the interlayer insulating film 15112 is sandwiched between the upper electrode 15111 and the second upper electrode 15301 are connected in parallel to each other to form a capacitor 15302 including the first capacitor and the second capacitor. The capacitor 15302 has a combined capacitance of capacitances of the first capacitor and the second capacitor; therefore, the capacitor having a large capacitance can be formed in a small area. That is, by using the capacitor in the pixel configuration of the invention, an aperture ratio can be further improved.

Figure 61B:
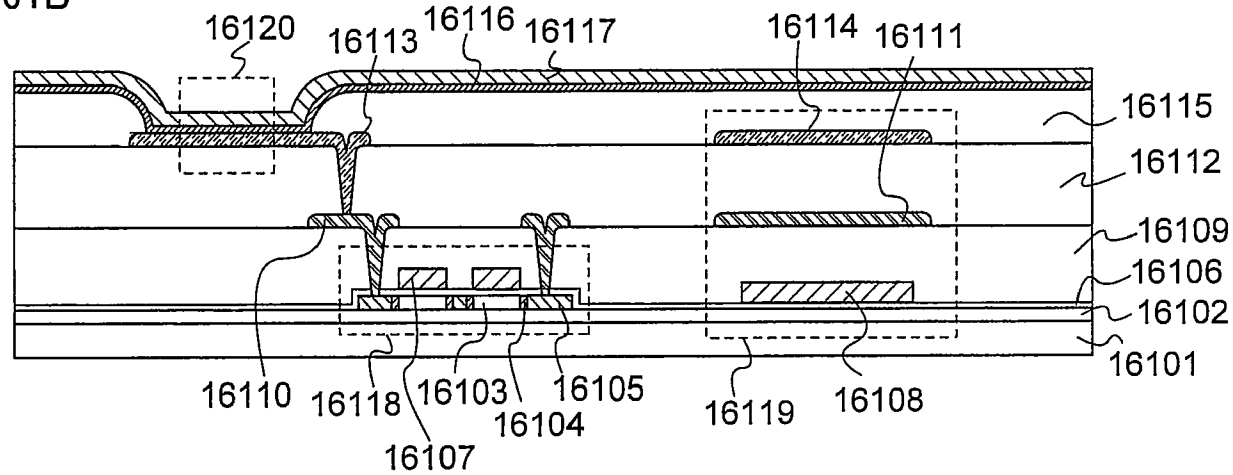

Alternatively, a structure of a capacitor as shown in FIG. 61B may be adopted. A base film 16102 is formed over a substrate 16101, and a semiconductor layer is formed thereover. The semiconductor layer includes a channel formation region 16103, an LDD region 16104, and an impurity region 16105 serving as a source region or a drain region of a driving transistor 16118. Note that channel doping may be performed to the channel formation region 16103.

As the substrate, a glass substrate, a quartz substrate, a ceramic substrate, or the like can be used. The base film 16102 can be formed using a single layer of aluminum nitride (AlN), silicon oxide ($SiO_2$), silicon oxynitride ($SiO_XN_Y$), or the like or a laminated layer thereof.

A gate electrode 16107 and a first electrode 16108 are formed over the semiconductor layer with a gate insulating film 16106 therebetween.

A first interlayer insulating film 16109 is formed to cover the driving transistor 16118 and the first electrode 16108. A contact hole is formed in the first interlayer insulating film 16109, through which a wire 16110 is in contact with the impurity region 16105. In addition, a second electrode 16111 is formed in the same layer formed of the same material as the wire 16110.

Furthermore, a second interlayer insulating film 16112 is formed to cover the wire 16110 and the second electrode 16111. A contact hole is formed in the second interlayer insulating film 16112, through which a pixel electrode 16113 is formed in contact with the wire 16110. A third electrode 16114 is formed in the same layer formed of the same material as the pixel electrode 16113. Accordingly, a capacitor 16119 is formed which includes the first electrode 16108, the second electrode 16111, and the third electrode 16114.

A layer 16116 containing an organic compound and an opposing electrode 16117 are formed over the pixel electrode 16113. A light emitting element 16120 is formed in a region where the layer 16116 containing an organic compound is sandwiched between the pixel electrode 16113 and the opposing electrode 16117.

As described above, the structures shown in FIGS. 60*a*, 60*b*, 61*a*, and 61*b* can be given as a structure of a transistor using a crystalline semiconductor film as its semiconductor layer. Note that the transistors having the structures shown in FIGS. 60*a*, 60*b*, 61*a*, and 61*b* are examples of a transistor having a top-gate structure. That is, the LDD region may be overlapped with the gate electrode or need not necessarily be overlapped with the gate electrode, or part of the LDD region may be overlapped with the gate electrode. Further, the gate electrode may have a tapered shape and the LDD region may be provided under the tapered portion of the gate electrode in a self-aligned manner. In addition, the number of gate electrodes is not limited to two. A multi-gate structure having three or more gate electrodes may be employed, or a single gate structure may be employed.

By using a crystalline semiconductor film as a semiconductor layer (such as a channel formation region, a source region, and a drain region) of a transistor included in the pixel of the invention, the scan line driver circuit and the signal line driver circuit can be easily integrated with the pixel portion. In addition, part of the signal line driver circuit may be integrated with the pixel portion, and another part thereof may be formed on an IC chip and mounted by COG or the like as shown in the display panel of FIGS. 56A and 56B. With this structure, manufacturing cost can be reduced.

Figure 62A:
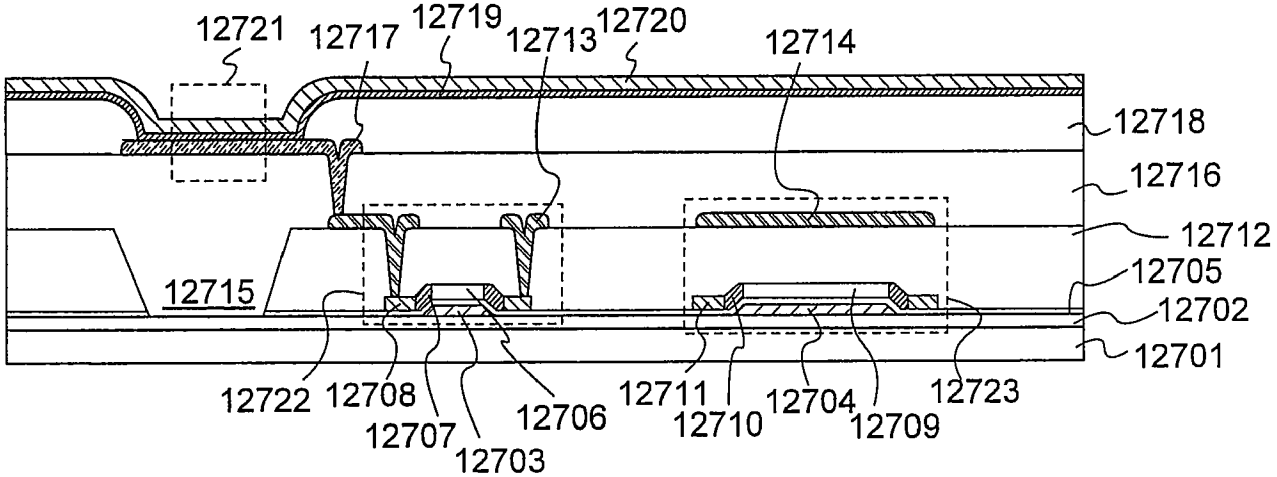
FIGS. 62A and 62B are partial cross-sectional views of a display panel.
Figure 62B:
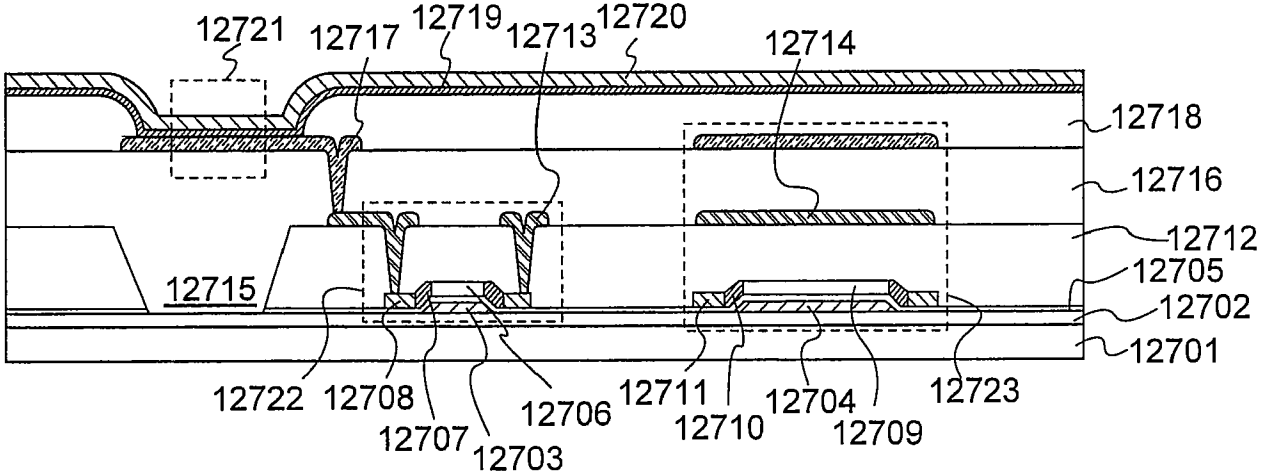

Next, FIGS. 62A and 62B are partial cross-sectional views of a display panel using a transistor having a structure in which a gate electrode is sandwiched between a substrate and a semiconductor layer, namely, a transistor having a bottom-gate structure in which a gate electrode is located below a semiconductor layer, as a structure of a transistor using a polysilicon (p-Si:H) film as its semiconductor layer.

A base film 12702 is formed over a substrate 12701. Then, a gate electrode 12703 is formed over the base film 12702. A first electrode 12704 is formed in the same layer formed of the same material as the gate electrode. As a material of the gate electrode 12703, polycrystalline silicon to which phosphorus is added can be used. Other than polycrystalline silicon, silicide that is a compound of metal and silicon may be used as well.

Then, a gate insulating film 12705 is formed to cover the gate electrode 12703 and the first electrode 12704. The gate insulating film 12705 is formed using a silicon oxide film, a silicon nitride film, or the like.

Over the gate insulating film 12705, a semiconductor layer is formed. The semiconductor layer includes a channel formation region 12706, an LDD region 12707, and an impurity region 12708 which serves as a source region or a drain region of a driving transistor 12722, and includes a channel formation region 12709, an LDD region 12710, and an impurity region 12711 which serve as a second electrode of a capacitor 12723. Note that channel doping may be performed on the channel formation region 12706 and the channel formation region 12709.

As the substrate, a glass substrate, a quartz substrate, a ceramic substrate, or the like can be used. The base film 12702 can be formed using a single layer of aluminum nitride (AlN), silicon oxide ($SiO_2$), silicon oxynitride ($SiO_XN_Y$), or the like or a laminated layer thereof.

A first interlayer insulating film 12712 is formed to cover the semiconductor layer. A contact hole is formed in the first interlayer insulating film 12712, through which a wire 12713 is in contact with the impurity region 12708. A third electrode 12714 is formed in the same layer formed of the same material as the wire 12713. The capacitor 12723 is formed with the first electrode 12704, the second electrode, and the third electrode 12714.

In addition, an opening 12715 is formed in the first interlayer insulating film 12712. A second interlayer insulating film 12716 is formed to cover the driving transistor 12722, the capacitor 12723, and the opening 12715. A pixel electrode 12717 is formed through a contact hole over the second interlayer insulating film 12716. Then, an insulator 12718 is formed to cover end portions of the pixel electrode 12717. For example, a positive type photosensitive acrylic resin film can be used. Subsequently, a layer 12719 containing an organic compound and an opposing electrode 12720 are formed over the pixel electrode 12717, and a light emitting element 12721 is formed in a region where the layer 12719 containing an organic compound is sandwiched between the pixel electrode 12717 and the opposing electrode 12720. The opening 12715 is located under the light emitting element 12721; accordingly, in the case where light emission of the light emitting element 12721 is extracted from the substrate side, the transmittance can be improved due to the existence of the opening 12715.

Furthermore, a fourth electrode 12724 may be formed in the same layer formed of the same material as the pixel electrode 12717 in FIG. 62A to form a structure which is shown in FIG. 62B. In that case, a capacitor 12725 can be formed with the first electrode 12704, the second electrode, the third electrode 12714, and the fourth electrode 12724.

Figure 63A:
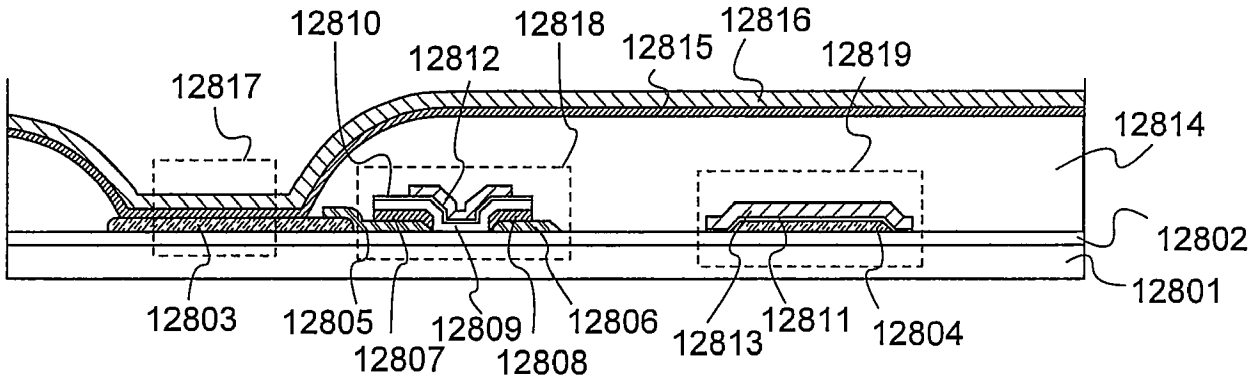
FIGS. 63A and 63B are partial cross-sectional views of a display panel.
Figure 63B:
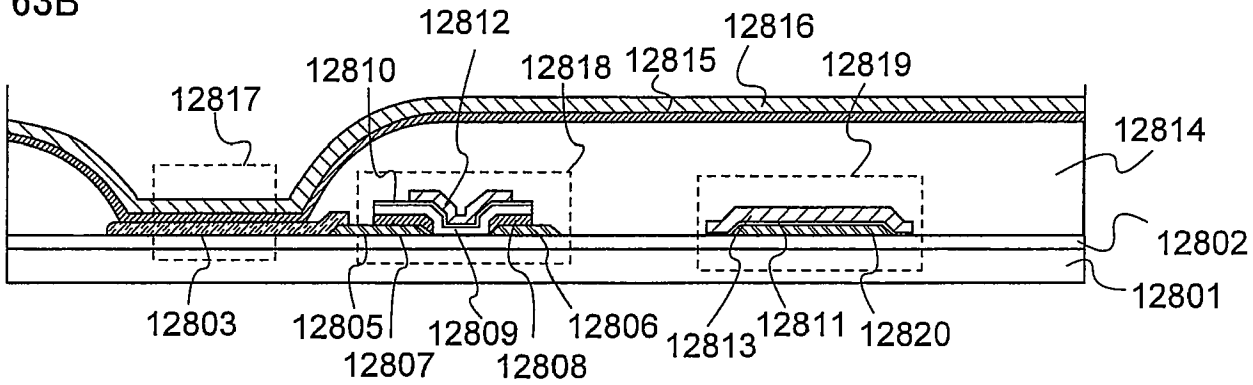

Subsequently, the case of using an amorphous silicon (a-Si:H) film as a semiconductor layer of a transistor is described. FIGS. 63A and 63B show the cases of a top-gate transistor, whereas FIGS. 64*a*, 64*b*, 65*a*, and 65*b* show the cases of a bottom-gate transistor.

FIG. 63A is a cross-sectional view of a top-gate transistor using amorphous silicon as its semiconductor layer. As shown in FIG. 63A, a base film 12802 is formed over a substrate 12801. Further, a pixel electrode 12803 is formed over the base film 12802. In addition, a first electrode 12804 is formed in the same layer formed of the same material as the pixel electrode 12803.

As the substrate, a glass substrate, a quartz substrate, a ceramic substrate, or the like can be used. The base film 12802 can be formed using a single layer of aluminum nitride (AlN), silicon oxide ($SiO_2$), silicon oxynitride ($SiO_XN_Y$), or the like or a laminated layer thereof.

A wire 12805 and a wire 12806 are formed over the base film 12802, and an end portion of the pixel electrode 12803 is covered with the wire 12805. Over the wire 12805 and the wire 12806, an n-type semiconductor layer 12807 and an n-type semiconductor layer 12808 having n-type conductivity are formed respectively. In addition, a semiconductor layer 12809 is formed over the base film 12802, between the wire 12805 and the wire 12806, which is partially extended to over the n-type semiconductor layer 12807 and the n-type semiconductor layer 12808. Note that this semiconductor layer is formed using an amorphous semiconductor film such as amorphous silicon (a-Si:H) film or a microcrystalline semiconductor (μ-Si:H) film. Then, a gate insulating film 12810 is formed over the semiconductor layer 12809, and an insulating film 12811 is formed in the same layer formed of the same material as the gate insulating film 12810, also over the first electrode 12804. Note that a silicon oxide film, a silicon nitride film, or the like is used as the gate insulating film 12810.

Over the gate insulating film 12810, a gate electrode 12812 is formed. In addition, a second electrode 12813 is formed in the same layer formed of the same material as the gate electrode, over the first electrode 12804 with the insulating film 12811 therebetween. A capacitor 12819 is formed by sandwiching the insulating film 12811 between the first electrode 12804 and the second electrode 12813. An interlayer insulating film 12814 is formed to cover end portions of the pixel electrode 12803, the driving transistor 12818, and the capacitor 12819.

Over the interlayer insulating film 12814 and the pixel electrode 12803 located in an opening of the interlayer insulating film 12814, a layer 12815 containing an organic compound and an opposing electrode 12816 are formed. A light emitting element 12817 is formed in a region where the layer 12815 containing an organic compound is sandwiched between the pixel electrode 12803 and the opposing electrode 12816.

The first electrode 12804 shown in FIG. 63A may be a first electrode 12820 as shown in FIG. 63B. The first electrode 12820 is formed in the same layer formed of the same material as the wires 12805 and 12806.

Figure 64A:
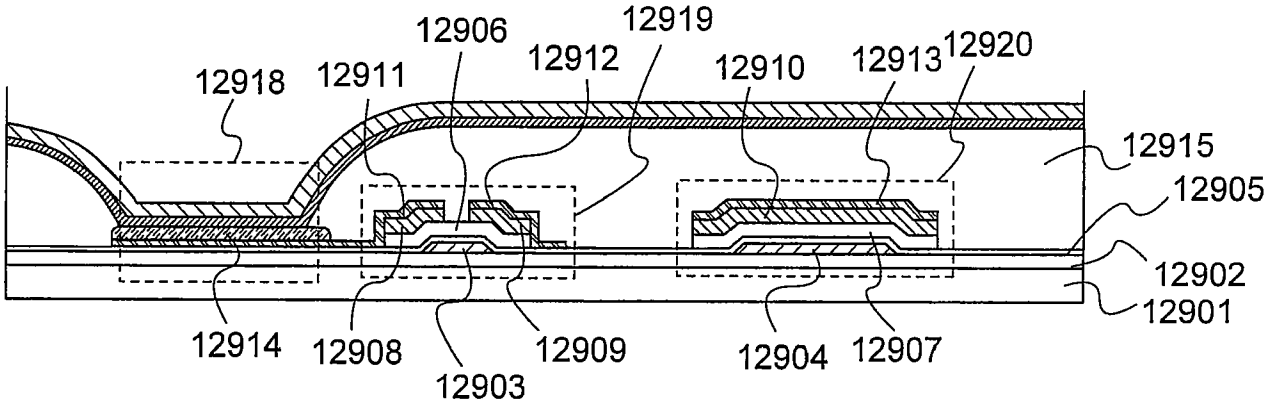
FIGS. 64A and 64B are partial cross-sectional views of a display panel.
Figure 64B:
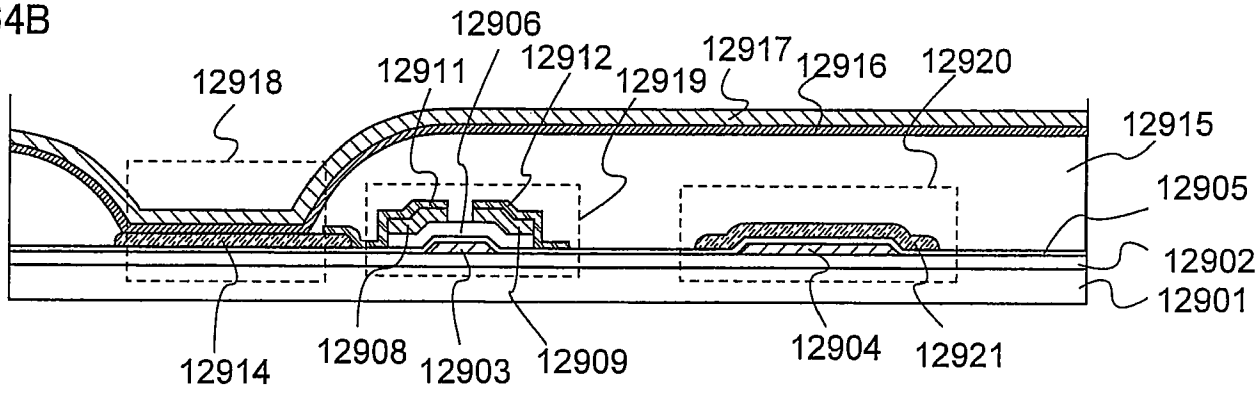

FIGS. 64A and 64B are partial cross-sectional views of a display panel provided with a bottom-gate transistor using amorphous silicon for its semiconductor layer.

A base film 12902 is formed over a substrate 12901. Over the base film 12902, a gate electrode 12903 is formed. In addition, a first electrode 12904 is formed in the same layer formed of the same material as the gate electrode. As a material for the gate electrode 12903, polycrystalline silicon to which phosphorus is added can be used. Other than polycrystalline silicon, silicide that is a compound of metal and silicon may be used as well.

Then, a gate insulating film 12905 is formed to cover the gate electrode 12903 and the first electrode 12904. The gate insulating film 12905 is formed using a silicon oxide film, a silicon nitride film, or the like.

A semiconductor layer 12906 is formed over the gate insulating film 12905. In addition, a semiconductor layer 12907 is formed in the same layer formed of the same material as the semiconductor layer 12906.

As the substrate, a glass substrate, a quartz substrate, a ceramic substrate, or the like can be used. The base film 12902 can be formed using a single layer of aluminum nitride (AlN), silicon oxide ($SiO_2$), silicon oxynitride ($SiO_XN_Y$), or the like or a laminated layer thereof.

N-type semiconductor layers 12908 and 12909 having n-type conductivity are formed over the semiconductor layer 12906, and an n-type semiconductor layer 12910 is formed over the semiconductor layer 12907.

Wires 12911 and 12912 are formed over the n-type semiconductor layers 12908 and 12909 respectively, and a conductive layer 12913 is formed in the same layer formed of the same material as the wires 12911 and 12912, over the n-type semiconductor layer 12910.

Thus, a second electrode is structured by the semiconductor layer 12907, the n-type semiconductor layer 12910, and the conductive layer 12913 are formed. Note that a capacitor 12920 is formed in which the gate insulating film 12905 is sandwiched between the second electrode and the first electrode 12904.

One end portion of the wire 12911 is extended, and a pixel electrode 12914 is formed over the extended wire 12911.

An insulator 12915 is formed to cover end portions of the pixel electrode 12914, a driving transistor 12919, and the capacitor 12920.

Then, a layer 12916 containing an organic compound and an opposing electrode 12917 are formed over the pixel electrode 12914 and the insulator 12915. A light emitting element 12918 is formed in a region where the layer 12916 containing an organic compound is sandwiched between the pixel electrode 12914 and the opposing electrode 12917.

The semiconductor layer 12907 and the n-type semiconductor layer 12910 which are part of the second electrode of the capacitor need not necessarily be provided. In other words, the second electrode may be constituted only by the conductive layer 12913, so that the capacitor may have a structure in which the gate insulating film is sandwiched between the first electrode 12904 and the conductive layer 12913.

Note that the pixel electrode 12914 may be formed before forming the wire 12911 in FIG. 64A, so that a capacitor 12922 can be formed in which the gate insulating film 12905 is sandwiched between a second electrode 12921 formed of the pixel electrode 12914 and the first electrode 12904 as shown in FIG. 64B.

Note that FIGS. 64A and 64B show inverted-staggered channel-etch type transistors; however, a channel protective type transistor may be used. The case of a channel protective type transistor is described with reference to FIGS. 65A and 65B.

Figure 65A:
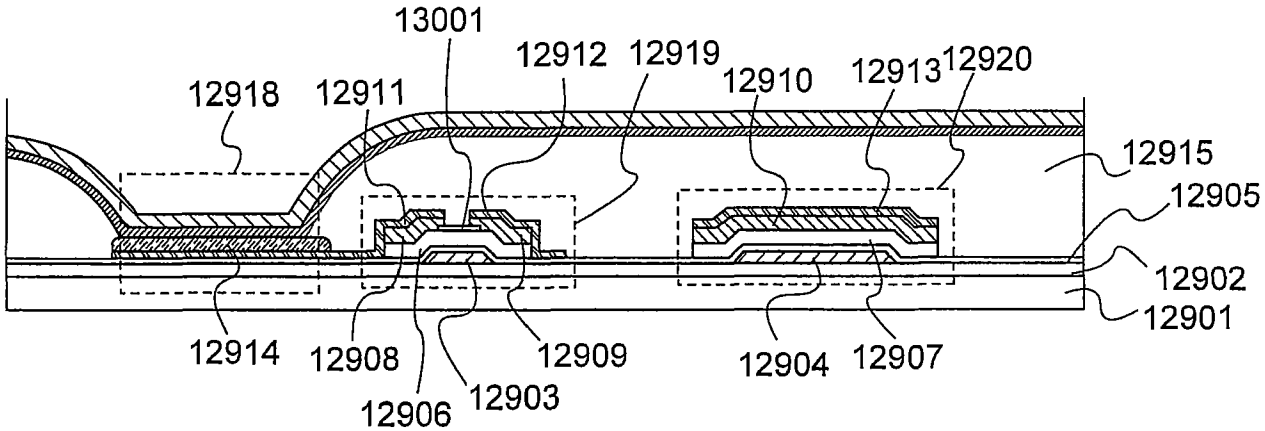
FIGS. 65A and 65B are partial cross-sectional views of a display panel.

A channel protective type transistor shown in FIG. 65A is different from the channel-etch type driving transistor 12919 shown in FIG. 64A in that an insulator 13001 serving as an etching mask is provided over the channel formation region in the semiconductor layer 12906. The other common portions are denoted by the same reference numerals.

Figure 65B:
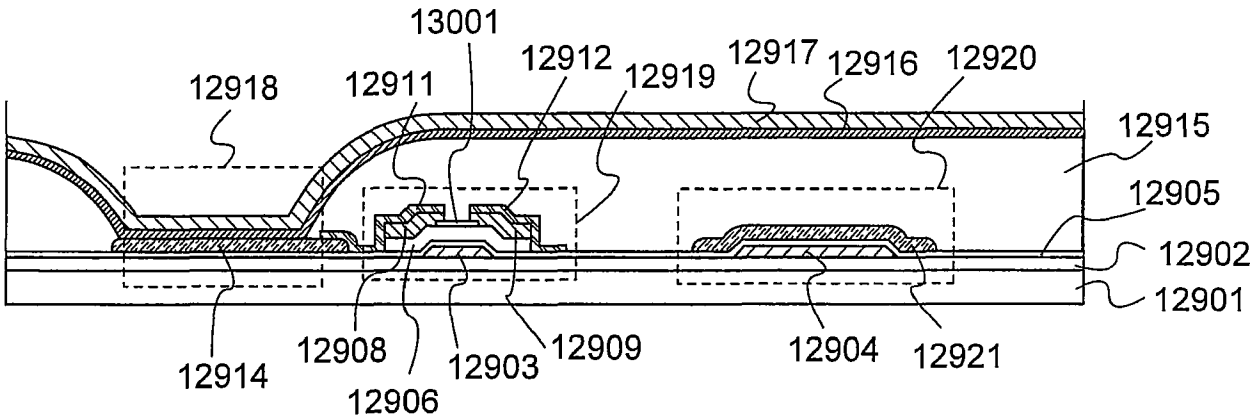

Similarly, a channel-protective type transistor shown in FIG. 65B is different from the channel-etch type driving transistor 12919 shown in FIG. 64B in that the insulator 13001 serving as an etching mask is provided over the channel formation region in the semiconductor layer 12906. The other common portions are denoted by the same reference numerals.

By using an amorphous semiconductor film as a semiconductor layer (such as a channel formation region, a source region, and a drain region) of a transistor included in the pixel of the invention, manufacturing cost can be reduced.

Note that structures of a transistor and a capacitor, to which the pixel configuration of the invention can be applied, are not limited to the above-described structures, and various structures of a transistor and a capacitor can be used.

Note that the content described in this embodiment mode can be implemented freely in combination with that described in Embodiment Modes 1 to 7.

Embodiment Mode 9

Figure 38:
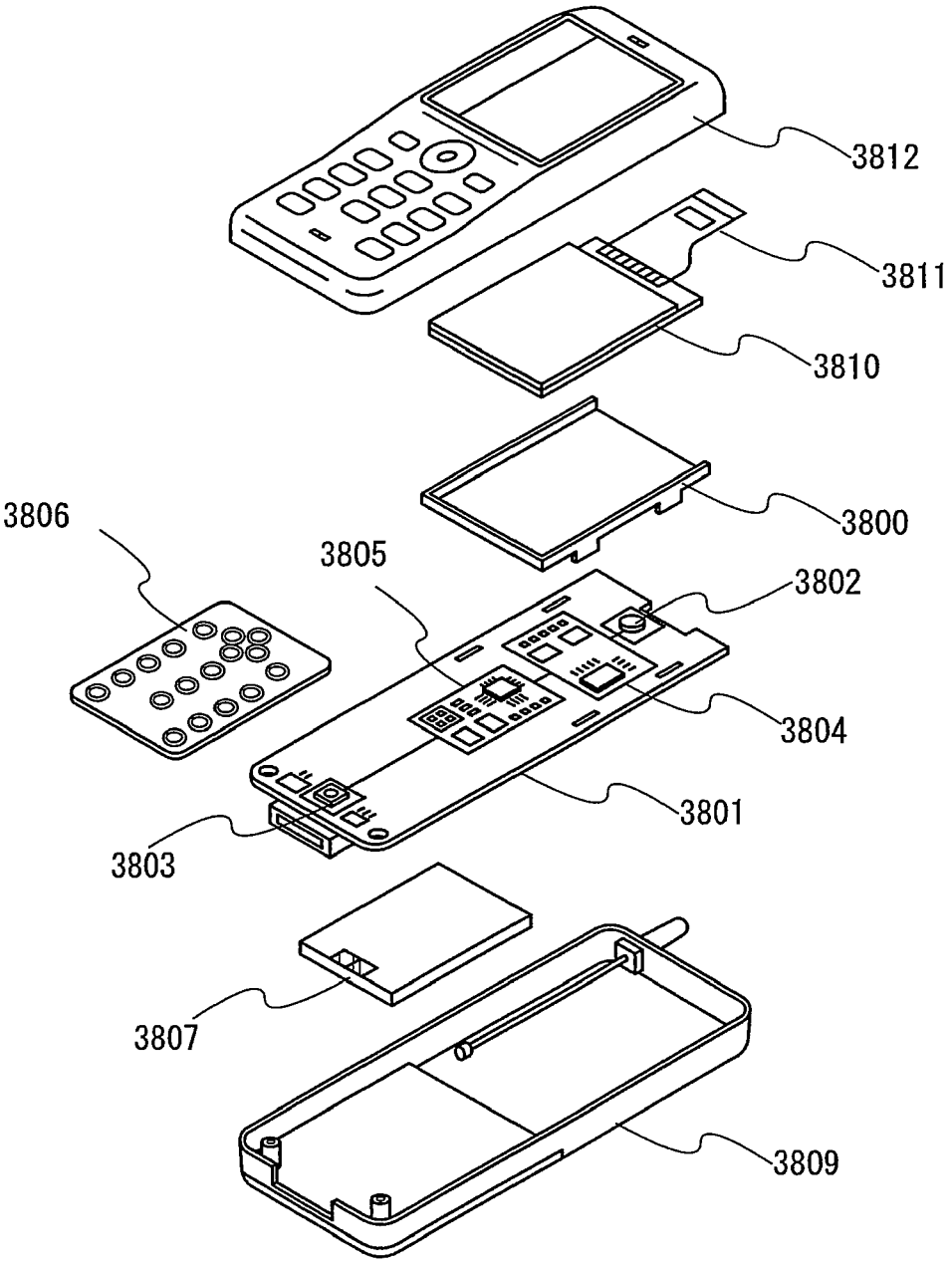
FIG. 38 is a view showing an example of a mobile phone using a driving method of the invention.

An example of a structure of a mobile phone which has the display device of the invention or a display device using the driving method of the invention in a display portion is described with reference to FIG. 38.

A display panel 3810 is incorporated in a housing 3800 so as to be detachable. The shape and size of the housing 3800 can be appropriately changed in accordance with the size of the display panel 3810. The housing 3800 to which the display panel 3810 is fixed is fitted in a printed circuit board 3801 to assemble as a module.

The display panel 3810 is connected to the printed circuit board 3801 via an FPC 3811. Over the printed circuit board 3801, a speaker 3802, a microphone 3803, a transmitting and receiving circuit 3804, and a signal processing circuit 3805 including a CPU, a controller, and the like are formed. Such a module, an input means 3806, and a buttery 3807 are combined and stored in chassis 3809 and 3812. A pixel portion of the display panel 3810 is interposed so as to be seen from a window formed in the chassis 3809.

In the display panel 3810, a pixel portion and part of peripheral driver circuits (a driver circuit having a low operation frequency among a plurality of driver circuits) may be integrated over a substrate by using TFTs, and another part of the peripheral driver circuits (a driver circuit having a high operation frequency among the plurality of driver circuits) may be formed on an IC chip. That IC chip may be mounted on the display panel 3810 by COG (Chip On Glass). The IC chip may alternatively be connected to a glass substrate by using TAB (Tape Automated Bonding) or a printed circuit board. Note that FIG. 39A shows an example of constitution of such a display panel where part of peripheral driver circuits is integrated with a pixel portion over the same substrate and an IC chip on which the other part of the peripheral driver circuits is formed is mounted by COG or the like. The display panel in FIG. 39A includes a substrate 3900, a signal line driver circuit 3901, a pixel portion 3902, a scan line driver circuit 3903, a scan line driver circuit 3904, an FPC 3905, an IC chip 3906, an IC chip 3907, a sealing substrate 3908, and a sealant 3909. By employing the above-described structure, power consumption of a display device can be reduced and operating time per charge of a mobile phone can be made longer. In addition, cost reduction of a mobile phone can be achieved.

In addition, by converting the impedance of a signal set to a scan line or a signal line by using a buffer, a writing period of pixels of each row can be shortened. Accordingly, a high-definition display device can be provided.

Figure 39B:
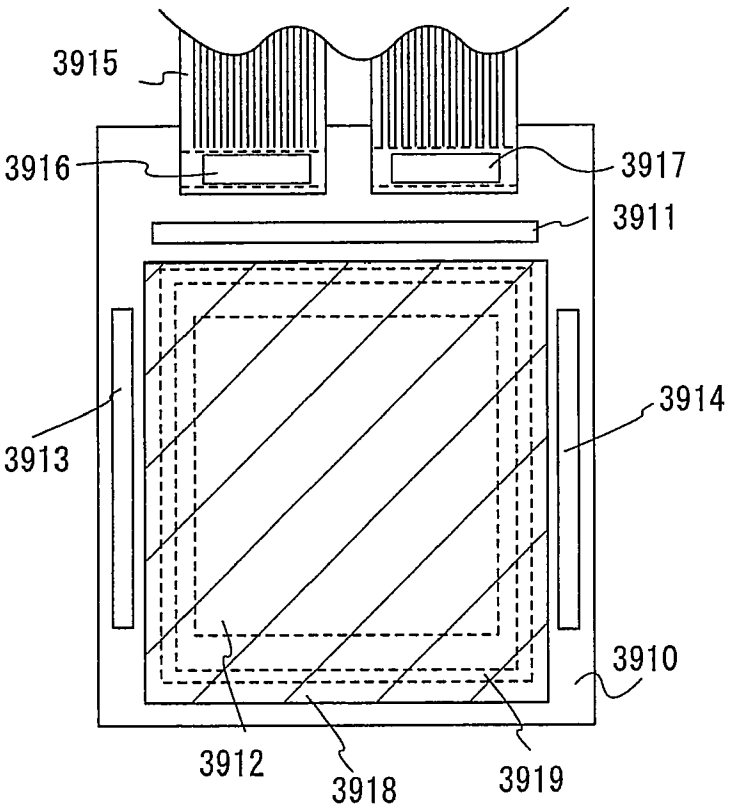
FIGS. 39A and 39B are diagrams each showing an example of a display panel using a driving method of the invention.
Figure 39A:
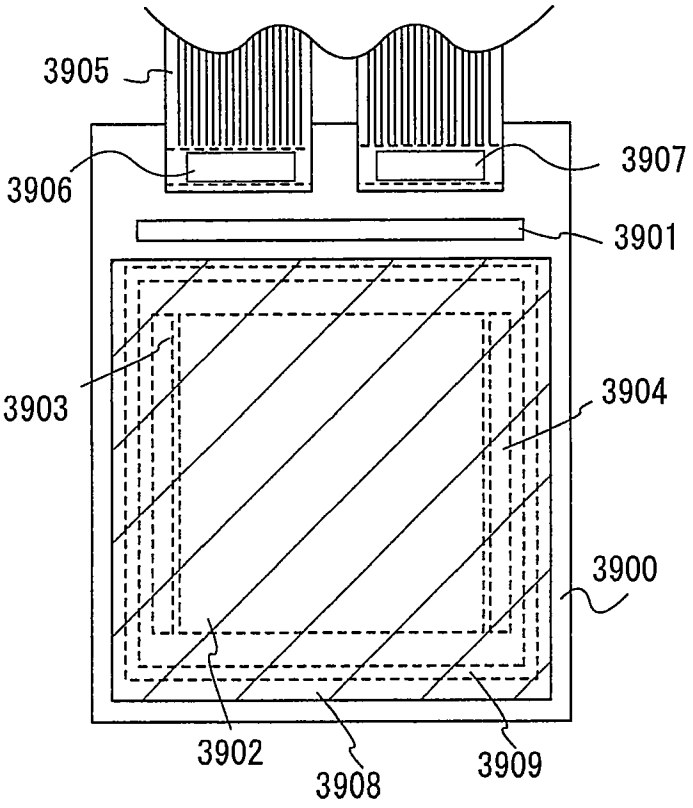

In addition, in order to further reduce power consumption, a pixel portion may be formed using TFTs over a substrate, all of peripheral driver circuits may be formed on an IC chip, and the IC chip may be mounted on a display panel by COG (Chip On Glass) or the like as shown in FIG. 39B. Note that the display panel in FIG. 39B includes a substrate 3910, a signal line driver circuit 3911, a pixel portion 3912, a scan line driver circuit 3913, a scan line driver circuit 3914, an FPC 3915, an IC chip 3916, an IC chip 3917, a sealing substrate 3918, and a sealant 3919.

By using the display device of the invention and the driving method thereof, it becomes possible to see an image clearly with a pseudo contour reduced. Accordingly, it becomes possible to clearly display even an image whose tone varies subtly, such as human skin.

Note that the structure described in this embodiment mode is an example of a mobile phone, and the display device of the invention can be applied not only to the mobile phone having the above-described structure but also to mobile phones having various kinds of structures.

Note that the content described in this embodiment mode can be implemented freely in combination with that described in Embodiment Modes 1 to 8.

Embodiment Mode 10

Figure 40:
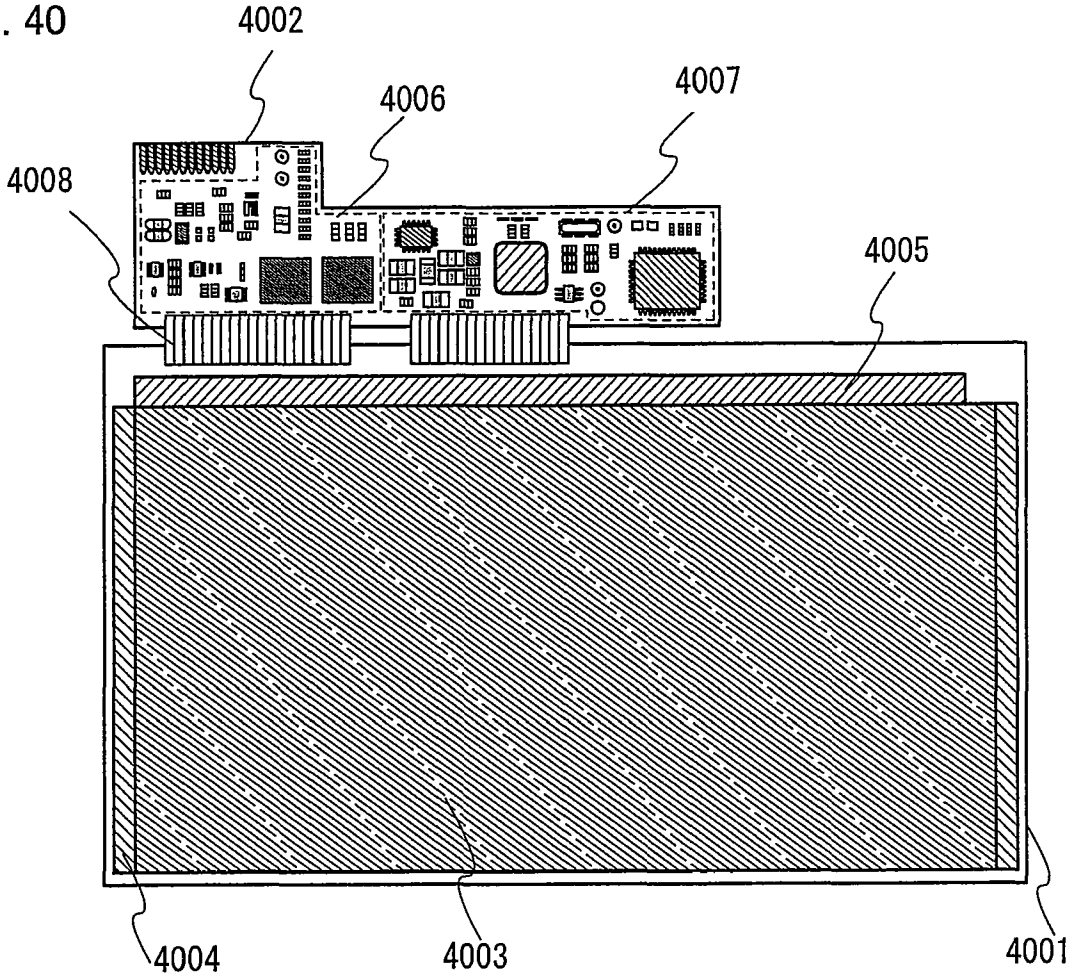
FIG. 40 is a view showing an example of an EL module using a driving method of the invention.

FIG. 40 shows an EL module in which a display panel 4001 and a circuit board 4002 are combined. The display panel 4001 includes a pixel portion 4003, a scan line driver circuit 4004, and a signal line driver circuit 4005. Over the circuit board 4002, for example, a control circuit 4006, a signal dividing circuit 4007, and the like are formed. The display panel 4001 and the circuit board 4002 are connected to each other by a connection wiring 4008. As the connection wiring, an FPC or the like can be used.

The control circuit 4006 corresponds to the controller 3708, the memory 3709, the memory 3710, or the like in Embodiment Mode 6. Mainly, in the control circuit 4006, the appearance order of subframes or the like is controlled.

In the display panel 4001, a pixel portion and part of peripheral driver circuits (a driver circuit having a low operation frequency among a plurality of driver circuits) may be integrated over a substrate by using TFTs, and another part of the peripheral driver circuits (a driver circuit having a high operation frequency among the plurality of driver circuits) may be formed on an IC chip. That IC chip may be mounted on the display panel 4001 by COG (Chip On Glass) or the like. The IC chip may alternatively be mounted on the display panel 4001 by using TAB (Tape Automated Bonding) or a printed circuit board.

In addition, by converting the impedance of a signal set to a scan line or a signal line by using a buffer, a writing period of pixels of each row can be shortened. Accordingly, a high-definition display device can be provided.

In addition, in order to further reduce power consumption, a pixel portion may be formed using TFTs over a glass substrate, all the signal line driver circuit may be formed on an IC chip, and the IC chip may be mounted on a display panel by COG (Chip On Glass) or the like.

Figure 41:
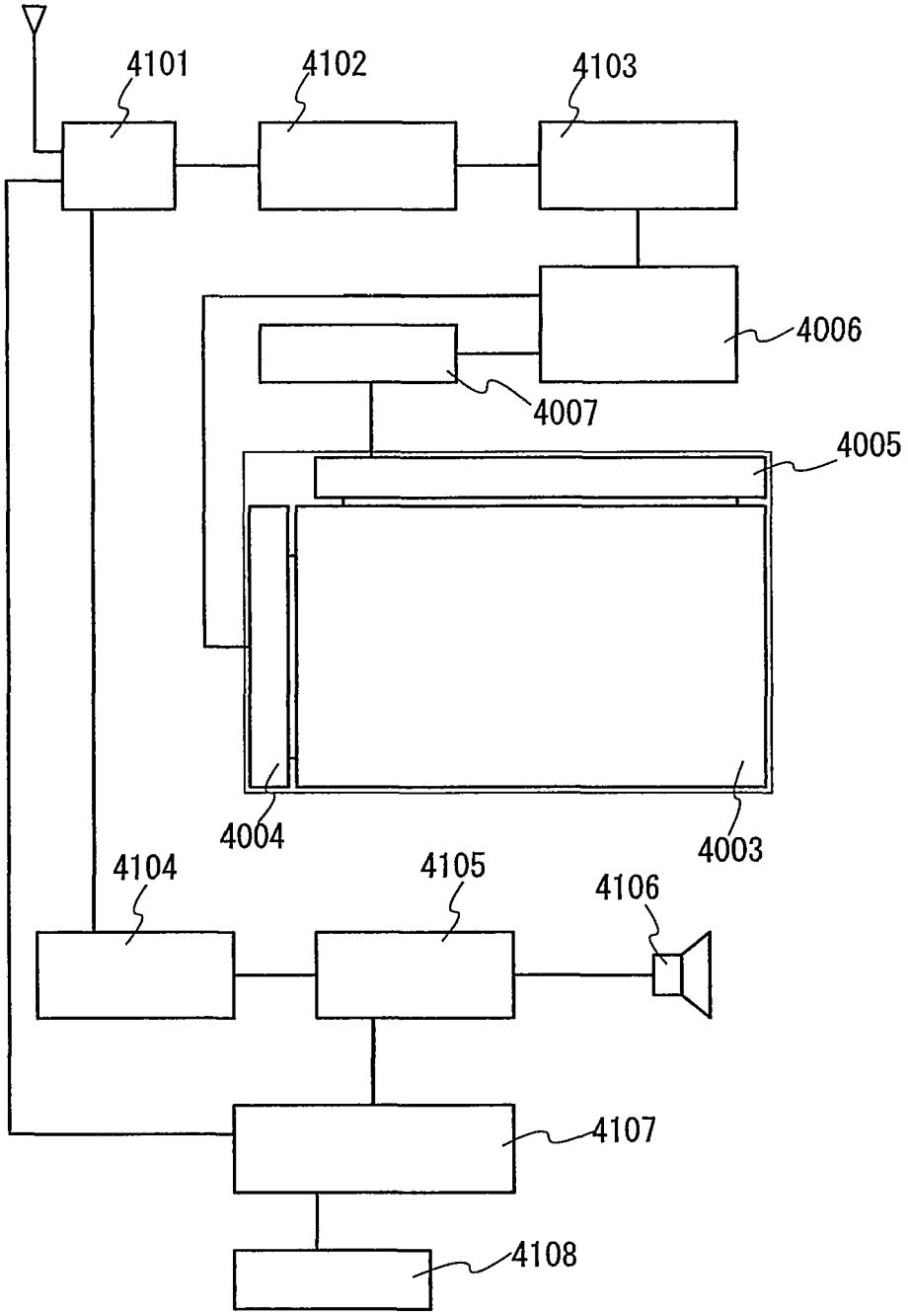
FIG. 41 is a diagram showing an example of an EL TV receiver using a driving method of the invention.

An EL TV receiver can be completed with the above-described EL module. FIG. 41 is a block diagram showing main constitution of an EL TV receiver. A tuner 4101 receives a video signal and an audio signal. The video signal is processed by a video signal amplifier circuit 4102, a video signal processing circuit 4103 for converting a signal output from the video signal amplifier circuit 4102 into a color signal corresponding to each color of red, green and blue, and a control circuit 4006 for converting the video signal into the input specification of a driver circuit. The control circuit 4006 outputs a signal to each of the scan line side and the signal line side. In the case of driving in a digital manner, constitution in which the signal dividing circuit 4007 is provided on the signal line side to supply an input digital signal divided into m pieces may be adopted.

An audio signal among signals received by the tuner 4101 is transmitted to an audio signal amplifier circuit 4104, an output of which is supplied to a speaker 4106 through an audio signal processing circuit 4105. A control circuit 4107 receives control information of a receiving station (reception frequency) or sound volume from an input portion 4108 and transmits signals to the tuner 4101 and the audio signal processing circuit 4105.

By incorporating the EL module into a chassis, a TV receiver can be completed. A display portion of the TV receiver is formed with the EL module. In addition, a speaker, a video input terminal, and the like are provided appropriately.

Naturally, the invention is not limited to the TV receiver, and can be applied to various use applications as a display medium such as an information display board at a train station, an airport, or the like, or an advertisement display board on the street, as well as a monitor of a personal computer.

By using the display device of the invention and the driving method thereof as described above, it becomes possible to see an image clearly with a pseudo contour reduced. Accordingly, it becomes possible to clearly display even an image whose tone varies subtly, such as human skin.

Note that the content described in this embodiment mode can be implemented freely in combination with that described in Embodiment Modes 1 to 9.

Embodiment Mode 11

Examples of electronic devices using semiconductor devices of the invention are as follows: a camera such as a video camera or a digital camera, a goggle type display (a head-mounted display), a navigation system, a sound reproducing device (such as a car audio or an audio component), a personal computer, a game machine, a portable information terminal (such as a mobile computer, a mobile phone, a portable game machine, or an electronic book), an image reproducing device provided with a storage medium reading portion (specifically, a device which can reproduce a storage medium such as a digital versatile disc (DVD) and includes a display capable of displaying images thereof), and the like. Specific examples thereof are shown in FIGS. 42A to 42H.

Figure 42A:
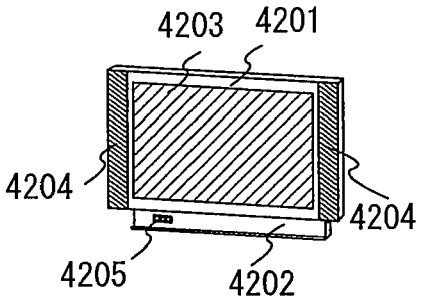
FIGS. 42A to 42H are views each showing an example of an electronic device to which a driving method of the invention is applied.

FIG. 42A shows a self-luminous display, which includes a chassis 4201, a support 4202, a display portion 4203, a speaker portion 4204, a video input terminal 4205, and the like. The invention can be used for a display device included in the display portion 4203. In addition, according to the invention, it becomes possible to see an image clearly with a pseudo contour reduced, and the display shown in FIG. 42A is completed. The display does not require a backlight because it is of self-luminous type, and a thinner display portion than a liquid crystal display can be provided. Note that the display includes in its category all display devices used for displaying information, for example, for a personal computer, for TV broadcast reception, or for advertisement display.

Figure 42B:
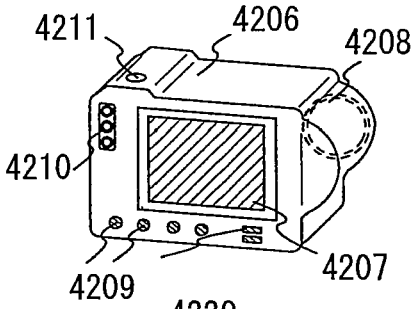

FIG. 42B shows a digital still camera, which includes a main body 4206, a display portion 4207, an image receiving portion 4208, an operation key 4209, an external connection port 4210, a shutter 4211, and the like. The invention can be used for a display device included in the display portion 4207. In addition, according to the invention, it becomes possible to see an image clearly with a pseudo contour reduced, and the digital still camera shown in FIG. 42B is completed.

Figure 42C:
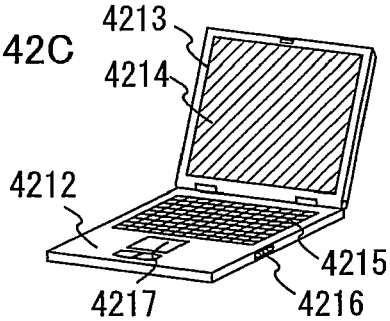

FIG. 42C shows a personal computer, which includes a main body 4212, a chassis 4213, a display portion 4214, a keyboard 4215, an external connection port 4216, a pointing mouse 4217, and the like. The invention can be used for a display device included in the display portion 4214. In addition, according to the invention, it becomes possible to see an image clearly with a pseudo contour reduced, and the personal computer shown in FIG. 42C is completed.

Figure 42D:
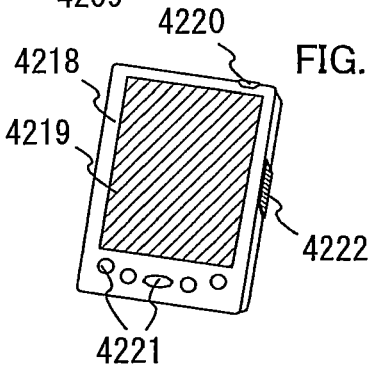

FIG. 42D shows a mobile computer, which includes a main body 4218, a display portion 4219, a switch 4220, an operation key 4221, an infrared port 4222, and the like. The invention can be used for a display device included in the display portion 4219. In addition, according to the invention, it becomes possible to see an image clearly with a pseudo contour reduced, and the mobile computer shown in FIG. 42D is completed.

Figure 42E:
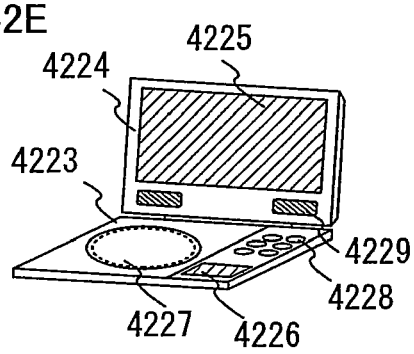

FIG. 42E shows an image reproducing device provided with a storage medium reading portion (specifically, a DVD reproducing device for example), which includes a main body 4223, a chassis 4224, a display portion A 4225, a display portion B 4226, a storage medium (DVD or the like) reading portion 4227, an operation key 4228, a speaker portion 4229, and the like. The display portion A 4225 mainly displays image information, and the display portion B 4226 mainly displays character information. The invention can be used for display devices included in the display portion A 4225 and the display portion B 4226. Note that the image reproducing device provided with a storage medium reading portion also includes a home-use game machine and the like. In addition, according to the invention, it becomes possible to see an image clearly with a pseudo contour reduced, and the image reproducing device shown in FIG. 42E is completed.

Figure 42F:
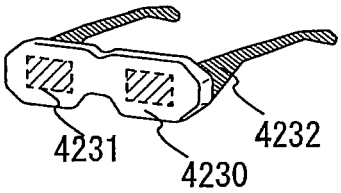

FIG. 42F shows a goggle type display (head-mounted display), which includes a main body 4230, a display portion 4231, an arm portion 4232, and the like. The invention can be used for a display device included in the display portion 4231. In addition, according to the invention, it becomes possible to see an image clearly with a pseudo contour reduced, and the goggle type display shown in FIG. 42F is completed.

Figure 42G:
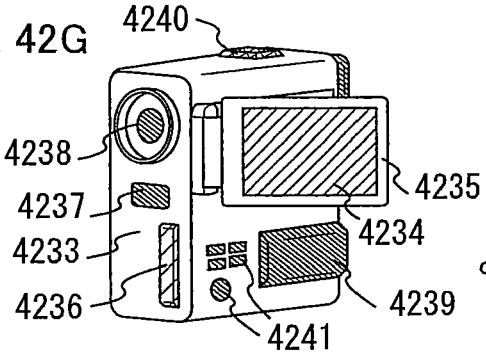

FIG. 42G shows a video camera, which includes a main body 4233, a display portion 4234, a housing 4235, an external connection port 4236, a remote control receiving portion 4237, an image receiving portion 4238, a battery 4239, an audio input portion 4240, an operation key 4241, and the like. The invention can be used for a display device included in the display portion 4234. In addition, according to the invention, it becomes possible to see an image clearly with a pseudo contour reduced, and the video camera shown in FIG. 42G is completed.

Figure 42H:
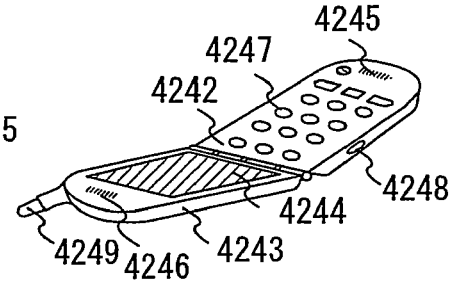
Figure 47A:
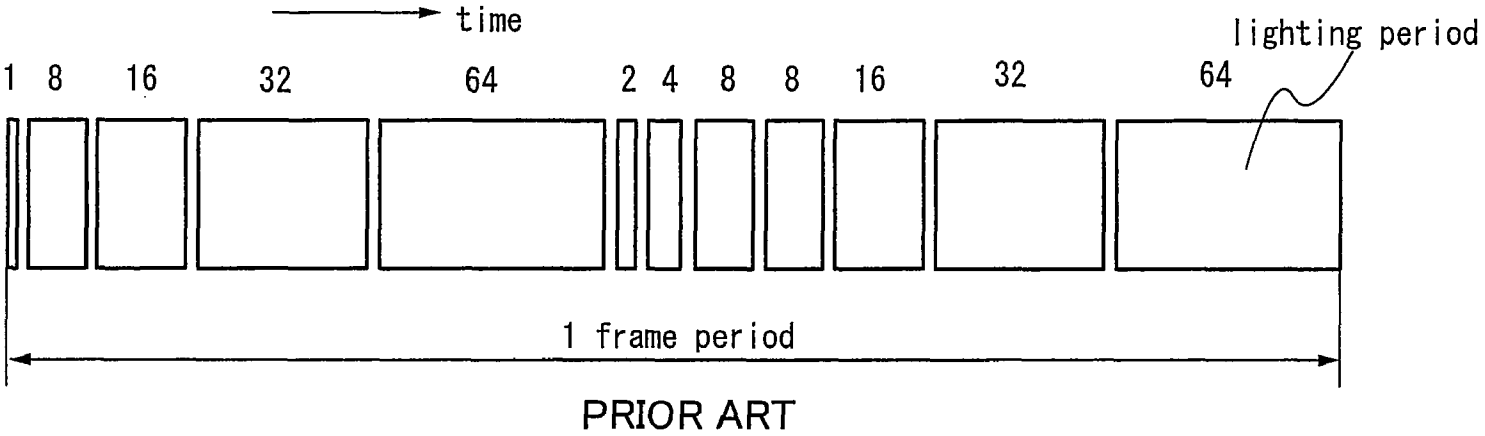
FIGS. 47A and 47B are diagrams each showing an example of a selection method of subframes according to a conventional double speed frame method.
Figure 47B:
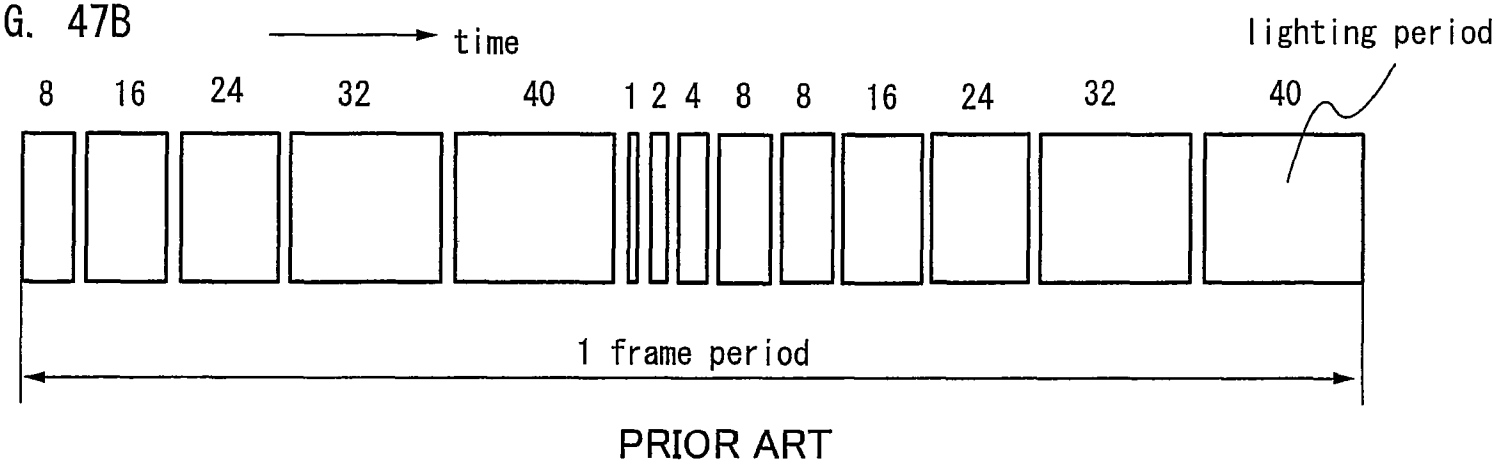
Figure 48A:
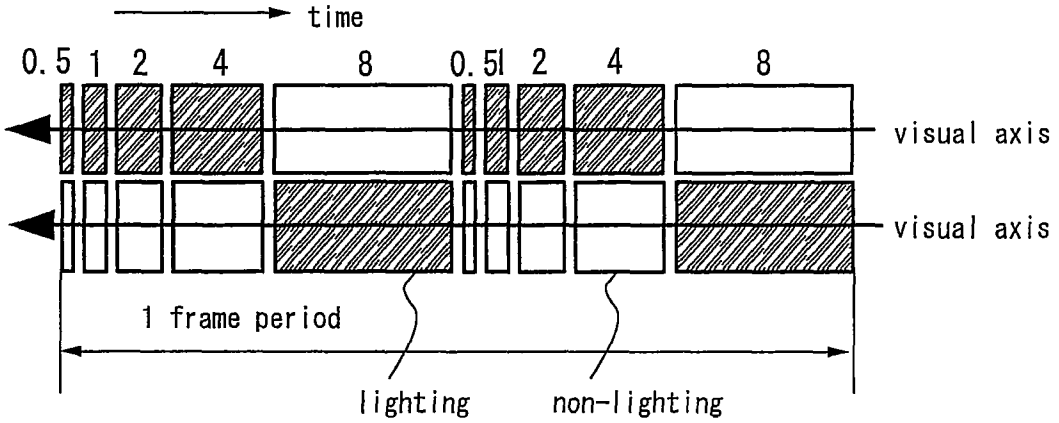
FIGS. 48A and 48B are diagrams showing a reason to generate a pseudo contour in a conventional double speed frame method.
Figure 48B:
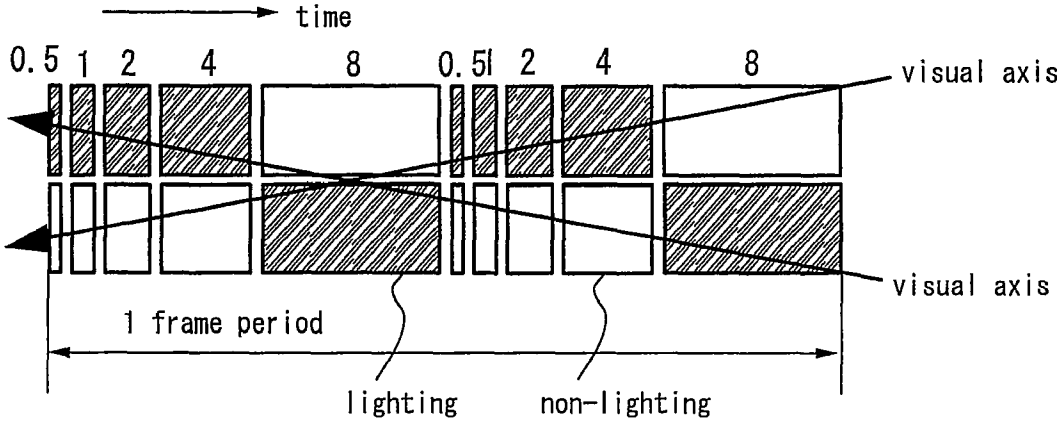
PRIOR ART FIG. 48B
Figure 49:
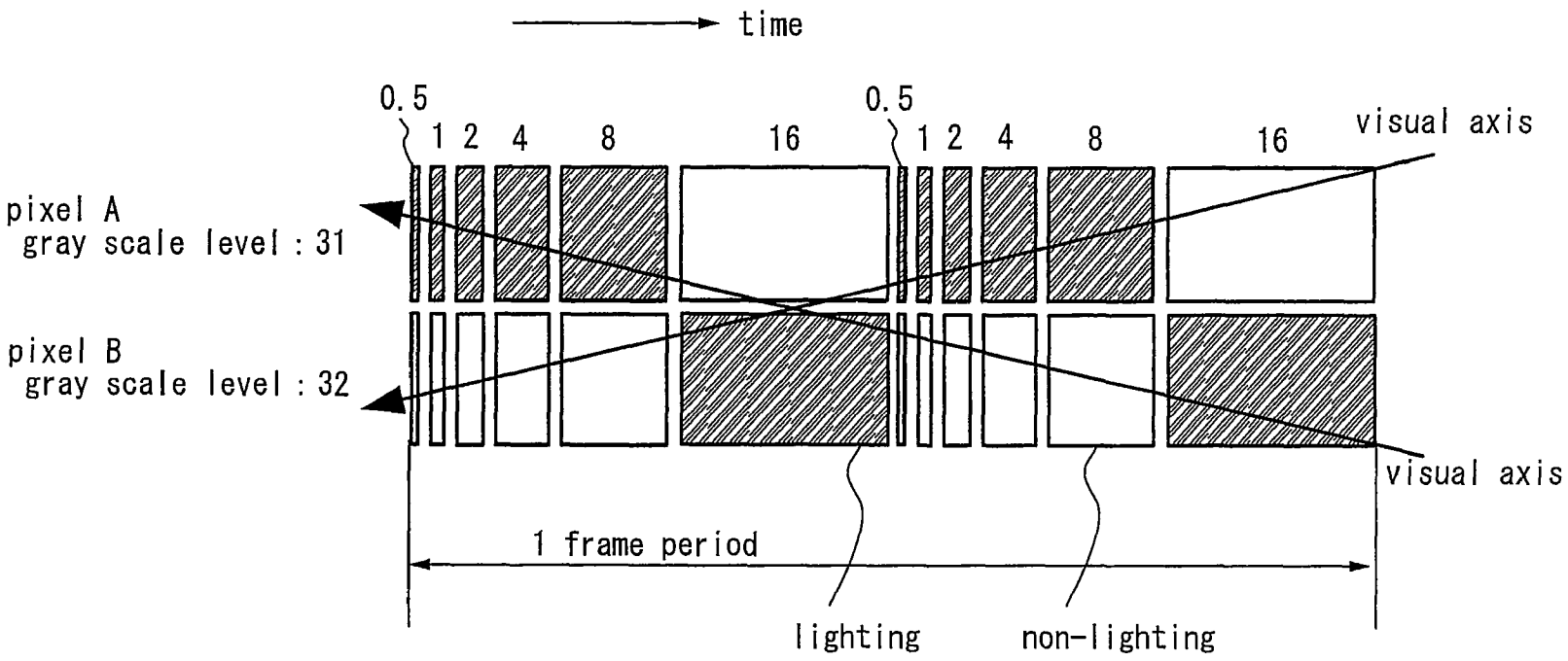
FIG. 49 is a diagram showing a reason to generate a pseudo contour in a conventional double speed frame method.
Figure 50A:
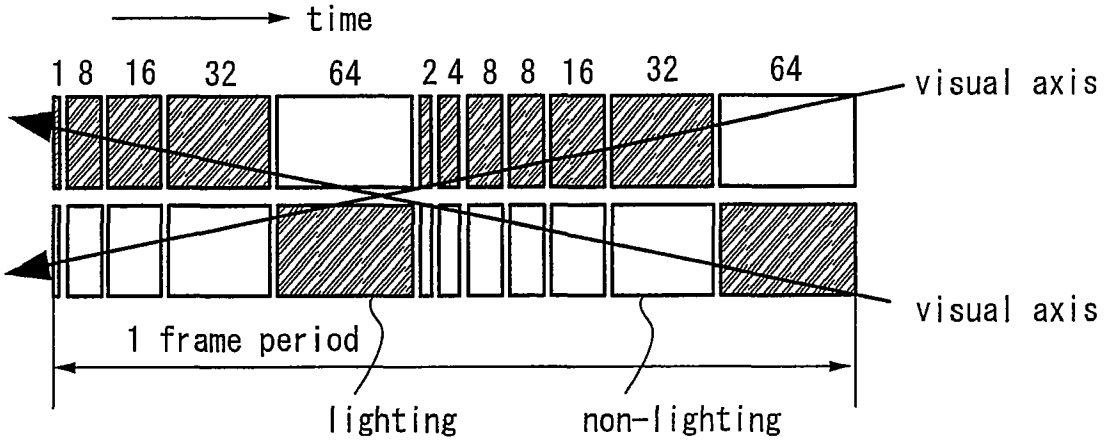
FIGS. 50A and 50B are diagrams showing a reason to generate a pseudo contour in a conventional double speed frame method.
Figure 50B:
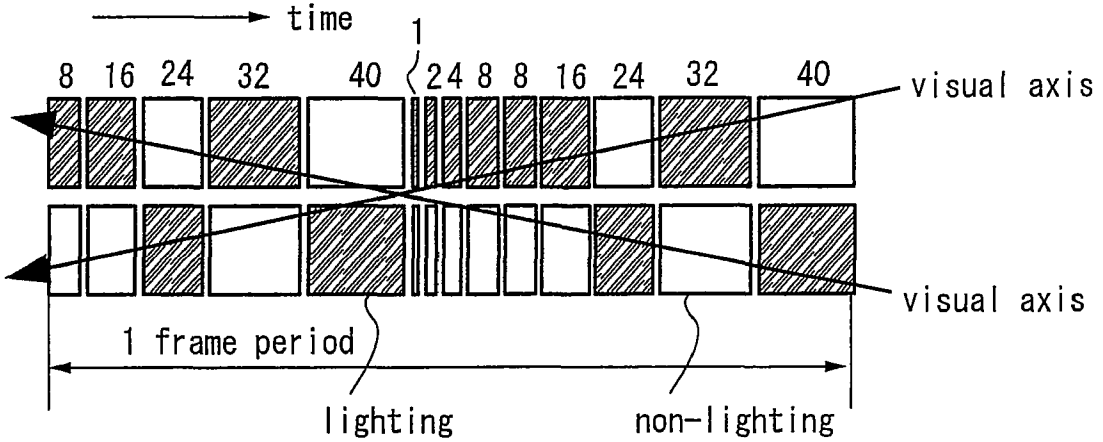

FIG. 42H shows a mobile phone, which includes a main body 4242, a chassis 4243, a display portion 4244, an audio input portion 4245, an audio output portion 4246, an operation key 4247, an external connection port 4248, an antenna 4249, and the like. The invention can be used for a display device included in the display portion 4244. Note that current consumption of the mobile phone can be reduced when the display portion 4244 displays white characters on a black background. In addition, according to the invention, it becomes possible to see an image clearly with a pseudo contour reduced, and the mobile phone shown in FIG. 42H is completed.

Note that, if a light emitting material with high luminance is used, the invention can be used for a front or rear projector which magnifies, with a lens or the like, and projects output light including image information.

Further, the aforementioned electronic devices have often been used for displaying information distributed through a telecommunications line such as Internet or a CATV (cable television system), and in particular, increasingly for displaying moving image information. A light emitting display device is suitable for displaying moving images since a light emitting material has very high response speed.

It is preferable to display information with as small light emitting portion as possible because the light emitting portion consumes power in the light emitting display device. Therefore, in the case of using the light emitting display device in a display portion of the portable information terminal, in particular a mobile phone, a sound reproducing device, or the like which mainly displays character information, it is preferable to drive the light emitting display device so that the character information is formed by a light emitting portion with a non-light emitting portion used as a background.

As described above, the applicable range of the invention is so wide that the invention can be applied to electronic devices of various fields. In addition, the electronic device of this embodiment mode may use a display device having any of the structures described in Embodiment Modes 1 to 10.

This application is based on Japanese Patent Application serial no. 2005117610 filed in Japan Patent Office on 14th, Apr., 2005, and the entire contents of which are hereby incorporated by reference.

What is claimed is:

1. A driving method of a display device for expressing gradation by dividing one frame into a plurality of subframes, in the case where gradation is expressed with an n bit (here n is an integer), the display device comprising:

a pixel portion comprising pixels over a substrate, each of the pixels comprising a capacitor and a bottom-gate transistor comprising a compound semiconductor;

a memory; and a circuit configured to output signals to the substrate by using signals stored in the memory, wherein the capacitor comprises a conductive layer and a semiconductor layer over the conductive layer with an insulating film between the conductive layer and the semiconductor layer, wherein a plurality of signals is input into each of the pixels by using the signals output from the circuit, and wherein the pixel portion is configured to display an image by expressing gray scales in accordance with the plurality of signals, the driving method comprising the steps of:

classifying bits each of which is shown by a binary of gray scales into three kinds of bit groups, that is, a first bit group, a second bit group, and a third bit group;

dividing the one frame into two subframe groups;

dividing each of a (here, a is an integer satisfying $0<a<n$) subframes corresponding to bits belonging to the first bit group into three or more, and arranging each about half of which in each of the two subframe groups of the one frame;

dividing each of b (here, b is an integer satisfying $0<b<n$) subframes corresponding to bits belonging to the second bit group into two, and arranging each one of which in each of the two subframe groups of the one frame; and arranging c (here, c is an integer satisfying $0<c<n$ and $a+b+c=n$) subframes corresponding to bits belonging to the third bit group in at least one of the two subframe groups of the one frame, wherein an appearance order of a plurality of subframes corresponding to bits belonging to the first bit group and a plurality of subframes corresponding to bits belonging to the second bit group is approximately the same between the two subframe groups of the one frame; and wherein as for a part or all of the plurality of subframes corresponding to bits belonging to the first bit group and the plurality of subframes corresponding to bits belonging to the second bit group, an overlapped time gray scale method is used in each of the two subframe groups of the one frame so that gradation is expressed.

2. The driving method according to claim 1, wherein each of the pixels further comprises a light emitting element.

3. A driving method of a display device for expressing gradation by dividing one frame into a plurality of subframes, in the case where gradation is expressed with an n bit (here n is an integer), the display device comprising:

a pixel portion comprising pixels over a substrate, each of the pixels comprising a capacitor and a bottom-gate transistor comprising InGaZnO;

a memory; and a circuit configured to output signals to the substrate by using signals stored in the memory, wherein the capacitor comprises a conductive layer and a semiconductor layer over the conductive layer with an insulating film between the conductive layer and the semiconductor layer, wherein a plurality of signals is input into each of the pixels by using the signals output from the circuit, and wherein the pixel portion is configured to display an image by expressing gray scales in accordance with the plurality of signals, the driving method comprising the steps of:

classifying bits each of which is shown by a binary of gray scales into three kinds of bit groups, that is, a first bit group, a second bit group, and a third bit group;

dividing the one frame into two subframe groups;

dividing each of a (here, a is an integer satisfying 0<a<n) subframes corresponding to bits belonging to the first bit group into three or more, and arranging each about half of which in each of the two subframe groups of the one frame;

dividing each of b (here, b is an integer satisfying 0<b<n) subframes corresponding to bits belonging to the second bit group into two, and arranging each one of which in each of the two subframe groups of the one frame; and arranging c (here, c is an integer satisfying 0<c<n and a+b+c=n) subframes corresponding to bits belonging to the third bit group in at least one of the two subframe groups of the one frame, wherein an appearance order of a plurality of subframes corresponding to bits belonging to the first bit group and a plurality of subframes corresponding to bits belonging to the second bit group is approximately the same between the two subframe groups of the one frame; and wherein as for a part or all of the plurality of subframes corresponding to bits belonging to the first bit group and the plurality of subframes corresponding to bits belonging to the second bit group, an overlapped time gray scale method is used in each of the two subframe groups of the one frame so that gradation is expressed.

4. The driving method according to claim 3, wherein each of the pixels further comprises a light emitting element.

5. A driving method of a display device for expressing gradation by dividing one frame into a plurality of subframes, in the case where gradation is expressed with an n bit (here n is an integer), the display device comprising:

a pixel portion comprising pixels over a substrate, each of the pixels comprising a capacitor and a bottom-gate transistor comprising a-InGaZnO;

a memory; and a circuit configured to output signals to the substrate by using signals stored in the memory, wherein the capacitor comprises a conductive layer and a semiconductor layer over the conductive layer with an insulating film between the conductive layer and the semiconductor layer, wherein a plurality of signals is input into each of the pixels by using the signals output from the circuit, and wherein the pixel portion is configured to display an image by expressing gray scales in accordance with the plurality of signals, the driving method comprising the steps of:

classifying bits each of which is shown by a binary of gray scales into three kinds of bit groups, that is, a first bit group, a second bit group, and a third bit group;

dividing the one frame into two subframe groups;

dividing each of a (here, a is an integer satisfying 0<a<n) subframes corresponding to bits belonging to the first bit group into three or more, and arranging each about half of which in each of the two subframe groups of the one frame;

dividing each of b (here, b is an integer satisfying 0<b<n) subframes corresponding to bits belonging to the second bit group into two, and arranging each one of which in each of the two subframe groups of the one frame; and arranging c (here, c is an integer satisfying 0<c<n and a+b+c=n) subframes corresponding to bits belonging to the third bit group in at least one of the two subframe groups of the one frame, wherein an appearance order of a plurality of subframes corresponding to bits belonging to the first bit group and a plurality of subframes corresponding to bits belonging to the second bit group is approximately the same between the two subframe groups of the one frame; and wherein as for a part or all of the plurality of subframes corresponding to bits belonging to the first bit group and the plurality of subframes corresponding to bits belonging to the second bit group, an overlapped time gray scale method is used in each of the two subframe groups of the one frame so that gradation is expressed.

6. The driving method according to claim 5, wherein each of the pixels further comprises a light emitting element.

7. A driving method of a display device for expressing gradation by dividing one frame into a plurality of subframes, in the case where gradation is expressed with an n bit (here n is an integer), the display device comprising:

a pixel portion comprising pixels over a substrate, each of the pixels comprising a capacitor and a bottom-gate transistor comprising a compound semiconductor;

a memory; and a circuit configured to output signals to the substrate by using signals stored in the memory, wherein the capacitor comprises a conductive layer and a semiconductor layer over the conductive layer with an insulating film between the conductive layer and the semiconductor layer, wherein a plurality of signals is input into each of the pixels by using the signals output from the circuit, and wherein the pixel portion is configured to display an image by expressing gray scales in accordance with the plurality of signals, the driving method comprising the steps of:

classifying bits each of which is shown by a binary of gray scales into three kinds of bit groups, that is, a first bit group, a second bit group, and a third bit group;

dividing the one frame into two subframe groups;

dividing each of a (here, a is an integer satisfying 0<a<n) subframes corresponding to bits belonging to the first bit group into three or more, and arranging each about half of which in each of the two subframe groups of the one frame;

dividing each of b (here, b is an integer satisfying 0<b<n) subframes corresponding to bits belonging to the second bit group into two, and arranging each one of which in each of the two subframe groups of the one frame; and arranging c (here, c is an integer satisfying 0<c<n and a+b+c=n) subframes corresponding to bits belonging to the third bit group in at least one of the two subframe groups of the one frame, wherein an appearance order of a plurality of subframes corresponding to bits belonging to the first bit group and a plurality of subframes corresponding to bits belonging to the second bit group is approximately the same between the two subframe groups of the one frame; and wherein as for a part or all of the plurality of subframes corresponding to bits belonging to the first bit group and the plurality of subframes corresponding to bits belonging to the second bit group, an overlapped time gray scale method is used in each of the two subframe groups of the one frame so that gradation is expressed.

8. The driving method according to claim 7, wherein each of the pixels further comprises a light emitting element.

9. A driving method of a display device for expressing gradation by dividing one frame into a plurality of subframes, in the case where gradation is expressed with an n bit (here n is an integer), the display device comprising:

a pixel portion comprising pixels over a substrate, each of the pixels comprising a capacitor and a bottom-gate transistor comprising InGaZnO;

a memory; and a circuit configured to output signals to the substrate by using signals stored in the memory, wherein the capacitor comprises a conductive layer and a semiconductor layer over the conductive layer with an insulating film between the conductive layer and the semiconductor layer, wherein a plurality of signals is input into each of the pixels by using the signals output from the circuit, and wherein the pixel portion is configured to display an image by expressing gray scales in accordance with the plurality of signals, the driving method comprising the steps of:

classifying bits each of which is shown by a binary of gray scales into three kinds of bit groups, that is, a first bit group, a second bit group, and a third bit group;

dividing the one frame into two subframe groups;

dividing each of a (here, a is an integer satisfying $0<a<n$) subframes corresponding to bits belonging to the first bit group into three or more, and arranging each about half of which in each of the two subframe groups of the one frame;

dividing each of b (here, b is an integer satisfying $0<b<n$) subframes corresponding to bits belonging to the second bit group into two, and arranging each one of which in each of the two subframe groups of the one frame; and arranging c (here, c is an integer satisfying $0<c<n$ and $a+b+c=n$) subframes corresponding to bits belonging to the third bit group in at least one of the two subframe groups of the one frame, wherein an appearance order of a plurality of subframes corresponding to bits belonging to the first bit group and a plurality of subframes corresponding to bits belonging to the second bit group is approximately the same between the two subframe groups of the one frame; and wherein as for a part or all of the plurality of subframes corresponding to bits belonging to the first bit group and the plurality of subframes corresponding to bits belonging to the second bit group, an overlapped time gray scale method is used in each of the two subframe groups of the one frame so that gradation is expressed.

10. The driving method according to claim 9, wherein each of the pixels further comprises a light emitting element.

11. A driving method of a display device for expressing gradation by dividing one frame into a plurality of subframes, in the case where gradation is expressed with an n bit (here n is an integer), the display device comprising:

a pixel portion comprising pixels over a substrate, each of the pixels comprising a capacitor and a bottom-gate transistor comprising a-InGaZnO;

a memory; and a circuit configured to output signals to the substrate by using signals stored in the memory, wherein the capacitor comprises a conductive layer and a semiconductor layer over the conductive layer with an insulating film between the conductive layer and the semiconductor layer, wherein a plurality of signals is input into each of the pixels by using the signals output from the circuit, and wherein the pixel portion is configured to display an image by expressing gray scales in accordance with the plurality of signals, the driving method comprising the steps of:

classifying bits each of which is shown by a binary of gray scales into three kinds of bit groups, that is, a first bit group, a second bit group, and a third bit group;

dividing the one frame into two subframe groups;

dividing each of a (here, a is an integer satisfying $0<a<n$) subframes corresponding to bits belonging to the first bit group into three or more, and arranging each about half of which in each of the two subframe groups of the one frame;

dividing each of b (here, b is an integer satisfying $0<b<n$) subframes corresponding to bits belonging to the second bit group into two, and arranging each one of which in each of the two subframe groups of the one frame; and arranging c (here, c is an integer satisfying $0<c<n$ and $a+b+c=n$) subframes corresponding to bits belonging to the third bit group in at least one of the two subframe groups of the one frame, wherein an appearance order of a plurality of subframes corresponding to bits belonging to the first bit group and a plurality of subframes corresponding to bits belonging to the second bit group is approximately the same between the two subframe groups of the one frame; and wherein as for a part or all of the plurality of subframes corresponding to bits belonging to the first bit group and the plurality of subframes corresponding to bits belonging to the second bit group, an overlapped time gray scale method is used in each of the two subframe groups of the one frame so that gradation is expressed.

12. The driving method according to claim 11, wherein each of the pixels further comprises a light emitting element.

* * * * *